US012109464B2

(12) United States Patent
Parsons et al.

(10) Patent No.: US 12,109,464 B2
(45) Date of Patent: Oct. 8, 2024

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Robert R. Parsons, Scottsdale, AZ (US); Michael R. Nicolette, Scottsdale, AZ (US); Bradley D. Schweigert, Cave Creek, AZ (US); Daniel C. Kirtley, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

(21) Appl. No.: 18/613,386

(22) Filed: Mar. 22, 2024

(65) Prior Publication Data

US 2024/0226674 A1 Jul. 11, 2024

Related U.S. Application Data

(63) Continuation-in-part of application No. 18/442,782, filed on Feb. 15, 2024, now Pat. No. 12,005,328, (Continued)

(51) Int. Cl.
*A63B 53/04* (2015.01)
*A63B 60/54* (2015.01)

(52) U.S. Cl.
CPC .. *A63B 53/0475* (2013.01); *A63B 2053/0479* (2013.01); *A63B 60/54* (2015.10); *A63B 2209/00* (2013.01)

(58) Field of Classification Search
CPC ..... A63B 53/0475; A63B 60/54
See application file for complete search history.

(56) References Cited

U.S. PATENT DOCUMENTS 723,258 A 3/1903 Felton
1,133,129 A 3/1915 Govan
(Continued)

FOREIGN PATENT DOCUMENTS

CN 1762514 A 4/2006
CN 202087021 U 12/2011
(Continued)

*Primary Examiner* — Jason L Vaughan
*Assistant Examiner* — Amanda Kreiling

(57) ABSTRACT

Embodiments of golf club heads, golf clubs, and methods to manufacture golf club heads and golf clubs are generally described herein. In one example, a golf club head includes a body portion, a face portion with at least one back groove portion, a filler material in an interior cavity of the body portion, a first mass portion having a center of gravity (CG) location $CG_{M1X}$, $CG_{M1Y}$, $CG_{M1Z}$, and a second mass portion having a CG location $CG_{M2X}$, $CG_{M2Y}$, $CG_{M2Z}$. The first mass portion and the second mass portion have different shapes. A distance between $CG_{M1X}$ and $CG_{M2X}$ is greater than or equal to 0.5 inch and less than or equal to 2.0 inch, between $CG_{M1Y}$ and $CG_{M2Y}$ is less than or equal to 0.25 inch, and between $CG_{M1Z}$ and $CG_{M2Z}$ is less than or equal to 0.1 inch. Other examples and embodiments may be described and claimed.

20 Claims, 48 Drawing Sheets

Related U.S. Application Data which is a continuation of application No. 18/526,106, filed on Dec. 1, 2023, now Pat. No. 11,938,385, which is a continuation-in-part of application No. 18/205,019, filed on Jun. 2, 2023, now Pat. No. 11,833,398, which is a continuation of application No. 18/115,222, filed on Feb. 28, 2023, now Pat. No. 11,707,655, and a continuation-in-part of application No. 17/988,585, filed on Nov. 16, 2022, now Pat. No. 11,779,820, which is a continuation of application No. 17/841,893, filed on Jun. 16, 2022, now Pat. No. 11,806,590, which is a continuation of application No. 17/685,546, filed on Mar. 3, 2022, now Pat. No. 11,400,352, which is a continuation-in-part of application No. 17/528,402, filed on Nov. 17, 2021, now Pat. No. 11,426,641, which is a continuation of application No. 16/566,597, filed on Sep. 10, 2019, now Pat. No. 11,207,575, which is a continuation of application No. 16/272,269, filed on Feb. 11, 2019, now Pat. No. 10,449,428.

(60) Provisional application No. 63/461,491, filed on Apr. 24, 2023, provisional application No. 63/443,494, filed on Feb. 6, 2023, provisional application No. 63/389,561, filed on Jul. 15, 2022, provisional application No. 63/276,981, filed on Nov. 8, 2021, provisional application No. 62/792,191, filed on Jan. 14, 2019, provisional application No. 62/787,554, filed on Jan. 2, 2019, provisional application No. 62/756,446, filed on Nov. 6, 2018, provisional application No. 62/755,160, filed on Nov. 2, 2018, provisional application No. 62/732,062, filed on Sep. 17, 2018, provisional application No. 62/722,491, filed on Aug. 24, 2018, provisional application No. 62/714,948, filed on Aug. 6, 2018, provisional application No. 62/629,459, filed on Feb. 12, 2018.

(56) References Cited

U.S. PATENT DOCUMENTS

| | | | |
|---|---|---|---|
| 1,538,312 | A | 5/1925 | Neish |
| 4,085,934 | A | 4/1978 | Churchward |
| D253,778 | S | 12/1979 | Madison |
| 4,502,687 | A | 3/1985 | Kochevar |
| 4,523,759 | A | 6/1985 | Igarashi |
| 4,545,580 | A | 10/1985 | Tomita et al. |
| 4,553,755 | A | 11/1985 | Yamada |
| 4,591,160 | A | 5/1986 | Piragino |
| 4,614,627 | A | 9/1986 | Curtis et al. |
| D294,617 | S | 3/1988 | Perkins |
| 4,754,977 | A | 7/1988 | Sahm |
| 4,803,023 | A | 2/1989 | Enomoto et al. |
| 4,824,116 | A | 4/1989 | Nagamoto et al. |
| 4,883,623 | A | 11/1989 | Nagamoto et al. |
| 4,928,972 | A | 5/1990 | Nakanishi et al. |
| 4,988,104 | A | 1/1991 | Shiotani et al. |
| 5,090,702 | A | 2/1992 | Viste |
| 5,106,094 | A | 4/1992 | Desbiolles et al. |
| 5,158,296 | A | 10/1992 | Lee |
| 5,176,384 | A | 1/1993 | Sata et al. |
| 5,184,823 | A | 2/1993 | Desboilles et al. |
| 5,213,328 | A | 5/1993 | Long et al. |
| D336,672 | S | 6/1993 | Gorman |
| 5,244,211 | A | 9/1993 | Lukasiewicz |
| 5,290,036 | A | 3/1994 | Fenton et al. |
| 5,306,450 | A | 4/1994 | Okumoto et al. |
| 5,348,302 | A | 9/1994 | Sasamoto et al. |
| 5,351,958 | A | 10/1994 | Helmstetter |
| 5,419,559 | A | 5/1995 | Melanson et al. |
| 5,419,560 | A | 5/1995 | Bamber |
| 5,421,577 | A | 6/1995 | Kobayashi |
| 5,425,535 | A | 6/1995 | Gee |
| 5,447,311 | A | 9/1995 | Viollaz et al. |
| 5,451,056 | A | 9/1995 | Manning |
| 5,472,201 | A | 12/1995 | Aizawa et al. |
| 5,518,243 | A | 5/1996 | Redman |
| 5,540,437 | A | 7/1996 | Bamber |
| 5,595,548 | A | 1/1997 | Beck |
| 5,637,045 | A | 6/1997 | Igarashi |
| 5,647,808 | A | 7/1997 | Hosokawa |
| 5,649,873 | A | 7/1997 | Fuller |
| 5,669,824 | A | 9/1997 | Aizawa et al. |
| 5,669,830 | A | 9/1997 | Bamber |
| D386,550 | S | 11/1997 | Wright et al. |
| D386,551 | S | 11/1997 | Solheim et al. |
| D387,405 | S | 12/1997 | Solheim et al. |
| 5,738,596 | A | 4/1998 | Meyer |
| 5,766,091 | A | 6/1998 | Humphrey et al. |
| 5,766,092 | A | 6/1998 | Mimeur et al. |
| 5,769,735 | A | 6/1998 | Hosokawa |
| 5,772,527 | A | 6/1998 | Liu |
| 5,788,584 | A | 8/1998 | Parente et al. |
| 5,797,807 | A | 8/1998 | Moore |
| 5,827,132 | A | 10/1998 | Bamber |
| 5,899,821 | A | 5/1999 | Hsu et al. |
| 5,971,868 | A | 10/1999 | Kosmatka |
| 6,012,990 | A | 1/2000 | Nishizawa |
| D421,080 | S | 2/2000 | Chen |
| 6,042,486 | A | 3/2000 | Gallagher |
| D426,276 | S | 6/2000 | Besnard et al. |
| 6,077,171 | A | 6/2000 | Yoneyama |
| D428,634 | S | 7/2000 | Nagai et al. |
| 6,083,118 | A | 7/2000 | Martins et al. |
| 6,162,133 | A | 12/2000 | Peterson |
| 6,165,081 | A | 12/2000 | Chou |
| 6,231,458 | B1 | 5/2001 | Cameron et al. |
| 6,238,302 | B1 | 5/2001 | Helmstetter et al. |
| D445,862 | S | 7/2001 | Ford |
| 6,290,609 | B1 | 9/2001 | Takeda |
| 6,379,262 | B1 | 4/2002 | Boone |
| 6,386,990 | B1 | 5/2002 | Reyes et al. |
| 6,454,665 | B2 | 9/2002 | Antonious |
| 6,471,604 | B2 | 10/2002 | Hocknell et al. |
| D469,833 | S | 2/2003 | Roberts et al. |
| D475,107 | S | 5/2003 | Madore |
| 6,595,057 | B2 | 7/2003 | Bissonnette et al. |
| D478,140 | S | 8/2003 | Burrows |
| 6,607,451 | B2 | 8/2003 | Kosmatka et al. |
| 6,638,182 | B2 | 10/2003 | Kosmatka |
| 6,641,491 | B1 | 11/2003 | Schillaci |
| 6,702,693 | B2 | 3/2004 | Bamber |
| 6,746,343 | B2 | 6/2004 | Yoneyama |
| 6,780,123 | B2 | 8/2004 | Hasebe |
| 6,793,591 | B2 | 9/2004 | Takeda |
| 6,811,496 | B2 | 11/2004 | Wahl et al. |
| 6,830,519 | B2 | 12/2004 | Reed et al. |
| 6,835,144 | B2 | 12/2004 | Best |
| 6,840,872 | B2 | 1/2005 | Yoneyama |
| 6,855,067 | B2 | 2/2005 | Solheim et al. |
| 6,857,973 | B2 | 2/2005 | Wieland et al. |
| D502,975 | S | 3/2005 | Schweigert et al. |
| D503,204 | S | 3/2005 | Nicolette et al. |
| 6,863,626 | B2 | 3/2005 | Evans et al. |
| 6,904,663 | B2 | 6/2005 | Willett et al. |
| D508,545 | S | 8/2005 | Roberts et al. |
| D508,969 | S | 8/2005 | Hasebe |
| 6,923,733 | B2 | 8/2005 | Chen |
| 6,984,180 | B2 | 1/2006 | Hasebe |
| 7,014,570 | B2 | 3/2006 | Evans et al. |
| 7,048,648 | B2 | 5/2006 | Breier et al. |
| D523,501 | S | 6/2006 | Nicolette et al. |
| 7,082,665 | B2 | 8/2006 | Deshmukh et al. |
| 7,101,289 | B2 | 9/2006 | Gibbs et al. |
| 7,121,956 | B2 | 10/2006 | Lo |
| 7,128,663 | B2 | 10/2006 | Bamber |
| 7,137,903 | B2 | 11/2006 | Best et al. |
| 7,153,222 | B2 | 12/2006 | Gilbert et al. |
| D534,595 | S | 1/2007 | Hasebe |
| 7,169,057 | B2 | 1/2007 | Wood et al. |

(56) References Cited

U.S. PATENT DOCUMENTS

| | | | |
|---|---|---|---|
| 7,169,062 | B2 | 1/2007 | Chen |
| 7,182,698 | B2 | 2/2007 | Tseng |
| 7,207,900 | B2 | 4/2007 | Nicolette et al. |
| D543,601 | S | 5/2007 | Kawami |
| 7,220,189 | B2 | 5/2007 | Wieland et al. |
| 7,281,991 | B2 | 10/2007 | Gilbert et al. |
| D555,219 | S | 11/2007 | Lin |
| 7,303,486 | B2 | 12/2007 | Imamoto |
| 7,326,127 | B2 | 2/2008 | Hou et al. |
| 7,338,388 | B2 | 3/2008 | Schweigert et al. |
| 7,351,164 | B2 | 4/2008 | Schweigert et al. |
| 7,367,897 | B2 | 5/2008 | Poynor |
| 7,387,579 | B2 | 6/2008 | Lin et al. |
| 7,396,299 | B2 | 7/2008 | Nicolette et al. |
| 7,442,132 | B2 | 10/2008 | Nishio |
| 7,476,162 | B2 | 1/2009 | Stites et al. |
| 7,494,426 | B2 | 2/2009 | Nishio et al. |
| 7,524,249 | B2 | 4/2009 | Breier et al. |
| 7,582,024 | B2 | 9/2009 | Shear |
| 7,584,531 | B2 | 9/2009 | Schweigert et al. |
| 7,588,502 | B2 | 9/2009 | Nishino |
| 7,594,862 | B2 | 9/2009 | Gilbert |
| 7,597,633 | B2 | 10/2009 | Shimazaki et al. |
| 7,611,424 | B2 | 11/2009 | Nagai et al. |
| 7,618,331 | B2 | 11/2009 | Hirano |
| 7,658,686 | B2 | 2/2010 | Soracco |
| D618,293 | S | 6/2010 | Foster et al. |
| 7,744,484 | B1 | 6/2010 | Chao |
| 7,744,486 | B2 | 6/2010 | Hou et al. |
| 7,744,487 | B2 | 6/2010 | Tavares et al. |
| 7,749,100 | B2 | 7/2010 | Tavares et al. |
| 7,785,212 | B2 | 8/2010 | Lukasiewicz et al. |
| 7,794,333 | B2 | 9/2010 | Wallans et al. |
| 7,803,068 | B2 | 9/2010 | Clausen et al. |
| 7,935,000 | B2 | 5/2011 | Stites |
| 7,938,738 | B2 | 5/2011 | Roach |
| 8,007,373 | B2 | 8/2011 | Soracco et al. |
| 8,012,040 | B2 | 9/2011 | Takechi |
| 8,062,150 | B2 | 11/2011 | Gilbert et al. |
| 8,088,025 | B2 | 1/2012 | Wahl et al. |
| 8,187,116 | B2 | 5/2012 | Boyd et al. |
| 8,246,487 | B1 | 8/2012 | Cackett et al. |
| 8,257,196 | B1 | 9/2012 | Abbott et al. |
| 8,262,506 | B2 | 9/2012 | Watson et al. |
| 8,277,337 | B2 | 10/2012 | Shimazaki |
| 8,348,782 | B2 | 1/2013 | Park et al. |
| 8,376,878 | B2 | 2/2013 | Bennett et al. |
| 8,393,976 | B2 | 3/2013 | Soracco et al. |
| D681,142 | S | 4/2013 | Fossum et al. |
| 8,414,422 | B2 | 4/2013 | Peralta et al. |
| 8,439,769 | B2 | 5/2013 | Rice et al. |
| 8,449,406 | B1 | 5/2013 | Frame et al. |
| 8,469,834 | B2 | 6/2013 | Wada et al. |
| 8,475,293 | B2 | 7/2013 | Morin et al. |
| 8,506,420 | B2 | 8/2013 | Hocknell et al. |
| 8,535,176 | B2 | 9/2013 | Bazzel et al. |
| 8,545,343 | B2 | 10/2013 | Boyd et al. |
| 8,574,094 | B2 | 11/2013 | Nicolette et al. |
| 8,657,700 | B2 | 2/2014 | Nicolette et al. |
| 8,663,026 | B2 | 3/2014 | Blowers et al. |
| 8,690,710 | B2 | 4/2014 | Nicolette et al. |
| 8,734,265 | B2 | 5/2014 | Soracco |
| 8,753,230 | B2 | 6/2014 | Stokke et al. |
| 8,790,196 | B2 | 7/2014 | Solheim et al. |
| 8,808,106 | B2 | 8/2014 | Tavares et al. |
| 8,814,717 | B2 | 8/2014 | Yashiki |
| 8,814,724 | B2 | 8/2014 | Kato |
| 8,826,512 | B2 | 9/2014 | Schweigert |
| 8,845,455 | B2 | 9/2014 | Ban et al. |
| 8,858,362 | B1 | 10/2014 | Leposky et al. |
| 8,900,072 | B1 | 12/2014 | Willett et al. |
| 8,915,794 | B2 | 12/2014 | Stites |
| 8,926,451 | B2 | 1/2015 | Deshmukh et al. |
| 9,011,268 | B2 | 4/2015 | Ban |
| 9,022,880 | B2 | 5/2015 | Kawaguchi et al. |
| 9,028,340 | B2 | 5/2015 | Ban |
| 9,033,819 | B2 | 5/2015 | Wahl et al. |
| 9,033,820 | B2 | 5/2015 | Kato |
| 9,044,653 | B2 | 6/2015 | Wahl et al. |
| 9,061,186 | B2 | 6/2015 | Larson |
| 9,079,081 | B2 | 7/2015 | Shimazaki |
| 9,089,746 | B2 | 7/2015 | Schweigert |
| 9,101,808 | B2 | 8/2015 | Stites et al. |
| 9,101,809 | B2 | 8/2015 | Gibbs et al. |
| 9,155,945 | B2 | 10/2015 | Demkowski et al. |
| 9,168,436 | B2 | 10/2015 | Slaughter et al. |
| 9,199,141 | B2 | 12/2015 | Cardani et al. |
| 9,199,143 | B1 | 12/2015 | Parsons et al. |
| 9,265,995 | B2 | 2/2016 | Wahl et al. |
| 9,468,821 | B2 | 10/2016 | Parsons et al. |
| 9,517,393 | B2 | 12/2016 | Cardani et al. |
| 9,533,201 | B2 | 1/2017 | Parsons et al. |
| 9,573,027 | B2 | 2/2017 | Nivanh et al. |
| 9,610,481 | B2 | 4/2017 | Parsons et al. |
| 9,623,296 | B2 | 4/2017 | Nicolette et al. |
| 9,649,542 | B2 | 5/2017 | Nicolette |
| 9,669,270 | B2 | 6/2017 | Schweigert et al. |
| 9,675,853 | B2 | 6/2017 | Parsons et al. |
| 9,717,959 | B2 | 8/2017 | Stites |
| 9,750,993 | B2 | 9/2017 | Ritchie et al. |
| 9,802,089 | B2 | 10/2017 | Honea et al. |
| 9,814,952 | B2 | 11/2017 | Parsons et al. |
| 9,844,710 | B2 | 12/2017 | Parsons et al. |
| 9,937,388 | B2 | 4/2018 | Cardani et al. |
| 9,975,013 | B2 | 5/2018 | Jertson et al. |
| 9,993,704 | B2 | 6/2018 | Hebreo et al. |
| 10,086,244 | B2 | 10/2018 | Morin et al. |
| 10,150,020 | B2 | 12/2018 | Cole et al. |
| 10,258,840 | B2 | 4/2019 | Larson |
| RE47,653 | E | 10/2019 | Wahl et al. |
| 10,449,428 | B2 | 10/2019 | Parsons et al. |
| 10,478,684 | B2 | 11/2019 | Parsons et al. |
| 10,512,829 | B2 | 12/2019 | Parsons et al. |
| 10,596,425 | B2 | 3/2020 | Parsons et al. |
| 10,632,349 | B2 | 4/2020 | Parsons et al. |
| 10,729,948 | B2 | 8/2020 | Parsons et al. |
| 10,729,949 | B2 | 8/2020 | Parsons et al. |
| 10,828,538 | B2 | 11/2020 | Parsons et al. |
| 10,874,921 | B2 | 12/2020 | Parsons et al. |
| 10,905,920 | B2 | 2/2021 | Parsons et al. |
| 10,905,925 | B2 | 2/2021 | Morales et al. |
| 10,933,286 | B2 | 3/2021 | Parsons et al. |
| 10,953,293 | B2 | 3/2021 | Demkowski et al. |
| 11,154,755 | B2 | 10/2021 | Parsons et al. |
| 11,167,187 | B2 | 11/2021 | Parsons et al. |
| 11,192,003 | B2 | 12/2021 | Parsons et al. |
| 11,344,775 | B2 | 5/2022 | Parsons et al. |
| 11,351,426 | B2 | 6/2022 | Demkowski et al. |
| 11,369,847 | B2 | 6/2022 | Parsons et al. |
| 11,400,352 | B1 | 8/2022 | Parsons et al. |
| 11,420,097 | B2 | 8/2022 | Demkowski et al. |
| 11,458,372 | B2 | 10/2022 | Parsons et al. |
| 11,541,288 | B2 | 1/2023 | Parsons et al. |
| 11,559,727 | B2 | 1/2023 | Demkowski et al. |
| 11,565,158 | B1 | 1/2023 | Parsons et al. |
| 2001/0055996 | A1 | 12/2001 | Iwata et al. |
| 2002/0004427 | A1 | 1/2002 | Cheng et al. |
| 2002/0037775 | A1 | 3/2002 | Keelan |
| 2002/0107087 | A1 | 8/2002 | Fagot |
| 2003/0139222 | A1 | 7/2003 | Vadersen |
| 2003/0139226 | A1 | 7/2003 | Cheng et al. |
| 2004/0204263 | A1 | 10/2004 | Fagot et al. |
| 2004/0266550 | A1 | 12/2004 | Gilbert et al. |
| 2005/0009632 | A1 | 1/2005 | Schweigert et al. |
| 2005/0014573 | A1 | 1/2005 | Lee |
| 2005/0043117 | A1 | 2/2005 | Gilbert et al. |
| 2005/0255936 | A1 | 11/2005 | Huang |
| 2005/0277485 | A1 | 12/2005 | Hou et al. |
| 2006/0229141 | A1 | 10/2006 | Galloway |
| 2007/0032308 | A1 | 2/2007 | Fagot et al. |
| 2007/0225084 | A1 | 9/2007 | Schweigert et al. |
| 2008/0022502 | A1 | 1/2008 | Tseng |
| 2008/0058113 | A1 | 3/2008 | Nicolette et al. |
| 2008/0300065 | A1 | 12/2008 | Schweigert |

(56) References Cited

U.S. PATENT DOCUMENTS

| | | | | |
|---|---|---|---|---|
| 2008/0318705 | A1 | 12/2008 | Clausen et al. | |
| 2009/0029790 | A1 | 1/2009 | Nicolette et al. | |
| 2010/0130306 | A1 | 5/2010 | Schweigert | |
| 2010/0178999 | A1 | 7/2010 | Nicolette et al. | |
| 2011/0111883 | A1 | 5/2011 | Cackett | |
| 2011/0165963 | A1 | 7/2011 | Cackett et al. | |
| 2011/0269567 | A1 | 11/2011 | Ban et al. | |
| 2011/0294596 | A1 | 12/2011 | Ban | |
| 2013/0288823 | A1 | 10/2013 | Hebreo | |
| 2014/0274441 | A1 | 9/2014 | Greer | |
| 2014/0274442 | A1 | 9/2014 | Honea et al. | |
| 2014/0274451 | A1 | 9/2014 | Knight et al. | |
| 2016/0144247 | A1 | 5/2016 | Chen et al. | |
| 2016/0296804 | A1* | 10/2016 | Parsons | A63B 53/0466 |
| 2022/0072393 | A1 | 3/2022 | Parsons et al. | |

FOREIGN PATENT DOCUMENTS

| | | | |
|---|---|---|---|
| CN | 101031342 | A | 1/2013 |
| DE | 29715997 | U1 | 2/1998 |
| GB | 2249031 | A | 4/1992 |
| JP | S51140374 | A | 12/1976 |
| JP | S54134561 | A | 10/1979 |
| JP | H0284972 | A | 3/1990 |
| JP | H08257181 | A | 10/1996 |
| JP | H10127832 | A | 5/1998 |
| JP | H10277187 | A | 10/1998 |
| JP | 2001346924 | A | 12/2001 |
| JP | 2002143356 | A | 5/2002 |
| JP | 2004313777 | A | 11/2004 |
| JP | 2006087783 | A | 4/2006 |
| JP | 2007044445 | A | 2/2007 |
| JP | 2010537731 | A | 12/2010 |
| JP | 2013188400 | A | 9/2013 |
| WO | 9215374 | A1 | 9/1992 |

* cited by examiner

| | Center | Heel | Toe | High | Low |
|---|---|---|---|---|---|
| Club No. 1 | 122.2 | 120.3 | 119.6 | 118.6 | 119.5 |
| Club No. 2 | 122.1 | 120.1 | 119.7 | 118.9 | 119.3 |
| Club No. 3 | 122.7 | 120.5 | 120.2 | 119.5 | 119.6 |

| | Center | Heel | Toe | High | Low |
|---|---|---|---|---|---|
| Club No. 1 | 15.1 | 14.8 | 14.9 | 15.3 | 14.5 |
| Club No. 2 | 15.4 | 15.1 | 15.2 | 15.4 | 15 |
| Club No. 3 | 15 | 14.6 | 15.1 | 15.2 | 14.7 |

| | Center | Heel | Toe | High | Low |
|---|---|---|---|---|---|
| Club No. 1 | 4528 | 4366 | 4602 | 4447 | 4982 |
| Club No. 2 | 4333 | 4187 | 4556 | 4487 | 4874 |
| Club No. 3 | 4443 | 4222 | 4536 | 4336 | 4820 |

| | Center | Heel | Toe | High | Low |
|---|---|---|---|---|---|
| Club No. 1 | 186.1 | 182.8 | 180.1 | 179.3 | 178 |
| Club No. 2 | 187.3 | 183.6 | 180.9 | 179.7 | 178.1 |
| Club No. 3 | 187.5 | 183.7 | 182 | 181.7 | 178.8 |

GOLF CLUB HEADS AND METHODS TO MANUFACTURE GOLF CLUB HEADS

CROSS REFERENCE

This application is a continuation-in-part of U.S. application Ser. No. 18/442,782, filed Feb. 15, 2024, which is a continuation of application Ser. No. 18/526,106, filed Dec. 1, 2023, now U.S. Pat. No. 11,938,385, which claims the benefit of U.S. Provisional Application No. 63/461,491, filed Apr. 24, 2023.

U.S. application Ser. No. 18/526,106, filed Dec. 1, 2023, is a continuation-in-part of U.S. application Ser. No. 18/205,019, filed Jun. 2, 2023, now U.S. Pat. No. 11,833,398, which is a continuation of U.S. application Ser. No. 18/115,222, filed Feb. 28, 2023, now U.S. Pat. No. 11,707,655, which claims the benefit of U.S. Provisional Application No. 63/389,561, filed Jul. 15, 2022, and claims the benefit of U.S. Provisional Application No. 63/443,494, filed Feb. 6, 2023.

U.S. application Ser. No. 18/205,019, filed Jun. 2, 2023, is a continuation-in-part of U.S. application Ser. No. 17/988,585, filed Nov. 16, 2022, which is a continuation of application Ser. No. 17/841,893, filed Jun. 16, 2022, now U.S. Pat. No. 11,806,590, which is a continuation of application Ser. No. 17/685,546, filed Mar. 3, 2022, now U.S. Pat. No. 11,400,352, which claims the benefit of U.S. Provisional Application No. 63/276,981, filed Nov. 8, 2021.

U.S. application Ser. No. 17/685,546, filed Mar. 3, 2022, is a continuation-in-part of application Ser. No. 17/528,402, filed Nov. 17, 2021, now U.S. Pat. No. 11,426,641, which is a continuation of application Ser. No. 16/566,597, filed Sep. 10, 2019, now U.S. Pat. No. 11,207,575, which is a continuation of application Ser. No. 16/272,269, filed Feb. 11, 2019, now U.S. Pat. No. 10,449,428, which claims the benefit of U.S. Provisional Application No. 62/629,459, filed Feb. 12, 2018; U.S. Provisional Application No. 62/714,948, filed Aug. 6, 2018; U.S. Provisional Application No. 62/722,491, filed Aug. 24, 2018; U.S. Provisional Application No. 62/732,062, filed Sep. 17, 2018; U.S. Provisional Application No. 62/755,160, filed Nov. 2, 2018; U.S. Provisional Application No. 62/756,446, filed Nov. 6, 2018; U.S. Provisional Application No. 62/787,554, filed Jan. 2, 2019; and U.S. Provisional Application No. 62/792,191, filed Jan. 14, 2019.

The disclosures of the above-referenced applications are incorporated by reference herein in their entirety.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club heads and methods to manufacture golf club heads.

BACKGROUND

Various materials (e.g., steel-based materials, titanium-based materials, tungsten-based materials, etc.) may be used to manufacture golf club heads. By using multiple materials to manufacture golf club heads, the position of the center of gravity (CG) and/or the moment of inertia (MOI) of the golf club heads may be optimized to produce certain trajectory and spin rate of a golf ball.

Figure 1:
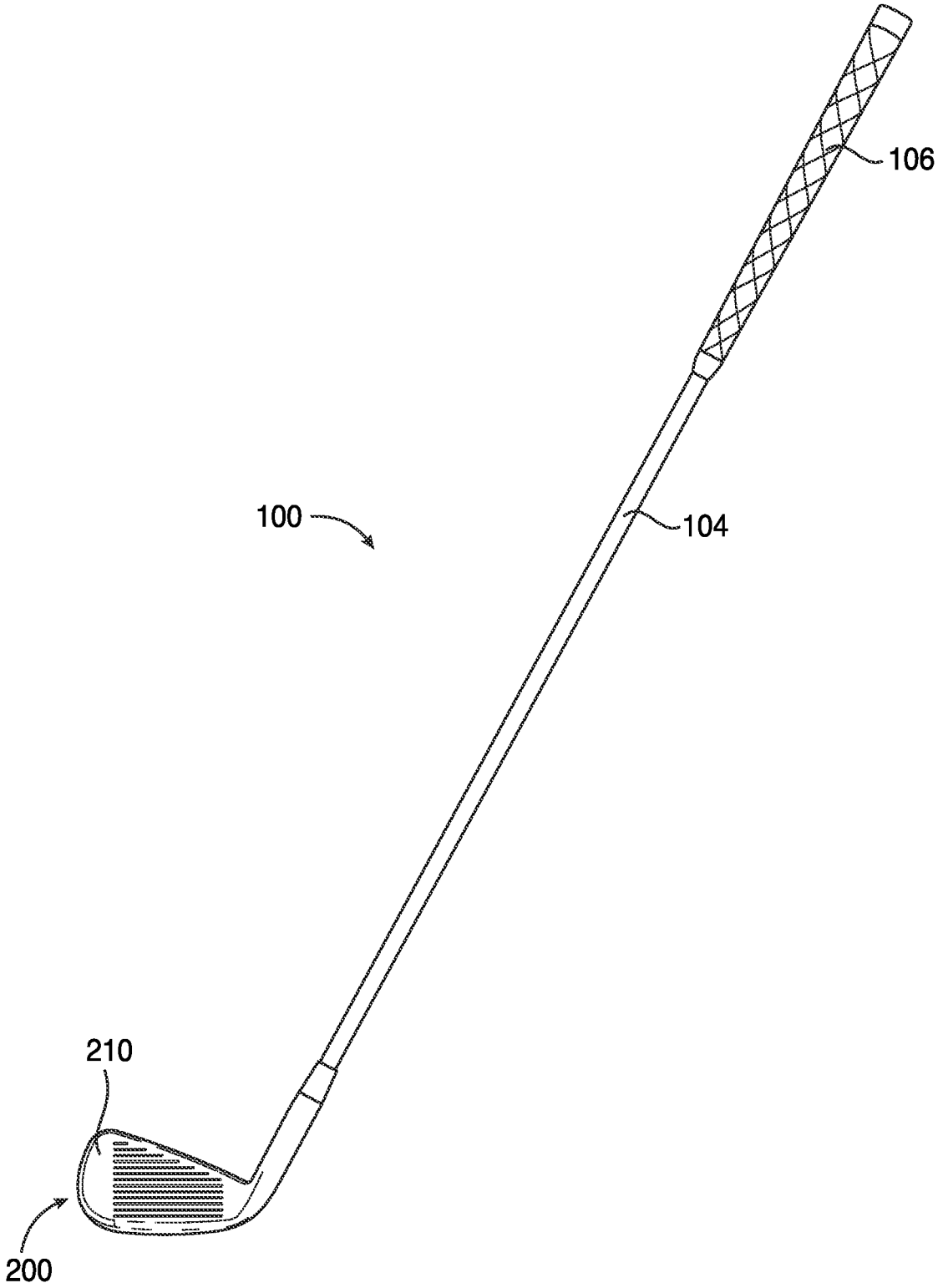
FIG. 1 depicts a golf club head having a golf club according to any embodiment of the apparatus, methods, and articles of manufacture described herein.
Figure 2:
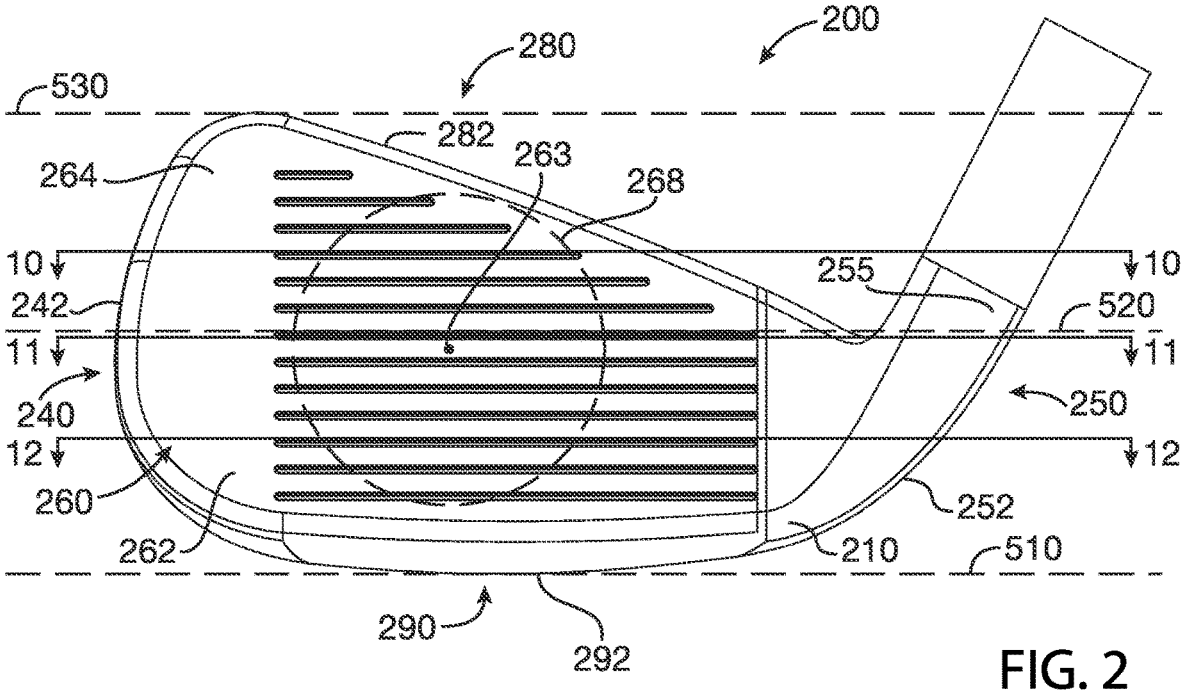
FIGS. 2, 3, 4, 5, 6, 7, 8, 9, 10, 11, and 12 depict a perspective front view, a perspective back view, a perspective cross-sectional view (along line 4-4 of FIG. 3), a perspective cross-sectional view (along line 5-5 of FIG. 3), a perspective cross-sectional view (along line 6-6 of FIG. 3), a perspective front view illustrated without a face portion, another perspective front view illustrated without a face portion, another perspective front view illustrated without a face portion, a perspective cross-sectional view (along line 10-10 of FIG. 2), a perspective cross-sectional view (along line 11-11 of FIG. 2), and a perspective cross-sectional view (along line 12-12 of FIG. 2), respectively, of a golf club head according to an embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

The following U.S. Patents and Patent Applications, which are collectively referred to herein as "the incorporated by reference patent documents," are incorporated by reference herein in their entirety: U.S. Pat. Nos. 8,961,336, 9,199,143, 9,421,437, 9,427,634, 9,468,821, 9,533,201, 9,610,481, 9,649,542, 9,675,853, 9,814,952, 9,878,220, 10,029,158, 10,029,159, 10,159,876, 10,232,235, 10,265,590, 10,279,233, 10,286,267, 10,293,229, 10,449,428, 10,478,684, 10,512,829, 10,596,424, 10,596,425, 10,632,349, 10,716,978, 10,729,948, 10,729,949, 10,814,193, 10,821,339, 10,821,340, 10,828,538, 10,864,414, 10,874,919, 10,874,921, 10,905,920, 10,933,286, 10,940,375, 11,058,932, 11,097,168, 11,117,030, 11,141,633, 11,154,755, 11,167,187, 11,173,359, 11,192,003, 11,207,575, 11,235,211; and U.S. Patent Publication Nos. 20170282026, 20170282027, 20170368429, 20180050243, 20180050244, 20180133567, 20180140910, 20180169488, 20180221727, 20180236325, 20190232125, 20190232126, 20190247727, 20200171363, 20210023422, 20210069557, 20210086044, 20210162278, 20210197037, 20210205672, 20210308537, 20220032138, and 20220040541.

In the example of FIGS. 1-14, a golf club 100 may include a golf club head 200, a shaft 104, and a grip 106. The golf club head 200 may be attached to one end of the shaft 104 and the grip 106 may be attached to the opposite end of the shaft 104. An individual can hold the grip 106 and swing the golf club head 200 with the shaft 104 to strike a golf ball (not illustrated). The golf club head 200 may include a body portion 210 having a toe portion 240 with a toe portion edge 242, a heel portion 250 with a heel portion edge 252 that may include a hosel portion 255 configured to receive a shaft (an example shaft 104 is illustrated in FIG. 1) with a grip (an example grip 106 is illustrated in FIG. 1) on one end and the golf club head 200 on the opposite end of the shaft to form a golf club (an example golf club 100 is illustrated in FIG. 1), a front portion 260 with a perimeter edge portion 261, a back portion 270 with a back wall portion 272, a top portion 280 with a top portion edge 282, and a sole portion 290 with a sole portion edge 292. The toe portion edge 242, the heel portion edge 252, the top portion edge 282, and the sole portion edge 292 may define a periphery of the body portion 210. The toe portion 240, the heel portion 250, the front portion 260, the back portion 270, the top portion 280, and/or the sole portion 290 may partially overlap each other. For example, a portion of the toe portion 240 may overlap portion(s) of the front portion 260, the back portion 270, the top portion 280, and/or the sole portion 290. In a similar manner, a portion of the heel portion 250 may overlap portion(s) of the front portion 260, the back portion 270, the top portion 280, and/or the sole portion 290. In another example, a portion of the back portion 270 may overlap portion(s) of the toe portion 240, the heel portion 250, the top portion 280, and/or the sole portion 290. The apparatus, methods, and articles of manufacture described herein are not limited in this regard.

The golf club head 200 may include a face portion 262 (i.e., the strike face), which may be integrally formed with the body portion 210 (e.g., a single unitary piece). In one example, as illustrated in FIGS. 2-13, the face portion 262 may be a separate piece coupled (e.g., adhesively, mechanically, by welding, and/or by soldering) to the front portion 260. The face portion 262 may include a front surface 264 and a back surface 266. In one example (not illustrated), the front portion 260 may include one or a plurality of recessed shoulders configured to receive the face portion 262 for attachment of the face portion 262 to the body portion 210. In another example, as illustrated in FIGS. 2-13, the back surface 266 may include a perimeter portion 267 that may be attached to a perimeter edge portion 261 of the body portion 210. The perimeter portion 267 of the face portion 262 may be attached to the perimeter edge portion 261 of the body portion 210 by one or more fasteners, one or more adhesive or bonding agents, and/or welding or soldering. In one example, as illustrated in FIGS. 2-13, the perimeter portion 267 of the face portion 262 may be welded to the perimeter edge portion 261 of the body portion 210 at one or more locations. Alternatively, the entire perimeter portion 267 of the face portion 262 may be welded to the entire perimeter edge portion 261 of the body portion 210 (i.e., a continuous weld). The face portion 262 may include a ball strike region 268 to strike a golf ball. In one example, the center of the ball strike region 268 may be a geometric center 263 of the face portion 262. In another example, the geometric center 263 of the face portion 262 may be offset from a center of the ball strike region 268. In one example, the geometric center 263 and one or more regions near and/or surrounding the geometric center within the ball strike region 268 may provide a generally optimum location (i.e., optimum ball distance, ball speed, ball spin characteristics, etc.) on the face portion 262 for striking a golf ball. In yet another example, any location at or near the geometric center 263 and within the ball strike region 268 may provide a generally optimum location on the face portion 262 for striking a golf ball. However, a ball may be struck with any portion of the face portion 262 within the ball strike region 268 or outside the ball strike region 268 for any of the golf club heads described herein resulting in certain ball flight characteristics different from an on-center hit that may be preferred by an individual. The configuration of the face portion 262 and the attachment of the face portion 262 (e.g., welding) to the body portion 210 may be similar in many respects to any of the golf club heads described herein and/or described in any of the incorporated by reference patent documents. The apparatus, methods, and articles of manufacture described herein are not limited in this regard.

The golf club head 200 may be associated with a ground plane 510, a horizontal midplane 520, and a top plane 530. In particular, the ground plane 510 may be a plane that is parallel or substantially parallel to the ground and is tangent to the lowest portion of the sole portion edge 292 when the golf club head 200 is at an address position (e.g., the golf club head 200 aligned to strike a golf ball). A top plane 530 may be a plane that is tangent to the upper most portion of top portion edge 282 when the golf club head 200 is at the address position. The ground plane 510 and the top plane 530 may be parallel or substantially parallel. The horizontal midplane 520 may be vertically halfway between the ground plane 510 and the top plane 530. Further, the golf club head 200 may be associated with a loft plane 540 defining a loft angle 545 ($\alpha$) of the golf club head 200. The loft plane 540 may be a plane that is tangent to the face portion 262. The loft angle 545 may be defined by an angle between the loft plane 540 and a vertical plane 550 normal to the ground plane 510.

The body portion 210 may be a hollow body including an interior cavity 310 having inner walls 312. The interior cavity 310 may extend between the front portion 260, the back portion 270, the top portion 280, and the sole portion 290. In the example of FIGS. 2-13, the interior cavity 310 of the body portion 210 may be enclosed with and partially defined with the face portion 262. The configuration of the interior cavity 310 (e.g., height, width, volume, shape, etc.), the configuration of the interior cavity 310 relative to the body portion 210 (e.g., volume of the interior cavity 310 relative to the volume of body portion 210), the width and height variation of the interior cavity 310, and access to the interior cavity 310 from one or more ports on the body portion 210 may be similar to any of the golf club heads described herein and/or described in any of the incorporated by reference patent documents. The apparatus, methods, and articles of manufacture described herein are not limited in this regard.

The back wall portion 272 of the back portion 270 may include an upper back wall portion 612 and a lower back wall portion 614. The back wall portion 272 may include a ledge portion 616 that may extend between the toe portion edge 242 and the heel portion edge 252 in a continuous or discontinuous manner. The lower back wall portion 614 may be located farther back on the body portion 210 than the upper back wall portion 612, with the ledge portion 616 defining a transition portion between the upper back wall portion 612 and the lower back wall portion 614. Accordingly, the ledge portion 616 may extend transverse to the upper back wall portion 612 and the lower back wall portion 614. In one example, as illustrated in FIG. 2-13, the ledge portion 616 may include a first ledge portion 626 and a second ledge portion 636. The first ledge portion 626 may extend on the back wall portion from the toe portion edge 242 to a center portion of the back wall back wall portion 272. The second ledge portion 636 may extend from the center portion of the back wall portion 272 to the heel portion edge 252. As illustrated in FIGS. 2-13, the ledge portion 616 may provide for a relatively greater mass of the body portion 210 below the horizontal midplane 520, and the mass of the body portion 210 below the horizontal midplane 520 to be moved farther back on the body portion 210. The width of the ledge portion 616 may be greater than, equal to, or less than the width of the interior cavity at certain locations of the body portion 210. The configuration of the ledge portion 616 (e.g., width, segments, tapering, shape, etc.) and the properties of the ledge portion 616 relative to the width of the interior cavity may be similar to any ledge portion or similar structure of any of the golf club heads described herein and/or described in any of the incorporated by reference patent documents. The apparatus, methods, and articles of manufacture described herein are not limited in this regard.

The body portion 210 may include one or more ports, which may be exterior ports and/or interior ports (e.g., located inside the body portion 210). The inner walls 312 of the interior cavity 310 may include one or more ports (not illustrated). In one example, as illustrated in FIGS. 2-13, the back portion 270 may include one or more ports along or proximate to the periphery of the body portion 210. For example, the body portion 210 may include a first set of ports 320 (e.g., illustrated as ports 321 and 322) above the horizontal midplane 520, a second set of ports 330 (e.g., illustrated as ports 331 and 332) below the horizontal midplane 520, a third set of ports 340 (e.g., illustrated as ports 341, 342, and 343) below the horizontal midplane 520, and a fourth set of ports 350 (e.g., illustrated as ports 351 and 352) below the horizontal midplane 520. The locations, spacing relative to other ports, and any other configuration of each port of the first set of ports 320, the second set of ports 330, the third set of ports 340, and/or the fourth set of ports 350 may be similar in many respects to any of the ports described herein or described in any of the incorporated by reference patent documents. Further, any one or more of the ports of the first set of ports 320, the second set of ports 330, the third set of ports 340, and/or the fourth set of ports 350 may be connected to interior cavity 310 through which one or more filler materials may be injected into the interior cavity 310. In the example of FIGS. 2-13, the ports 321, 331, and 351 may be connected to the interior cavity 310 via openings 361, 371, and 381, respectively. The apparatus, methods, and articles of manufacture described herein are not limited in this regard.

The body portion 210 may include one or more mass portions (e.g., weight portion(s)), which may be integral mass portion(s) or separate mass portion(s) that may be coupled to the body portion 210. In the illustrated example as illustrated in FIGS. 2-13, the body portion 210 may include a first set of mass portions 420 (e.g., illustrated as mass portions 421 and 422), a second set of mass portions 430 (e.g., illustrated as mass portions 431 and 432), a third set of mass portions 440 (e.g., illustrated as mass portions 441, 442, and 443), and a fourth set of mass portions 450 (e.g., illustrated as mass portions 451 and 452). While the above example may describe a particular number or portions of mass portions, a set of mass portions may include a single mass portion, or a plurality of mass portions as described herein and in any of the incorporated by reference patent documents. For example, any one or a combination of adjacent sets of mass portions of the first set of mass portions 420 may be a single mass portion, the second set of mass portions 430 may be a single mass portion, the third set of mass portions 440 may be a single mass portion, and/or the fourth set of mass portions 450 may be a single mass portion. Further, the first set of mass portions 420, the second set of mass portions 430, the third set of mass portions 440, and/or the fourth set of mass portions 450 may be a portion of the physical structure of the body portion 210. The mass portions of the first set of mass portions 420, the second set of mass portions 430, the third set of mass portions 440, and/or the fourth set of mass portions 450 may be similar to any of the mass portions described in any of the incorporated by reference patent documents. The apparatus, methods, and articles of manufacture described herein are not limited in this regard.

The interior cavity 310 may be partially or entirely filled with one or more filler materials (i.e., a cavity filling material), which may include one or more similar or different types of materials. In one example, as illustrated in FIGS. 2-13, the interior cavity 310 may be filled with a first filler material 512 and a second filler material 514. In one example, the first filler material 512 may be a rubber or rubber compound, and the second filler material 514 may be an epoxy-type of material. In another example, the first filler material 512 and/or the second filler material 514 may be different polymer materials. The first filler material 512 and the second filler material 514 may be similar to any of the filler materials described herein or described in any of the incorporated by reference patent documents. The first filler material 512 and/or the second filler material 514 may be coupled to all or portions of the inner walls 312 of the interior cavity 310. In one example, the first filler material 512 and/or the second filler material 514 may have inherent adhesive or bonding properties to attach to all or portions of the inner walls 312. In another example, the first filler material 512 and/or the second filler material may be attached to all or portions of the inner walls 312 with one or more bonding agents or adhesives that may be mixed with the first filler material 512 and/or the second filler material 514, respectively. In another example, the first filler material 512 and/or the second filler material 514 may be attached to all or portions of the inner walls 312 with one or more bonding agents or adhesives that may be separate from the first filler material 512 and/or the second filler material 514, respectively. The amount (i.e., volume and/or mass) of the first filler material 512 and/or the second filler material 514 may be determined for each golf club head (i.e., having a certain loft angle) to (i) provide vibration dampening or sound dampening (e.g., consistent and/or pleasing sound and feel when the golf club head 200 strikes a golf ball as perceived by an individual using the golf club head 200), (ii) provide structural support for the face portion 262, and/or (iii) optimize ball travel distance, ball speed, ball launch angle, ball spin rate, ball peak height, ball landing angle and/or ball dispersion. Details regarding the filler materials 512 and 514, coupling of the filler materials 512 and 514 to the body portion 210 and each other, material compositions and/or physical properties of the filler materials 512 and 514, the mass and/or volume of each of the filler materials 512 and 514 in the interior cavity 310 may be provided in detail in any of the incorporated by reference patent documents, and in particular, in U.S. Pat. No. 10,632,349, which is incorporated by reference herein. The apparatus, methods, and articles of manufacture described herein are not limited in this regard.

In the example of FIGS. 2-13, a portion of the interior cavity 310 including a central portion 311 of the interior cavity 310, which may be a portion of the interior cavity 310 that may generally correspond to the ball strike region 268, may be include the first filler material 512 and the second filler material 514. The width 313 of the interior cavity 310 at the central portion 311 of the interior cavity 310 may be generally greater than the width 313 of the interior cavity 310 at other portions of the interior cavity 310. Accordingly, the region of the interior cavity 310 behind the ball strike region 268, i.e., the central portion 311, may include a relatively large volume of the first filler material 512 and/or the second filler material 514. Further, the configuration of the central portion 311 (i.e., size, shape, contour, volume, etc.) may depend on the loft angle 545. For example, a golf club head 200 with a relatively small loft angle may have a larger central portion 311 (i.e., larger volume, depth, height, etc.) than a golf club head 200 with a relatively large loft angle. Accordingly, as described herein, the amount of first filler material 512 and/or the second filler material 514 inside the interior cavity 310, and more specifically, in the central portion 311 may be determined based on the loft angle 545 to provide (i) provide vibration dampening or sound dampening (e.g., consistent and/or pleasing sound and feel when the golf club head 200 strikes a golf ball as perceived by an individual using the golf club head 200), (ii) provide structural support for the face portion 262, and/or (iii) optimize ball travel distance, ball speed, ball launch angle, ball spin rate, ball peak height, ball landing angle and/or ball dispersion. The apparatus, methods, and articles of manufacture described herein are not limited in this regard.

The contour of the interior cavity 310 or the shape of the inner walls 312 may be defined by a plurality of recessed portions that may be recessed relative to the perimeter edge portion 261. In the example of FIGS. 2-13, the interior cavity 310 may include a first recessed portion 314, a second recessed portion 315 that may have a generally smaller depth (i.e., defined by the interior cavity width 313 as viewed in cross section in FIGS. 5-40) relative to the first recessed portion 314, a third recessed portion 316 that may have a generally smaller depth than the second recessed portion 315, a fourth recessed portion 317 that may have a generally smaller depth than the third recessed portion 316, and a fifth recessed portion 318 that may have a generally smaller depth than the fourth recessed portion 317. The interior cavity 310 may have a greater number or a fewer number of recessed portions as described and illustrated herein. The interior cavity 310 may include a first internal channel 325 that may extend from a location at the toe portion 240 to the central portion 311, and a second internal channel 326 that may extend from a location at the heel portion 250 to the central portion 311. The first recessed portion 314, the second recessed portion 315, the third recessed portion 316, the fourth recessed portion 317, the fifth recessed portion 318, the first internal channel 325, the second internal channel 326, and/or any transition regions therebetween may be described in detail in one or more of the incorporated by reference patent documents, and in particular, in U.S. Pat. No. 10,632,349, which is incorporated by reference herein. The apparatus, methods, and articles of manufacture described herein are not limited in this regard.

In one example, as illustrated in FIGS. 2-13, the first recessed portion 314, the second recessed portion 315, the third recessed portion 316, and the internal channels 325 and 326 may be filled with the first filler material 512, whereas the remaining portions of the interior cavity 310 may be filled with the second filler material 514. In another example, the first recessed portion 314, the second recessed portion 315, and the internal channels 325 and 326 may be filled with the first filler material 512, whereas the remaining portions of the interior cavity 310 may be filled with the second filler material 514. In another example, the first recessed portion 314, the second recessed portion 315, the internal channels 325 and 326, the third recessed portion 316 and the fifth recessed portion 318 may be filled with the first filler material 512, whereas the remaining portions of the interior cavity 310 may be filled with the second filler material 514. In yet another example, the entire interior cavity 310 may be filled with the first filler material 512 or the first filler material. The apparatus, methods, and articles of manufacture described herein are not limited in this regard.

A width 522 ($W_{F1}$) of the first filler material 512 and the width 524 ($W_{F2}$) of the second filler material 514 may vary from the toe portion 240 to the heel portion 250 and/or from the top portion 280 to the sole portion 290 and/or according to the shapes of the first recessed portion 314, the second recessed portion 315, the third recessed portion 316, the fourth recessed portion 317, and/or the fifth recessed portion 318 depending on the location inside the interior cavity 310. The width 522 of the first filler material 512 and the width 524 of the second filler material 514 as related to the physical properties, ball strike and trajectory characteristics, and configuration of the golf club head 200 (e.g., loft angle) may be provided in detail in any of the incorporated by reference patent documents, and in particular, in U.S. Pat. No. 10,632,349, which is incorporated by reference herein. The apparatus, methods, and articles of manufacture described herein are not limited in this regard.

Figure 13:
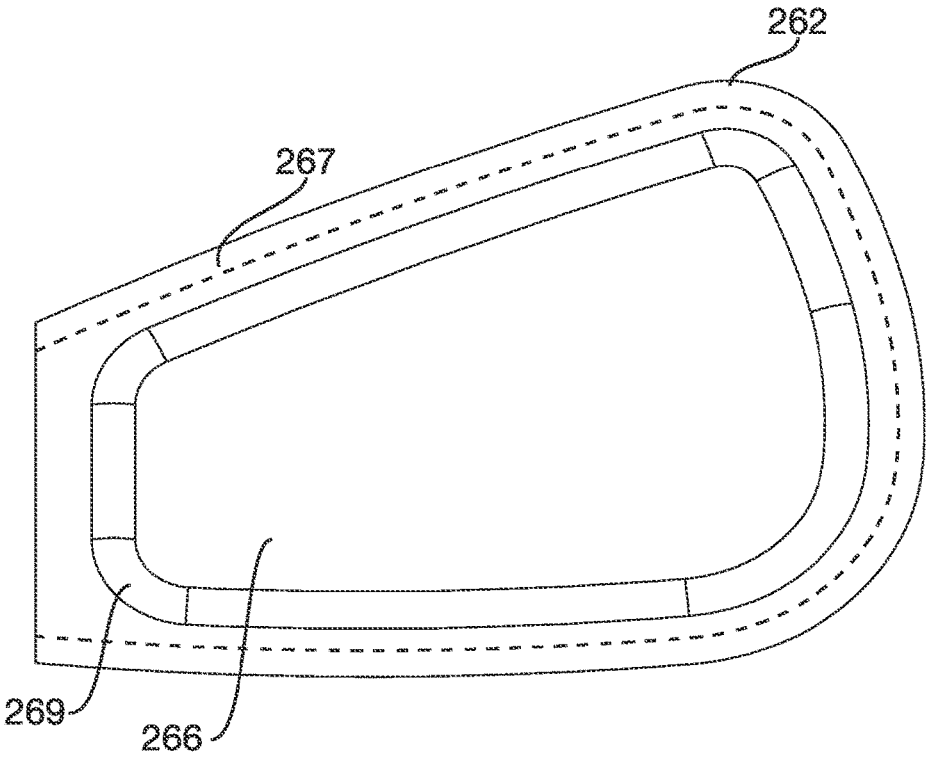
FIG. 13 depicts a back view of a face portion of a golf club head according to any embodiment of the apparatus, methods, and articles of manufacture described herein.

In one example, as illustrated in FIG. 13, the back surface 266 of the face portion 262 may include one or more grooves proximate to the perimeter portion 267 of the face portion 262. In one example, as illustrated in FIG. 13, a back groove 269 may be a continuous groove (i.e., defining a loop) extending in a path similar to the path of the perimeter portion 267 proximate to the perimeter portion 267. The back groove 269 may include a relatively thinner portion of the face portion 262. Accordingly, the back groove 269 may increase the flexibility of the face portion 262 so that when a golf ball strikes the face portion 262, the face portion 262 provides a greater rebound (i.e., a greater trampoline effect), and hence may provide a greater velocity for the golf ball. All or portions of the back groove 269 may be filled with the first filler material 512 and/or second filler material 514. In the example of the golf club head 200, all of the back groove 269 may be filled with the second filler material 514. Accordingly, the second filler material 514 may structurally support the relatively thinner portions of the face portion 262 defined by the back groove 269. In another example, a plurality of separate grooves (not illustrated) may be provided on the back surface 266 of the face portion 262 at certain locations proximate to the perimeter portion 267 to provide a certain rebound effect for the face portion 262. In yet another example, a continuous groove similar to the back groove 269 and/or a plurality of separate grooves (not illustrated) may be provided at certain locations between the perimeter portion 267 and the geometric center 263 on the back surface 266 of the face portion 262 to provide a certain rebound effect for the face portion 262. The face portion of any of the golf club heads described herein may include the back groove 269. The apparatus, methods, and articles of manufacture described herein are not limited in this regard.

As described herein, the face portion 262 may be relatively thin to provide increased bending and deflection of the face portion 262 during a golf ball strike. Further, the face portion 262 may include one or more grooves such as the back groove 269 on the back surface 266 of the face portion 262 as described herein to further increase the flexibility of the face portion 262. The second filler material 514 may be a polymer material with a relatively high strength and stiffness to provide structural support and stability for the face portion 262 to prevent failure of the face portion 262 during a golf ball strike or repeated golf ball strikes (i.e., face portion fatigue). As described herein, the second filler material 514 may be an epoxy-type of material. The second filler material 514 may also have a relatively high COR as described herein to provide a rebound effect for the face portion 262 after a golf ball strike. As further described herein, the first filler material 512 may be a rubber-type of compound with a lower strength and stiffness (i.e., softer or less rigid) than the second filler material 514 and a higher COR than the second filler material 514. Accordingly, the first filler material 512 may provide additional structural support for the face portion 262. Further, the relatively higher COR of the first filler material 512 may allow the first filler material 512 to store the energy from a golf ball strike and to release a substantial amount of the energy back to the golf ball (i.e., without losing much impact energy) by providing a relatively large rebound effect for the face portion 262. Additionally, the different material properties of the first filler material 512 and the second filler material 514 as described herein may provide sound and vibration dampening at different frequency ranges to provide a pleasant sound and feel for an individual. The apparatus, methods, and articles of manufacture described herein are not limited in this regard.

Figure 14:
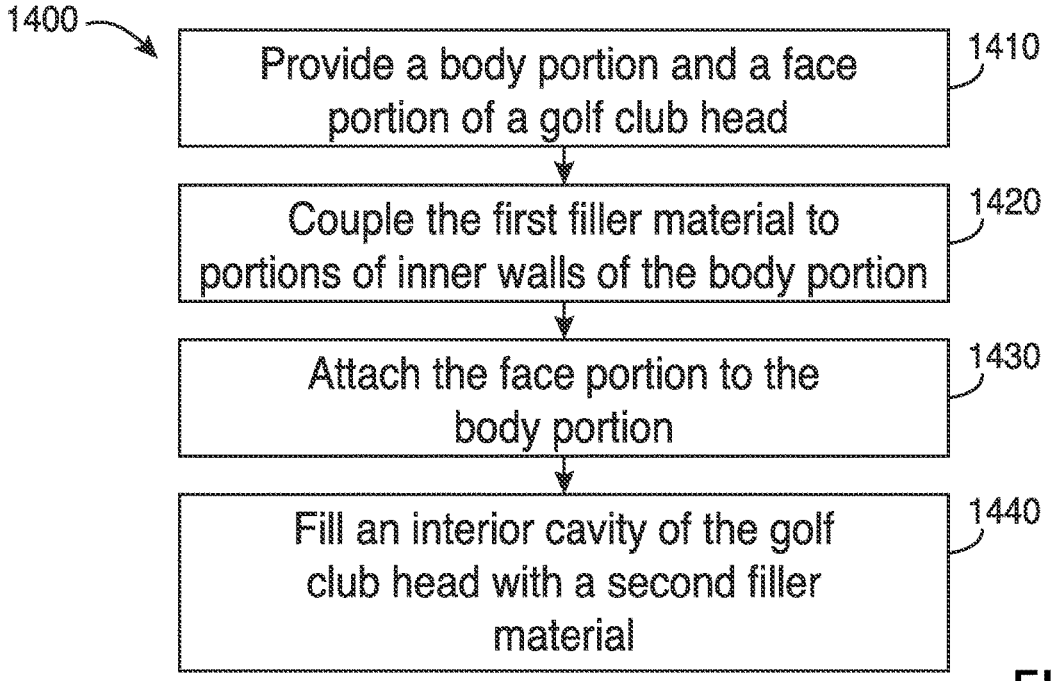
FIG. 14 depicts a manner in which an example golf club head described herein may be manufactured.

FIG. 14 depicts one manner by which the golf club head 200 or any of the golf club heads described herein may be manufactured. In the example of FIG. 14, the process 1400 may begin with providing a body portion 210 and a face portion 262 of a golf club head 200 (block 1410). The first filler material 512 may be coupled to the interior cavity 310 (block 1420). In one example, the first filler material 512 may be formed in one or more recessed portions as described herein (i.e., any of the recessed portions described herein) of the interior cavity 310 by injection molding. The first filler material 512 may then cure at ambient temperature or by one or more heating/cooling cycles depending on the material used for the first filler material 512. In another example, the first filler material 512 may be molded into the shape of one or more recessed portions as described herein and then coupled to the one or more recessed portions with a bonding agent as described herein. The face portion 262 may then be attached to the body portion 210 as described herein to enclose the interior cavity 310 (block 1430). The second filler material 514 may then be injected into the interior cavity 310 through one or more of the ports of the first set of ports 320, the second set of ports 330, the third set of ports 340, and/or the fourth set of ports 350 that may be connected to the interior cavity 310 as described herein (block 1440). The second filler material 514 may then cure at ambient temperature or by one or more heating/cooling cycles depending on the material used for the second filler material 514. The apparatus, methods, and articles of manufacture described herein are not limited in this regard.

Figure 15:
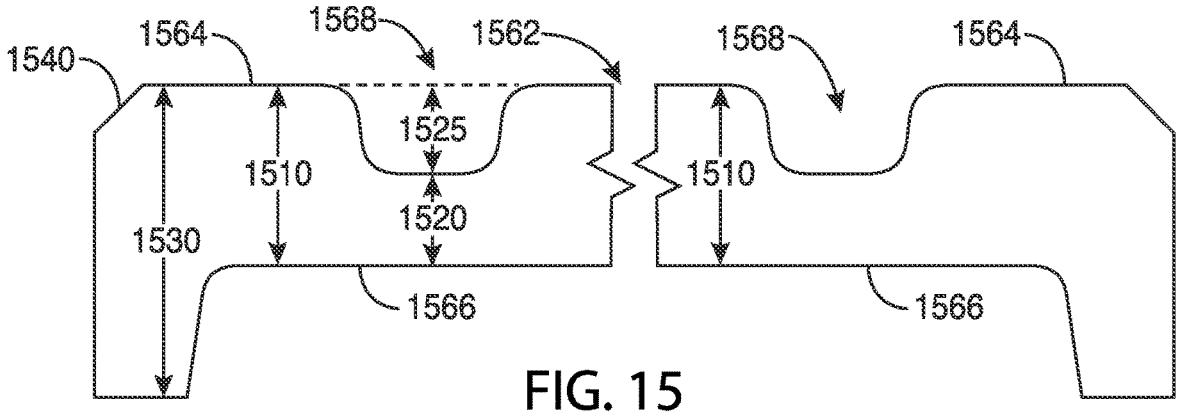
FIGS. 15 and 16 depict schematic cross-sectional views of two example face portions of a golf club head according to embodiments of the apparatus, methods, and articles of manufacture described herein.

In one example, as illustrated in FIG. 15, a face portion 1562, which may be any of the face portions described herein, may have a first thickness 1510 (T1) or a second thickness 1520 (T2). The first thickness 1510 may be a thickness of a section of the face portion 1562 adjacent to a groove 1568 whereas the second thickness 1520 may be a thickness of a section of the face portion 1562 below the groove 1568. For example, the first thickness 1510 may be a maximum distance between the front surface 1564 and the back surface 1566. The second thickness 1520 may be based on the groove 1568. In particular, the groove 1568 may have a groove depth 1525 (Dgroove). The second thickness 1520 may be a maximum distance between the bottom of the groove 1568 and the back surface 1566. The sum of the second thickness 1520 and the groove depth 1525 may be substantially equal to the first thickness 1510 (e.g., T2+Dgroove=T1). Accordingly, the second thickness 1520 may be less than the first thickness 1510 (e.g., T2<T1).

To lower and/or move the CG of a golf club head further back, such as the CG of any of the golf club heads described herein, mass from the front portion of a golf club head may be removed by using a relatively thinner face portion 1562. For example, the first thickness 1510 or the second thickness 1520 may be less than or equal to 0.1 inch (2.54 millimeters). In another example, the first thickness 1510 or the second thickness 1520 may be about 0.075 inch (1.875 millimeters) (e.g., T1=0.075 inch). With the support of the back wall portion of a golf club head to form an interior cavity and filling at least a portion of the interior cavity with one or more filler materials as described herein, the face portion 1562 may be relatively thinner (e.g., T1<0.075 inch) without degrading the structural integrity, sound, and/or feel of a golf club head. In one example, the first thickness 1510 may be less than or equal to 0.060 inch (1.524 millimeters) (e.g., T1≤0.060 inch). In another example, the first thickness 1510 may be less than or equal to 0.040 inch (1.016 millimeters) (e.g., T1≤0.040 inch). Based on the type of material(s) used to form the face portion 1562 and/or the body portion 210, the face portion 1562 may be even thinner with the first thickness 1510 being less than or equal to 0.030 inch (0.762 millimeters) (e.g., T1≤0.030 inch). The groove depth 1525 may be greater than or equal to the second thickness 1520 (e.g., Dgroove≥T2). In one example, the groove depth 1525 may be about 0.020 inch (0.508 millimeters) (e.g., Dgroove=0.020 inch). Accordingly, the second thickness 1520 may be about 0.010 inch (0.254 millimeters) (e.g., T2=0.010 inch). In another example, the groove depth 1525 may be about 0.015 inch (0.381 millimeters), and the second thickness 1520 may be about 0.015 inch (e.g., Dgroove=T2=0.015 inch). Alternatively, the groove depth 1525 may be less than the second thickness 1520 (e.g., Dgroove<T2). Without the support of the back wall portion of a golf club head and one or more filler materials used to fill in the interior cavity, the golf club head may not be able to withstand multiple impacts by a golf ball on a face portion. In contrast, a golf club head with a relatively thin face portion but without the support of the back wall portion and the one or more filler materials as described herein (e.g., a cavity-back golf club head) may produce unpleasant sound (e.g., a tinny sound) and/or feel during impact with a golf ball. The apparatus, methods, and articles of manufacture described herein are not limited in this regard.

Based on manufacturing processes and methods used to form a golf club head such as any of the golf club heads described herein, the face portion 1562 may include additional material at or proximate to a periphery of the face portion 1562. Accordingly, the face portion 1562 may also include a third thickness 1530, and a chamfer portion 1540. The third thickness 1530 may be greater than either the first thickness 1510 or the second thickness 1520 (e.g., T3>T1>T2). In particular, the face portion 1562 may be coupled to the body portion of a golf club head by a welding process. For example, the first thickness 1510 may be about 0.030 inch (0.762 millimeters), the second thickness 1520 may be about 0.015 inch (0.381 millimeters), and the third thickness 1530 may be about 0.050 inch (1.27 millimeters). Accordingly, the chamfer portion 1540 may accommodate some of the additional material when the face portion 1562 is welded to the body portion of the golf club head.

Figure 16:
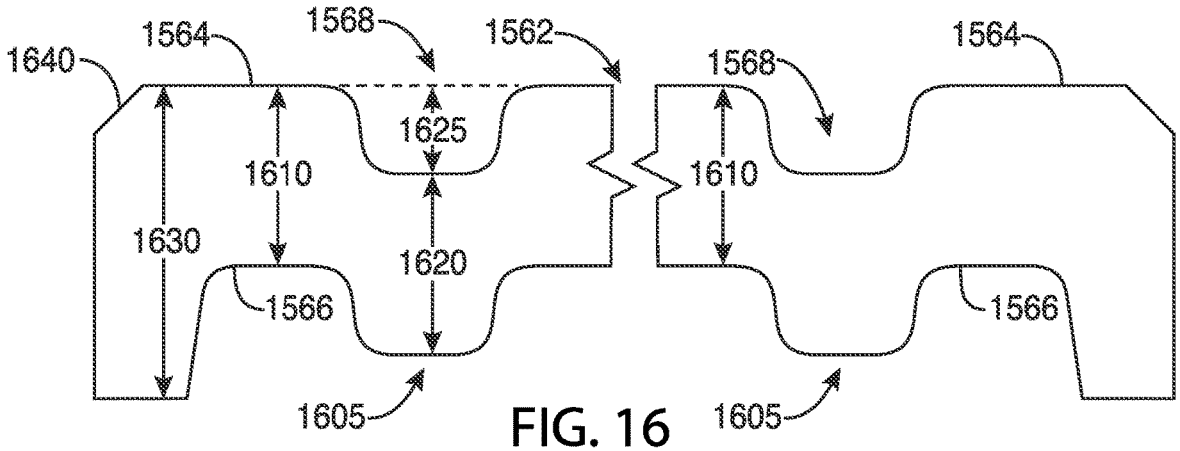

As illustrated in FIG. 16, for example, the face portion 1562 may include a reinforcement section, which is generally illustrated as reinforcement section 1605, below one or more grooves 1568. In one example, the face portion 1562 may include a reinforcement section 1605 below each groove. Alternatively, face portion 1562 may include the reinforcement section 1605 below some grooves (e.g., every other groove) or below only one groove. The face portion 1562 may include a first thickness 1610, a second thickness 1620, a third thickness 1630, and a chamfer portion 1640. The groove 1568 may have a groove depth 1625. The reinforcement section 1605 may define the second thickness 1620. The first and second thicknesses 1610 and 1620, respectively, may be substantially equal to each other (e.g., T1=T2). In one example, the first and second thicknesses 1610 and 1620, respectively, may be about 0.030 inch (0.762 millimeters) (e.g., T1=T2=0.030 inch). The groove depth 1625 may be about 0.015 inch (0.381 millimeters), and the third thickness 1630 may be about 0.050 inch (1.27 millimeters). The groove 1568 may also have a groove width. The width of the reinforcement section 1605 may be greater than or equal to the groove width. The apparatus, methods, and articles of manufacture described herein are not limited in this regard.

Alternatively, the face portion 1562 may vary in thickness at and/or between the top portion and the sole portion of a golf club head. In one example, the face portion 1562 may be relatively thicker at or proximate to the top portion than at or proximate to the sole portion (e.g., thickness of the face portion 1562 may taper from the top portion towards the sole portion). In another example, the face portion 1562 may be relatively thicker at or proximate to the sole portion than at or proximate to the top portion (e.g., thickness of the face portion 1562 may taper from the sole portion towards the top portion). In yet another example, the face portion 1562 may be relatively thicker between the top portion and the sole portion than at or proximate to the top portion and the sole portion (e.g., thickness of the face portion 1562 may have a bell-shaped contour). The face portion 1562 may be similar to any of the face portions described in any of the incorporated by reference patent documents. The apparatus, methods, and articles of manufacture described herein are not limited in this regard.

Figure 17:
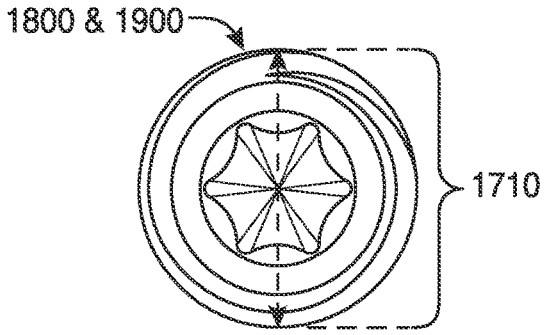
FIG. 17 depicts a top view of a mass portion of a golf club head according to an embodiment of the apparatus, methods, and articles of manufacture described herein.

One or more mass portions of any of the sets of mass portions described herein may have similar or different physical properties (e.g., color, marking, shape, size, density, mass, volume, external surface texture, materials of construction, etc.). In the illustrated example as illustrated in FIG. 17, one or more mass portions of any of the sets of mass portions described herein may have a cylindrical shape (e.g., a circular cross section). Alternatively, one or more mass portions of any of the sets of mass portions described herein may have similar or different shapes relative to one or more other mass portions of the set of mass portions. In another example, one or more mass portions of any of the sets of mass portions described herein may have a different color(s), marking(s), shape(s), density or densities, mass(es), volume (s), material(s) of construction, external surface texture(s), and/or any other physical property as compared to one or more mass portions of another one of the sets of mass portions as described herein. The properties of any of the mass portions and sets of mass portions described herein may be similar to any of the mass portions and sets of mass portions described in any of the incorporated by reference patent documents. The apparatus, methods, and articles of manufacture described herein are not limited in this regard.

Figure 18:
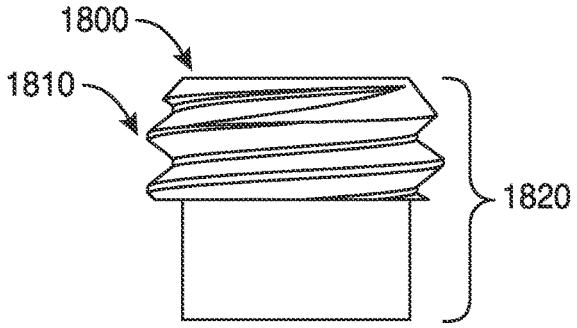
FIGS. 18 and 19 depict side views of two example mass portions of a golf club head according to embodiments of the apparatus, methods, and articles of manufacture described herein.
Figure 19:
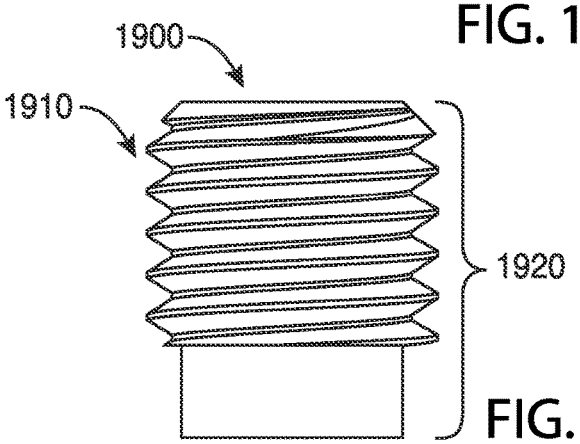
Figure 20:
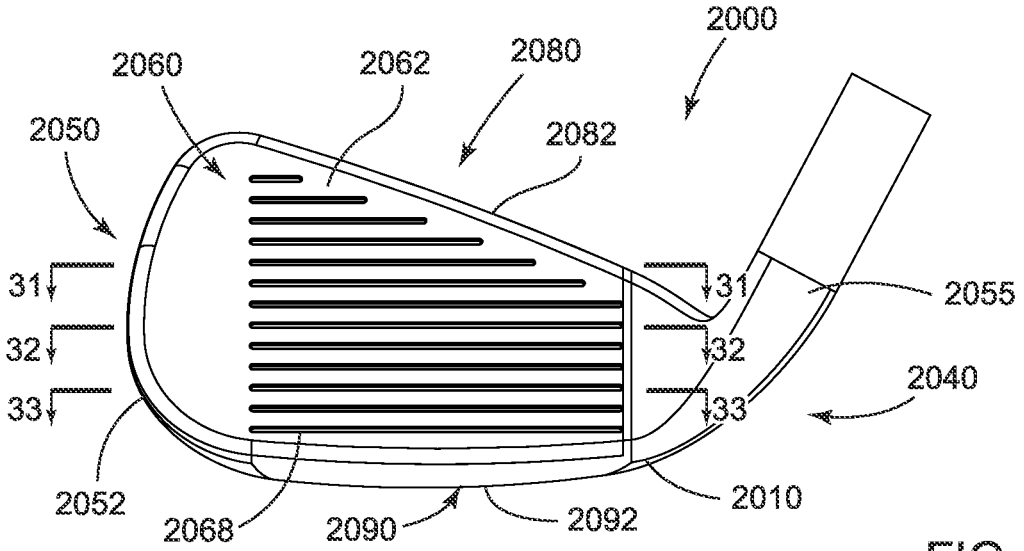
FIGS. 20, 21, 22, 23, 24, 25, 26, 27, 28, 29, 30, 31, 32, and 33 depict a front view, a top view, a bottom view, a back view, another back view, a top and toe side view, a toe side view, a heel side view, a cross-sectional view taken at line 28-28 of FIG. 23, a cross-sectional view taken at line 29-29 of FIG. 23, a cross-sectional view taken at line 30-30 of FIG. 23, a cross-sectional view taken at line 31-31 of FIG. 20, a cross-sectional view taken at line 32-32 of FIG. 20, a cross-sectional view taken at line 33-33 of FIG. 20, respectively, of a golf club head according to an embodiment of the apparatus, methods, and articles of manufacture described herein.
Figure 21:
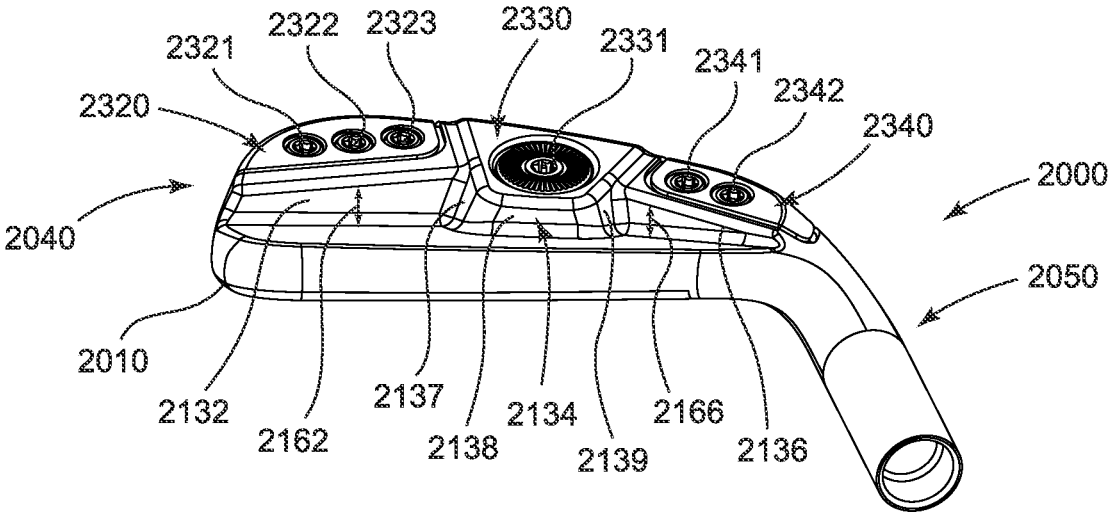
Figure 22:
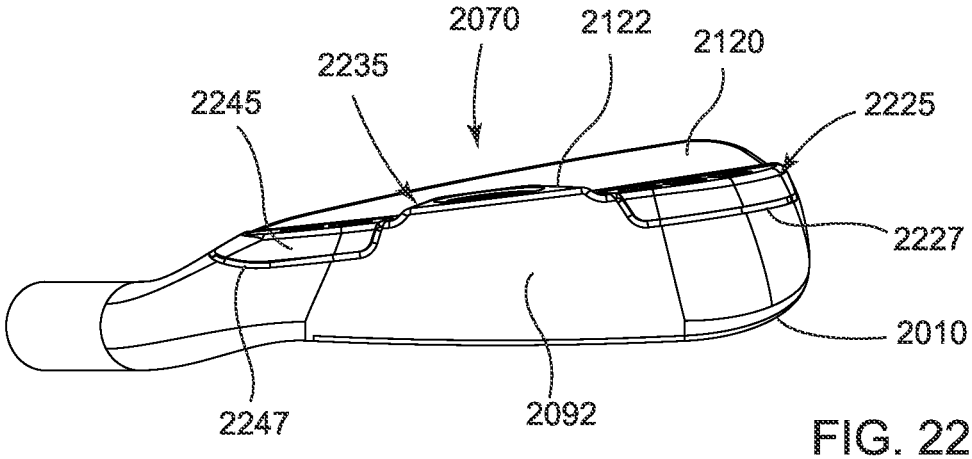

Referring to FIGS. 18 and 19, for example, a first mass portion 1800 and a second mass portion 1900 may include threads, generally illustrated as threads 1810 and threads 1910, respectively, to engage with correspondingly configured threads in ports on the to secure in the ports as described herein. Accordingly, one or more mass portions as described herein may be shaped similar to and function as a screw or threaded fastener for engaging threads in a port. For example, one or more mass portions of any of the sets of mass portions described herein may be a screw. One or more mass portions of any of the mass portions described herein may not be readily removable from the body portion of a golf club head with or without a tool. Alternatively, one or more mass portions of any of the sets of mass portions described herein may be readily removable (e.g., with a tool) so that a relatively heavier or lighter mass portion may replace one or more mass portions of any of the sets of mass portions described herein. In another example, one or more mass portions of any of the sets of mass portions described herein may be secured in the ports with epoxy or adhesive so that the mass portions may not be readily removable. In yet another example, one or more mass portions of any of the sets of mass portions described herein may be secured in the ports with both threads and thread sealant (e.g., acrylic adhesive, cyanoacrylate adhesive, epoxy, thermoplastic adhesive, silicone sealant, or urethane adhesive) so that the mass portions may not be readily removable. In yet another example, one or more mass portions of any of the sets of mass portions described herein may be press fit in a port. In yet another example, one or more mass portions of any of the sets of mass portions described herein may be formed inside a port by injection molding. For example, a liquid metallic material (i.e., molten metal) or a plastic material (e.g., rubber, foam, or any polymer material) may be injected or otherwise introduced into a port. After the liquid material is cooled and/or cured inside the port, the resulting solid material (e.g., a metal material, a plastic material, or a combination thereof) may form a mass portion. The apparatus, methods, and articles of manufacture described herein are not limited in this regard.

In one example, as illustrated in FIGS. 17-19, one or more mass portions of any of the sets of mass portions described herein may have a diameter 1710 of about 0.25 inch (6.35 millimeters) but one or more mass portions of another one or more sets of mass portions described herein may be different in height. In particular, one or more mass portions of any of the sets of mass portions described herein may be associated with a first height 1820, and one or more mass portions of another one or more sets of mass portions described herein may be associated with a second height 1920. The first height 1820 may be relatively shorter than the second height 1920. In one example, the first height 1820 may be about 0.125 inch (3.175 millimeters) whereas the second height 1920 may be about 0.3 inch (7.62 millimeters). In another example, the first height 1820 may be about 0.16 inch (4.064 millimeters) whereas the second height 1920 may be about 0.4 inch (10.16 millimeters). Alternatively, the first height 1820 may be equal to or greater than the second height 1920. Although the above examples may describe particular dimensions, one or more mass portions described herein may have different dimensions. In one example, any of the mass portions described herein may be interchangeably used in any of the ports described herein. Any property of any of the mass portions described herein may be similar to the corresponding property of any of the mass portions described in any of the incorporated by reference patent documents. The apparatus, methods, and articles of manufacture described herein are not limited in this regard.

In the example of FIGS. 20-38, a golf club head 2000 may include a body portion 2010 having a toe portion 2040 with a toe portion edge 2042, a heel portion 2050 with a heel portion edge 2052 that may include a hosel portion 2055. A golf club shaft (such as the shaft 104 that is illustrated for example in FIG. 1) may include one end coupled to the hosel portion 2055, and an opposite end coupled to a golf club grip (such as the grip 106 that is illustrated for example in FIG. 1) to form a golf club (such as the golf club 100 that is illustrated for example in FIG. 1). The body portion 2010 may further include a front portion 2060 with a perimeter edge portion 2061, a back portion 2070 with a back wall portion 2072, a top portion 2080 with a top portion edge 2082, and a sole portion 2090 with a sole portion edge 2092. The toe portion 2040, the heel portion 2050, the front portion 2060, the back portion 2070, the top portion 2080, and/or the sole portion 2090 may partially overlap each other. The toe portion edge 2042, the heel portion edge 2052, the top portion edge 2082, and the sole portion edge 2092 may define a periphery of the body portion 2010. The golf club head 2000 may be any type of golf club head described herein, such as, for example, an iron-type golf club head or a wedge-type golf club head. The volume of the golf club head 2000, the materials of construction of the golf club head 2000, and/or any components thereof may be similar to any of the golf club heads described herein and/or described in any of the incorporated by reference patent documents. The apparatus, methods, and articles of manufacture described herein are not limited in this regard.

The golf club head 2000 may include a face portion 2062 (i.e., the strike face), which may be integrally formed with the body portion 2010 (e.g., a single unitary piece). In one example, as illustrated in FIGS. 20-38, the face portion 2062 may be a separate piece coupled (e.g., directly or indirectly, adhesively, mechanically, by welding, and/or by soldering) to the front portion 2060 to close a front opening of the front portion 2060. The face portion 2062 may include a front surface 2064 and a back surface 2066. The front surface 2064 may include a plurality of front grooves 2068 that may extend between the toe portion 2040 and the heel portion 2050. Each front groove 2068 may have a front groove depth 2069 ($D_{FG}$). In one example, the front groove depth 2069 may be greater than or equal to 0.005 inch (0.127 mm) and less than or equal to 0.025 inch (0.635 mm) (0.005 in≤$D_{FG}$≤0.025 in). In another example, the front groove depth 2069 may be greater than or equal to 0.011 inch (0.267 mm) and less than or equal to 0.018 inch (0.445 mm) (0.011 in≤$D_{FG}$≤0.018 in). In another example, the front groove depth 2069 may be greater than or equal to 0.012 inch (0.311 mm) and less than or equal to 0.016 inch (0.400 mm) (0.012 in≤$D_{FG}$≤0.016 in). In yet another example, the front groove depth 2069 may be greater than or equal to 0.013 inch (0.33 mm) and less than or equal to 0.015 inch (0.381 mm) (0.013 in≤$D_{FG}$≤0.015 in). The front groove depth 2069 and the configuration of the front grooves 2068 (i.e., cross-sectional shape, curvature, length, width, etc.) may be determined to provide certain performance characteristics for the golf club head 2000. The apparatus, methods, and articles of manufacture described herein are not limited in this regard.

Each front groove 2068 may have a front groove width 2071 ($W_{FG}$). In one example, the front groove width 2071 may be greater than or equal to 0.011 inch (0.267 mm) and less than or equal to 0.033 inch (0.833 mm) (0.011 in≤$W_{FG}$≤0.033 in). In another example, the front groove width 2071 may be greater than or equal to 0.014 inch (0.347 mm) and less than or equal to 0.055 inch (1.406 mm) (0.014 in≤$W_{FG}$≤0.055 in). In another example, the front groove width 2071 may be greater than or equal to 0.017 inch (0.427 mm) and less than or equal to 0.062 inch (1.562 mm) (0.017 in≤$W_{FG}$≤0.062 in). In another example, the front groove width 2071 may be greater than or equal to 0.021 inch (0.521 mm) and less than or equal to 0.041 inch (1.041 mm) (0.021 in≤$W_{FG}$≤0.041 in). In another example, the front groove width 2071 may be greater than or equal to 0.025 inch (0.640 mm) and less than or equal to 0.032 inch (0.800 mm) (0.025 in≤$W_{FG}$≤0.032 in). In yet another example, the front groove width 2071 may be greater than or equal to 0.027 inch (0.677 mm) and less than or equal to 0.053 inch (1.354 mm) (0.027 in≤$W_{FG}$≤0.053 in). The front groove width 2071 and the configuration of the front grooves 2068 (i.e., cross-sectional shape, curvature, length, width, etc.) may be determined to provide certain performance characteristics for the golf club head 2000. The apparatus, methods, and articles of manufacture described herein are not limited in this regard.

In one example (not illustrated), the front portion 2060 may include one or a plurality of recessed shoulders configured to receive the face portion 2062 for attachment of the face portion 2062 to the body portion 2010. In another example, as illustrated in FIGS. 20-38, the back surface 2066 may include a perimeter portion 2067 that may be attached to a perimeter edge portion 2061 of the body portion 2010. The perimeter portion 2067 of the face portion 2062 may be attached to the perimeter edge portion 2061 of the body portion 2010 by one or more fasteners, one or more adhesive or bonding agents, and/or welding or soldering. In one example, the perimeter portion 2067 may be welded to the perimeter edge portion 2061 at one or more locations. In another example, the entire perimeter portion 2067 may be welded to the entire perimeter edge portion 2061 (i.e., a continuous weld). The configuration of the face portion 2062 and the attachment of the face portion 2062 (e.g., welding) to the body portion 2010 may be similar in many respects to any of the golf club heads described herein and/or described in any of the incorporated by reference patent documents. The apparatus, methods, and articles of manufacture described herein are not limited in this regard.

The golf club head 2000 may be associated with a ground plane 2410, a horizontal midplane 2420, and a top plane 2430. In particular, the ground plane 2410 may be a plane that is parallel or substantially parallel to the ground and is tangent to the lowest portion of the sole portion edge 2092 when the golf club head 2000 is at an address position (e.g., the golf club head 2000 aligned to strike a golf ball). A top plane 2430 may be a plane that is tangent to the upper most portion of top portion edge 2082 when the golf club head 2000 is at the address position. The ground plane 2410 and the top plane 2430, respectively, may be parallel or substantially parallel to each other. The horizontal midplane 2420 may be vertically halfway between the ground plane 2410 and the top plane 2430, respectively, and be parallel or substantially parallel to the ground plane 2410. Further, the golf club head 2000 may be associated with a loft plane 2440 defining a loft angle 2445 ($\alpha$) of the golf club head 2000. The loft plane 2440 may be a plane that is tangent or coplanar to the face portion 2062. The loft angle 2445 may be defined by an angle between the loft plane 2440 and a vertical plane 2450 that is normal to the ground plane 2410. The apparatus, methods, and articles of manufacture described herein are not limited in this regard.

The back wall portion 2072 may include an upper back wall portion 2120, a lower back wall portion 2122, and a ledge portion 2130 between the upper back wall portion 2120 and the lower back wall portion 2122. The ledge portion 2130 may extend outward (i.e., away from the face portion 2062) from the upper back wall portion 2120 to the lower back wall portion 2122 (i.e., the ledge portion 2130 may extend inward or toward the face portion 2062 from the lower back wall portion 2122 to the upper back wall portion 2120). Accordingly, a body portion upper width 2150 ($W_{UB}$) may be defined by a distance between the front surface 2064 of the face portion 2062 and the outer surface of the upper back wall portion 2120, and a body portion lower width 2152 ($W_{LB}$) may be defined by a distance between the front surface 2064 of the face portion 2062 and the outer surface of the lower back wall portion 2122. In one example, the maximum value of the body portion lower width 2152 may be greater than or equal to 1.5 the maximum value of the body portion upper width 2150 ($W_{LB(MAX)}$≥1.5 $W_{UB(MAX)}$). In another example, the maximum value of the body portion lower width 2152 may be greater than or equal to 1.25 the maximum value of the body portion upper width 2150 ($W_{LB(MAX)}$≥1.25 $W_{UB(MAX)}$). In another example, the maximum value of the body portion lower width 2152 may be greater than or equal to 1.75 the maximum value of the body portion upper width 2150 ($(W_{LB(MAX)} \geq 1.75\ W_{UB(MAX)})$). In another example, the maximum value of the body portion lower width 2152 may be greater than or equal to twice the maximum value of the body portion upper width 2150 ($(W_{LB(MAX)} \geq 2.0\ W_{UB(MAX)})$). In another example, the maximum value of the body portion lower width 2152 may be greater than the maximum value of the body portion upper width 2150 ($(W_{LB(MAX)} \geq W_{UB(MAX)})$). The apparatus, methods, and articles of manufacture described herein are not limited in this regard.

In the example of FIGS. 20-38, the ledge portion 2130 may include a first ledge portion 2132 that may extend from a location at or proximate to the toe portion edge 2042 toward the heel portion 2050, a second ledge portion 2134 that may be located at or proximate to a center portion 2073 of the back wall portion 2072, and a third ledge portion 2136 that may extend from a location at or proximate to the heel portion edge 2052 toward the toe portion 2040. The second ledge portion 2134 may extend between the first ledge portion 2132 and the third ledge portion 2136. The first ledge portion 2132 and the third ledge portion 2136 may also extend in a downwardly inclined direction toward the sole portion 2090. Accordingly, as illustrated in FIGS. 20-38, a first ledge portion height 2142, which may be defined by a distance between the first ledge portion 2132 and the ground plane 2410, may increase from the center portion 2073 toward the toe portion edge 2042, and a third ledge portion height 2146, which may be defined by a distance between the third ledge portion 2136 and the ground plane 2410, may increase from the center portion 2073 toward the heel portion edge 2052. As illustrated in FIGS. 20-38, for example, the second ledge portion 2134 may include a first side wall portion 2137 that may extend from the first ledge portion 2132 toward the top portion 2080, a center ledge portion 2138 that may extend from the first side wall portion 2137 toward the heel portion 2050, and a second side wall portion 2139 that may extend from the center ledge portion 2138 toward the sole portion 2090 and to the third ledge portion 2136. The second ledge portion 2134 may include a second ledge portion height 2144, which may be defined by a distance between the center ledge portion 2138 and the ground plane 2410. The second ledge portion height 2144 may be greater than the first ledge portion height 2142 and the third ledge portion height 2146 at or proximate to the center portion 2073. In another example, the ledge portion 2130 may be similar in some or many respects to the ledge portion 616 of the golf club head 200. In yet another example, the ledge portion 2130 may be similar in some or many respects to any of the ledge portions of the golf club heads described in any of the incorporated by reference patent documents. The apparatus, methods, and articles of manufacture described herein are not limited in this regard.

In the example of FIGS. 20-38, the first ledge portion 2132 may include a first ledge portion width 2162 that may decrease from the center portion 2073 toward the toe portion edge 2042. Accordingly, the widest part of the first ledge portion 2132 may be at the location where the first ledge portion 2132 and the first side wall portion 2137 meet. In one example, the increase in the first ledge portion height 2142 and the decrease in the first ledge portion width 2162 may be correlated. For example, every increase in the first ledge portion height 2142 may correspond to a decrease in the first ledge portion width 2162 that may be based on a certain factor, similar rate of change, certain non-similar rate of change, or a certain mathematical relationship. In another example, the increase in the first ledge portion height 2142 and decrease in the first ledge portion width 2162 may not have any correlation. The apparatus, methods, and articles of manufacture described herein are not limited in this regard.

In the example of FIGS. 20-38, the third ledge portion 2136 may include a third ledge portion width 2166 that may decrease from the center portion 2073 toward the heel portion edge 2052. Accordingly, the widest part of the third ledge portion 2136 may be at the location where the third ledge portion 2136 and the second side wall portion 2139 meet. In one example, the increase in the third ledge portion height 2146 and the decrease in the third ledge portion width 2166 may be correlated. For example, every increase in the third ledge portion height 2146 may correspond to a decrease in the third ledge portion width 2166 that may be based on a certain factor, similar rate of change, certain non-similar rate of change, or a certain mathematical relationship. In another example, the increase in the third ledge portion height 2146 and the decrease in the third ledge portion width 2166 may not have any correlation. The apparatus, methods, and articles of manufacture described herein are not limited in this regard.

In the example of FIGS. 20-38, the first side wall portion 2137 and the second side wall portion 2139 may increase in width from the center ledge portion 2138 to the first ledge portion 2132 and from the center ledge portion 2138 to the third ledge portion 2136, respectively. The downwardly inclined configuration and the increasing widths toward the center portion 2073 of the first ledge portion 2132 and the third ledge portion 2136, and the downwardly increasing widths of the first side wall portion 2137 and the second side wall portion 2139 may allow more mass to be placed at the toe portion 2040 and/or the heel portion 2050 below the first ledge portion 2132 and the third ledge portion 2136, respectively, for optimizing the moment of inertia (MOI) of the golf club head 2000, and more mass may be placed at or below the center portion 2073 of the back wall portion to lower and move farther aft the center of gravity (CG) of the golf club head 2000. In other words, the configuration of the ledge portion 2130 may provide for a relatively large portion of the mass of the golf club head 2000 to be selectively placed (i) below the ledge portion 2130 and closer to the toe portion edge 2042, (ii) below the ledge portion 2130 and closer to the heel portion edge 2052, (iii) at or proximate to the center portion 2073, and/or, (iv) at or proximate to the sole portion edge 2092 to increase the MOI of the golf club head 2000 and move the CG of the golf club head lower and farther aft. The apparatus, methods, and articles of manufacture described herein are not limited in this regard.

The body portion 2010 may include one or more ports, which may be exterior ports and/or interior ports (e.g., located inside the body portion 2010). The one or more ports may be at any location on the body portion 2010. The inner walls of the body portion 2010 that define the interior cavity 2110 may include one or more ports. In the illustrated example of FIGS. 20-38, the body portion may include a first port region 2225 located below the first ledge portion 2132 and between the toe portion edge 2042 and the center portion 2073. In one example, as illustrated in FIGS. 20-38, the first port region 2225 may include a first perimeter groove 2227, which may visually define a portion or all of the first port region 2225. The first perimeter groove 2227 may be a slot, channel, depression, or a recess. The mass that may be removed from the body portion 2010 to define the first perimeter groove 2227 may be placed at other locations on or inside the body portion 2010 to provide certain MOI, CG location, and/or golf club performance characteristics without changing or substantially changing the overall mass of the body portion 2010. In another example, the portion of the body portion 2010 within the first perimeter groove 2227 may have a different color, texture, or other visual distinguishing features relative to outside the first perimeter groove 2227 to visually define the first port region 2225. The apparatus, methods, and articles of manufacture described herein are not limited in this regard.

In the illustrated example of FIGS. 20-38, the body portion may include a second port region 2235 located below the center ledge portion 2138 of the second ledge portion 2134, and a third port region 2245 located below the third ledge portion 2136 and between the heel portion edge 2052 and the center portion 2073. The second port region 2235 may be between the first port region 2225 and the third port region 2245. In one example, as illustrated in FIGS. 20-38, the third port region 2245 may include a second perimeter groove 2247, which may visually define a portion or all of the third port region 2245. The second perimeter groove 2247 may be a slot, channel, depression, or a recess. The mass that may be removed from the body portion 2010 to define the second perimeter groove 2247 may be placed at other locations on or inside the body portion 2010 to provide certain MOI, CG location, and golf club performance characteristics without changing or substantially changing the overall mass of the body portion 2010. In another example, the portion of the body portion 2010 within the second perimeter groove 2247 may have a different color, texture, or other visual distinguishing features relative to outside the second perimeter groove 2247 to visually define the third port region 2245. The apparatus, methods, and articles of manufacture described herein are not limited in this regard.

The first port region 2225 may include any number of ports, and any one or more of the ports of the first port region 2225 may be connected to the interior cavity 2110. In one example, as illustrated in FIGS. 20-38, the first port region 2225 may include a first set of ports 2220 (e.g., illustrated as ports 2221, 2222, and 2223). The ports 2221, 2222, and 2223 may be arranged in the first port region 2225 in any manner. In one example, the ports 2221, 2222, and 2223 may be arranged to be aligned with the contour of the sole portion edge 2092 similar to the ports of the golf club head 200. In another example, as illustrated in FIGS. 20-38, the ports 2221, 2222, and 2223 may be arranged to be aligned with the general direction of the first ledge portion 2132. The spacing between the ports of the first set of ports 2220 may have any configuration. In the illustrated example of FIGS. 20-38, each port of the first set of ports 2220 may be spaced apart from an adjacent port of the first set of ports 2220 by a distance of less than or equal to the port diameter of any of the ports of the first set of ports 2220. The distance from any of the ports of the first set of ports 2220 to the toe portion edge 2042 may be less than the distance from any of the ports of the first set of ports 2220 to the heel portion edge 2052 or to the hosel portion 2055. The first port region 2225 may be a thicker portion and/or a structurally enhanced portion of the back wall portion 2072 to accommodate the structures and/or functions of the ports of the first set of ports 2220. The apparatus, methods, and articles of manufacture described herein are not limited in this regard.

Figure 28:
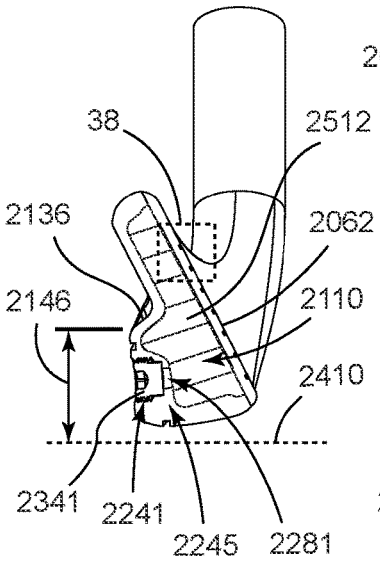
Figure 29:
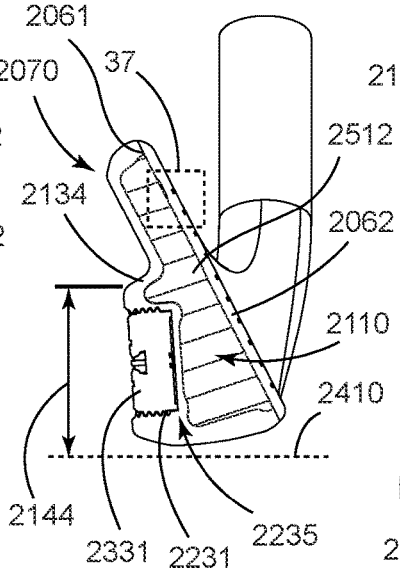

The second port region 2235 may include any number of ports, and any one or more of the ports may be connected to the interior cavity 2110. In one example, as illustrated in FIGS. 20-38, the second port region 2235 may include a second set of ports 2230 (e.g., illustrated as port 2231). The second port region 2235 may be at or proximate to the center portion 2073. The second port region 2235 may be a thicker portion and/or a structurally enhanced portion of the back wall portion 2072 to accommodate the ports of the second set of ports 2230. In one example, as illustrated in FIG. 29, the second port region 2235 may include structurally enhanced portions of the back wall portion 2072 to accommodate the structure and/or function of the port 2231. The apparatus, methods, and articles of manufacture described herein are not limited in this regard.

The third port region 2245 may include any number of ports, and any one or more of the ports of the third port region 2245 may be connected to the interior cavity 2110. In one example, as illustrated in FIGS. 20-38, the third port region 2245 may include a third set of ports 2240 (e.g., illustrated as ports 2241 and 2242). The ports 2241 and 2242 may be arranged in the third port region 2245 in any manner. In one example, the ports 2241 and 2242 may be arranged to be aligned with the contour of the sole portion edge 2092 similar to the ports of the golf club head 200. In another example, as illustrated in FIGS. 20-38, the ports 2241 and 2242 may be arranged to be aligned with the general direction of the third ledge portion 2136. The spacing between the ports of the third set of ports 2240 may have any configuration. In the illustrated example of FIGS. 20-38, each port of the third set of ports 2240 may be spaced apart from an adjacent port of the third set of ports 2240 by a distance of less than or equal to the port diameter of any of the ports of the third set of ports 2240. The distance from any of the ports of the third set of ports 2240 to the toe portion edge 2042 may be greater than the distance from any of the ports of the third set of ports 2240 to the heel portion edge 2052 or to the hosel portion 2055. The third port region 2245 may be a thicker portion and/or a structurally enhanced portion of the back wall portion 2072 to accommodate the structures and/or functions of the ports of the third set of ports 2240. The apparatus, methods, and articles of manufacture described herein are not limited in this regard.

The first set of ports 2220, the second set of ports 2230, and/or the third set of ports 2240 may include any number of ports. The locations, spacing relative to other ports, and any other configuration of each port of the first set of ports 2220, the second set of ports 2230, and/or the third set of ports 2240 may be similar in many respects to any of the ports described herein or described in any of the incorporated by reference patent documents. Further, any one or more of the ports of the first set of ports 2220, the second set of ports 2230, and/or the third set of ports 2240 may be connected to interior cavity 2110 through which one or more filler materials may be injected into the interior cavity 2110. In the illustrated example of FIGS. 20-38, the port 2221 and the port 2241 may be connected to the interior cavity 2110 via opening 2261 and opening 2281, respectively. The apparatus, methods, and articles of manufacture described herein are not limited in this regard.

In one example, as illustrated in FIGS. 20-38, the second set of ports 2230 may include a single port 2231 that may be larger in diameter than any of the ports of the first set of ports 2220 and/or the third set of ports 2240. The port 2231 may be located at or proximate to the center portion 2073 of the back wall portion 2072 and at or proximate to the sole portion edge 2092. In one example, the diameter of the port 2231 may be greater than or equal to 1.1 times the diameter and less than or equal to 8.0 times the diameter of any of the ports of the first set of ports 2220 and any of the ports of the third set of ports 2240. In another example, the diameter of the port 2231 may be greater than or equal to twice the diameter of any of the ports of the first set of ports 2220 and the third set of ports 2240. In another example, the diameter of the port 2231 may be greater than or equal to 2.5 times the diameter of any of the ports of the first set of ports 2220 and the third set of ports 2240. In another example, the diameter of the port 2231 may be greater than or equal to 3.5 times the diameter of any of the ports of the first set of ports 2220 and the third set of ports 2240. In yet another example, the diameter of the port 2231 may be greater than or equal to the diameter any of the ports of the first set of ports 2220 and any of the ports of the third set of ports 2240. In the example of FIGS. 20-38, the ports of the first set of ports 2220, the second set of ports 2230 and the third set of ports 2240 are illustrated to be cylindrical. In other examples (not illustrated), the ports may have any shape. Accordingly, the relative sizes of the ports may be expressed by any dimension such as length, width, radius, diameter, distance between two boundaries, or any dimension corresponding to a particular geometric shape (e.g., major and minor axes for an elliptical shaped port). The apparatus, methods, and articles of manufacture described herein are not limited in this regard.

The body portion 2010 may include any number of ports above and/or below the first ledge portion 2132, the second ledge portion 2134, and/or the third ledge portion 2136. The body portion 2010 may include any number of ports above and/or below the horizontal midplane 2420. The body portion 2010 may include any number of ports on the toe portion edge 2042, the heel portion edge 2052, the top portion edge 2082, and/or the sole portion edge 2092. The number of ports on the body portion 2010, the arrangement and/or the configuration of the ports on the body portion 2010 may be similar in many respects to the golf club head 200 or any of the golf club heads described in any of the incorporated by reference patent documents. The apparatus, methods, and articles of manufacture described herein are not limited in this regard.

Figure 33:
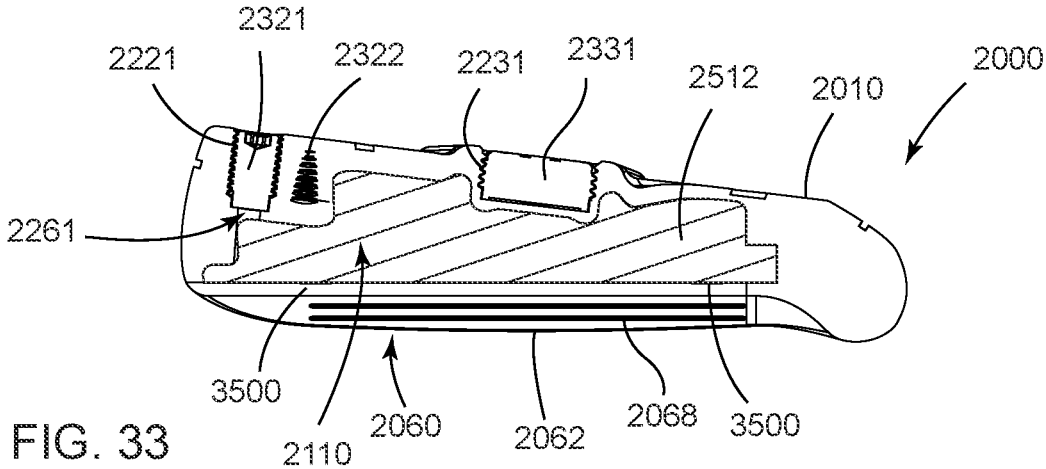
Figure 34:
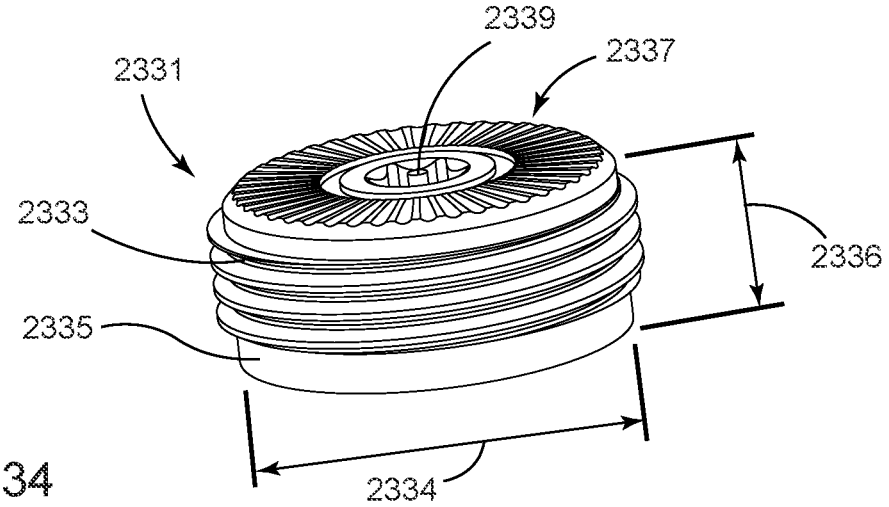
FIGS. 34, 35 and 36 are a mass portion, an example face portion, and another example face portion, respectively, for the golf club head of FIG. 20 according to embodiments of the apparatus, methods, and articles of manufacture described herein.

The body portion 2010 may include one or more mass portions (e.g., weight portion(s)) at any location on the body portion 2010. The one or more mass portions may be integral mass portion(s) or separate mass portion(s) that may be coupled to the body portion 2010 at any exterior or interior location on the body portion 2010. In the illustrated example of FIGS. 20-38, the body portion 2010 may include a first set of mass portions 2320 (e.g., illustrated as mass portions 2321, 2322, and 2323), a second set of mass portions 2330 (e.g., illustrated as mass portion 2331), and a third set of mass portions 2340 (e.g., illustrated as mass portion 2341 and mass portion 2342). In the example of FIGS. 20-38, the mass portions of the first set of mass portions 2320 and the third set of mass portions 2320 may be similar to any of the mass portions described herein, such as the mass portions 1800 and 1900 of FIGS. 17-19, or the mass portions described in any of the incorporated by reference patent documents. The second set of mass portions 2330 may include a single mass portion 2331, which may have a greater mass than any of the mass portions of the first set of mass portions 2320 and the third set of mass portions 2340. In one example, as illustrated in FIG. 33, the mass portion 2331 may be cylindrical with a head portion 2333, a shaft portion 2335 and a top portion 2337 including a tool engagement portion 2339. The diameter 2334 of the mass portion 2331 may be greater than the length 2336 of the mass portion 2331. Accordingly, the mass portion 2331 may be disc shaped as illustrated in FIG. 34 with the diameter 2334 being greater as described herein than the diameters of the mass portions of the first set of mass portions 2320 and the third set of mass portions 2340 as illustrated for example by mass portions 1800 and 1900 of FIGS. 17-19. The port 2231 may be configured to receive the mass portion 2331, which may be inserted and secured into the port 2231 by any of the methods described herein such as being screwed in, press fitted, secured with an adhesive, or welded. In one example, as illustrated in FIG. 33, the head portion 2333 may be threaded to engage internal threads in the port 2231 to secure the mass portion 2331 in the port 2231. The apparatus, methods, and articles of manufacture described herein are not limited in this regard.

Figure 30:
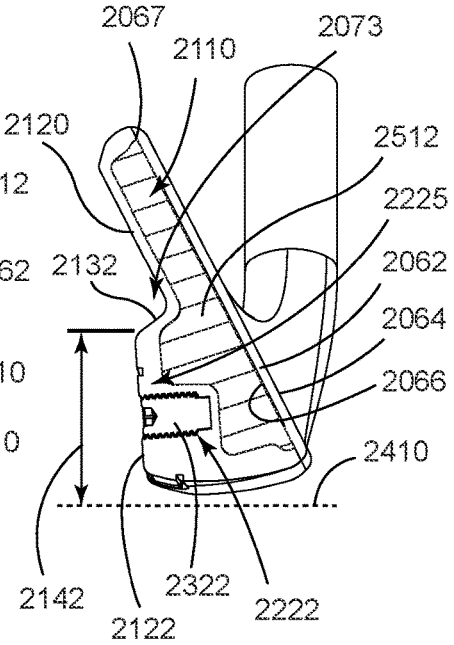
Figure 31:
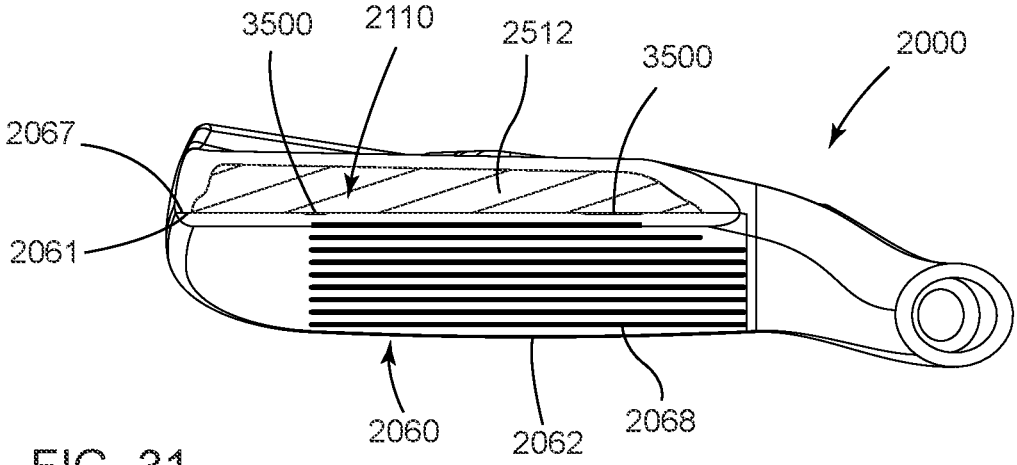
Figure 32:
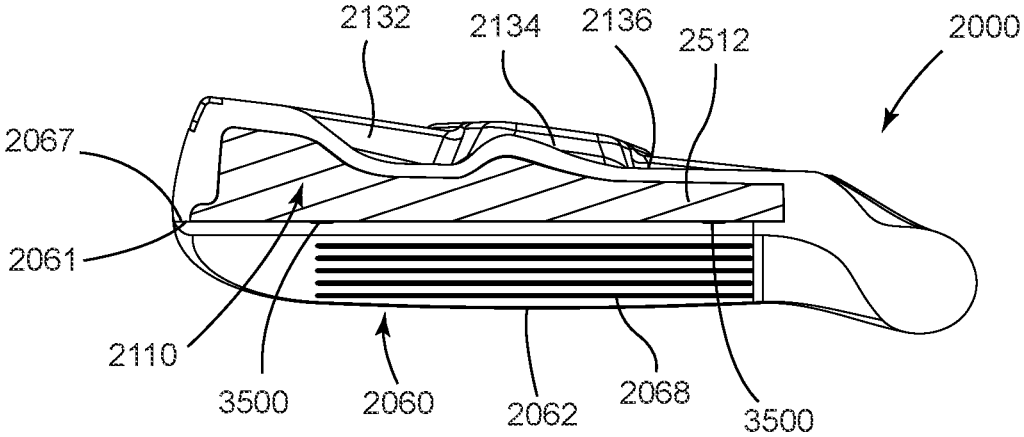

Each port of the first set of ports 2220 and the third set of ports 2240 may be configured to receive any of the mass portions of the first set of mass portions 2320 and/or the third set of mass portions 2340 similar to the coupling and/or engagement of any of the mass portions and ports described herein (e.g., mass portions 1800 and 1900 of FIGS. 17-19) or described in any of the incorporated by reference patent documents. As illustrated in the example of FIGS. 18 and 19, the mass portions of the first set of mass portions 2320 and/or the third set of mass portions 2340 may have different lengths or other physical properties (e.g., one or more materials of construction) as described herein. Accordingly, each port of the first set of ports 2220 and/or the third set of ports 2240 may receive a mass portion of the first set of mass portions 2320 or the third set of mass portions 2340 that may correspond or substantially correspond in length to the depth of the port. For example, as illustrated in FIGS. 28 and 30, the depth of the port 2222 may be greater than the depth of the port 2241. Accordingly, the mass portion 2322 that is secured in the port 2222 may have a greater length (an example illustrated in FIG. 19) than the mass portion 2341 (an example illustrated in FIG. 18) that is secured in the port 2241. Thus, as illustrated in FIGS. 20-38, the inner diameter and/or the depth of each port of the first set of ports 2220, the second set of ports 2230, and the third set of ports 2240 and/or the diameter and/or length of each mass portion of the first set of mass portions 2320, the second set of mass portions 2330, and the third set of mass portions 2340 may determine the selection of a corresponding mass portion for a flush configuration of the mass portion relative to the outer surface of the back wall portion 2072. Further, as described herein and in any of the incorporated by reference patent documents, the material of construction of each mass portion, which affects the density of each mass portion, may determine the selection of a mass portion. In other words, each port may receive a correspondingly sized mass portion having a certain total mass as described herein. In another example, the inner diameter and/or the depth of each port of the first set of ports 2220, the second set of ports 2230, and the third set of ports 2240 and/or the diameter and/or length of each mass portion of the first set of mass portions 2320, the second set of mass portions 2330, and the third set of mass portions 2340 may determine the selection of a corresponding mass portion for a recessed configuration of the mass portion relative to the outer surface of the back wall portion 2072. In yet another example, the inner diameter and/or the depth of each port of the first set of ports 2220, the second set of ports 2230, and the third set of ports 2240 and/or the diameter and/or length of each mass portion of the first set of mass portions 2320, the second set of mass portions 2330, and the third set of mass portions 2340 may determine the selection of a corresponding mass for a protruding configuration of the mass portion relative to the outer surface of the back wall portion 2072. Certain golf club head performance criteria, which may be affected by the MOI and CG location of the golf club head may also dictate the section of a mass portion for a port. In one example, mass portions having greater masses may be placed in the ports that are closer to the toe portion than to the heel portion to increase the moment of inertia (MOI) of the golf club head. In another example, the ports that are closest to the center portion 2073 may receive relatively heavier mass portions to lower the center of gravity of the golf club head. Each mass of the first set of mass portions 2320, the second set of mass portions 2330, and/or the third set of mass portions 2340 may be interchangeable with a relatively heavier or lighter mass to provide certain performance characteristics for the golf club head 2000. Thus, the configuration of each port, the configuration of each mass portion, and/or certain golf club head performance criteria may determine selection and/or placement of a mass portion in a port. The apparatus, methods, and articles of manufacture described herein are not limited in this regard.

The total mass of the mass portion 2331 may be greater than the total mass of any mass portion of the first set of mass portions 2320 and/or the third set of mass portions 2340. The total mass of the mass portion 2331 may be greater than or equal to the total mass of the first set of mass portions 2320 and/or the third set of mass portions 2340. The total mass of the mass portion 2331 may be determined to provide certain performance characteristics for the golf club head 2000. In one example, the mass portion 2331 may have a total mass that is greater than or equal to 2 grams and less than or equal to 30 grams. In another example, the mass portion 2331 may have a total mass that is greater than or equal to 4 grams and less than or equal to 18 grams. In another example, the mass portion 2331 may have a total mass that is greater than or equal to 6 grams and less than or equal to 12 grams. In another example, the mass portion 2331 may have a total mass that is greater than or equal to 7 grams and less than or equal to 9 grams. The apparatus, methods, and articles of manufacture described herein are not limited in this regard.

The diameter of the mass portion 2331 may be determined based on one or more properties (e.g., material density) of the materials of construction of the mass portion 2331. In one example, the mass portion 2331 may have a diameter that is greater than or equal to 0.2 inch (5.08 mm) and less than or equal to 1.0 inch (25.4 mm). In another example, the mass portion 2331 may have a diameter that is greater than or equal to 0.3 inch (7.62 mm) and less than 1.5 inch (38.1 mm). In another example, the mass portion 2331 may have a diameter that is greater than or equal to 0.4 inch (10.16 mm) and less than or equal to 0.8 inch (20.32 mm). In another example, the mass portion 2331 may have a diameter that is greater than or equal to 0.5 inch (12.7 mm) and less than or equal to 0.7 inch (17.78 mm). The apparatus, methods, and articles of manufacture described herein are not limited in this regard.

A center region or a geometric center of the port 2231 of the second set of ports 2230 may be located at or proximate to the CG of the golf club head 2000. Accordingly, a center of gravity of the mass portion 2331 may also be located at or proximate to the CG of the golf club head 2000 when the mass portion 2331 is secured in the port 2231 as described herein. As a result, the mass portion 2331 may be interchangeable with another mass portion 2331 having lower mass or a mass portion 2331 having a higher mass without causing a relatively large or a significant shift in the CG of the golf club head 2000. In one example, for each gram mass increase of the mass portion 2331, the CG location of the golf club head may shift by less than 0.5% of the $CG_X$ location (x-axis coordinate of the CG), less than 0.5% of the $CG_Y$ location (y-axis coordinate of the CG), and/or less than 0.2% of the $CG_Z$ location (z-axis coordinate of the CG). In another example, for each gram mass increase of the mass portion 2331, the CG location of the golf club head may shift by less than 0.35% of the $CG_X$ location, less than 0.35% of the $CG_Y$ location, and/or less than 0.15% of the $CG_Z$ location. In yet another example, for each gram mass increase of the mass portion 2331, the CG location of the golf club head may shift by less than 0.25% of the $CG_X$ location, less than 0.25% of the $CG_Y$ location, and/or less than 0.10% of the $CG_Z$ location. Thus, the mass portion 2331 may be interchangeable with another mass portion 2331 having a lower or a greater mass to provide certain performance characteristics for an individual (i.e., customize the performance of the golf club head 2000 for a certain individual) without substantially shifting the CG of the golf club head 2000 and/or altering the overall or general performance characteristics of the golf club head 2000. The apparatus, methods, and articles of manufacture described herein are not limited in this regard.

In one example, each mass portion of the first set of mass portions 2320 and/or the third set of mass portions 2340 may have a mass of greater than or equal to 0.25 grams and less than or equal to 6.0 grams. In another example, each mass portion of the first set of mass portions 2320 and/or the third set of mass portions 2340 may have a mass of greater than or equal to 1.25 grams and less than or equal to 5.25 grams. In another example, each mass portion of the first set of mass portions 2320 and/or the third set of mass portions 2340 may have a mass of greater than or equal to 1.75 grams and less than or equal to 4.1 grams. In another example, each mass portion of the first set of mass portions 2320 and/or the third set of mass portions 2340 may have a mass of greater than or equal to 0.75 grams and less than or equal to 3.5 grams. In yet another example, each mass portion of the first set of mass portions 2320 and/or the third set of mass portions 2340 may have a mass of greater than or equal to 0.5 grams and less than or equal to 4.0 grams. The apparatus, methods, and articles of manufacture described herein are not limited in this regard.

The interior cavity 2110 may be partially or entirely filled with one or more filler materials (i.e., a cavity filling material), which may include one or more similar or different types of materials. In one example, as illustrated in FIGS. 20-38, the interior cavity 2110 may be filled with a filler material 2512 that may be similar to any of the filler materials described herein or in any of the incorporated by reference patent documents. In another example (not illustrated for FIGS. 20-38), the interior cavity 2110 may be filled with a first filler material and a second filler material that may be similar to the golf club head 200 or similar to any of the golf club heads described in any of the incorporated by reference patent documents. In one example, as illustrated in FIGS. 20-38, the filler material 2512 may be injected into the interior cavity 2110 from any of the ports 2221 and 2241, while the other one of the ports 2221 and 2241 may functions as an air exhaust port through which the air in the interior cavity 2110 that is displaced by the filler material 2512 may exit. Accordingly, as illustrated in FIGS. 20-38, the filler material 2512 may be molded in the shape of the interior cavity 2110. The apparatus, methods, and articles of manufacture described herein are not limited in this regard.

In one example, one or more materials of the filler material, the physical properties of the one or more materials (i.e., density and/or elasticity), the amount (i.e., volume and/or mass) of the filler material 2512 may be determined for each golf club head (i.e., having a certain loft angle) to (i) provide vibration dampening or sound dampening (e.g., consistent and/or pleasing sound and feel when the golf club head 2000 strikes a golf ball as perceived by an individual using the golf club head 2000), (ii) provide structural support for the face portion 2062, and/or (iii) optimize ball travel distance, ball speed, ball launch angle, ball spin rate, ball peak height, ball landing angle and/or ball dispersion. In one example, the filler material 2512 may be formed from any type of polymer materials such as any of the polymer materials described herein or described in any of the incorporated by reference patent documents. In one example, the filler material 2512 may be formed from a rubber or a rubber-based compound such as any of the rubber-based compounds described herein. In another example, the filler material 2512 may be formed from a thermoset material, such as an epoxy-based material. In another example, the filler material 2512 may be formed from a thermoplastic material. In yet another example, the filler material may be formed from a metal or metal alloy (e.g., aluminum or aluminum alloy) that may have a different density than the density of the material of the body portion 2010. The filler material 2512 may be attached to the inner walls of the body portion 2010 and the face portion 2062 with any bonding agent or any adhesive that may be appropriate for bonding or attaching the filler material 2512 to the material of the body portion 2010 and/or the face portion 2062. In another example (not illustrated), the filler material 2512 may be a polymer material that may include self-adhesive properties to adhere to the body portion 2010 and/or the face portion 2062 without using a bonding agent or an adhesive. In another example, the injection molding and/or curing the filler material 2512 may provide sufficient holding forces (e.g., the filler material 2512 expanding during the filling or curing process) to maintain the filler material 2512 engaged with the body portion 2010 and/or the face portion 2062 without the use of bonding agents or adhesives. In yet another example, the filler material 2512 may be preformed and placed inside the interior cavity 2110 and/or attached to the interior walls of the body portion 2010 that define the interior cavity 2110 prior to enclosing the interior cavity 2110. The injection molding, curing, and/or attachment of the filler material 2512 in the interior cavity 2110 may be similar to the processes described herein or in any of the incorporated by reference application. The apparatus, methods, and articles of manufacture described herein are not limited in this regard.

Figure 35:
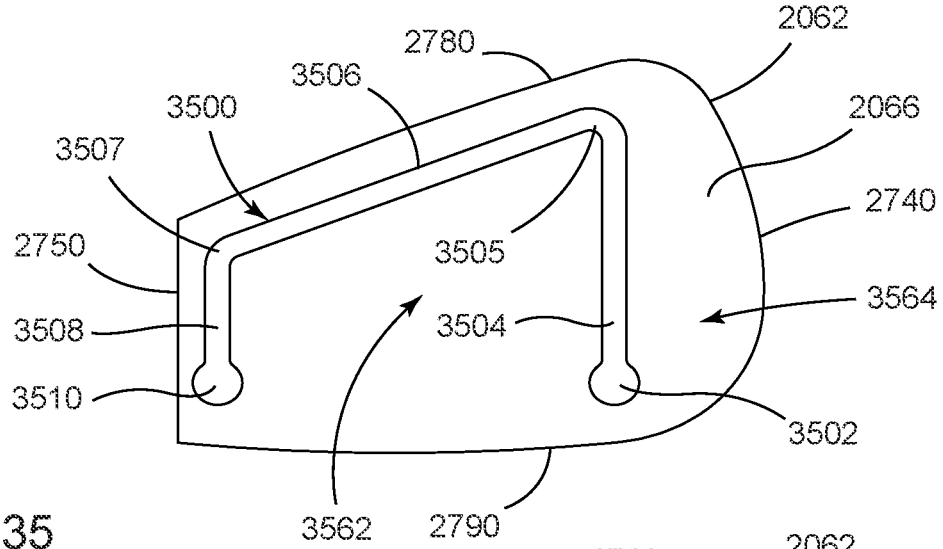

In the illustrated example of FIG. 35, the face portion 2062 may include a face perimeter that may include four perimeter sides, which may be a first perimeter side defined by a face portion toe portion edge (referred to herein as the face toe edge 2740), a second perimeter side defined by a face portion heel portion edge (referred to herein as the face heel edge 2750), a third perimeter side defined by a face portion top portion edge (referred to herein as face top edge 2780), and fourth perimeter side defined by a face portion sole portion edge (referred to herein as face sole edge 2790). The back surface 2066 of the face portion 2062 may include one or more grooves, slots, channels, depressions, or recesses, any of which may be referred to herein as back grooves and may define any structure on the back surface 2066 that may provide a relatively decreased face thickness. In the illustrated example of FIG. 35, the back surface 2066 may include a back groove 3500 having a first end portion 3502, a first portion 3504, a first transition portion 3505, a second portion 3506, a second transition portion 3507, a third portion 3508, and a second end portion 3510. In one example, as illustrated in FIG. 35, the first end portion 3502 may be proximate to the face toe edge 2740 and proximate to the face sole edge 2790. The first end portion 3502 may be circular as illustrated in FIG. 35 to eliminate or reduce stress concentration regions on the face portion 2062 at or proximate to the first end portion 3502. The first portion 3504 may extend from the first end portion 3502 toward the face top edge 2780. In the illustrated example of FIG. 35, the first portion 3504 may be linear and extend vertically from the first end portion 3502 toward the face top edge 2780. In another example, the first portion 3504 may extend from the first end portion 3502 toward the face top edge 2780 with a curvature that may be similar or substantially similar to the curvature or contour of the face toe edge 2740. In yet another example, the first portion 3504 may be inwardly curved. The first portion 3504 may then transition to the second portion 3506 via the first transition portion 3505 located proximate to the face toe edge 2740 and proximate to the face top edge 2780. The first transition portion 3505 may be curved to eliminate or reduce stress concentration regions on the face portion 2062 at or proximate to the first transition portion 3505. The second portion 3506 may extend from the first transition portion 3505 toward the face heel edge 2750. The second portion 3506 may be linear and have the same orientation and contour as the face top edge 2780. The second portion 3506 may then transition to the third portion 3508 via the second transition portion 3507 located proximate to the face heel edge 2750 and proximate to the face top edge 2780. The second transition portion 3507 may be curved to prevent or reduce stress concentration regions on the face portion 2062 at or proximate to the second transition portion 3507. The third portion 3508 may extend from the second transition portion 3507 toward the second end portion 3510 to the second end portion 3510. The second portion 3506 may be linear and have the same orientation and contour as the face heel edge 2750. The second end portion 3510 may be located proximate to the face heel edge 2750 and proximate to the face sole edge 2790. The second end portion 3510 may be circular as illustrated in FIG. 35 to eliminate or reduce stress concentration regions on the face portion 2062 at or proximate to the second end portion 3510. The apparatus, methods, and articles of manufacture described herein are not limited in this regard.

As illustrated in FIG. 35, the back groove 3500 may define an inner area 3562 and an outer area 3564 of the face portion 2062. The inner area 3562 may correspond to or include a portion of the face portion 2062 that may generally strike a golf ball. As discussed herein, the back groove 3500 may provide a relatively thinner part of the face portion 2062 as compared to the remaining parts of the face portion 2062. Accordingly, the back groove 3500 may provide enhanced deflection of the inner area 3562 relative to the outer area 3564 as compared a face portion 2062 without the back groove 3500. In other words, the back groove 3500 may provide a trampoline effect for the inner area 3562 of the face portion 2062. The enhanced deflection of the inner area 3562 may provide enhanced rebounding of the inner area 3562 after the face portion 2062 strikes a golf ball, which may increase ball launch angle, decrease ball backspin and/or increase ball carry distance compared to a similar golf club head as the golf club head 2000 but without having the back groove 3500. The apparatus, methods, and articles of manufacture described herein are not limited in this regard.

Figure 37:
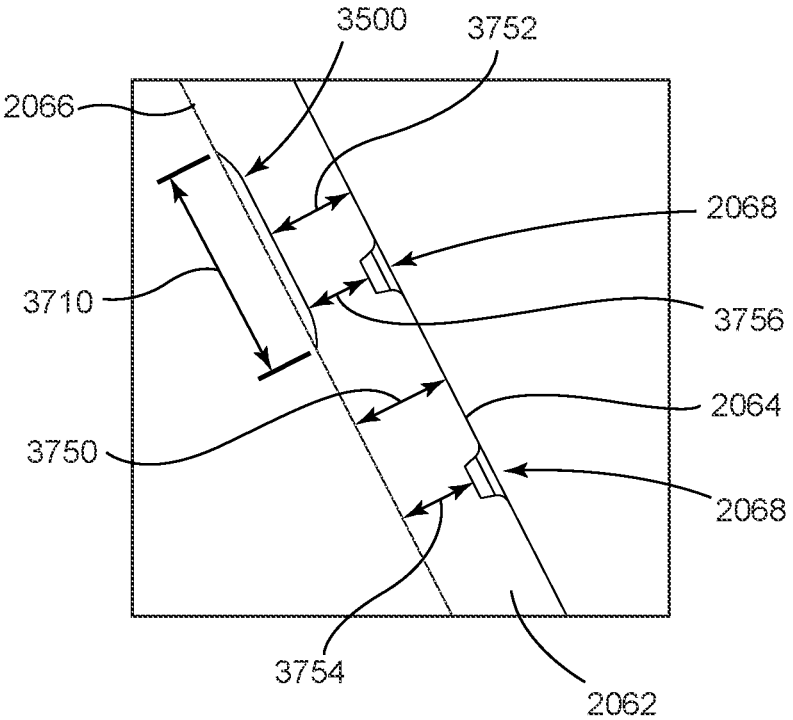
FIGS. 37 and 38 are enlarged views of area 37 of FIG. 28 and area 38 of FIG. 29, respectively.
Figure 38:
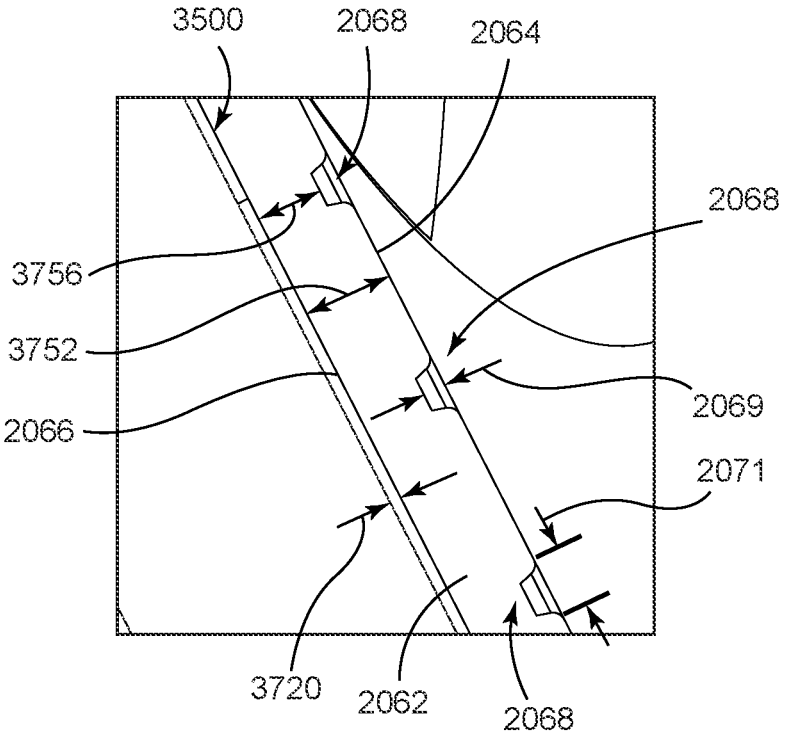

In one example, as illustrated in FIGS. 35, 37, and 38, any portion of the back groove 3500 may include a back groove width 3710 ($W_{BG}$) The back groove width 3710 ($W_{BG}$) may have any value to provide certain performance characteristics for the golf club head 2000. In one example, the back groove width 3710 may be greater than or equal to 0.050 inch (1.270 mm) and less than or equal to 0.200 inch (5.080 mm) (0.050 in≤$W_{BG}$≤0.200 in). In another example, the back groove width 3710 may be greater than or equal to 0.094 inch (2.381 mm) and less than or equal to 0.156 inch (3.969 mm) (0.094 in≤$W_{BG}$≤0.156 in). In another example, the back groove width 3710 may be greater than or equal to 0.109 inch (2.778 mm) and less than or equal to 0.141 inch (3.572 mm) (0.109 in≤$W_{BG}$≤0.141 in). In yet another example, the back groove width 3710 may be greater than or equal to 0.120 inch (3.048 mm) and less than or equal to 0.130 inch (3.302 mm) (0.120 in≤$W_{BG}$≤0.130 in). The back groove width 3710 may be constant or substantially constant (considering manufacturing tolerances) along any one or more portions or all of the back groove 3500. The back groove width 3710 may vary at a certain portion or portions of the back groove 3500. Any portion of back groove 3500 and/or any portion of the back groove 3600 may have any cross-sectional shape. Accordingly, the back groove width 3710 at any one or more portions may vary according to corresponding variations in the cross-sectional shape of the back groove 3500. The apparatus, methods, and articles of manufacture described herein are not limited in this regard.

In one example, as illustrated in FIGS. 35, 37, and 38, any portion of the back groove 3500 may include a back groove depth 3720 ($D_{BG}$). The back groove depth 3720 ($D_{BG}$) may have any value to provide certain performance characteristics for the golf club head 2000. In one example, the back groove depth 3720 may be greater than or equal to 0.003 inch (0.076 mm) and less than or equal to 0.015 inch (0.381 mm) (0.003 in≤$D_{BG}$≤0.015 in). In another example, the back groove depth 3720 may be greater than or equal to 0.005 inch (0.133 mm) and less than or equal to 0.009 inch (0.222 mm) (0.005 in≤$D_{BG}$≤0.009 in). In another example, the back groove depth 3720 may be greater than or equal to 0.006 inch (0.156 mm) and less than or equal to 0.008 inch (0.200 mm) (0.006 in≤$D_{BG}$≤0.008 in). In yet another example, the back groove depth 3720 may be greater than or equal to 0.0065 inch (0.1651 mm) and less than or equal to 0.0075 inch (0.1905 mm) (0.0065 in≤$D_{BG}$≤0.0075 in). The back groove depth 3720 may be constant or substantially constant (considering manufacturing tolerances) along any one or more portions of back groove 3500 or along the entire back groove 3500. The back groove depth 3720 may vary at a certain portion or portions of the back groove 3500. Any portion of back groove 3500 and/or any portion of the back groove 3600 may have any cross-sectional shape. Accordingly, the back groove depth 3720 at any one or more portions may vary according to corresponding variations in the cross-sectional shape of the back groove 3500. The apparatus, methods, and articles of manufacture described herein are not limited in this regard.

In one example, as illustrated in FIGS. 37 and 38, the face portion 2062 may include a first face thickness 3750 ($T_1$), a second face thickness 3752 ($T_2$), a third face thickness 3754 ($T_3$), and a fourth face thickness 3756 ($T_4$). The first face thickness 3750 may be defined by a distance between the front surface 2064 and the back surface 2066 of the face portion 2062 at a location on the face portion 2062 that does not include any portion of a front groove 2068 and any portion of the back groove 3500. The second face thickness 3752 may be defined by a distance between the front surface 2064 of the face portion 2062 and a bottom surface of the back groove 3500 at a location on the face portion 2062 that includes a portion of the back groove 3500 but does not include any portion of a front groove 2068. Accordingly, the second face thickness 3752 may be determined by subtracting the back groove depth 3720 from the first face thickness 3750. The third face thickness 3754 may be defined by a distance between a bottom surface of a front groove 2068 and the back surface 2066 of the face portion 2062 at a location on the face portion 2062 that does not include any portion of the back groove 3500. Accordingly, the third face thickness 3754 may be determined by subtracting a front groove depth 2069 from the first face thickness 3750. The fourth face thickness 3756 may be defined by a distance between a bottom surface of a front groove 2068 and a bottom surface of the back groove 3500 at a location on the face portion 2062 that includes a portion of a front groove 2068 and an opposing portion of a back groove 3500. Accordingly, the fourth face thickness 3756 may be determined by subtracting a sum of the back groove depth 3720 and a front groove depth 2069 from the first face thickness 3750. The first face thickness 3750 may be greater than the second face thickness 3752, the third face thickness 3754, and the fourth face thickness 3756 ($T_1>T_2$, $T_1>T_3$, $T_1>T_4$). The second face thickness 3752 may be greater than the fourth face thickness 3756 ($T_2>T_4$). The third face thickness 3754 may be greater than the fourth face thickness 3756 ($T_3>T_4$). In one example, as illustrated in FIGS. 37 and 38, the second face thickness 3752 may be greater than the third face thickness 3754 ($T_2>T_3$). In another example (not shown), the third face thickness 3754 may be greater than the second face thickness 3752 ($T_3>T_2$). The apparatus, methods, and articles of manufacture described herein are not limited in this regard.

The first face thickness 3750 may have any value to provide certain performance characteristics for the golf club head 2000. In one example, the first face thickness 3750 may be greater than or equal to 0.025 inch (0.635 mm) and less than or equal to 0.125 inch (3.175 mm) (0.025 in≤$T_1$≤0.125). In another example, the first face thickness 3750 may be greater than or equal to 0.047 inch (1.181 mm) and less than or equal to 0.078 inch (1.969 mm) (0.047 in≤$T_1$≤0.078). In another example, the first face thickness 3750 may be greater than or equal to 0.054 inch (1.378 mm) and less than or equal to 0.070 inch (1.772 mm) (0.054 in≤$T_1$≤0.070). In another example, the first face thickness 3750 may be greater than or equal to 0.060 inch (1.524 mm) and less than or equal to 0.065 inch (1.651 mm) (0.060 in≤$T_1$≤0.065). The apparatus, methods, and articles of manufacture described herein are not limited in this regard.

The second face thickness 3752 may have any value to provide certain performance characteristics for the golf club head 2000. The value of the second face thickness 3752 may be determined by subtracting the value of the back groove depth 3720 as described herein from the value of the first face thickness 3750. The value of the second face thickness 3752 may also be expressed as a percentage of the value of the first face thickness 3750. In one example, the second face thickness 3752 may be greater than or equal to 75% and less than or equal to 98% of the first face thickness 3750 ($0.75 \le T_2/T_1 \le 0.98$). Accordingly, the back groove depth 3720 may be less than or equal to 25% and greater than or equal to 2% of first face thickness 3750 ($0.02 \le D_{BG}/T_1 \le 0.25$). In another example, the second face thickness 3752 may be greater than or equal to 70% and less than or equal to 85% of the first face thickness 3750 ($0.70 \le T_2/T_1 \le 0.85$). Accordingly, the back groove depth 3720 may be less than or equal to 30% and greater than or equal to 15% of first face thickness 3750 ($0.15 \le D_{BG}/T_1 \le 0.30$). In another example, the second face thickness 3752 may be greater than or equal to 85% and less than or equal to 95% of the first face thickness 3750 ($0.85 \le T_2/T_1 \le 0.95$). Accordingly, the back groove depth 3720 may be less than or equal to 15% and greater than or equal to 5% of first face thickness 3750 ($0.05 \leq D_{BG}/T_1 \leq 0.15$). In yet another example, the second face thickness 3752 may be greater than or equal to 80% and less than or equal to 90% of the first face thickness 3750 ($0.80 \leq T_2/T_1 \leq 0.90$). Accordingly, the back groove depth 3720 may be less than or equal to 20% and greater than or equal to 10% of first face thickness 3750 ($0.10 \leq D_{BG}/T_1 \leq 0.20$). The apparatus, methods, and articles of manufacture described herein are not limited in this regard.

The third face thickness 3754 may have any value to provide certain performance characteristics for the golf club head 2000. The value of the third face thickness 3754 may be determined by subtracting value of the front groove depth 2069 as described herein from the value of first face thickness 3750. The value of the third face thickness 3754 may also be expressed as a percentage of the value of the first face thickness 3750. In one example, the third face thickness 3754 may be greater than or equal to 60% and less than or equal to 97% of the first face thickness 3750 ($0.60 \leq T_3/T_1 \leq 0.97$). In another example, the third face thickness 3754 may be greater than or equal to 75% and less than or equal to 85% of the first face thickness 3750 ($0.75 \leq T_3/T_1 \leq 0.85$). In another example, the third face thickness 3754 may be greater than or equal to 80% and less than or equal to 95% of the first face thickness 3750 ($0.80 \leq T_3/T_1 \leq 0.95$). In yet another example, the third face thickness 3754 may be greater than or equal to 70% and less than or equal to 90% of the first face thickness 3750 ($0.70 \leq T_3/T_1 \leq 0.90$). The apparatus, methods, and articles of manufacture described herein are not limited in this regard.

The fourth face thickness 3756 may have any value to provide certain performance characteristics for the golf club head 2000. The value of the fourth face thickness 3756 may be determined by subtracting the value of the front groove depth 2069 as described herein and the value of the back groove depth 3720 as described herein from the value of the first face thickness 3750. The value of the fourth face thickness 3756 may also be expressed as a percentage of the value of the first face thickness 3750. In one example, the fourth face thickness 3756 may be greater than or equal to 45% and less than or equal to 85% of the first face thickness 3750 ($0.45 \leq T_4/T_1 \leq 0.85$). In another example, the fourth face thickness 3756 may be greater than or equal to 55% and less than or equal to 75% of the first face thickness 3750 ($0.55 \leq T_4/T_1 \leq 0.75$). In another example, the fourth face thickness 3756 may be greater than or equal to 60% and less than or equal to 70% of the first face thickness 3750 ($0.60 \leq T_4/T_1 \leq 0.70$). In yet another example, the fourth face thickness 3756 may be greater than or equal to 62% and less than or equal to 68% of the first face thickness 3750 ($0.62 \leq T_4/T_1 \leq 0.68$). The apparatus, methods, and articles of manufacture described herein are not limited in this regard.

In one example, as illustrated in FIGS. 37 and 38, the back groove width 3710 may be greater than the front groove width 2071, and the back groove depth 3720 may be less than the front groove depth 2069. In another example (not shown), the back groove width 3710 may be greater than the front groove width 2071, and the back groove depth 3720 may be greater than the front groove depth 2069. In another example (not shown), the back groove width 3710 may be less than the front groove width 2071, and the back groove depth 3720 may be greater than the front groove depth 2069. In yet another example (not shown), the back groove width 3710 may be less than the front groove width 2071, and the back groove depth 3720 may be less than the front groove depth 2069. The apparatus, methods, and articles of manufacture described herein are not limited in this regard.

In one example, the back groove width 3710 and the back groove depth 3720 may be similar. In another example, the back groove width 3710 may be less than the back groove depth 3720. In yet another example, the back groove width 3710 may be greater than the back groove depth 3720. In the illustrated example of FIGS. 37 and 38, the back groove width 3710 may be substantially greater than the back groove depth 3720. The back groove width 3710 and the back groove depth 3720 may be determined to provide sufficient deflection for the face portion 2062 without compromising the structural integrity of the face portion. In other words, the back groove width 3710 and the back groove depth 3720 may be determined so that the face portion 2062 may sufficiently deflect to provide the rebounding and the trampoline effect described herein when striking a golf ball without failure after one, a few, or repeated and long-term use of the golf club head 2000 for golf ball strikes. Additionally, values of the back groove width 3710 and the back groove depth 3720 may depend on the values of the first face thickness 3750, the front groove width 2071, and/or the front groove depth 2069. The apparatus, methods, and articles of manufacture described herein are not limited in this regard.

As described herein, the interior cavity 2110 may be filled with one or more filler materials, such as the filler material 2512. Accordingly, in one example, all or portions of the back groove 3500 may be filled with the filler material 2512. The filler material 2512 may structurally support the relatively thinner portions of the face portion 2062 at locations in and/or proximate to the back groove 3500. In another example, all or portions of the back groove 3500 may be filled with a filler material that may have different physical properties than any of the filler materials in the interior cavity 2110. In yet another example, a portion of the back groove 3500 may be filled with a first filler material, whereas another portion of the back groove 3500 may be filled with a second filler material having one or more different physical properties than the first filler material. The configuration (e.g., depth, width, location on the face portion, cross-sectional shape) of the back groove 3500 may determine the physical properties of the one or more filler materials and the amount of the one or more filler materials that may be used to fill the back groove 3500 and/or the interior cavity 2110. The apparatus, methods, and articles of manufacture described herein are not limited in this regard.

Figure 49:
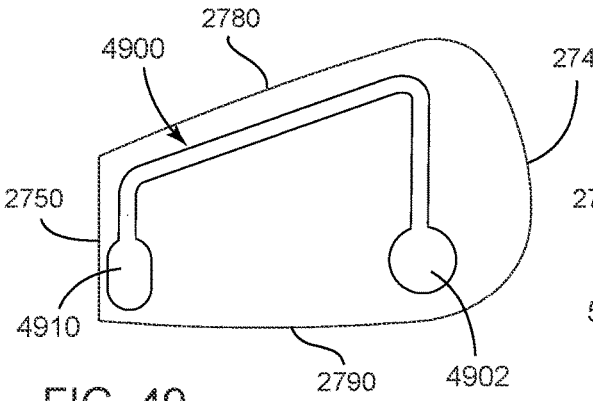
Figure 59:
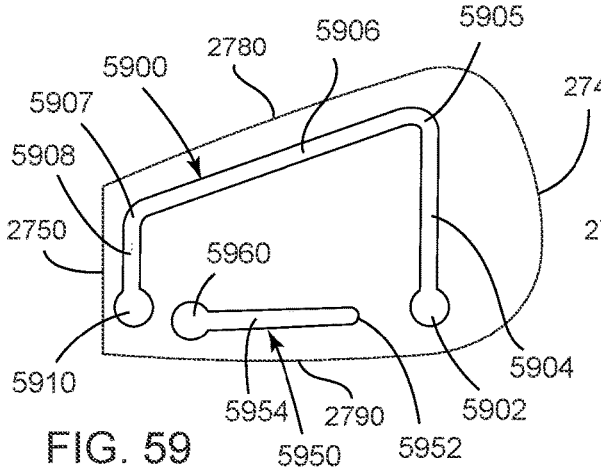
Figure 65:
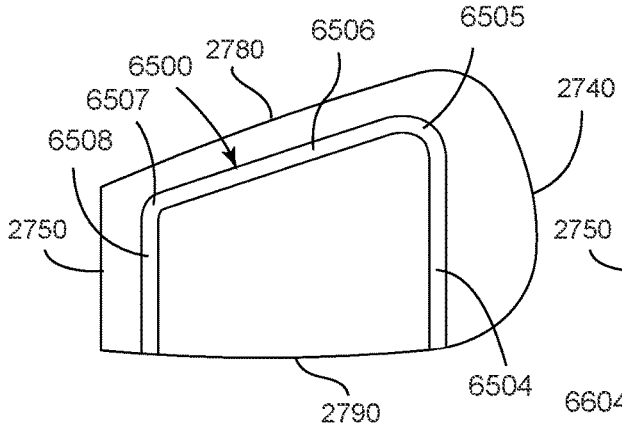
Figure 66:
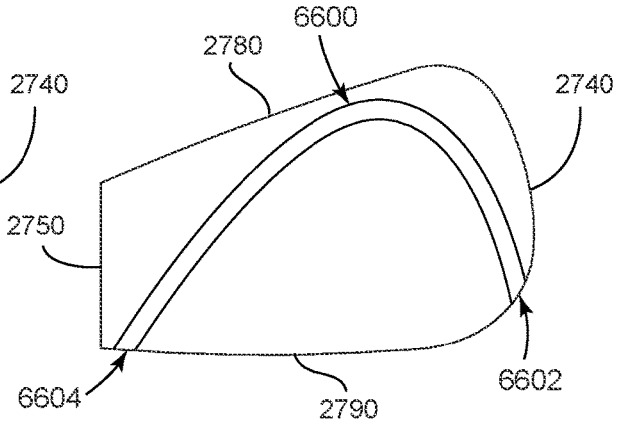
Figure 67:
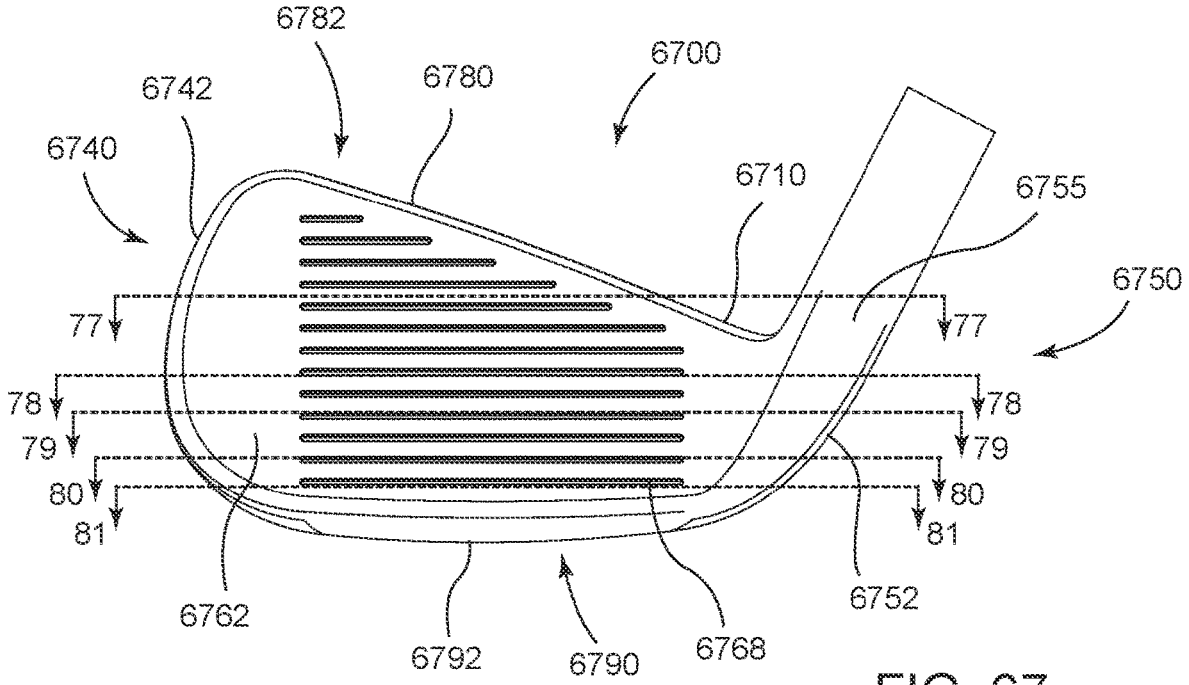
FIGS. 67, 68, 69, 70, 71, 72, 73, 74, 75, 76, 77, 78, 79, 80, 81, 82, 83, 84, 85, 86, and 87 illustrate a front view, a back view, a top view, a bottom view, a heel side view, a toe side view, a cross-sectional view taken at line 73-73 of FIG. 68, a cross-sectional view taken at line 74-74 of FIG. 68, a cross-sectional view taken at line 75-75 of FIG. 68, a cross-sectional view taken at line 76-76 of FIG. 68, a cross-sectional view taken at line 77-77 of FIG. 67, a cross-sectional view taken at line 78-78 of FIG. 67, a cross-sectional view taken at line 79-79 of FIG. 67, a cross-sectional view taken at line 80-80 of FIG. 67, a cross-sectional view taken at line 81-81 of FIG. 67, a front view with the face portion removed, a back view without a mass portion and a badge, a side view of an internal mass portion, a rear view of an internal mass portion, a front and side view of an internal mass portion, and a method of manufacturing, respectively, of a golf club head according to embodiments of the apparatus, methods, and articles of manufacture described herein.
Figure 68:
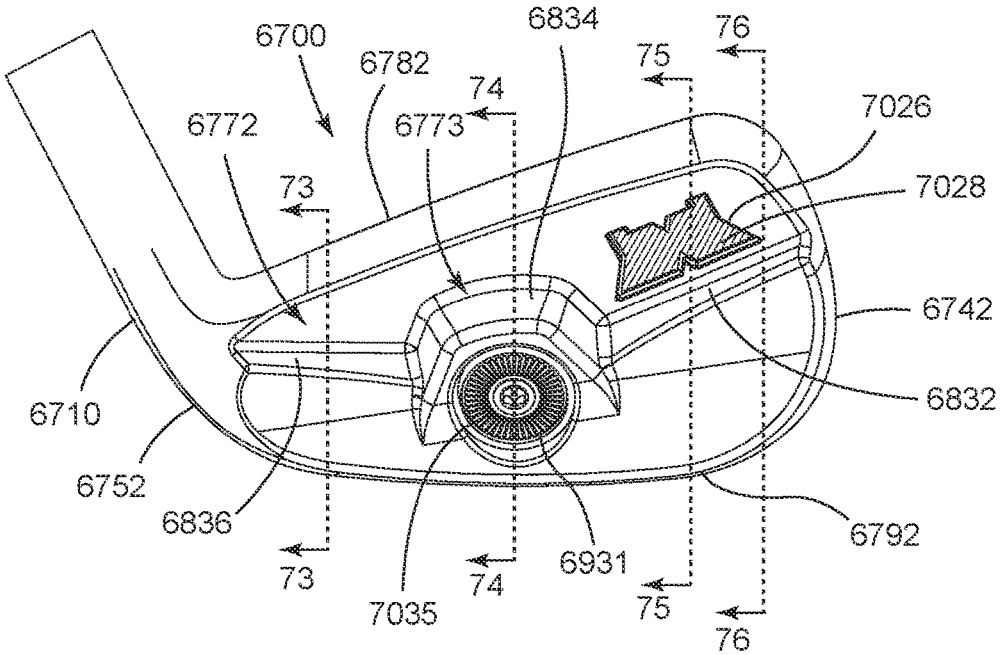
Figure 69:
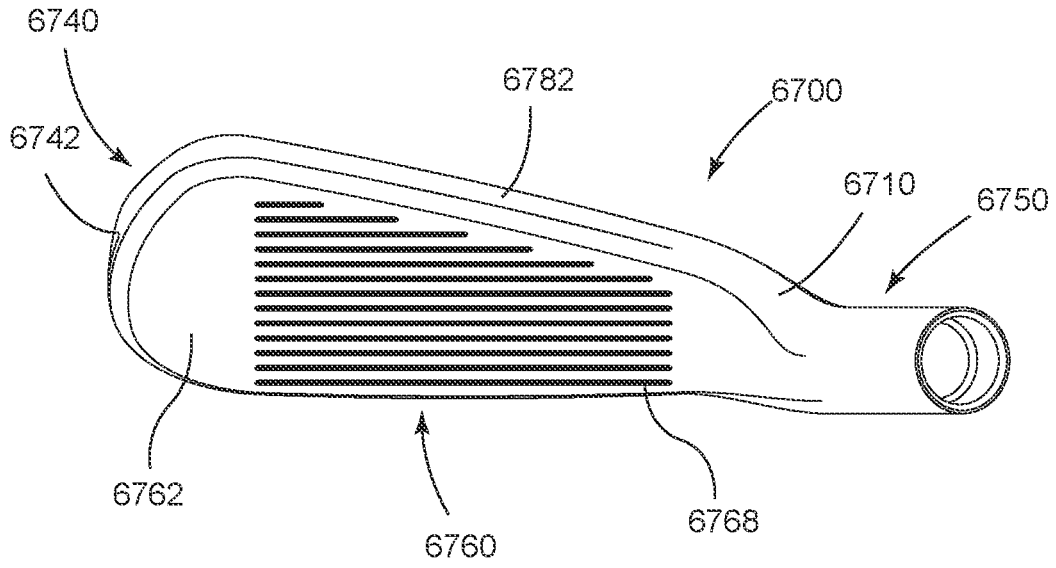
Figure 70:
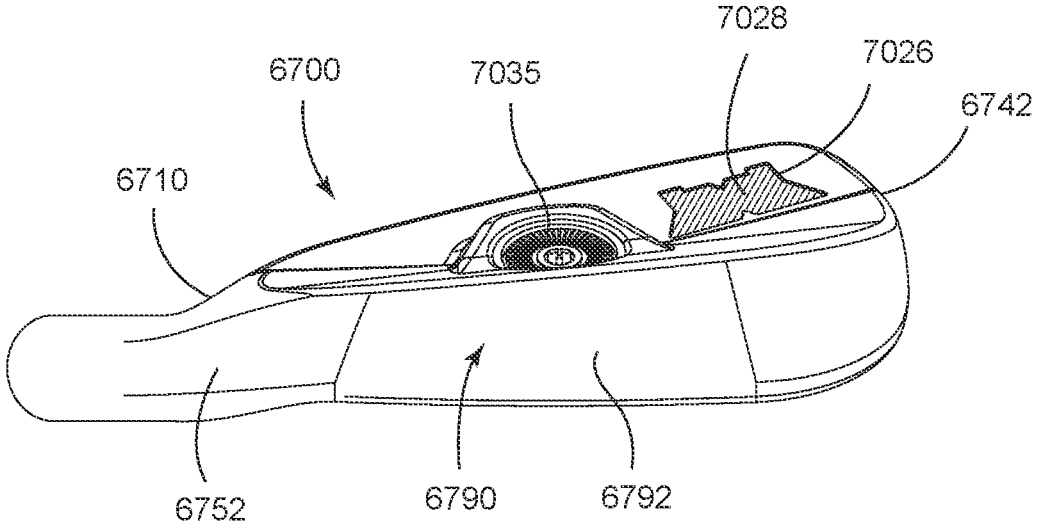
Figure 71:
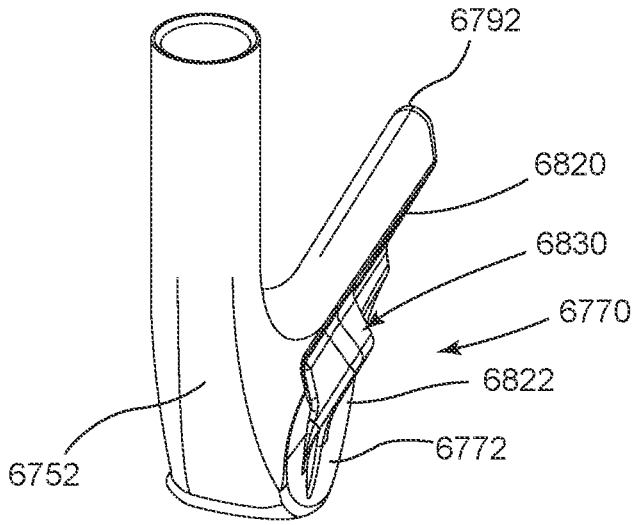

The first end portion 3502 and/or or the second end portion 3510 may have any shape and/or size without any sharp corners or vertices to eliminate or reduce stress concentration points or regions at or proximate to the back groove 3500. In one example, the first end portion 3502 and/or the second end portion 3510 may have an elliptical or a semi-elliptical shape. In another example, the first end portion 3502 and/or the second end portion 3510 may have a triangular shape with rounded vertices. In another example, as illustrated in FIG. 49, the first end portion 3502 and/or the second end portion 3510 may have an obround shape (i.e., a rectangle with semicircles at opposite sides). In another example, as illustrated in FIGS. 65 and 66, the back groove 3500 may extend to the face perimeter. In other words, any portion of a back groove 3500 may extend to the face perimeter and terminate at the face perimeter. In yet another example, as illustrated in FIG. 59, the back groove 3500 may terminate at a rounded or curved end portion 5952 having the same width as the back groove width 3710 without having an enlarged end portion. Any end portion of any of the back grooves described herein may have any shape and/or any shape without sharp corners or vertices to eliminate or reduce any stress concentration regions on the face portion 2062 at or proximate to the back groove. The apparatus, methods, and articles of manufacture described herein are not limited in this regard.

The cross-sectional shape of the back groove 3500 may be without any sharp corners to eliminate or reduce stress concentration points or regions at or proximate to the back groove 3500. In one example, as illustrated in FIG. 37, the cross-section of the back groove 3500 may have a wide and shallow U-shape. In another example, the cross-section of the back groove 3500 may have a deep and/or narrow U-shape. In another example, the cross-section of the back groove 3500 may have a rectangular shape with rounded corners or vertices. In yet another example, the cross-sectional shape of the back groove 3500 may be semi-circular or semi-elliptical. Accordingly, the back groove 3500 may be manufactured with any cross-sectional shape. The cross-sectional shape of the back groove 3500 may be manufactured without sharp corners or vertices to eliminate or reduce any stress concentration regions on the face portion 2062 at or proximate to the back groove 3500. The apparatus, methods, and articles of manufacture described herein are not limited in this regard.

Figure 36:
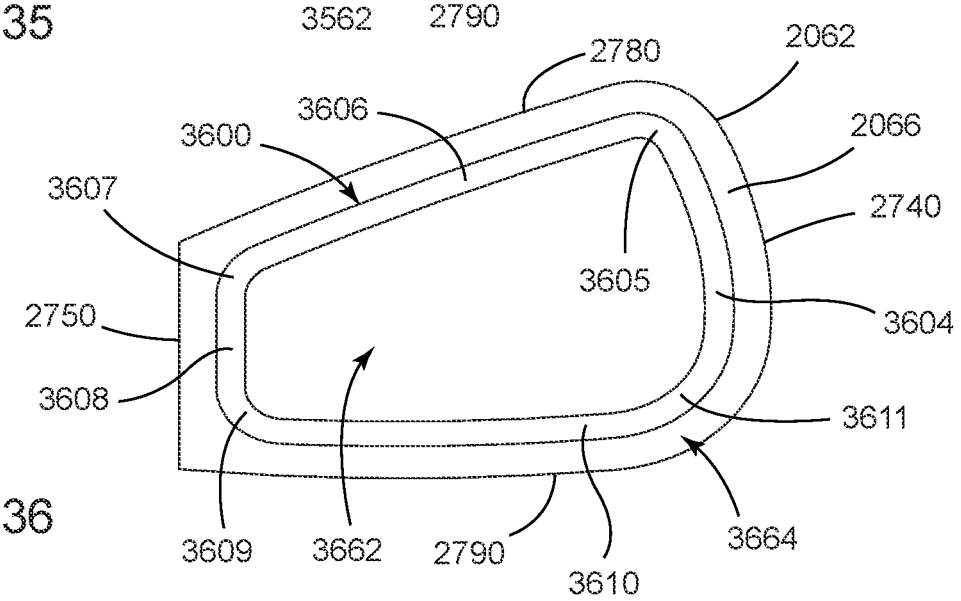

In another example, as illustrated in FIG. 36, the back surface 2066 of the face portion 2062 may include a back groove 3600, which may be similar in many respects to the back groove 269 of FIG. 13. The back groove 3600 may have similar back groove width, back groove depth, and/or cross-sectional shape as described and illustrated herein with respect to the back groove 3500. The back groove 3600 may include a first portion 3604, a first transition portion 3605, a second portion 3606, a second transition portion 3607, a third portion 3608, and a third transition portion 3609, a fourth portion 3610, and a fourth transition portion 3611, all of which may back groove 3600 that may be continuous and extends proximate to a perimeter of the back surface 2066 of the face portion 2062 and generally follows the contour of the perimeter of the face portion 2062 without having any sharp corners to prevent stress concentration regions at or near any portion of the back groove 3600. As illustrated in FIG. 36, the back groove 3600 may define an inner area 3662 and an outer area 3664 of the face portion 2062. The inner area 3662 may correspond to or include a portion of the face portion 2062 that generally strikes a golf ball. Further, the back groove 3600 may provide a relatively thinner part of the face portion 2062 as compared to the remaining parts of the face portion 2062. Accordingly, the back groove 3600 may provide enhanced deflection of the inner area 3662 relative to the outer area 3664 as compared to face portion 2062 without the back groove 3600. In other words, the back groove 3600 may provide a trampoline effect for the inner area 3662 of the face portion 2062. The enhanced deflection of the inner area 3662 may provide enhanced rebounding of the inner area 3662 after the face portion 2062 strikes a golf ball, which may increase ball speed and/or carry distance. The apparatus, methods, and articles of manufacture described herein are not limited in this regard.

In one example, to eliminate or reduce stress concentration regions in or around the back groove 3500, any portion of the back groove 3500 may have a curved or chamfered shape when changing directions. In one example, as illustrated in FIG. 35, the first transition portion 3505 and/or the second transition portion 3507 of the back groove 3500 may be curved. In another example, as illustrated in FIG. 36, the first transition portion 3605, the second transition portion 3607, the third transition portion 3609, and the fourth transition portion 3611 of the back groove 3600 may be curved. In another example as illustrated in FIG. 35, the first end portion 3502 and the second end portion 3510 of the back groove 3500 may be circular. The size of the circle defining the first end portion 3502 and/or the second end portion 3510 may be determined considering the first face thickness, the second face thickness, the third face thickness, the fourth face thickness, material properties of the face portion, the method by which the face portion is manufactured, and/or a broad range of deflections to which the face portion 2062 may be subjected with repeated golf ball strikes. In one example, the diameter of a circle defining the first end portion 3502 and/or the second end portion 3510 may be greater than or equal to 0.1 inch (2.54 mm) and less than or equal to 0.4 inch (10.16 mm). In another example, the diameter of a circle defining the first end portion 3502 and/or the second end portion 3510 may be greater than or equal to 0.188 inch (4.763 mm) and less than or equal to 0.313 inch (7.938 mm). In yet another example, the diameter of a circle defining the first end portion 3502 and/or the second end portion 3510 may be greater than or equal to 0.219 inch (5.556 mm) and less than or equal to 0.281 inch (7.144 mm). The apparatus, methods, and articles of manufacture described herein are not limited in this regard.

To determine the effect of back groove 3500 and the back groove 3600 on the performance of the golf club head 2000, certain club performance parameters were measured for three sample golf clubs, which are identified in FIGS. 39-42 as golf club number one (Club No. 1), golf club number two (Club No. 2), and golf club number 3 (Club No. 3). All three golf clubs were 7-iron golf clubs with golf club heads that were identical in every respect to the golf club head 2000 as described herein except for the configuration of the back groove on the back surface 2066 of the face portion 2062. Club No. 1 did not include any back grooves such as the back groove 3500 or the back groove 3600. Club No. 2 included the back groove 3500 as described herein and illustrated in FIG. 35. Club No. 3 included the back groove 3600 as described herein and illustrated in FIG. 36. The back groove 3500 of Club No. 2 and the back groove 3600 of Club No. 3 had a back groove width 3710 of about 0.125 inch (3.175 mm) and a back groove depth 3720 of about 0.007 inch (0.178 mm). The diameter of the circles defining the first end portion 3502 and the second end portion 3510 of the back groove 3500 were about 0.25 inch (6.350 mm).

Each of the sample golf clubs was tested with a swing robot to strike a golf ball at an average golf club head speed of 84 mph to 86 mph for multiple iterations at each of five locations on the face portion of the golf club head to determine average ball speed (mph), average ball launch angle (degrees), average ball backspin (rpm), and average total carry distance (yards). For example, the swing robot may be a model manufactured by Golf Laboratories of San Diego, California. The five locations of the face portion were a center location, a toe location, a heel location, a low location, and a high location, all of which may be referred to herein as the measurement locations. The center location was determined as the location on the face portion by which a golf ball is typically struck by an individual. In other words, the center location statistically (e.g., greater than 75%) receives the highest number of ball strikes. The center location was set at 0.75 inches or approximately 0.75 inches up from the sole portion edge 2092 and at the center of a corresponding front groove 2068 on the face portion 2062 subject to variations and/or approximations according to measurement tolerances and/or the actual ball strike region on the face portion 2062 by the swing robot. The toe location and the heel location were set as 0.5 inches or approximately 0.5 inches from the center location in the toe direction and in the heel direction, respectively, subject to variations and/or approximations according to measurement tolerances and the actual ball strike point on the face portion 2062 by the swing robot. The high location and the low location were set at 0.25 inches or approximately 0.25 inches from the center location in the top direction and the bottom direction, respectively, subject to variations and/or approximations according to measurement tolerances and the actual ball strike point on the face portion 2062 by the swing robot. The apparatus, methods, and articles of manufacture described herein are not limited in this regard.

Figure 39:
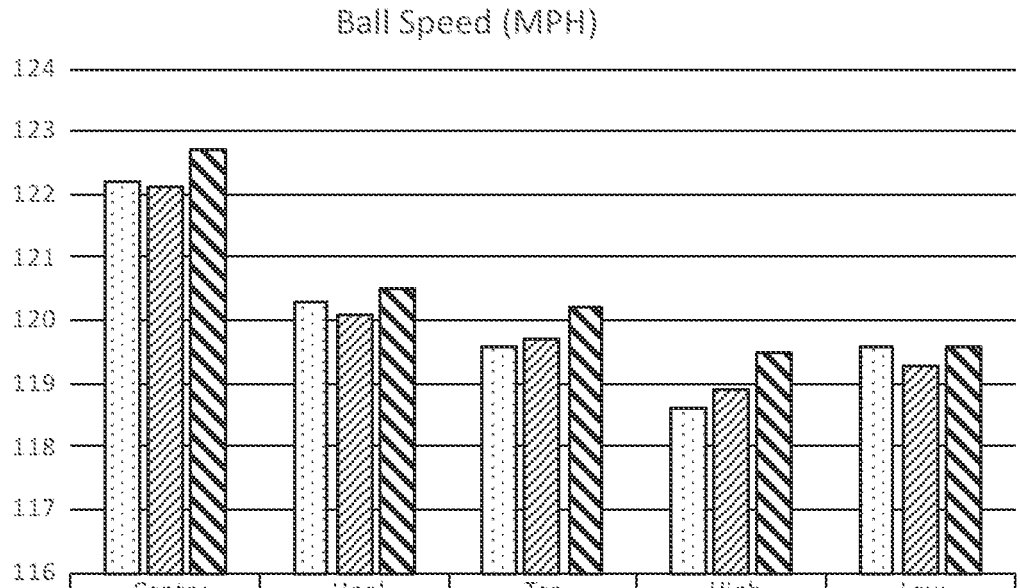
FIGS. 39, 40, 41, and 42 are plots of experimental results for the golf club head of FIG. 20 according to several embodiments of the apparatus, methods, and articles of manufacture described herein.

As illustrated in FIG. 39, ball speed for Club No. 3 was higher at all measurement locations than the ball speeds for Club No. 1 and Club No. 2. Referring back to FIG. 36, the back groove 3600 forms a continuous loop on the back surface 2066 of the face portion 2062. Accordingly, the inner area 3662 of the face portion 2062 may deflect inward relative to the outer area 3664 with a golf ball strike to provide an enhanced trampoline or rebounding effect for the golf ball to result in enhanced ball speeds at all measurement locations relative to Club No. 1 and Club No. 3.

Figure 40:
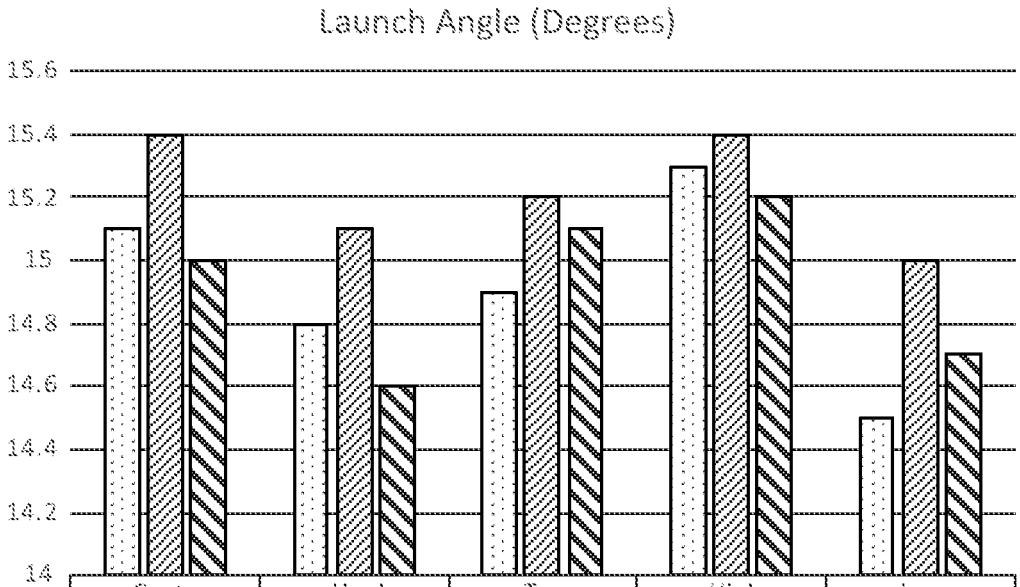

As illustrated in FIG. 40, launch angle for Club No. 2 was higher at all measurement locations than the launch angle for Club No. 1 and Club No. 3. Referring back to FIG. 35, the back groove 3500 forms a C-shaped groove on the back surface 2066 of the face portion 2062. Accordingly, the upper portion of the inner area 3562 of the face portion 2062 may have a greater inward deflection when the face portion 2062 strikes a golf ball than the lower portion of the inner area 3562, hence launching the golf ball with a higher launch angle. In other words, the upper portion of the inner area 3562 may provide a greater trampoline or rebound effect than the lower portion of the inner area 3562 to produce a relatively higher launch angle than Club No. 1 and Club No. 3.

Figure 41:
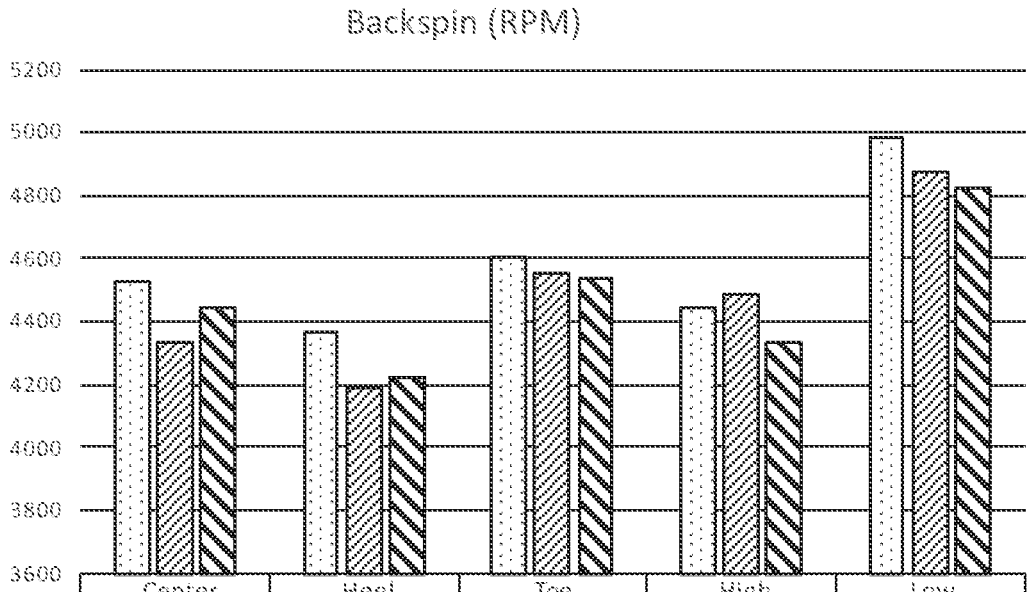

As illustrated in FIG. 41, ball backspin for Club No. 2 was lower at the center location than the backspin for Club No. 1 and Club No. 3. Referring back to FIG. 35, the back groove 3500 forms a C-shaped groove on the back surface 2066 of the face portion 2062. Accordingly, the center portion of the inner area 3562 of the face portion 2062 may have a greater inward deflection when the face portion 2062 strikes a golf ball than the lower portion of the inner area 3562, hence creating a lower backspin on the golf ball. In other words, the relatively greater inward deflection of the upper portion of the inner area 3562 may impart a lower backspin on the ball than Club No. 1 and Club No. 3.

Figure 42:
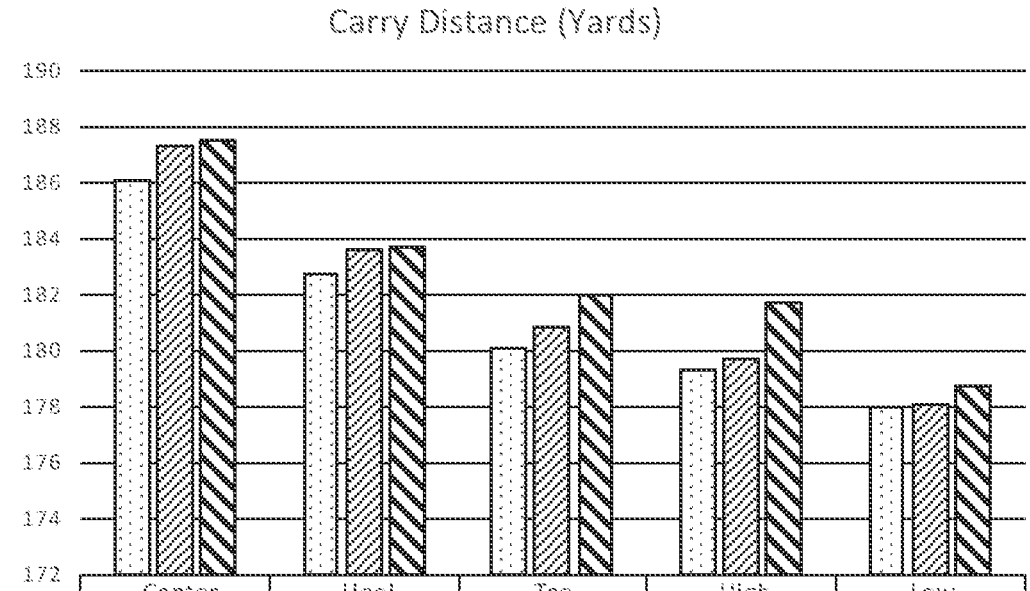

As illustrated in FIG. 42, ball carry distance for Club No. 2 and Club No. 3 were generally similar at the center location and the heel location, but higher than the ball carry distance for Club No. 1 at all five locations. As discussed herein, the greater trampoline or rebound effects provided by the back groove 3500 of Club No. 2 and the back groove 3600 of Club No. 3 may generate a larger carry distance than Club No. 1.

Figure 43:
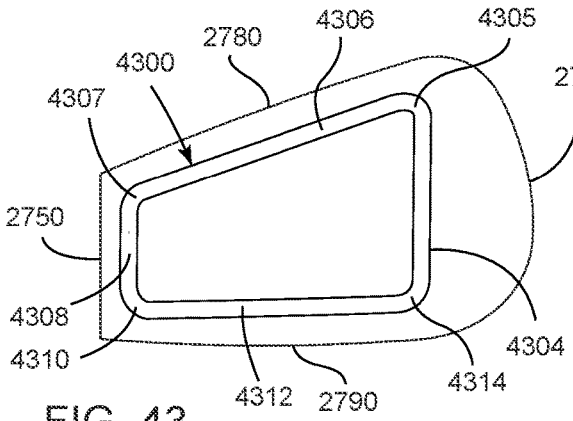
FIGS. 43, 44, 45, 46, 47, 48, 49, 50, 51, 52, 53, 54, 55, 56, 57, 58, 59, 60, 61, 62, 63, 64, 65, and 66 are face portions according to several embodiments of the apparatus, methods, and articles of manufacture described herein.

The configuration of a back groove on the back surface 2066 of the face portion 2062 may affect performance characteristics of a golf club. Accordingly, certain performance characteristic for a golf club may be achieved by different groove configurations. In one example, as illustrated in FIG. 43, the face portion 2062 may include a back groove 4300 having a first portion 4304, a first transition portion 4305, a second portion 4306, a second transition portion 4307, a third portion 4308, a third transition portion 4310, a fourth portion 4312, and a fourth transition portion 4314, all of which define a back groove 4300 that may be continuous. The back groove 4300 may be similar in many respects to the back groove 3600, except that the first portion 4304 may extend linearly between the face top edge 2780 and the face sole edge 2790 instead of following the contour of the face toe edge 2740 as illustrated in FIG. 36. The apparatus, methods, and articles of manufacture described herein are not limited in this regard.

Figure 44:
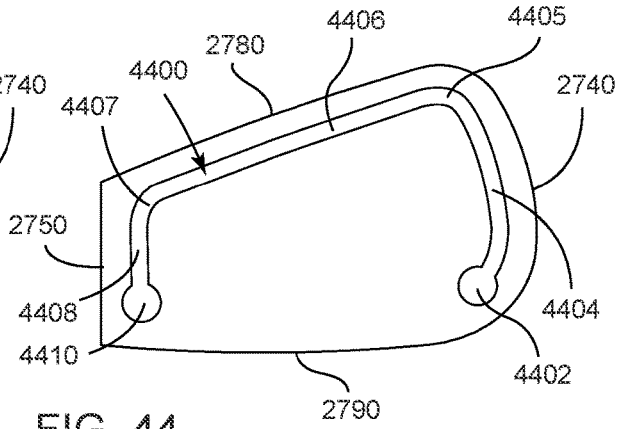

In another example, as illustrated in FIG. 44, the face portion 2062 may include a back groove 4400 having a first end portion 4402, a first portion 4404, a first transition portion 4405, a second portion 4406, a second transition portion 4407, a third portion 4408, and a second end portion 4410. The back groove 4400 may be similar in many respects to the back groove 3600, except that the first portion 4404 terminates at the first end portion 4402 located at or proximate to the face toe edge 2740 and the face sole edge 2790, and the third portion 4408 terminates at the second end portion 4410 located at or proximate to the face heel edge 2750 and the face sole edge 2790. The apparatus, methods, and articles of manufacture described herein are not limited in this regard.

Figure 45:
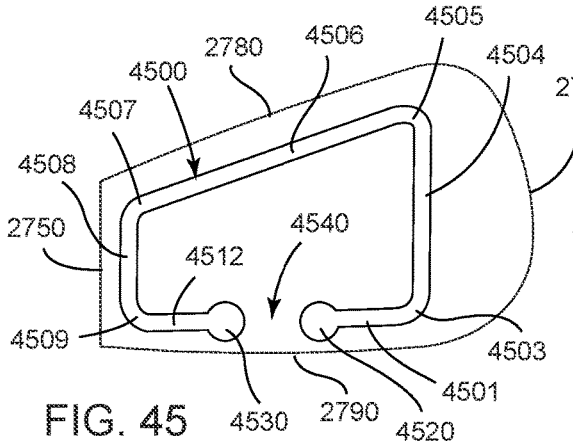

In another example, as illustrated in FIG. 45, the face portion 2062 may include a back groove 4500 having a first portion 4504, a first transition portion 4505, a second portion 4506, a second transition portion 4507, and a third portion 4508. The back groove 4500 may also include a first end portion 4520 that may be at or proximate to the face sole edge 2790 and a second end portion 4530 at or proximate to the face sole edge 2790. The first end portion 4520 may be closer to the face toe edge 2740 than to the face heel edge 2750, and the second end portion 4530 may be closer to the face heel edge 2750 than to the face toe edge 2740. The back groove 4500 may further include a fourth portion 4501 that extends from the first end portion 4520 toward the face toe edge 2740 and to a third transition portion 4503 that connects the fourth portion 4501 to the first portion 4504, and a fifth portion 4512 that extends from the second end portion 4530 toward the face heel edge 2750 and to a fourth transition portion 4509 that connects the fifth portion 4512 to the third portion 4508. Accordingly, the back groove 4500 may be partially similar in configuration to the back groove 3500 and extend continuously on the back surface 2066 of the face portion 2062 except for a discontinuity defined by a gap 4540 between the first end portion 4520 and the second end portion 4530. The apparatus, methods, and articles of manufacture described herein are not limited in this regard.

Figure 46:
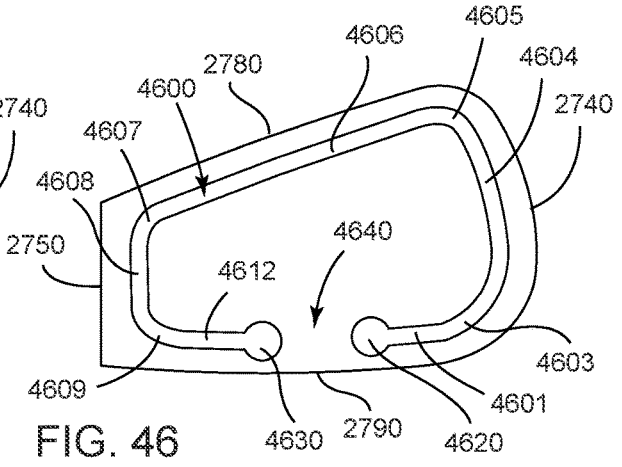

In another example, as illustrated in FIG. 46, the face portion 2062 may include a back groove 4600 having a first portion 4604, a first transition portion 4605, a second portion 4606, a second transition portion 4607, and a third portion 4608. The back groove 4600 may also include a first end portion 4620 that may be at or proximate to the face sole edge 2790 and a second end portion 4630 at or proximate to the face sole edge 2790. The first end portion 4620 may be closer to the face toe edge 2740 than to the face heel edge 2750, and the second end portion 4630 may be closer to the face heel edge 2750 than to the face toe edge 2740. The back groove 4600 may further include a fourth portion 4601 that extends from the first end portion 4620 toward the face toe edge 2740 and to a third transition portion 4603 that connects the fourth portion 4601 to the first portion 4604, and a fifth portion 4612 that extends from the second end portion 4630 toward the face heel edge 2750 and to a fourth transition portion 4609 that connects the fifth portion 4612 to the third portion 4608. Accordingly, the back groove 4600 may be partially similar in configuration to the back groove 3600 and extend continuously on the back surface 2066 of the face portion 2062 except for a discontinuity defined by a gap 4640 between the first end portion 4620 and the second end portion 4630. The apparatus, methods, and articles of manufacture described herein are not limited in this regard.

Figure 47:
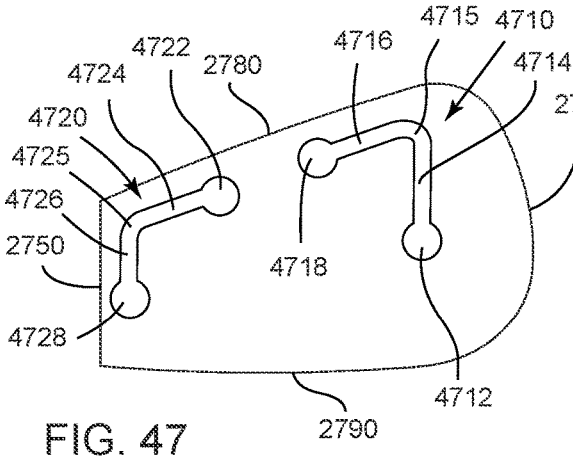

In another example, as illustrated in FIG. 47, the face portion 2062 may include a first back groove 4710 and a second back groove 4720. The first back groove 4710 may include a first end portion 4712, a first portion 4714, a transition portion 4715, a second portion 4716, and a second end portion 4718. The first back groove 4710 may be closer to the face toe edge 2740 than to the face heel edge 2750. The second back groove 4720 may include a first end portion 4722, a first portion 4724, a transition portion 4725, a second portion 4726, and a second end portion 4728. The second back groove 4720 may be closer to the face heel edge 2750 than to the face toe edge 2740. Further, all or significant portions of the first back groove 4710 and the second back groove 4720 may be closer to the face top edge 2780 than to the face sole edge 2790. The apparatus, methods, and articles of manufacture described herein are not limited in this regard.

Figure 48:
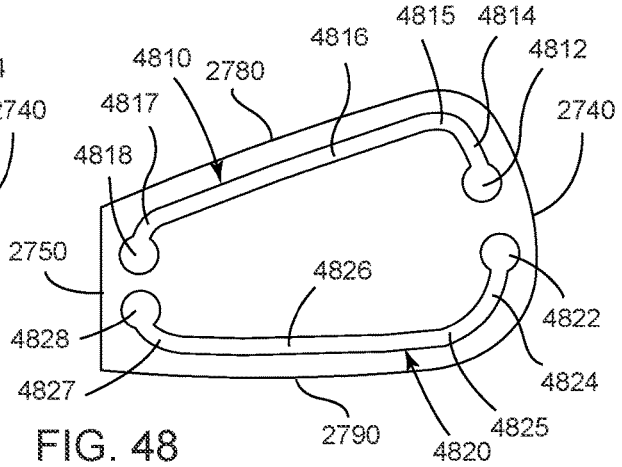

In another example, as illustrated in FIG. 48, the face portion 2062 may include a first back groove 4810 and a second back groove 4820. The first back groove 4810 may include a first end portion 4812, a first portion 4814, a first transition portion 4815, a second portion 4816, a second transition portion 4817, and a second end portion 4818. The first back groove 4810 may be closer to the face top edge 2780 than to the face sole edge 2790. The second back groove 4820 may include a first end portion 4822, a first portion 4824, a transition portion 4825, a second portion 4826, a second transition portion 4827, and a second end portion 4828. The second back groove 4820 may be closer to the face sole edge 2790 than to the face top edge 2780. Further, each of the first back groove 4810 and the second back groove 4820 may extend from a location at or proximate to the face toe edge 2740 to a location at or proximate to the face heel edge 2750. The first back groove 4810 may be proximate to and follow the contours of the face toe edge 2740, the face top edge 2780, and the face heel edge 2750. The second back groove 4820 may be proximate to and follow the contours of the face toe edge 2740, the face sole edge 2790, and the face heel edge 2750. The apparatus, methods, and articles of manufacture described herein are not limited in this regard.

In another example, as illustrated in FIG. 49, the face portion 2062 may include a back groove 4900, which may be similar in many respects to the back groove 3500 except for the first end portion 4902 and the second end portion 4910. Referring back to the illustrated example of FIG. 35, the first end portion 3502 and the second end portion 3510 may be circular and can have any diameter as described herein. In another example, as illustrated in FIG. 49, the first end portion 4902 may be circular with a larger diameter than the first end portion 3502 of FIG. 35. In another example, as illustrated in FIG. 49, the second end portion 4910 may have an obround shape (i.e., a rectangle with semicircles at opposite sides). In another example (not shown), the first end portion 4902 and/or the second end portion 4910 may have an elliptical shape. In another example (not shown), the first end portion 4902 and/or the second end portion 4910 may have a triangular shape with rounded vertices. In yet another example (not shown), the first end portion 4902, the second end portion 4910, and/or any of the back groove end portions described herein may have any shape and/or any shape without sharp corners or vertices so as to eliminate or reduce any stress concentration regions on the face portion 2062 at or proximate to the back groove. The apparatus, methods, and articles of manufacture described herein are not limited in this regard.

Figure 50:
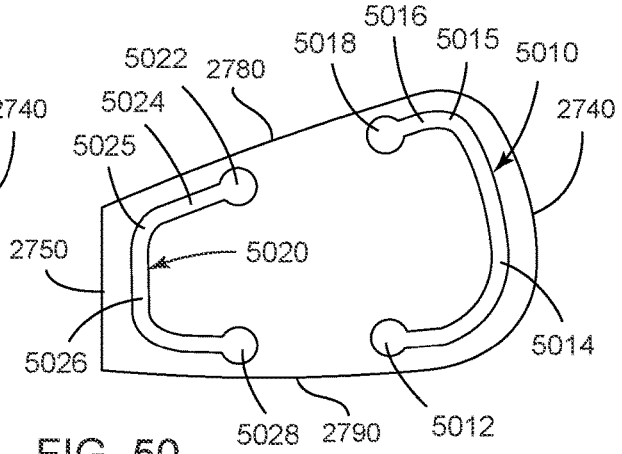

In another example, as illustrated in FIG. 50, the face portion 2062 may include a first back groove 5010 and a second back groove 5020. The first back groove 5010 may include a first end portion 5012, a first portion 5014, a first transition portion 5015, a second portion 5016, and a second end portion 5018. The first back groove 5010 may be closer to the face toe edge 2740 than to the face heel edge 2750. The second back groove 5020 may include a first end portion 5022, a first portion 5024, a transition portion 5025, a second portion 5026 and a second end portion 5028. The second back groove 5020 may be closer to the face heel edge 2750 than to the face toe edge 2740. Further, each of the first back groove 5010 and the second back groove 5020 may extend from a location at or proximate to the face top edge 2780 to a location at or proximate to the face sole edge 2790. The first back groove 5010 may be proximate to and follow the contours of the face top edge 2780, the face toe edge 2740, and the face sole edge 2790. The second back groove 5020 may be proximate to and follow the contours of the face top edge 2780, the face heel edge 2750, and the face sole edge 2790. The apparatus, methods, and articles of manufacture described herein are not limited in this regard.

Figure 51:
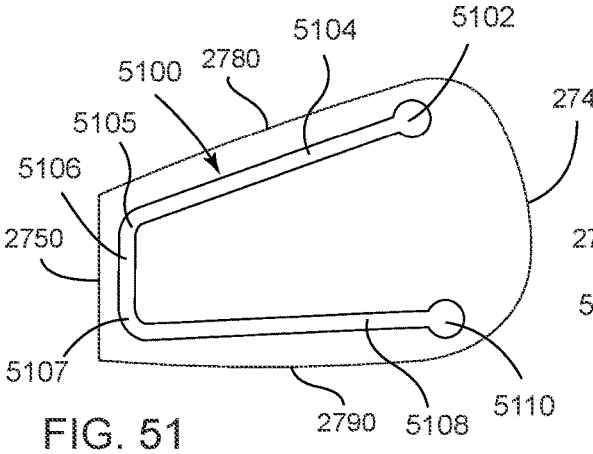

In another example, as illustrated in FIG. 51, the face portion 2062 may include a back groove 5100 having a first end portion 5102, a first portion 5104, a first transition portion 5105, a second portion 5106, a second transition portion 5107, a third portion 5108, and a second end portion 5110. The back groove 5100 may extend proximate to and follow the contours of the face top edge 2780, the face heel edge 2750, and the face sole edge 2790. The first end portion 5102 may be at or proximate to the face top edge 2780 and the face toe edge 2740, and the second end portion 5110 may be at or proximate to the face sole edge 2790 and the face toe edge 2740. Accordingly, the back groove 5100 may not include an elongated portion between the first end portion 5102 and the second end portion 5110 that extends in a direction from the face top edge 2780 to the face sole edge 2790 at a location at or proximate to the face toe edge 2740. The apparatus, methods, and articles of manufacture described herein are not limited in this regard.

Figure 52:
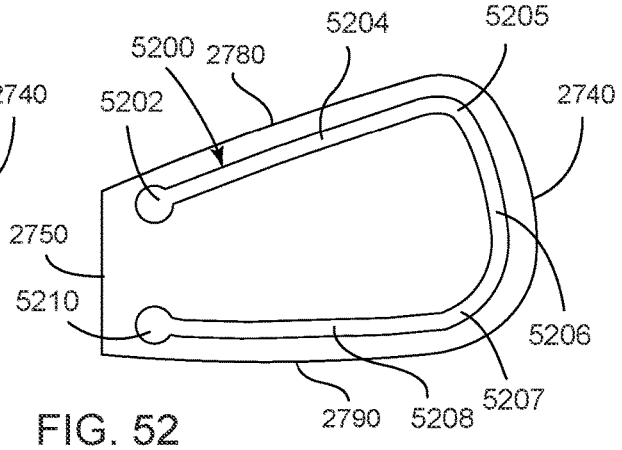

In another example, as illustrated in FIG. 52, the face portion 2062 may include a back groove 5200 having a first end portion 5202, a first portion 5204, a first transition portion 5205, a second portion 5206, a second transition portion 5207, a third portion 5208, and a second end portion 5210. The back groove 5200 may extend proximate to and follow the contours of the face top edge 2780, the face toe edge 2740, and the face sole edge 2790. The first end portion 5202 may be at or proximate to the face top edge 2780 and the face heel edge 2750, and the second end portion 5210 may be at or proximate to the face sole edge 2790 and the face heel edge 2750. Accordingly, the back groove 5200 may not include an elongated portion between the first end portion 5202 and the second end portion 5210 that extends in a direction from the face top edge 2780 to the face sole edge 2790 at a location at or proximate to the face heel edge 2750. The apparatus, methods, and articles of manufacture described herein are not limited in this regard.

Figure 53:
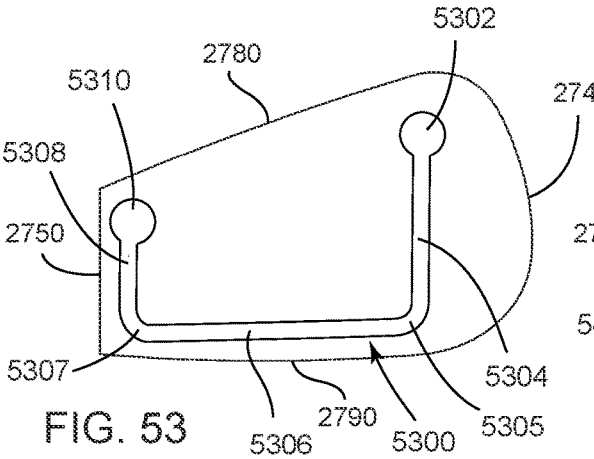

In another example, as illustrated in FIG. 53, the face portion 2062 may include a back groove 5300 having a first end portion 5302, a first portion 5304, a first transition portion 5305, a second portion 5306, a second transition portion 5307, a third portion 5308, and a second end portion 5310. The back groove 5300 may extend proximate to the face toe edge 2740, the face sole edge 2790, and the face heel edge 2750. The first end portion 5302 may be at or proximate to the face top edge 2780 and the face toe edge 2740, and the second end portion 5310 may be at or proximate to the face top edge 2780 and the face toe edge 2740. Accordingly, the back groove 5300 may not include an elongated portion between the first end portion 5302 and the second end portion 5310 that extends in a direction from the face toe edge 2740 to the face heel edge 2750 at a location at or proximate to the face top edge 2780. As illustrated in FIG. 53, the back groove 5300 may be similar in many respects to the back groove 3500 but may be in an inverted configuration on the back surface 2066 of the face portion 2062 as compared to the back groove 3500. The apparatus, methods, and articles of manufacture described herein are not limited in this regard.

Figure 54:
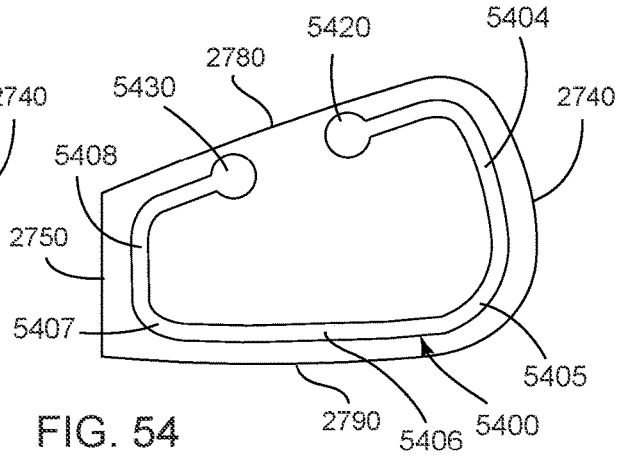

In another example, as illustrated in FIG. 54, the face portion 2062 may include a back groove 5400 having a first portion 5404, a first transition portion 5405, a second portion 5406, a second transition portion 5407, and a third portion 5408. The back groove 5400 may also include a first end portion 5420 that may be at or proximate to the face top edge 2780 and a second end portion 5430 at or proximate to the face top edge 2780. The first end portion 5420 may be closer to the face toe edge 2740 than to the face heel edge 2750, and the second end portion 5430 may be closer to the face heel edge 2750 than to the face toe edge 2740. As illustrated in FIG. 54, the back groove 5400 may be similar in many respects to the back groove 4600 but may be in an inverted configuration on the back surface 2066 of the face portion 2062 as compared to the back groove 4600. The apparatus, methods, and articles of manufacture described herein are not limited in this regard.

Figure 55:
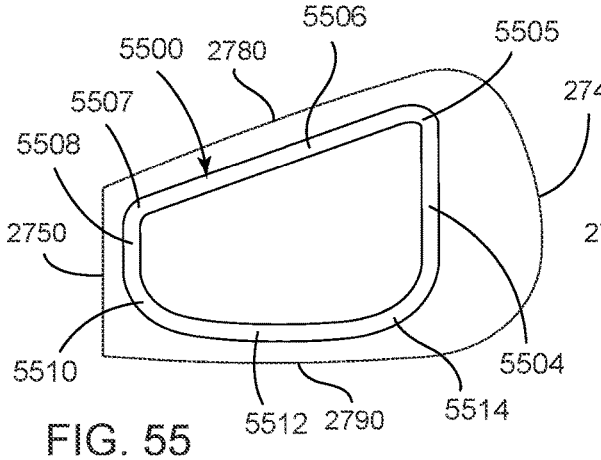

In one example, as illustrated in FIG. 55, the face portion 2062 may include a back groove 5500 having a first portion 5504, a first transition portion 5505, a second portion 5506, a second transition portion 5507, a third portion 5508, and a third transition portion 5510, a fourth portion 5512, and a fourth transition portion 5514, all of which may define a back groove 5500 that may be continuous. The back groove 5500 may be similar in many respects to the back groove 4300, except that the fourth portion 5512 may have a convex shape relative to the face sole edge 2790. The apparatus, methods, and articles of manufacture described herein are not limited in this regard.

Figure 56:
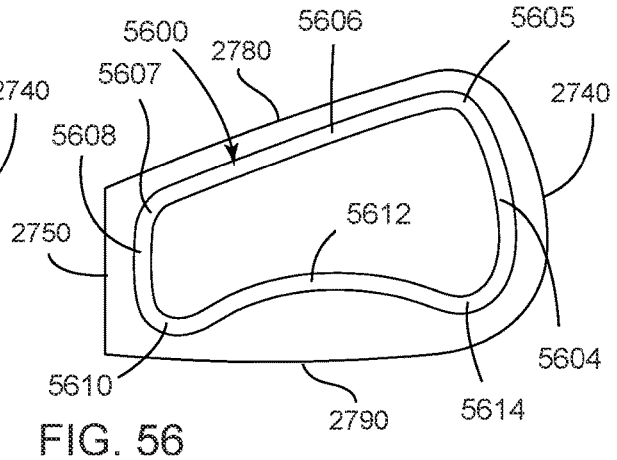

In one example, as illustrated in FIG. 56, the face portion 2062 may include a back groove 5600 having a first portion 5604, a first transition portion 5605, a second portion 5606, a second transition portion 5607, a third portion 5608, and a third transition portion 5610, a fourth portion 5612, and a fourth transition portion 5614, all of which may define a continuous back groove 5600. The back groove 5600 may be similar in many respects to the back groove 3600, except that the fourth portion 5612 may have a concave shape relative to the face sole edge 2790. The apparatus, methods, and articles of manufacture described herein are not limited in this regard.

Figure 57:
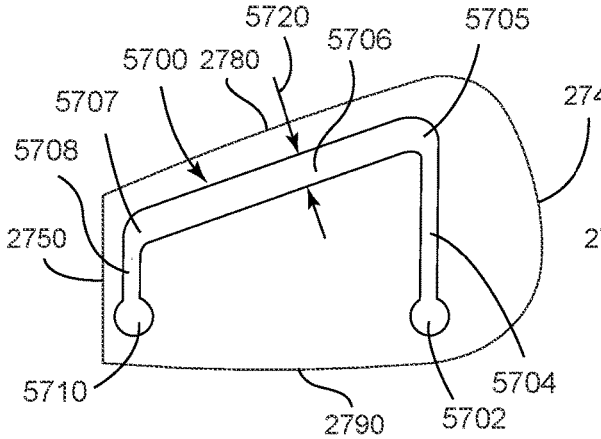

In another example, as illustrated in FIG. 57, the face portion 2062 may include a back groove 5700 having a first end portion 5702, a first portion 5704, a first transition portion 5705, a second portion 5706, a second transition portion 5707, a third portion 5708, and a second end portion 5710. The back groove 5700 may be similar in many respects to the back groove 3500, except that the back groove width 5720 of the second portion 5706 may be greater than the back groove width 5720 of the remaining portions of the back groove 5700. In another example, any one or more of the first portion 5704, the second portion 5706, and the third portion 5708 may have similar or different back groove widths and/or back groove depths. Any of the back grooves described herein may have portions with different or similar back groove widths and/or back groove depths. The apparatus, methods, and articles of manufacture described herein are not limited in this regard.

Figure 58:
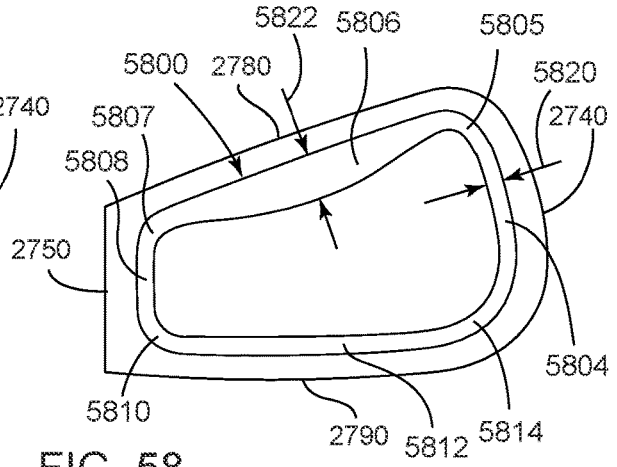

In another example, as illustrated in FIG. 58, the face portion 2062 may include a back groove 5800 having a first portion 5804, a first transition portion 5805, a second portion 5806, a second transition portion 5807, a third portion 5808, a third transition portion 5810, a fourth portion 5812, and a fourth transition portion 5814, all of which may define a back groove 5800 that may be continuous. The back groove 5800 may be similar in many respects to the back groove 3600, except that the back groove width 5820 of the second portion 5806 may vary between the first transition portion 5805 and the second transition portion 5807. As illustrated in the example of FIG. 58, the back groove width 5820 may gradually increase from the first transition portion 5805 in a direction toward the second transition portion 5807 to a maximum back groove width 5822 and may gradually decrease from the location of the maximum back groove width 5822 in a direction toward the second transition portion 5807. Any portion of any of the back grooves described herein may have portions with different or similar back groove widths and/or back groove depths that may increase, decrease in a continuous (i.e., gradual), or discrete manner (i.e., increase or decrease in steps). The apparatus, methods, and articles of manufacture described herein are not limited in this regard.

In another example, as illustrated in FIG. 59, the face portion 2062 may include a first back groove 5900 and a second back groove 5950. The first back groove 5900 may include a first end portion 5902, a first portion 5904, a first transition portion 5905, a second portion 5906, a second transition portion 5907, a third portion 5908, and a second end portion 5910. The first back groove 5900 may be similar in many respects to the back groove 3500. The second back groove 5950 may extend between the first end portion 5902 and the second end portion 5910 and include a second groove first end portion 5952, a second groove portion 5954, and a second groove second end portion 5960. The second groove first end portion 5952 may be proximate to the first end portion 5902, and the second groove second end portion 5960 may be proximate to the second end portion 5910. FIG. 59 illustrates an example of multiple back grooves disposed on the back surface 2066 of the face portion 2062 with different configurations. The apparatus, methods, and articles of manufacture described herein are not limited in this regard.

Figure 60:
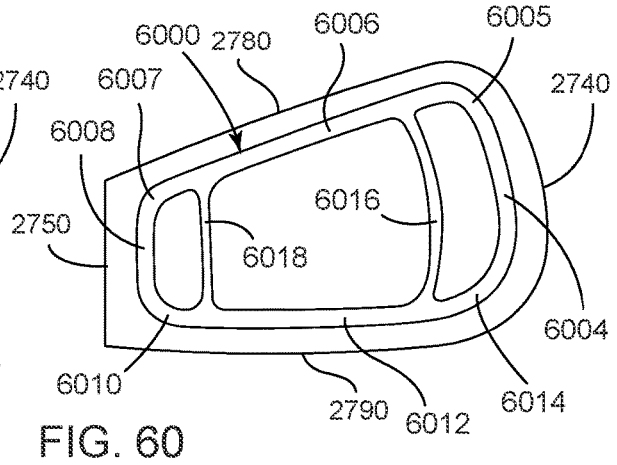

In another example, as illustrated in FIG. 60, the face portion 2062 may include a back groove 6000 having a first portion 6004, a first transition portion 6005, a second portion 6006, a second transition portion 6007, a third portion 6008, a third transition portion 6010, a fourth portion 6012, and a fourth transition portion 6014, all of which may define a continuous back groove 6000. The back groove 6000 may be similar in many respects to the back groove 6000, and further include a fifth portion 6016 and a sixth portion 6018, both of which may be located between the first portion 6004 and the third portion 6008 and extend from the second portion 6006 to the fourth portion 6012. The fifth portion 6016 may be closer to the face toe edge 2740 than to the face heel edge 2750. The sixth portion 6018 may be closer to the face heel edge 2750 than to the face toe edge 2740. The back groove 6000 may include any groove portions extending between and/or connecting any two adjacent or opposing pairs of the first portion 6004, the first transition portion 6005, the second portion 6006, the second transition portion 6007, the third portion 6008, the third transition portion 6010, the fourth portion 6012, and/or the fourth transition portion 6014. The apparatus, methods, and articles of manufacture described herein are not limited in this regard.

Figure 61:
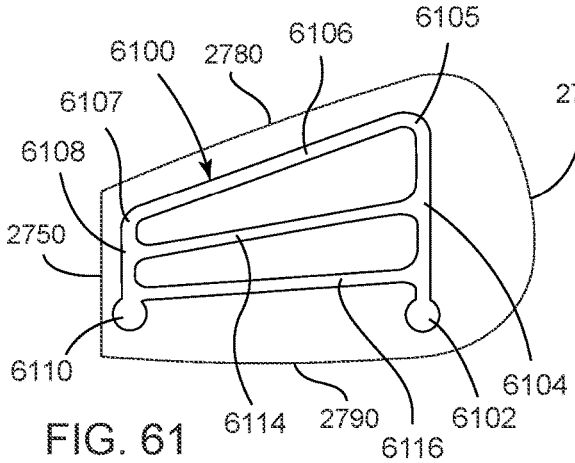

In another example, as illustrated in FIG. 61, the face portion 2062 may include a back groove 6100 having a first end portion 6102, a first portion 6104, a first transition portion 6105, a second portion 6106, a second transition portion 6107, a third portion 6108, and a second end portion 6110. The back groove 5700 may be similar in many respects to the back groove 3500, and further include a fifth portion 6114 and a sixth portion 6116, both of which may be located between the second portion 6106 and the face sole edge 2790 and extend from the first portion 6104 and the third portion 6108. The fifth portion 6114 may be closer to the face top edge 2780 than to the face sole edge 2700. The sixth portion 6116 may be closer to the face sole edge 2790 than to the face top edge 2780. The back groove 6100 may include any groove portions extending between and/or connecting any two adjacent or opposing pairs of the first end portion 6102, the first portion 6104, the first transition portion 6105, the second portion 6106, the second transition portion 6107, the third portion 6108, and/or the second end portion 6110. The apparatus, methods, and articles of manufacture described herein are not limited in this regard.

Figure 62:
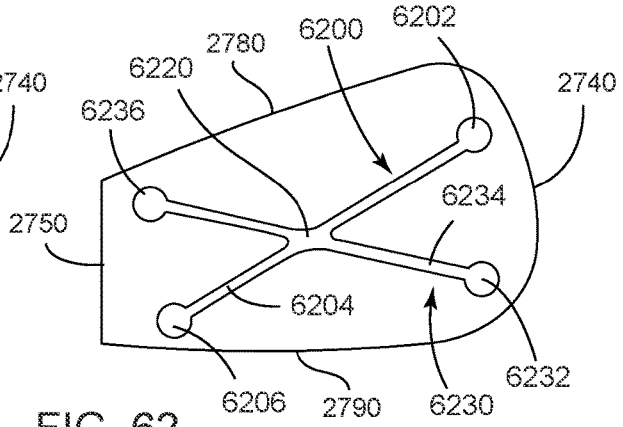

In another example, as illustrated in FIG. 62, the face portion 2062 may include a first back groove 6200 and the second back groove 6230. The first back groove 6200 may extend diagonally on the back surface 2066 of the face portion 2062 and include a first end portion 6202 located proximate to the face toe edge 2740 and the face top edge 2780, a second end portion 6206 located proximate to the face heel edge 2750 and the face sole edge 2790, and a groove portion 6204 connecting the first end portion 6202 and the second end portion 6206. The second back groove 6230 may extend diagonally on the back surface 2066 of the face portion 2062 and include a first end portion 6232 located proximate to the face toe edge 2740 and the face sole edge 2790, a second end portion 6236 located proximate to the face heel edge 2750 and the face top edge 2780, and a groove portion 6234 connecting the first end portion 6232 and the second end portion 6236. The groove portion 6204 of the first back groove 6200 and the groove portion 6234 of the second back groove 6230 may intersect at a common groove portion 6220 that may be located at or proximate to a center region of the face portion 2062. The apparatus, methods, and articles of manufacture described herein are not limited in this regard.

Figure 63:
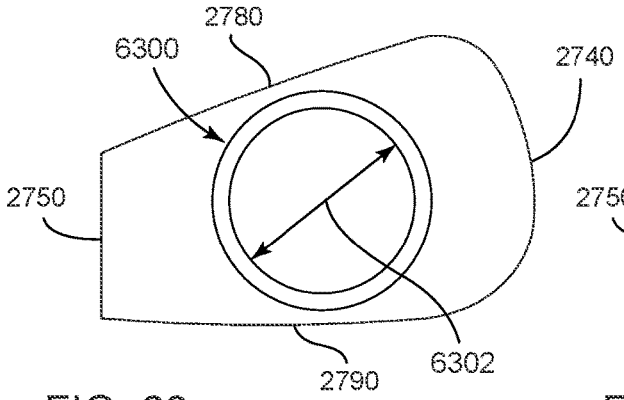

In another example, as illustrated in FIG. 63, the face portion 2062 may include a back groove 6300 that may be circular having an inner diameter 6302 that may be within the boundaries of the face portion 2062 as defined by the face toe edge 2740, the face heel edge 2750, the face top edge 2780, and the face sole edge 2790. The back groove 6300 may be located at a center region of the face portion 2062 as illustrated in the example of FIG. 63. In another example the back groove 6300 may be at any location on the back surface 2066 of the face portion 2062. In another example, the back groove 6300 may include a plurality separate or overlapping circular grooves on the back surface 2066 of the face portion. In yet another example, the back groove 6300 may include a plurality separate and concentric circular grooves on the back surface 2066 of the face portion. The apparatus, methods, and articles of manufacture described herein are not limited in this regard.

Figure 64:
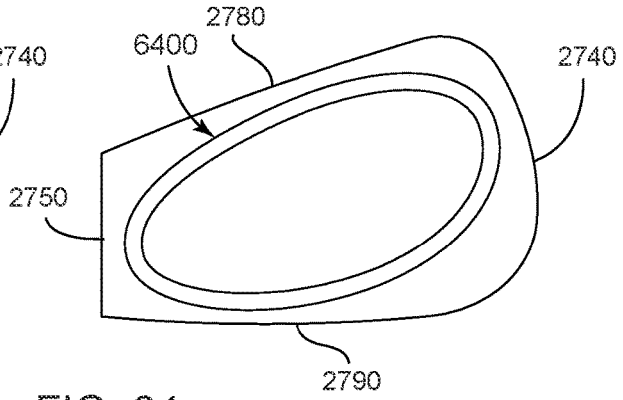

In another example, as illustrated in FIG. 64, the face portion 2062 may include a back groove 6400 that may be elliptical and located within the boundaries of the face portion 2062 as defined by the face toe edge 2740, the face heel edge 2750, the face top edge 2780, and the face sole edge 2790. A center portion of the back groove 6400 may be located at a center region of the face portion 2062 as illustrated in the example of FIG. 64. In another example the back groove 6400 may be at any location on the back surface 2066 of the face portion 2062. In another example, the back groove 6400 may include a plurality of separate or overlapping elliptical grooves on the back surface 2066 of the face portion. In yet another example, the back groove 6400 may include a plurality of separate or concentric or nested elliptical grooves on the back surface 2066 of the face portion. The apparatus, methods, and articles of manufacture described herein are not limited in this regard.

In another example, as illustrated in FIG. 65, the face portion 2062 may include a back groove 6500 having a first portion 6504, a first transition portion 6505, a second portion 6506, a second transition portion 6507, and a third portion 6508. The back groove 6500 may be similar in many respects to the back groove 3500, except that the back groove 6500 may not include the first end portion 3502 and the second end portion 3510 of the back groove 3500. The first portion 6504 and the third portion 6508 extend to the face sole edge 2790. Similarly, any portion of any of the back grooves discussed herein may extend to the face toe edge 2740, the face heel edge 2750, the face top edge 2780, or the face sole edge 2790. The apparatus, methods, and articles of manufacture described herein are not limited in this regard.

In yet another example, as illustrated in FIG. 66, the face portion 2062 may include a back groove 6600 having a curved shape that may be concave relative to the face sole edge 2790. The back groove 6600 may be continuous and extend from a first groove end 6602 at the face sole edge 2790 and proximate to the face toe edge 2740 to a second groove end 6604 at the face sole edge 2790 and proximate to the face heel edge 2750. Similarly, any portion of any of the back grooves discussed herein may have any linear or curved shape and extend to the face toe edge 2740, the face heel edge 2750, the face top edge 2780, or the face sole edge 2790. The apparatus, methods, and articles of manufacture described herein are not limited in this regard.

Any one or more of the back grooves illustrated in examples of FIGS. 13, 35, 36, and 43-66, or any one or more portions of the back grooves illustrated in examples of FIGS. 13, 35, 36, and 43-66 may be combined to provide other back groove configurations. In one example, the back surface 2066 of the face portion 2062 may include any one or both of the back grooves 6200 and 6230 of FIG. 62 in combination with the back groove 64 of FIG. 64. In another example, the back surface 2066 of the face portion 2062 may include the back groove 3600 of FIG. 36 and the back groove 6300 of FIG. 63. In another example, the back surface 2066 of the face portion 2062 may include the first back groove 4710 and the second back groove 4720 of FIG. 47 and the back groove 5950 of FIG. 59. In another example, the back surface 2066 of the face portion 2062 may include the back groove 6500 of FIG. 65 and the back groove portion 5950 of FIG. 59. In yet another example, the back surface 2066 of the face portion 2062 may include any one or both of the first back groove 5010 and the second back groove 5020 of FIG. 50, and the back groove 6300 of FIG. 63. Thus, any one or more back grooves or any one or more portions of the back grooves discussed herein and illustrated in FIGS. 13, 35, 36, and 43-66 may be combined to provide any configuration of back groove portions on the back surface 2066 of the face portion 2062. The apparatus, methods, and articles of manufacture described herein are not limited in this regard.

As illustrated by the examples of FIGS. 13, 35, 36, and 43-66, the back surface 2066 of the face portion 2062 may have any number of back grooves with any configuration to provide certain performance characteristics for the golf club head 2000. As described herein, an area of the face portion 2062 that may be partially or fully surrounded by one or more back grooves (i.e., partially or fully bound by a back groove portion) may exhibit greater deflection than an area of the face portion 2062 that surrounds the back groove when a golf ball strikes the face portion 2062. Accordingly, certain face portion deflection characteristics may be achieved by providing certain back groove characteristics. In one example and referring back to FIG. 50, the portion of the face portion 2062 that is surrounded by the first back groove 5010 and the portion of the face portion 2062 that is surrounded by the second back groove 5020 may each have a greater deflection that a center region of the face portion 2062. In another example and referring back to FIG. 51, the portion of the face portion 2062 that is surrounded by the back groove 5100 may have a greater deflection at a location that is closer to the face heel edge 2750 than the portion of the back groove 5100 that is closer to the face toe edge 2740. In another example, and referring back to FIG. 54, the portion of the face portion 2062 that is surrounded by the back groove 5400 may have a greater deflection at a location that is closer to the face sole edge 2790 than a portion of the back groove 5400 that is closer to the face top edge 2780. In yet another example and referring back to FIG. 62, the greatest deflection of the face portion 2062 may be at or proximate to the common groove portion 6220. Accordingly, each of the back groove configurations illustrated in the examples of FIGS. 13, 35, 36, and 43-66 may provide a certain performance characteristic for a golf club head. The apparatus, methods, and articles of manufacture described herein are not limited in this regard.

The golf club head 2000 may be manufactured by any of the methods described herein, such as the method illustrated in FIG. 14, or the methods described in any of the incorporated by reference patent documents. The back groove may be manufactured with the face portion or formed on the face portion after manufacturing the face portion by any method of creating grooves, channels, slots, slits, depressions, dimples, recesses, or in general reducing a thickness of a portion of an object. For example, the back groove may be machined on the back surface of the face portion. The apparatus, methods, and articles of manufacture described herein are not limited in this regard.

In the example of FIGS. 67-87, a golf club head 6700 may include a body portion 6710 having a toe portion 6740 with a toe portion edge 6742, a heel portion 6750 with a heel portion edge 6752 that may include a hosel portion 6755. A golf club shaft (such as the shaft 104 that is illustrated for example in FIG. 1) may include one end coupled to the hosel portion 6755, and an opposite end coupled to a golf club grip (such as the grip 106 that is illustrated for example in FIG. 1) to form a golf club (such as the golf club 100 that is illustrated for example in FIG. 1). The body portion 6710 may further include a front portion 6760, a back portion 6770 with a back wall portion 6772, a top portion 6780 with a top portion edge 6782, and a sole portion 6790 with a sole portion edge 6792. The toe portion 6740, the heel portion 6750, the front portion 6760, the back portion 6770, the top portion 6780, and/or the sole portion 6790 may partially overlap. The toe portion edge 6742, the heel portion edge 6752, the top portion edge 6782, and the sole portion edge 6792 may define a periphery of the body portion 6710. The golf club head 6700 may be any type of golf club head described herein, such as, for example, an iron-type golf club head or a wedge-type golf club head. The volume of the golf club head 6700, the materials of construction of the golf club head 6700, and/or any components thereof may be similar to any of the golf club heads described herein and/or described in any of the incorporated by reference patent documents. The apparatus, methods, and articles of manufacture described herein are not limited in this regard.

The golf club head 6700 may include a face portion 6762 (i.e., the strike face), which may be integrally formed with the body portion 6710 (e.g., a single unitary piece). In one example, as illustrated in FIGS. 67-87, the face portion 6762 may be a separate piece coupled (e.g., directly or indirectly, adhesively, mechanically, by welding, and/or by soldering) to the front portion 6760 to close a front opening of the front portion 6760. The face portion 6762 may include a front surface 6764 and a back surface 6766. The front surface 6764 may include a plurality of front grooves 6768 that may extend between the toe portion 6740 and the heel portion 6750. The front grooves 6768 may be similar in many respects to the front grooves 2068 of the golf club head 2000 or similar to the front grooves of any of the golf club heads described herein or described in any of the incorporated by reference patent documents. The back surface 6766 of the face portion 6762 may include one or more grooves, slots, channels, depressions, or recesses. In one example, the grooves on the back surface 6766 may be similar in many respects to the back grooves of the golf club head 2000, such as the back grooves illustrated in FIGS. 35-38 and 43-66. In another example, the back surface 6766 may not include any grooves, slots, channels, depressions, or recesses. The apparatus, methods, and articles of manufacture described herein are not limited in this regard.

The golf club head 6700 may be associated with a ground plane 7110, a horizontal midplane 7120, and a top plane 7130. In particular, the ground plane 7110 may be a plane that is parallel or substantially parallel to the ground and is tangent to the lowest portion of the sole portion edge 6792 when the golf club head 6700 is at an address position (e.g., the golf club head 6700 aligned to strike a golf ball). A top plane 7130 may be a plane that is tangent to the upper most portion of top portion edge 6782 when the golf club head 6700 is at the address position. The ground plane 7110 and the top plane 7130 may be parallel or substantially parallel. The horizontal midplane 7120 may be vertically halfway between the ground plane 7110 and the top plane 7130, respectively, and be parallel or substantially parallel to the ground plane 7110. Further, the golf club head 6700 may be associated with a loft plane 7140 defining a loft angle 7145 ($\alpha$) of the golf club head 6700. The loft plane 7140 may be a plane that is tangent to or coplanar with the face portion 6762. The loft angle 7145 may be defined by an angle between the loft plane 7140 and a vertical plane 7150 that is normal to the ground plane 7110. The apparatus, methods, and articles of manufacture described herein are not limited in this regard.

The back wall portion 6772 may include an upper back wall portion 6820, a lower back wall portion 6822, and a ledge portion 6830 between the upper back wall portion 6820 and the lower back wall portion 6822. The ledge portion 6830 may extend outward (i.e., away from the face portion 6762) from the upper back wall portion 6820 to the lower back wall portion 6822 (i.e., the ledge portion 6830 may extend inward or toward the face portion 6762 from the lower back wall portion 6822 to the upper back wall portion 6820). The ledge portion 6830 may include a first ledge portion 6832 that may extend from a location at or proximate to the toe portion edge 6742 toward the heel portion 6750, a second ledge portion 6834 that may be located at or proximate to a center portion 6773 of the back wall portion 6772, and a third ledge portion 6836 that may extend from a location at or proximate to the heel portion edge 6752 toward the toe portion 6740. The second ledge portion 6834 may extend between the first ledge portion 6832 and the third ledge portion 6836. The first ledge portion 6832 may also extend in a downwardly inclined direction toward the sole portion 6790 as it extends from a location at or proximate to the toe portion edge 6742 to the second ledge portion 6834. The third ledge portion 6836 may also extend in a downwardly inclined direction toward the sole portion 6790 as it extends from a location at or proximate to the heel portion edge 6752 to the second ledge portion 6834. The ledge portion 6830 including the first ledge portion 6832, the second ledge portion 6834, and the third ledge portion 6836 may be similar in many respects (e.g., height, width, orientation, configurations of any sidewall portions, configurations of any ledge portion transition portions, etc.) to the ledge portion 2130 including the first ledge portion 2132, the second ledge portion 2134, and the third ledge portion 2136, respectively, of the golf club head 2000. The ledge portion 6830 may be similar in many respects to any of the ledge portions described herein or described in any of the incorporated by reference patent documents. The apparatus, methods, and articles of manufacture described herein are not limited in this regard.

Figure 3:
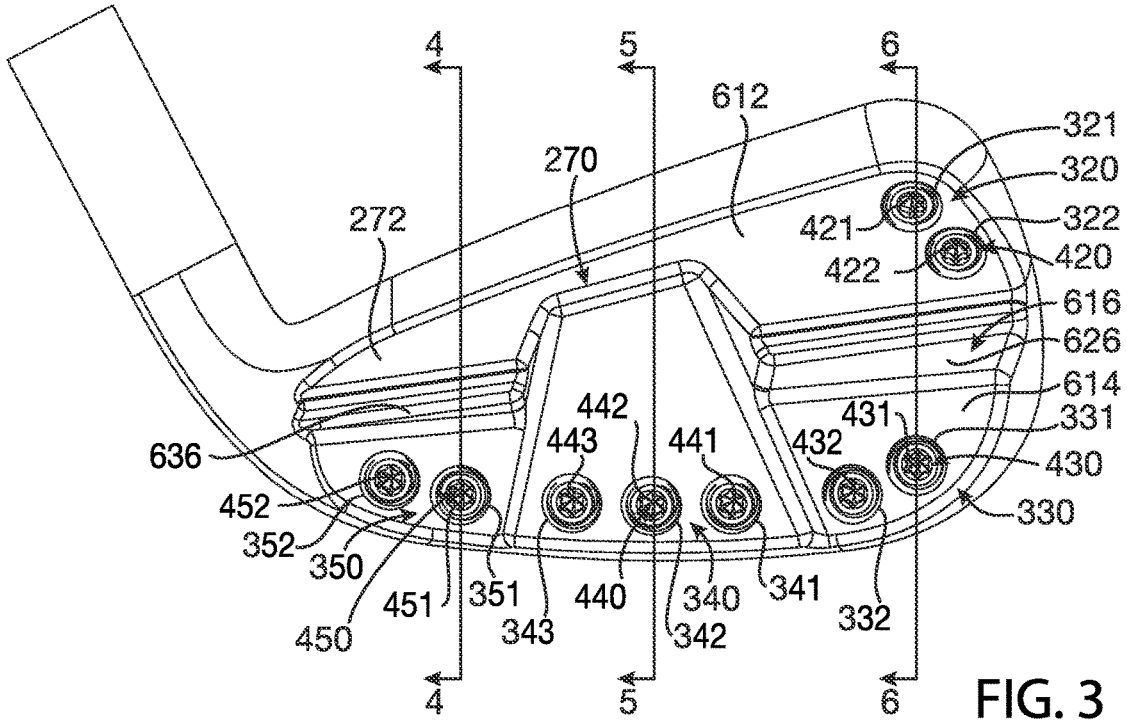
Figure 4:
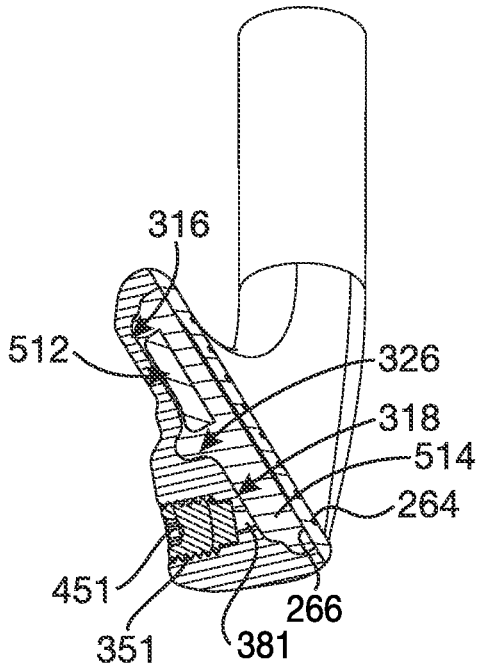
Figure 5:
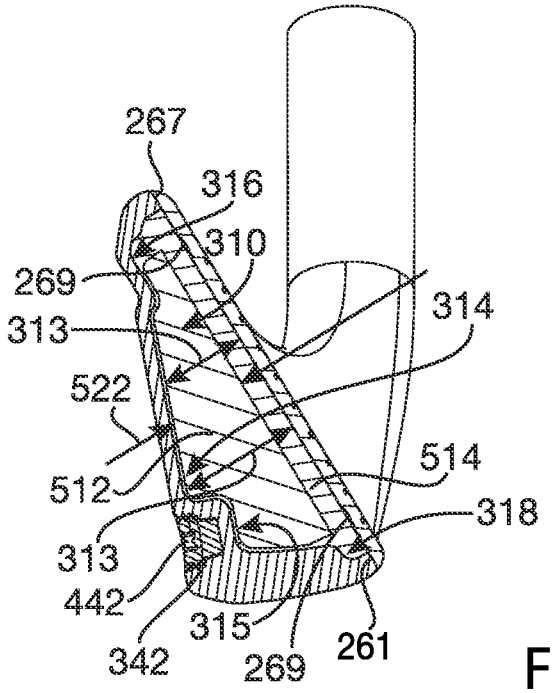
Figure 6:
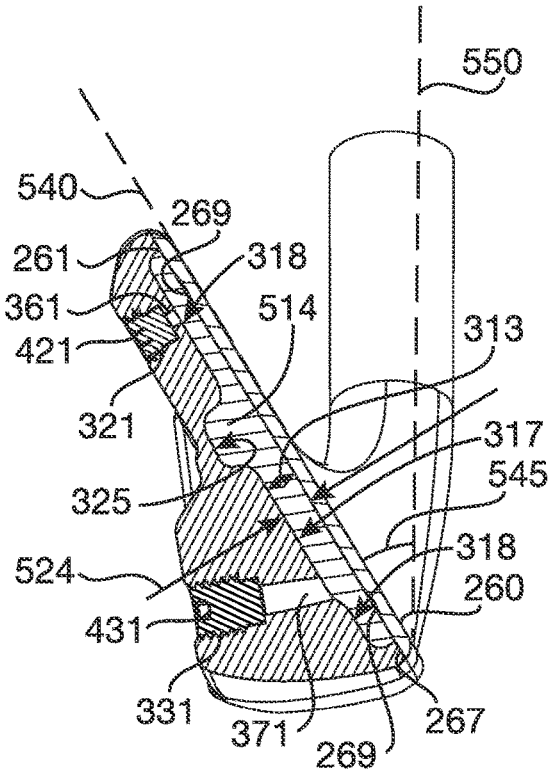
Figure 7:
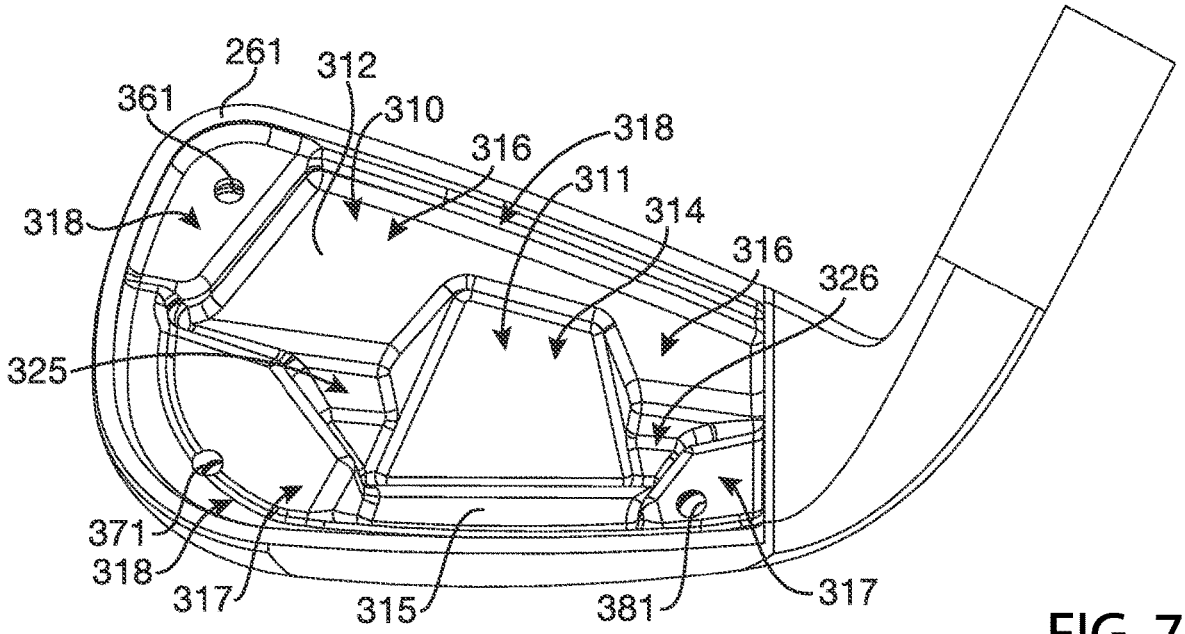
Figure 8:
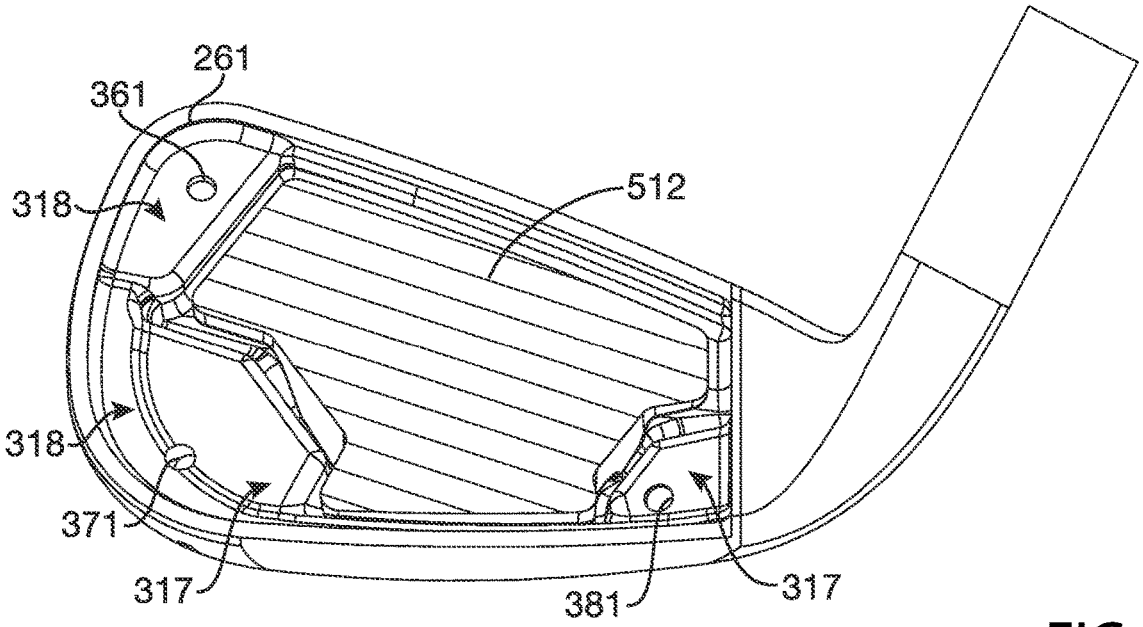
Figure 9:
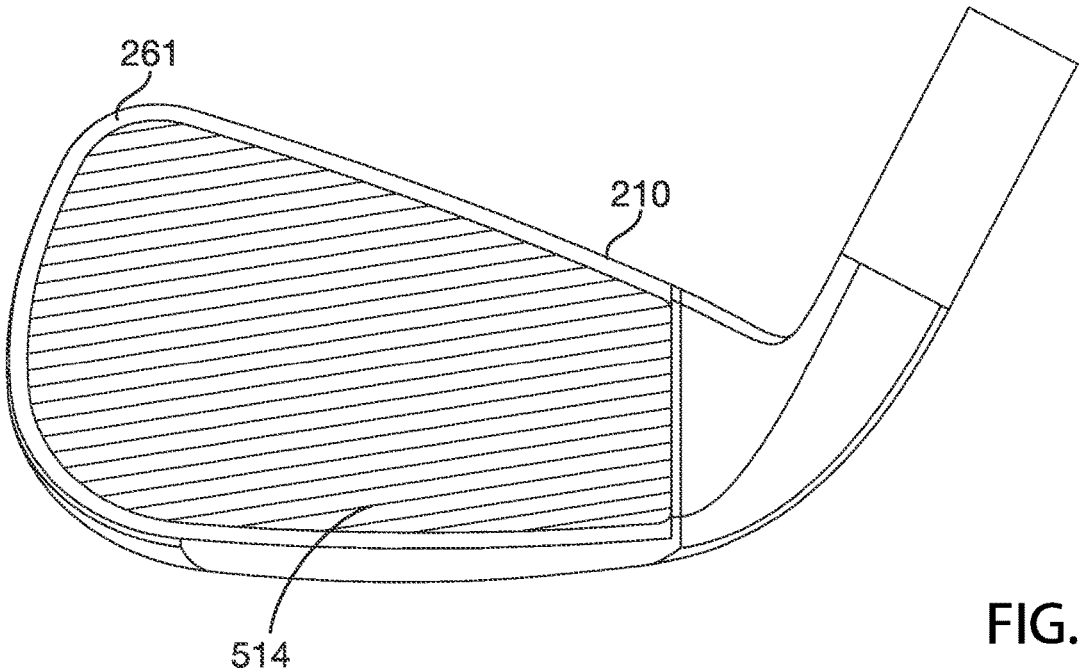
Figure 10:
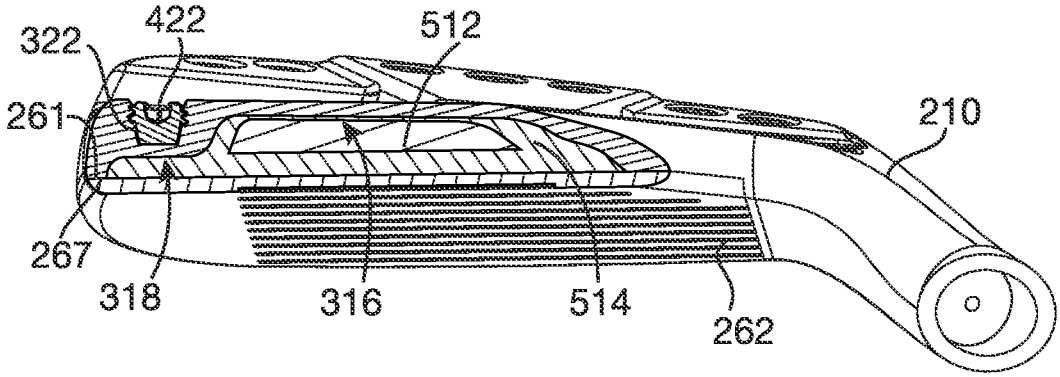
Figure 11:
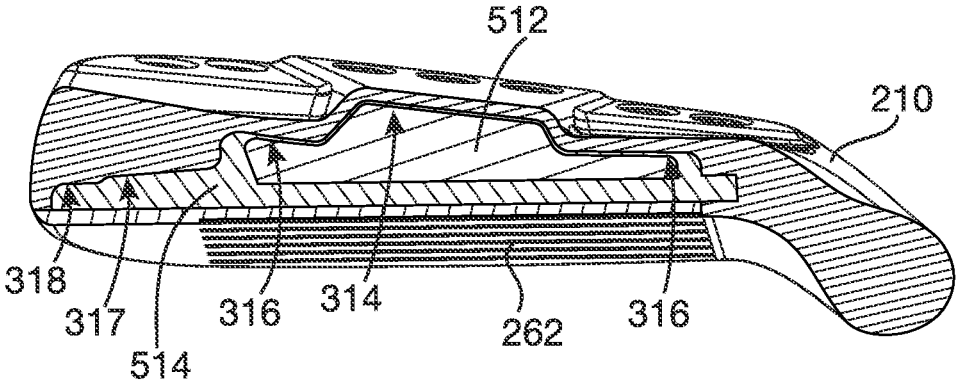
Figure 12:
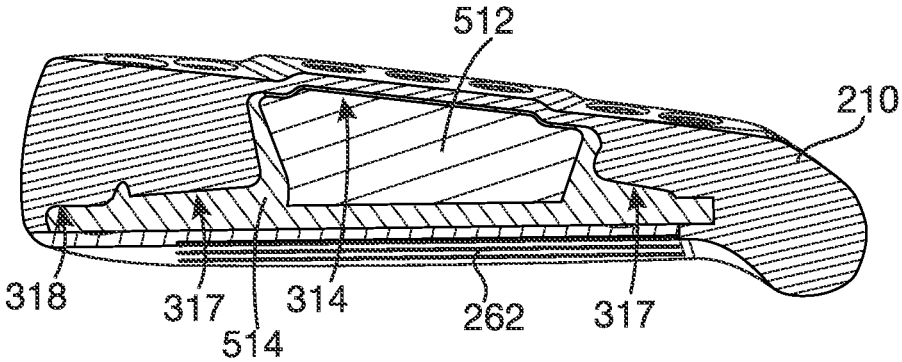
Figure 23:
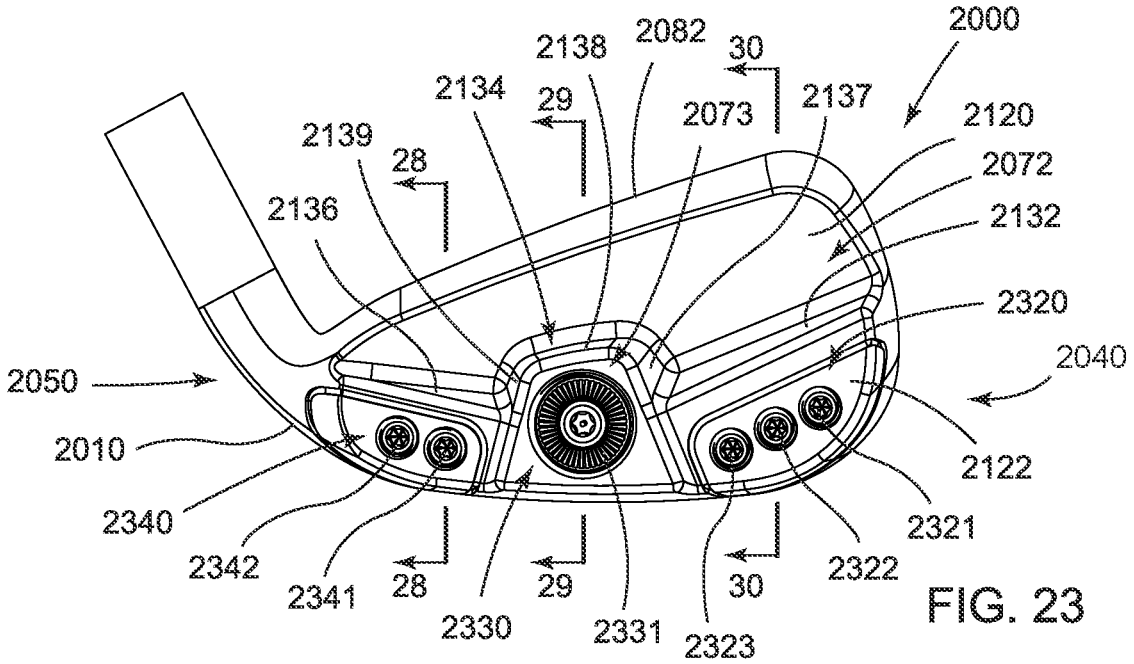
Figure 24:
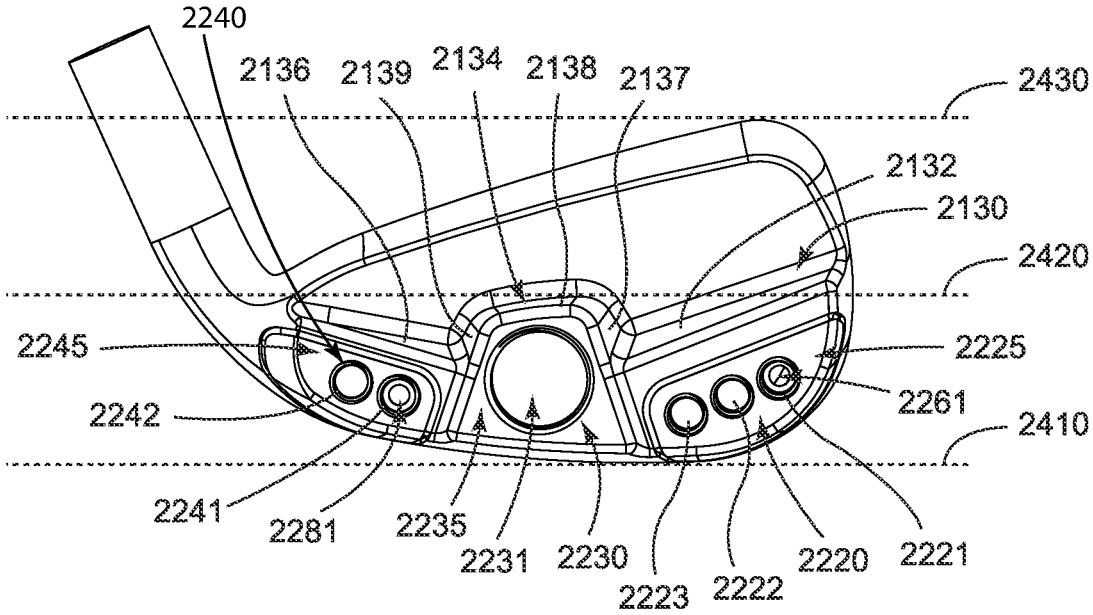
Figure 25:
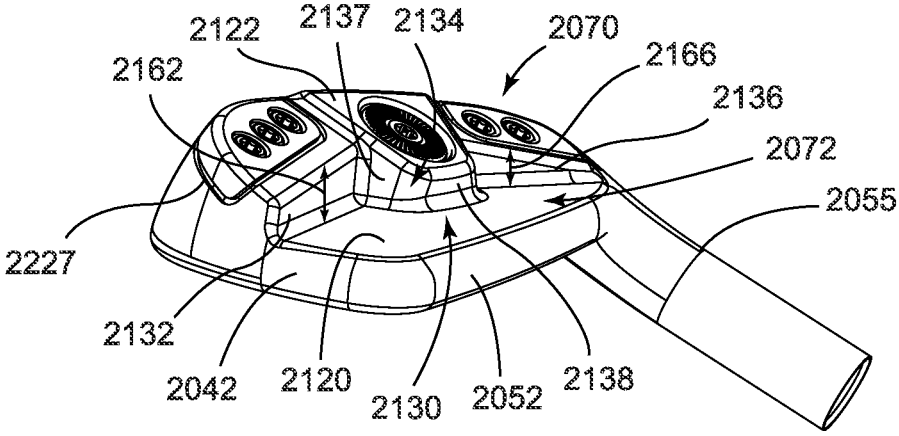
Figure 26:
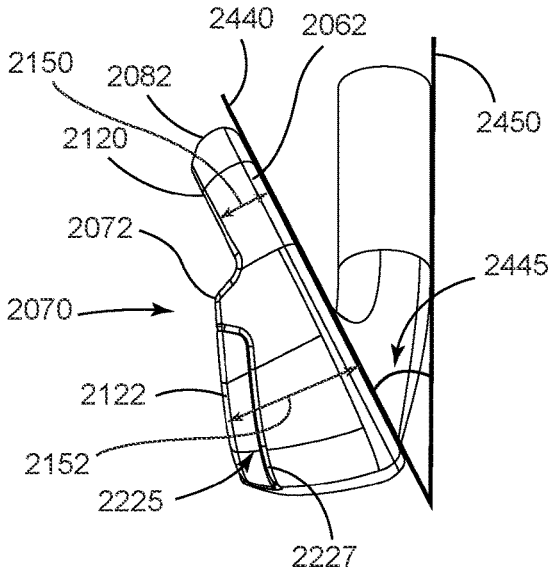
Figure 27:
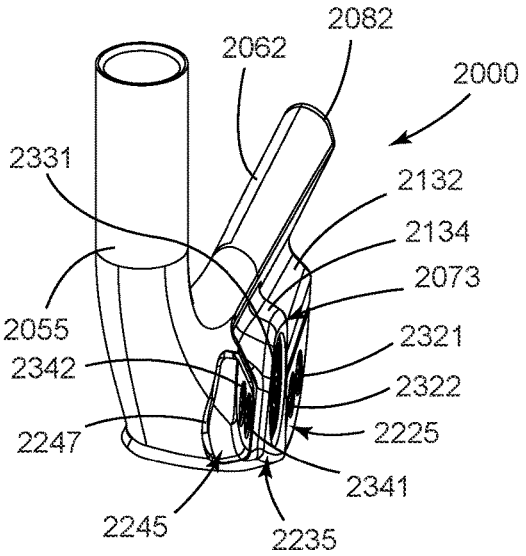

The body portion 6710 may include one or more ports, which may be exterior ports and/or interior ports (e.g., located inside the body portion 6710). The one or more ports may be at any location on the body portion 6710. The inner walls of the body portion 6710 that define the interior cavity 6810 may include one or more ports. In one example, the body portion 6710 may include ports that may be similar in many respects to the ports of the golf club head 2000 as illustrated in FIG. 23. In another example, the body portion 6710 may include ports that may be similar in many respects to the ports of the golf club head 200 as illustrated in FIG. 3. In another example, the body portion 6710 may include ports that may be similar in many respects to any of the ports described in any of the incorporated by reference patent documents. In yet another example, as illustrated in FIGS. 67-87, the body portion 6710 may include a first port 6921 above the first ledge portion 6832, a second port 6931 located below the second ledge portion 6834, and a third port 6941 in the interior cavity 6810. Accordingly, the first port 6921 and the second port 6931 may be external ports, i.e., having port openings on an external surface of the body portion 6710, whereas the third port 6941 may be an internal port having an opening on one or more internal walls of the body portion 6710 that define the interior cavity 6810. The apparatus, methods, and articles of manufacture described herein are not limited in this regard.

In one example as illustrated in FIGS. 67-87, the first port 6921 may be located above the first ledge portion 6832 and proximate to the toe portion edge 6742. In another example, the first port 6921 may be on the toe portion edge 6742. In yet another example, the first port 6921 may be below the first ledge portion 6832. The first port 6921 may have a first port opening 6926 inside a recessed portion 7026 on the upper back wall portion 6820. The first port 6921 may be cylindrical and extend from the first port opening 6926 to the interior cavity at a second port opening 6927 to connect to the interior cavity 6810. Accordingly, the first port opening 6926 may provide access to the interior cavity 6810 from outside the body portion 6710 via the second port opening 6927. As illustrated in FIGS. 67-87, the first port 6921 may have a circular cross section (i.e., cylindrical port). In another example, the first port 6921 may be elliptical. In yet another example, the first port 6921 may have any shape. In one example, as illustrated in FIGS. 67-87, the recessed portion 7026 may be configured to receive a cover portion or a badge 7028 to cover the first port opening 6926. In another example, the first port 6921 may be closed with a mass portion that may be constructed from a material having a different density than a material of the body portion 6710. In yet another example, the first port 6921 may be closed with a mass portion that may be constructed from a material having the same density as a material of the body portion 6710. The apparatus, methods, and articles of manufacture described herein are not limited in this regard.

In one example, the badge 7028 may display one or more alphanumeric characters, symbols, shapes or other visual marks to signify a particular feature of the golf club head 6700 such as the manufacturer of the golf club head 6700 (i.e., brand of the golf club head 6700). Accordingly, the badge 7028 may be configured to be inserted and secured in the recessed portion 7026. In one example, the badge 7028 may be secured in the recessed portion 7026 with an adhesive or a bonding agent. In another example, depending on the material of construction of the badge 7028, welding or soldering may be used to attach the badge 7028 inside the recessed portion 7026. In another example, the badge 7028 may be press fit into the recessed portion 7026. In yet another example, one or more fasteners may be used to attach the badge 7028 inside recessed portion 7026. As described herein, the badge 7028 may cover and/or close the first port 6921. In one example, the badge 7028 may be plate shaped to fit in the recessed portion 7026. In another example, the badge 7028 may further have a projection that may be received in the first port 6921 to close the first port 6921. In another example, the badge 7028 may be rectangular, circular, or have any shape. In another example, the badge 7028 may be visible and distinguishable from the remaining parts of the body portion 6710 by color, texture, materials of construction, and/or other visual features. In yet another example, the badge 7028 may be attached to the body portion 6710 such as to appear seamless with the body portion 6710 and be an integral part of the body portion 6710, i.e., indistinguishable or substantially indistinguishable from the body portion 6710. The apparatus, methods, and articles of manufacture described herein are not limited in this regard.

In one example, as illustrated in FIGS. 67-87, the second port 6931 may be larger in diameter than the first port 6921. The second port 6931 may be located at or proximate to the center portion 6773 of the back wall portion 6772 and at or proximate to the sole portion edge 6792. The second port 6931 may be located between the sole portion edge 6792 and the second ledge portion 6834. The second port 6931 may be similar in many respects to the second port 2231 of the golf club head 2000. The second port 6931 may have a second port outer opening 6933 on the back wall portion 6772 and port walls 6935 that extend from the second port outer opening 6933 to a second port inner opening 6937 that may be connected to the interior cavity 6810. Accordingly, the interior cavity 6810 may be accessed from outside the body portion 6710 through the second port outer opening 6933 and the second port inner opening 6937. The second port inner opening 6937 may have a smaller diameter than the second port outer opening 6933 to define a port bottom 6939. In one example, an inner diameter of the second port 6931, which may define the diameter of the second port 6931 from the second port outer opening 6933 to the port bottom 6939, may be greater than or equal to 0.2 inch (5.08 mm) and less than or equal to 1.0 inch (25.4 mm). In another example, the inner diameter of the second port 6931 may be greater than or equal to 0.3 inch (7.62 mm) and less than 1.5 inch (38.1 mm). In another example, the inner diameter of the second port 6931 may be greater than or equal to 0.4 inch (10.16 mm) and less than or equal to 0.8 inch (20.32 mm). In yet another example, the inner diameter of the second port 6931 may be greater than or equal to 0.5 inch (12.7 mm) and less than or equal to 0.7 inch (17.78 mm). The apparatus, methods, and articles of manufacture described herein are not limited in this regard.

As described herein, the first ledge portion 6832 may extend in a downwardly inclined direction toward the sole portion 6790 as it extends from a location at or proximate to the toe portion edge 6742 to the second ledge portion 6834, and the third ledge portion 6836 may extend in a downwardly inclined direction toward the sole portion 6790 as it extends from a location at or proximate to the heel portion edge 6752 to the second ledge portion 6834. As illustrated in FIGS. 67-87, the width (i.e., measured in a direction between the lower back wall portion 6822 and the upper back wall portion 6820) of the first ledge portion 6832 may increase as the first ledge portion 6832 extends from a location at or proximate to the toe portion edge 6742 to the second ledge portion 6834, and the width (i.e., measured in a direction between the lower back wall portion 6822 and the upper back wall portion 6820) of the third ledge portion 6836 may increase as the third ledge portion 6836 extends from a location at or proximate to the heel portion edge 6752 to the second ledge portion 6834. As illustrated in FIGS. 67-87, the second ledge portion 6834 may partially surround the second port 6931. Accordingly, the second ledge portion 6834 may have a curved, semi-circular, segmented, or concave shape relative to the sole portion edge 6792. In the example of FIGS. 67-87, the second ledge portion 6834 may include a toe-side wall 6844 extending upward from the first ledge portion 6832 to a location above the second port 6931, and a heel-side wall 6864 extending upward from the third ledge portion 6836 to a location above the second port 6931. A center ledge portion 6854 may extend between and connect the toe-side wall 6844 and the heel-side wall 6864. The second ledge portion 6834 may have any shape and connect the first ledge portion 6832 and the third ledge portion 6836. The apparatus, methods, and articles of manufacture described herein are not limited in this regard.

The body portion 6710 may include any number of ports above and/or below the first ledge portion 6832, the second ledge portion 6834, and/or the third ledge portion 6836. The body portion 6710 may include any number of ports above and/or below the horizontal midplane 7120. The body portion 6710 may include any number of ports on the toe portion edge 6742, the heel portion edge 6752, the top portion edge 6782, and/or the sole portion edge 6792. Any port may be connected to the interior cavity 6810. The number of ports on the body portion 6710, the arrangement and/or the configuration of the ports on the body portion 6710 may be similar in many respects to any of the golf club heads described in any of the incorporated by reference patent documents. The apparatus, methods, and articles of manufacture described herein are not limited in this regard.

The body portion 6710 may include one or more mass portions (e.g., weight portion(s)) at any location on the body portion 6710. The one or more mass portions may be integral mass portion(s) or separate mass portion(s) that may be coupled to the body portion 6710 at any exterior or interior location on the body portion 6710. In the illustrated example of FIGS. 67-87, the body portion 6710 may include an external mass portion 7035, which may be also referred to herein as the first mass portion, and an internal mass portion 7045, which may be also referred to herein as the second mass portion. The external mass portion 7035 may be similar in many respects to the mass portion 2331 of the golf club head 2000. Accordingly, the external mass portion 7035 may be disc shaped as illustrated in FIG. 34. The diameter of the external mass portion 7035 may be determined based on one or more properties (e.g., material density) of the materials of construction of the external mass portion 7035. The second port 6931 may be configured to receive the external mass portion 7035, which may be inserted and secured into the second port 6931 by any of the methods described herein with respect to any of the golf club heads described herein such as being screwed in (i.e., second port 6931 with internal threads), press fitted, secured with an adhesive, or welded. The external mass portion 7035 may engage the port bottom 6939 to prevent further insertion of the external mass portion 7035 into the second port 6931. Accordingly, the inner diameter of the second port 6931 may correspond to the outer diameter of the external mass portion 7035. The apparatus, methods, and articles of manufacture described herein are not limited in this regard.

A center region or a geometric center of the second port 6931 may be located at or proximate to the CG of the golf club head 6700. Accordingly, a center of gravity of the external mass portion 7035 may also be located at or proximate to the CG of the golf club head 6700 when the external mass portion 7035 is secured in the second port 6931 as described herein. As a result, the external mass portion 7035 may be interchangeable with another mass portion having a lower mass or a mass portion having a higher mass without causing a relatively large or a significant shift in the CG of the golf club head 6700. In one example, for each gram of mass increase of the external mass portion 7035, the CG location of the golf club head may shift by less than 0.5% of the $CG_X$ location (x-axis coordinate of the CG), less than 0.5% of the $CG_Y$ location (y-axis coordinate of the CG), and/or less than 0.2% of the $CG_Z$ location (z-axis coordinate of the CG). In another example, for each gram of mass increase of the external mass portion 7035, the CG location of the golf club head may shift by less than 0.35% of the $CG_X$ location, less than 0.35% of the $CG_Y$ location, and/or less than 0.15% of the $CG_Z$ location. In yet another example, for each gram of mass increase of the external mass portion 7035, the CG location of the golf club head may shift by less than 0.25% of the $CG_X$ location, less than 0.25% of the $CG_Y$ location, and/or less than 0.10% of the $CG_Z$ location. Thus, the external mass portion 7035 may be interchangeable with another mass portion having a lower or a greater mass to provide certain performance characteristics for an individual (i.e., customize the performance of the golf club head 6700 for a certain individual) without substantially shifting the CG of the golf club head 6700 and/or altering the overall or general performance characteristics of the golf club head 6700. The apparatus, methods, and articles of manufacture described herein are not limited in this regard.

The internal mass portion 7045 may be at any location on the body portion 6710. In one example, as illustrated in FIGS. 67-87, the internal mass portion 7045 may be located proximate to the toe portion edge 6742. In another example, the internal mass portion 7045 may be located between the external mass portion 7035 and the toe portion edge 6742. The location of the internal mass portion 7045 being proximate to the toe portion edge 6742 may increase the moment of inertia of the golf club head 6700 to improve performance. All or portions of the internal mass portion 7045 may be placed close to the toe portion edge 6742 to increase the moment of inertia of the golf club head. In one example, as illustrated in FIGS. 67-87, the internal mass portion 7045 may have an angled shape that may approximately correspond to the shape of the toe portion edge 6742. Accordingly, a top portion 7546 of the internal mass portion 7045 may be oriented at an obtuse angle 7547 relative to a bottom portion 7548 of the internal mass portion 7045 to discreetly simulate the curvature of the toe portion edge 6742. In another example (not shown), the internal mass portion 7045 may be located close to the toe portion edge 6742 and have a plurality of continuous portions oriented at obtuse angles relative to each other to closely simulate the curved shape of the toe portion edge 6742. In another example (not shown), the internal mass portion 7045 may have a curvature that may exactly or substantially exactly simulate the curved shape of the toe portion edge 6742 and be located close to the toe portion edge 6742. In another example, the internal mass portion 7045 may include two separate mass portions that may be located close to the toe portion edge 6742. In yet another example, the internal mass portion 7045 may include a plurality of separate mass portions that may be arranged close to the toe portion edge 6742 to correspond to the shape of the toe portion edge 6742. The apparatus, methods, and articles of manufacture described herein are not limited in this regard.

In one example as illustrated in FIGS. 67-87, the top portion 7546 of the internal mass portion 7045 may have a smaller volume than the bottom portion 7548, and the internal mass portion 7045 may have a gradually increasing volume from the top portion 7546 to the bottom portion 7548. Accordingly, to lower a center of gravity of the golf club head 6700, all or a larger portion of the internal mass portion 7045 may be below the horizontal midplane 7120, and/or a distance between a center of gravity of the internal mass portion 7045 and the sole portion edge 6792 may be less than or substantially less than a distance between the center of gravity of the internal mass portion 7045 and the top portion edge 6782. In other words, the shape of the internal mass portion 7045 as provided herein allows placement of the internal mass portion 7045 close to the toe portion edge and placement of a relatively larger portion of the internal mass portion 7045 below the horizontal midplane 7120. In another example, all portions of the internal mass portion 7045 may be below the horizontal midplane 7120. In another example, the internal mass portion 7045 may include a plurality of internal mass portions arranged proximate to the toe portion edge 6742 in a top-to-sole and toe-to heel direction, with a greater number or all of the mass portions being located below the horizontal midplane 7120. In another example, the internal mass portion 7045 may include large portions that extend close to the sole portion edge 6792. The apparatus, methods, and articles of manufacture described herein are not limited in this regard.

As illustrated in FIGS. 67-87, the internal mass portion 7045 may include a height 8410 in a top-to-sole direction, a width 8420 in a toe-to-heel direction, and a depth 8430 in a front-to-back direction. In one example, as illustrated in FIGS. 67-87, the height 8410 may be greater than the width 8420 and greater than the depth 8430. Accordingly, the internal mass portion 7045 may extend proximate to a greater portion of the toe portion edge 6742 to increase the moment of inertia of the golf club head 6700. In another example, as illustrated in FIGS. 67-87, the depth 8430 may increase in a top-to-sole direction to increase the volume and the mass of the internal mass portion 7045 in a top-to-sole direction as described herein. In another example, as illustrated in FIGS. 67-87, the depth 8430 may be greater than the width 8420. Accordingly, the internal mass portion 7045 may extend proximate to a greater portion of the toe portion edge 6742 and farther aft to increase the moment of inertia of the golf club head 6700 and move the center of gravity of the golf club head 6700 lower and farther aft. The apparatus, methods, and articles of manufacture described herein are not limited in this regard.

The third port 6941 may define a recess or cavity in the body portion 6710 that may be shaped to correspond to the shape of the internal mass portion 7045 to receive the internal mass portion 7045. In one example, as illustrated in FIGS. 67-87, the third port 6941 may be shaped to completely receive the internal mass portion 7045 so that the outer surface of the internal mass portion is flush with the interior walls of the body portion 6710 defining the interior cavity 6810. The internal mass portion 7045 may be secured inside the third port 6941 with one or more adhesives or bonding agents, by welding or soldering, and/or by being press fit. The third port 6941 may be defined by a cavity inside a body mass portion 6745, which may be an integral portion of the body portion 6710, formed with the body portion 6710, and/or include the same materials as the materials of the body portion 6710. The body mass portion 6745 may be located in the toe portion 6740 and may extend to the toe portion edge 6742 to increase the moment of inertial of the golf club head 6700. The shape, size, volume, and/or mass of the body mass portion 6745 may be determined to provide certain performance characteristics for the golf club head 6700. In one example, as illustrated in FIGS. 67-87, the body mass portion 6745 may be located in the toe portion 6740, extend to the toe portion edge 6742, and extend from the top portion edge 6782 to the sole portion edge 6792. The shape, size, volume, and/or mass of the body mass portion 6745 may vary and depend on various properties of the golf club head 6700 including the loft angle 7145. The apparatus, methods, and articles of manufacture described herein are not limited in this regard.

Figure 74:
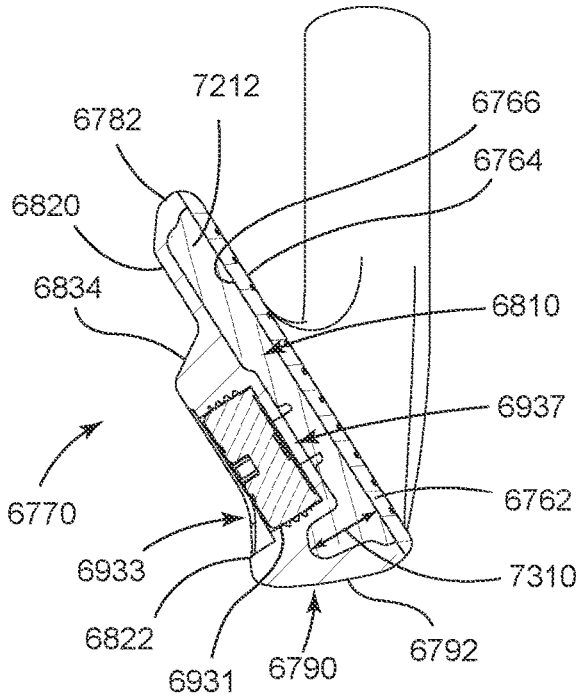
Figure 75:
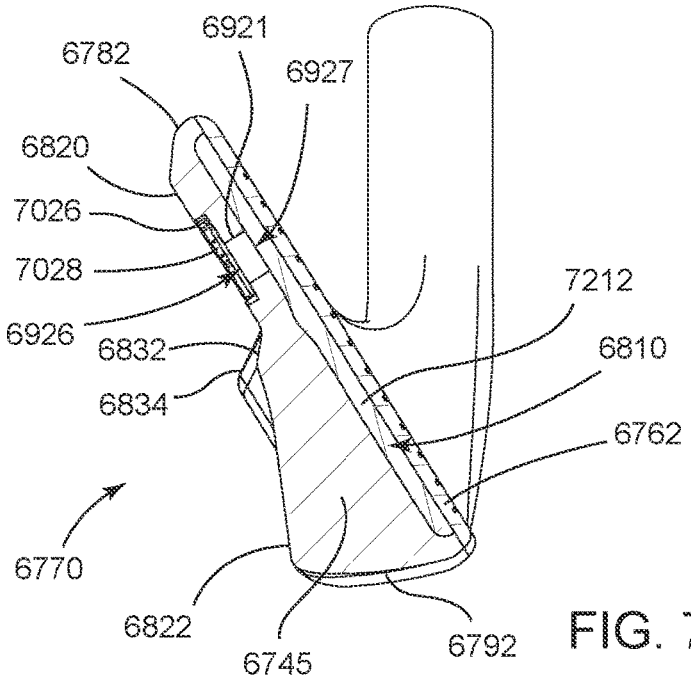
Figure 76:
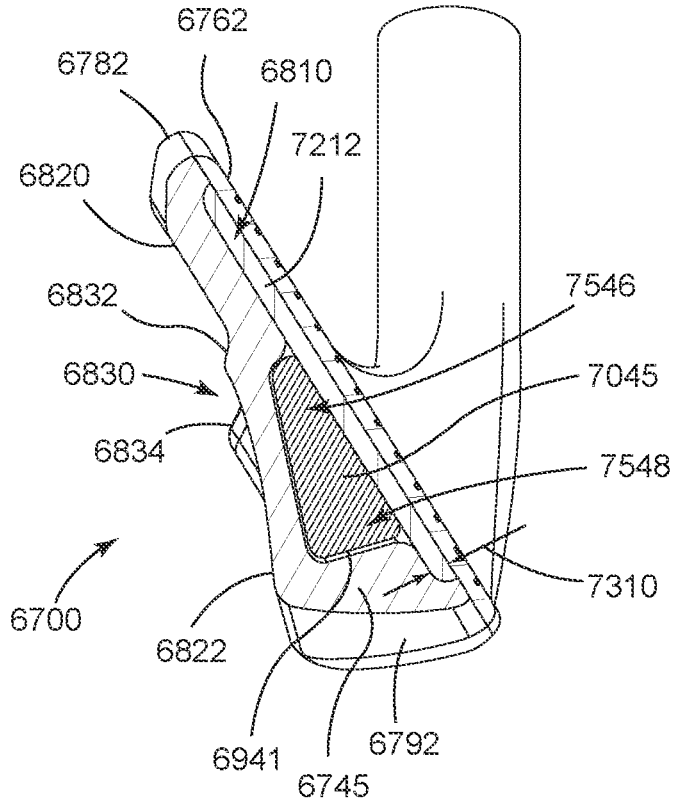
Figure 77:
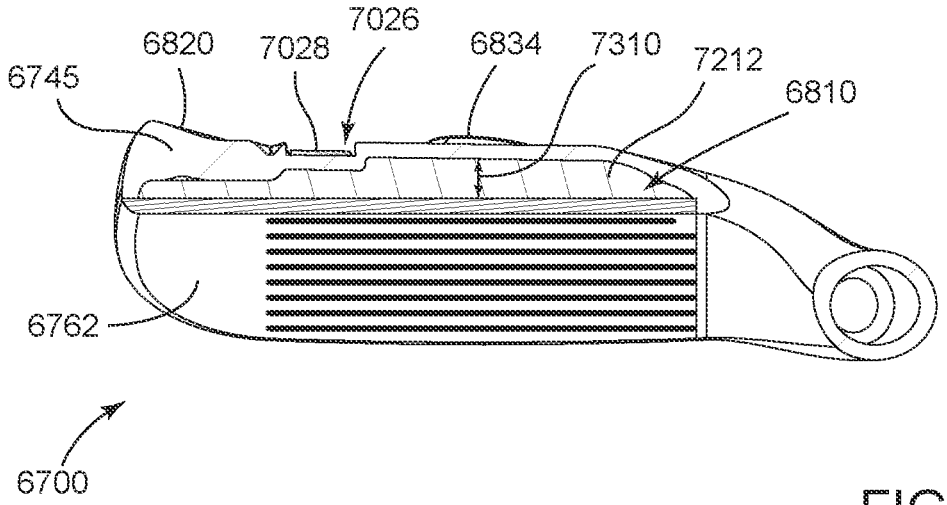
Figure 78:
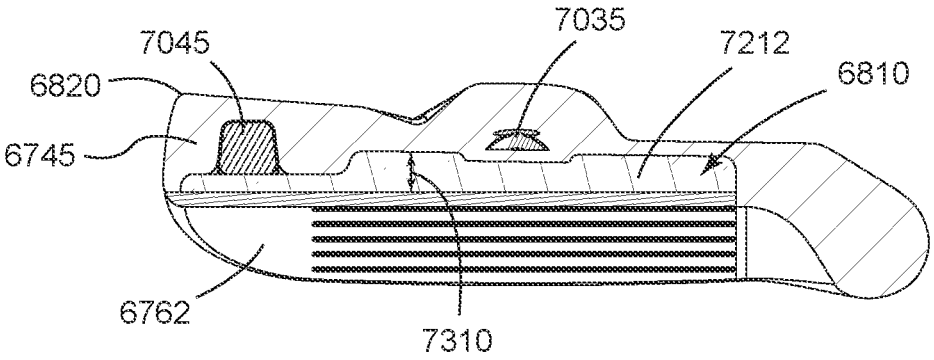
Figure 79:
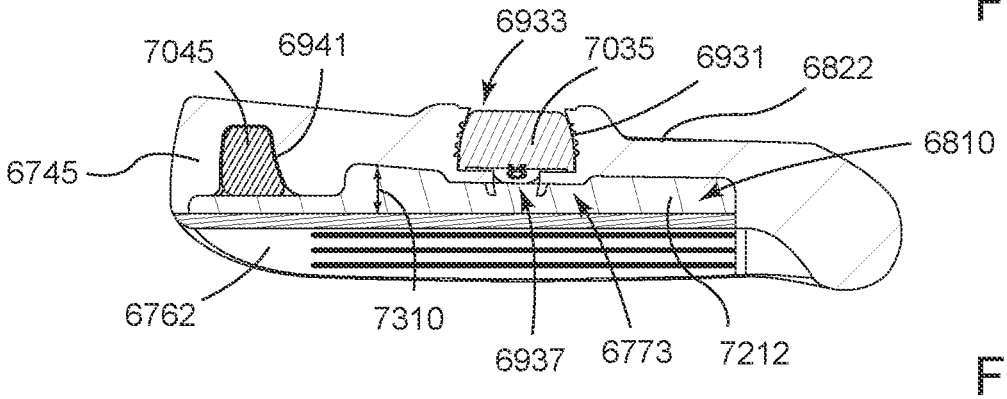
Figure 80:
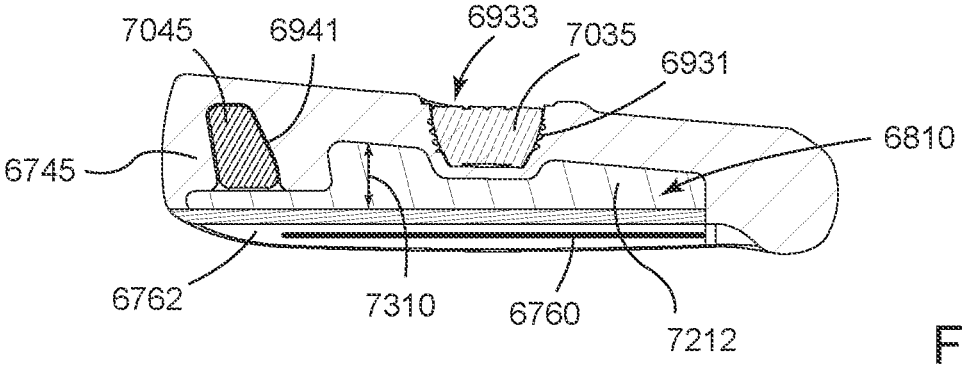
Figure 81:
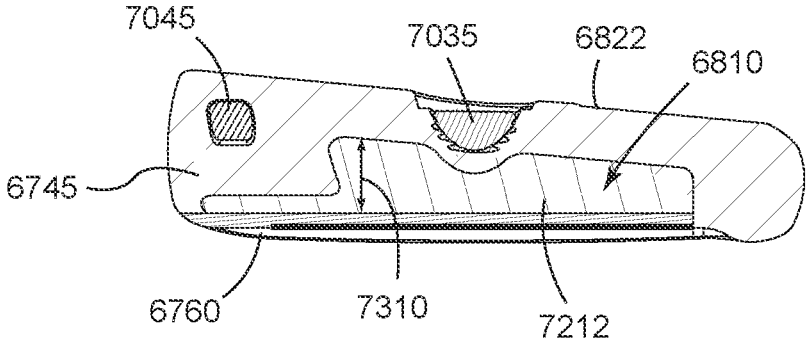
Figure 82:
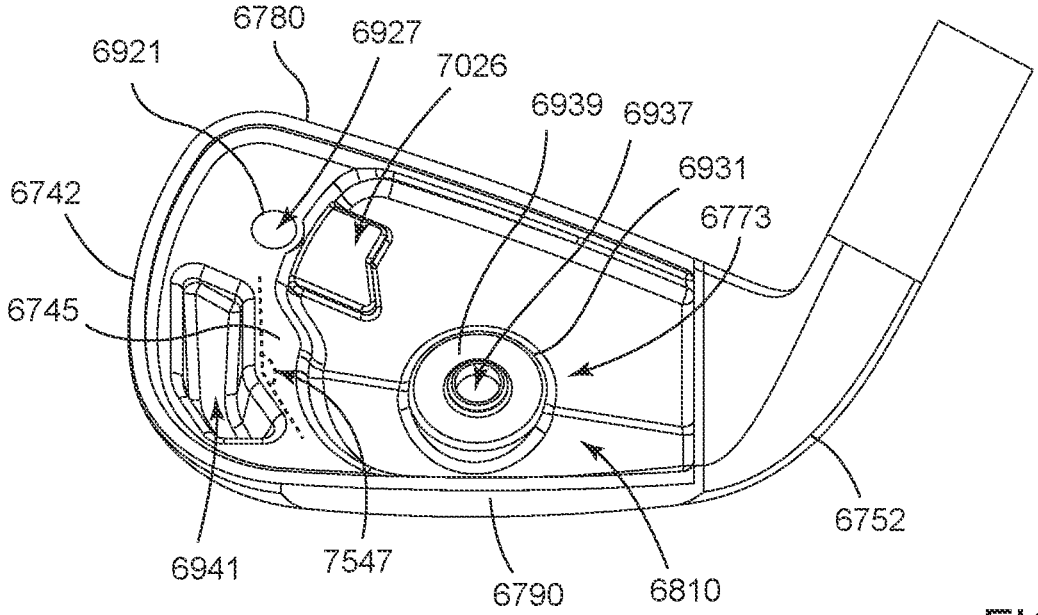
Figure 83:
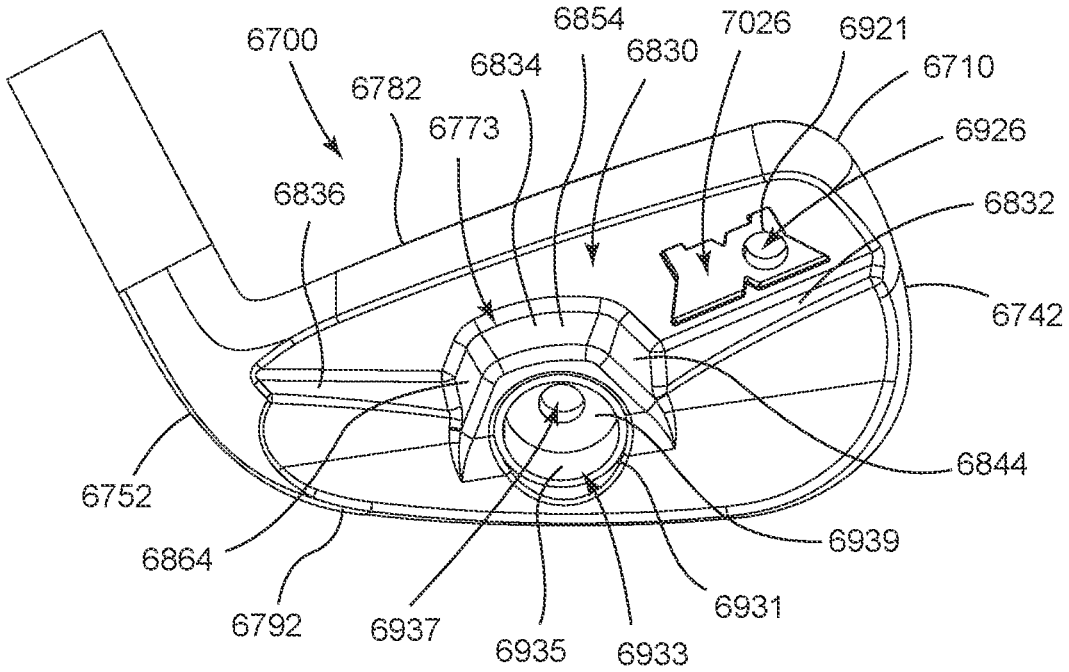
Figure 84:
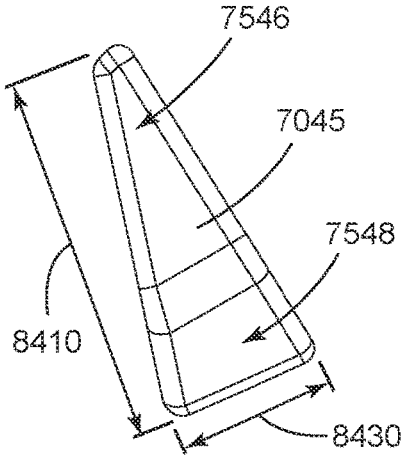
Figure 85:
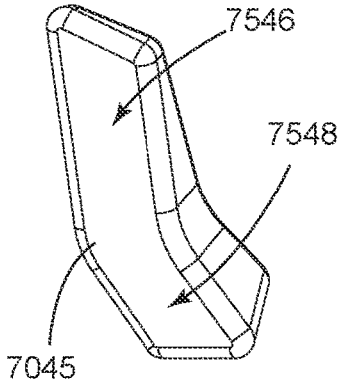
Figure 86:
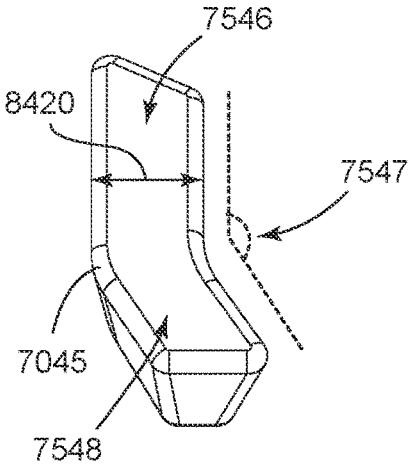

The interior cavity 6810 may vary in width between the toe portion 6740 and the heel portion 6750. An interior cavity width 7310 may be smaller proximate to the toe portion edge 6742 than the interior cavity width 7310 at the center portion of the body portion or at the heel portion 6750. Accordingly, a greater portion of the mass of the body portion 6710 may be closer to the toe portion edge 6742 than the heel portion edge 6752 to increase the moment of inertia of the body portion 6710. In one example, as illustrated in FIGS. 67-87, the interior cavity width 7310 may have a maximum value at a location between the external mass portion 7035 and the internal mass portion 7045. As illustrated in the example of FIGS. 74 and 80, portions of the interior cavity 6810 may extend vertically below the external mass portion 7035 and be farther from the face portion 6762 than portions of the external mass portion 7035. Accordingly, in one example as illustrated in FIGS. 67-87, a maximum value of the interior cavity width 7310, which may be measured in a face-to-back direction, may be between the external mass portion 7035 and the internal mass portion 7045 in a toe-to-heel direction and between the sole portion edge 6792 and the external mass portion 7035 in a top-to sole direction. The apparatus, methods, and articles of manufacture described herein are not limited in this regard.

In another example, as also illustrated in FIGS. 67-87, a center portion of the interior cavity 6810, which may be a region of the interior cavity that is at or surrounding the first port 6921 may define the largest volume of the interior cavity as compared to other portions of the interior cavity 6810 so as to accommodate a larger volume of a filler material as described herein for enhanced sound and vibration dampening and feel. The apparatus, methods, and articles of manufacture described herein are not limited in this regard.

In one example, as illustrated in FIGS. 67-87, the second port 6931, the badge 7028, and the internal mass portion 7045 may be located between the external mass portion 7035 and the toe portion edge 6742. As described herein, the external mass portion 7035 may function to lower the center of gravity of the golf club head 6700 and shift the center of gravity rearward. The internal mass portion 7045 may function to increase the moment of inertia of the golf club head 6700. Additionally, with the bottom portion 7548 of the internal mass portion 7045 having a greater mass than the top portion 7546, a vertical location of the center of gravity of the golf club head 6700 may not be largely shifted by the internal mass portion 7045. The apparatus, methods, and articles of manufacture described herein are not limited in this regard.

In one example, the badge 7028 may be constructed from a material having a lower density than the material of the body portion 6710 to not have a large effect on the mass distribution of the body portion 6710. In yet another example, the badge 7028 may be made from a material having a relatively large density such as the material form which any of the mass portions may be constructed. Accordingly, the badge 7028 may function to increase the moment of inertia of the golf club head 6700. The apparatus, methods, and articles of manufacture described herein are not limited in this regard.

The interior cavity 6810 may be partially or entirely filled with one or more filler materials (i.e., a cavity filling material), which may include one or more similar or different types of materials. In one example, as illustrated in FIGS. 67-87, the interior cavity 6810 may be filled with a filler material 7212 that may be similar to the filler material 2512 of the golf club head 2000 or similar to any of the filler materials described herein or in any of the incorporated by reference patent documents. In another example (not illustrated for FIGS. 67-87), the interior cavity 6810 may be filled with a first filler material and a second filler material that may be similar to the first filler material 512 and the second filler material 514 of the golf club head 200 or similar to any of the golf club heads described in any of the incorporated by reference patent documents. In one example, as illustrated in FIGS. 67-87, the filler material 7212 may be injected into the interior cavity 6810 from any of the first port 6921 or the second port 6931, while the other one of the first port 6921 or the second port 6931 may functions as an air exhaust port through which the air in the interior cavity 6810 that is displaced by the filler material 7212 or excess filler material 7212 may exit. Accordingly, as illustrated in FIGS. 67-87, the filler material 7212 may be molded in the shape of the interior cavity 6810. The apparatus, methods, and articles of manufacture described herein are not limited in this regard.

Figure 87:
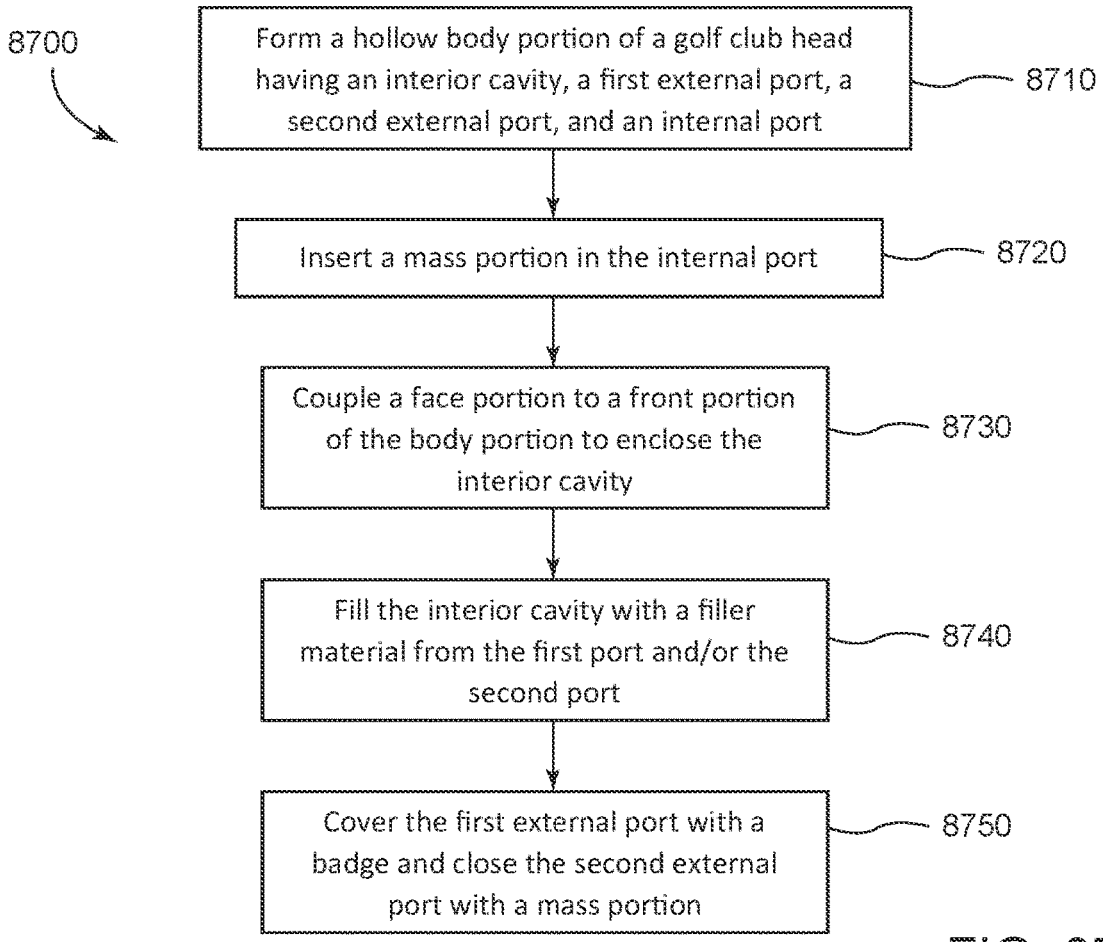
Figure 88:
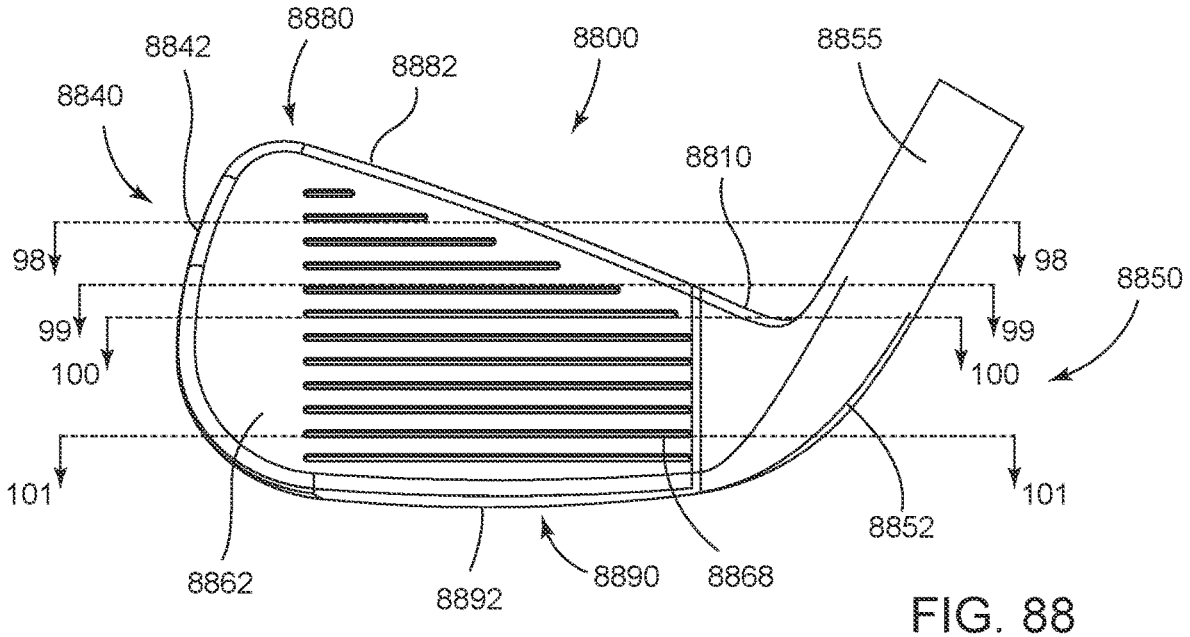
FIGS. 88, 89, 90, 91, 92, 93, 94, 95, 96, 97, 98, 99, 100, 101, 102, 103, 104, 105, and 106 illustrate a front view, a back view, a top view, a bottom view, a heel side view, a toe side view, a cross-sectional view taken at line 94-94 of FIG. 89, a cross-sectional view taken at line 95-95 of FIG. 89, a cross-sectional view taken at line 96-96 of FIG. 89, a cross-sectional view taken at line 97-97 of FIG. 89, a cross-sectional view taken at line 98-98 of FIG. 88, a cross-sectional view taken at line 99-99 of FIG. 88, a cross-sectional view taken at line 100-100 of FIG. 88, a cross-sectional view taken at line 101-101 of FIG. 88, a back view without a mass portion and a badge, a front view with the face portion removed, a side view of an internal mass portion, and a rear view of an internal mass portion, respectively, of a golf club head according to embodiments of the apparatus, methods, and articles of manufacture described herein.
Figure 89:
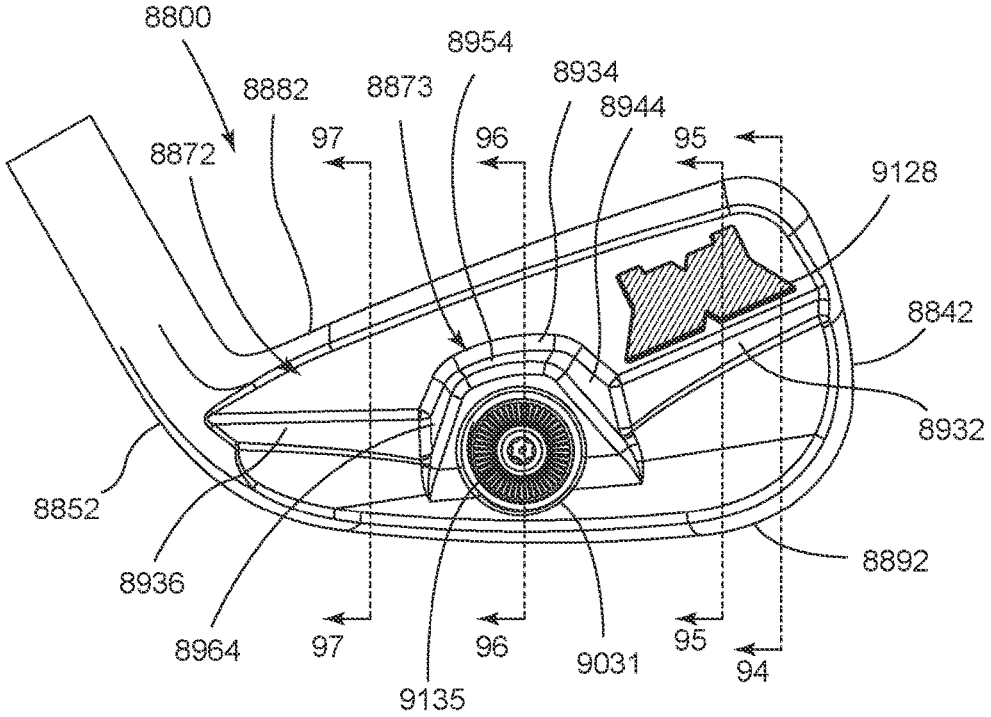
Figure 90:
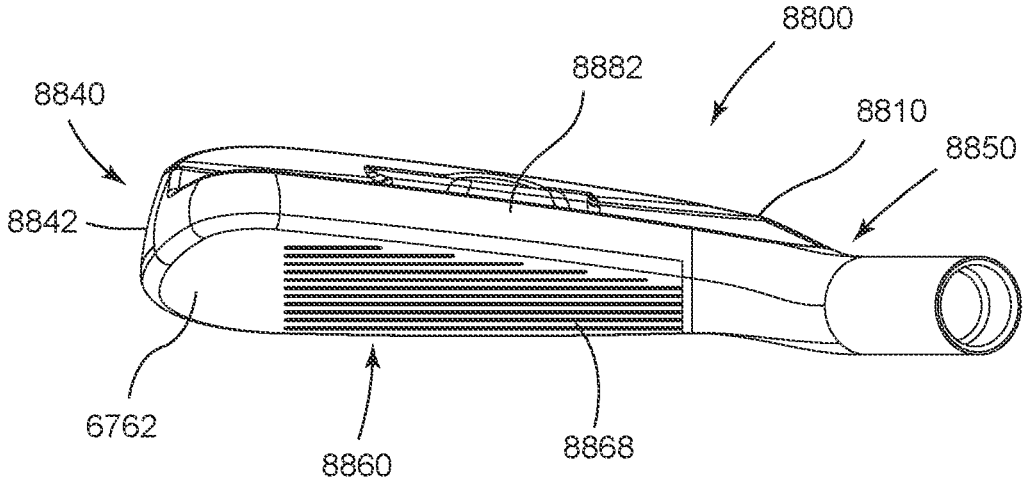
Figure 91:
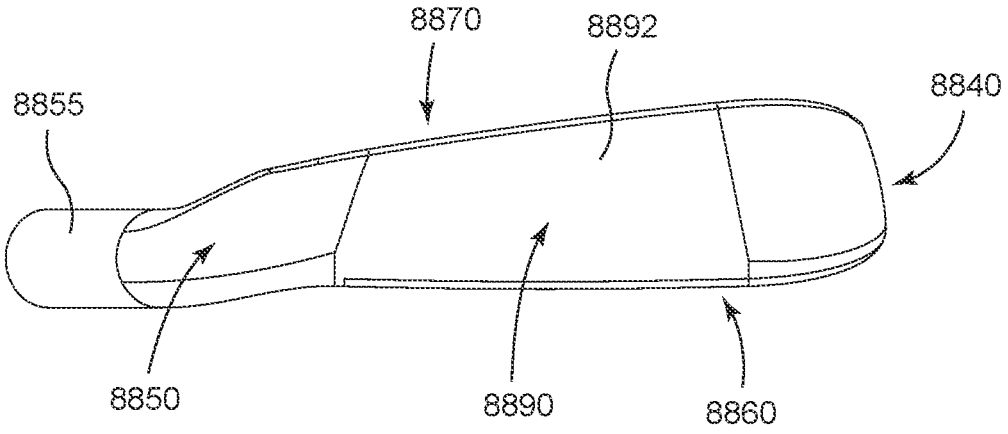
Figure 92:
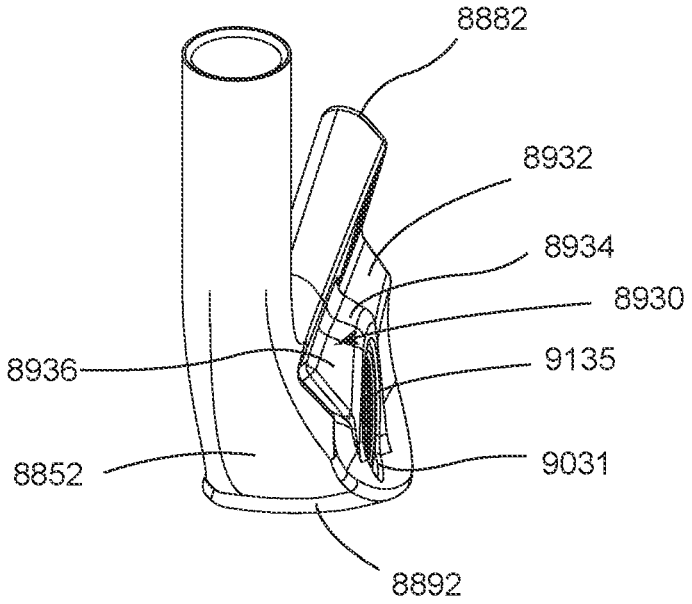

In one example, as illustrated in FIG. 87, a method 8700 of manufacturing the golf club head 6700 may include forming the body portion 6710 having a first port 6921, the second port 6931, and the third port 6941 as described herein (block 8710). The internal mass portion 7045 may be secured in the third port 6941 as described herein (block 8720). The face portion 6762 may be attached to the front portion 6760 of the body portion 6710 to enclose the interior cavity 6810 (block 8730). The interior cavity 6810 may be filled with a filler material 7212 (block 8740) from one of the first port 6921 or the second port 6931, while the other one of the first port 6921 or the second port 6931 may function as an exhaust port for the air inside the interior cavity 6810 to escape during the filling process. The badge 7028 may be attached in the recessed portion 7026 to cover or close the first port 6921, and the external mass portion 7035 may then be inserted and secured in the second port 6931 as described herein (bock 8750). Any of the operations described herein may be performed in a different order. The apparatus, methods, and articles of manufacture described herein are not limited in this regard.

In the example of FIGS. 88-106, a golf club head 8800 may include a body portion 8810 having a toe portion 8840 with a toe portion edge 8842, a heel portion 8850 with a heel portion edge 8852 that may include a hosel portion 8855. A golf club shaft (such as the shaft 104 that is illustrated for example in FIG. 1) may include one end coupled to the hosel portion 8855, and an opposite end coupled to a golf club grip (such as the grip 106 that is illustrated for example in FIG. 1) to form a golf club (such as the golf club 100 that is illustrated for example in FIG. 1). The body portion 8810 may further include a front portion 8860, a back portion 8870 with a back wall portion 8872, a top portion 8880 with a top portion edge 8882, and a sole portion 8890 with a sole portion edge 8892. The toe portion 8840, the heel portion 8850, the front portion 8860, the back portion 8870, the top portion 8880, and/or the sole portion 8890 may partially overlap. The toe portion edge 8842, the heel portion edge 8852, the top portion edge 8882, and the sole portion edge 8892 may define a periphery of the body portion 8810. The golf club head 8800 may be any type of golf club head described herein, such as, for example, an iron-type golf club head or a wedge-type golf club head. The volume of the golf club head 8800, the materials of construction of the golf club head 8800, and/or any components thereof may be similar to any of the golf club heads described herein and/or described in any of the incorporated by reference patent documents. The golf club head 8800 may be manufactured by any of the methods described herein such as the method 8700 or described in any of the incorporated by reference patent documents. The apparatus, methods, and articles of manufacture described herein are not limited in this regard.

The golf club head 8800 may include a face portion 8862 (i.e., the strike face), which may be integrally formed with the body portion 8810 (e.g., a single unitary piece). In one example, as illustrated in FIGS. 88-106, the face portion 8862 may be a separate piece coupled (e.g., directly or indirectly, adhesively, mechanically, by welding, and/or by soldering) to the front portion 8860 to close a front opening of the front portion 8860. The face portion 8862 may include a front surface 8864 and a back surface 8866. The front surface 8864 may include a plurality of front grooves 8868 that may extend between the toe portion 8840 and the heel portion 8850. The front grooves 8868 may be similar in many respects to the front grooves 2068 of the golf club head 2000 or similar to the front grooves of any of the golf club heads described herein or described in any of the incorporated by reference patent documents. The back surface 8866 of the face portion 8862 may include one or more grooves, slots, channels, depressions, or recesses. The grooves on the back surface 8866 may be similar in many respects to the back grooves of the golf club head 2000, such as the back grooves illustrated in FIGS. 35-38 and 43-66. The back surface 8866 may not include any grooves, slots, channels, depressions, or recesses. The apparatus, methods, and articles of manufacture described herein are not limited in this regard.

The golf club head 8800 may be associated with a ground plane 9210, a horizontal midplane 9220, and a top plane 9230. In particular, the ground plane 9210 may be a plane that is parallel or substantially parallel to the ground and is tangent to the lowest portion of the sole portion edge 8892 when the golf club head 8800 is at an address position (e.g., the golf club head 8800 aligned to strike a golf ball). A top plane 9230 may be a plane that is tangent to the upper most portion of top portion edge 8882 when the golf club head 8800 is at the address position. The ground plane 9210 and the top plane 9230 may be parallel or substantially parallel to each other. The horizontal midplane 9220 may be vertically halfway between the ground plane 9210 and the top plane 9230, respectively, and be parallel or substantially parallel to the ground plane 9210. Further, the golf club head 8800 may be associated with a loft plane 9240 defining a loft angle 9245 ($\alpha$) of the golf club head 8800. The loft plane 9240 may be a plane that is tangent to or coplanar with the face portion 8862. The loft angle 9245 may be defined by an angle between the loft plane 9240 and a vertical plane 9250 that is normal to the ground plane 9210. The apparatus, methods, and articles of manufacture described herein are not limited in this regard.

The back wall portion 8872 may include an upper back wall portion 8920, a lower back wall portion 8922, and a ledge portion 8930 between the upper back wall portion 8920 and the lower back wall portion 8922. The ledge portion 8930 may extend outward (i.e., away from the face portion 8862) from the upper back wall portion 8920 to the lower back wall portion 8922 (i.e., the ledge portion 8930 may extend inward or toward the face portion 8862 from the lower back wall portion 8922 to the upper back wall portion 8920). The ledge portion 8930 may include a first ledge portion 8932 that may extend from a location at or proximate to the toe portion edge 8842 toward the heel portion 8850, a second ledge portion 8934 that may be located at or proximate to a center portion 8873 of the back wall portion 8872, and a third ledge portion 8936 that may extend from a location at or proximate to the heel portion edge 8852 toward the toe portion 8840. The second ledge portion 8934 may extend between the first ledge portion 8932 and the third ledge portion 8936. The first ledge portion 8932 may also extend in a downwardly inclined direction toward the sole portion 8890 as it extends from a location at or proximate to the toe portion edge 8842 to the second ledge portion 8934. The third ledge portion 8936 may also extend in a downwardly inclined direction toward the sole portion 8890 as it extends from a location at or proximate to the heel portion edge 8852 to the second ledge portion 8934. The ledge portion 8930 including the first ledge portion 8932, the second ledge portion 8934, and the third ledge portion 8936 may be similar in many respects (e.g., height, width, orientation, configurations of any sidewall portions, configurations of any ledge portion transition portions, etc.) to the ledge portion 2130 including the first ledge portion 2132, the second ledge portion 2134, and the third ledge portion 2136, respectively, of the golf club head 2000. The ledge portion 8930 may be similar in many respects to any of the ledge portions described herein or described in any of the incorporated by reference patent documents. The apparatus, methods, and articles of manufacture described herein are not limited in this regard.

The body portion 8810 may include one or more ports, which may be exterior ports and/or interior ports (e.g., located inside the body portion 8810). The one or more ports may be at any location on the body portion 8810. The inner walls of the body portion 8810 that define the interior cavity 8910 may include one or more ports. In one example, the body portion 8810 may include ports that may be similar in many respects to the ports of the golf club head 2000 as illustrated in FIG. 23. In another example, the body portion 8810 may include ports that may be similar in many respects to the ports of the golf club head 200 as illustrated in FIG. 3. In another example, the body portion 8810 may include ports that may be similar in many respects to any of the ports described in any of the incorporated by reference patent documents. In yet another example, as illustrated in FIGS. 88-106, the body portion 8810 may include a first port 9021 above the first ledge portion 8932, a second port 9031 located below the second ledge portion 8934, and a third port 9041 in the interior cavity 8910. Accordingly, the first port 9021 and the second port 9031 may be external ports, i.e., having port openings on an external surface of the body portion 8810, whereas the third port 9041 may be an internal port having an opening on one or more internal walls of the body portion 8810 that define the interior cavity 8910. The apparatus, methods, and articles of manufacture described herein are not limited in this regard.

In one example as illustrated in FIGS. 88-106, the first port 9021 may be located above the first ledge portion 8932 and proximate to the toe portion edge 8842. In another example, the first port 9021 may be on the toe portion edge 8842. In yet another example, the first port 9021 may be below the first ledge portion 8932. The first port 9021 may have a first port opening 9026 inside a recessed portion 9126 on the upper back wall portion 8920. The first port 9021 may be cylindrical and extend from the first port opening 9026 to the interior cavity at a second port opening 9027 to connect to the interior cavity 8910. Accordingly, the first port opening 9026 may provide access to the interior cavity 8910 from outside the body portion 8810 via the second port opening 9027. As illustrated in FIGS. 88-106, the first port 9021 may have a circular cross section (i.e., cylindrical port). In another example, the first port 9021 may be elliptical. In yet another example, the first port 9021 may have any shape. In one example, as illustrated in FIGS. 88-106, the recessed portion 9126 may be configured to receive a cover portion or a badge 9128 to cover the first port opening 9026. In another example, the first port 9021 may be closed with a mass portion that may be constructed from a material having a different density than a material of the body portion 8810. In yet another example, the first port 9021 may be closed with a mass portion that may be constructed from a material having the same density as a material of the body portion 8810. The apparatus, methods, and articles of manufacture described herein are not limited in this regard.

In one example, the badge 9128 may display one or more alphanumeric characters, symbols, shapes or other visual marks to signify a particular feature of the golf club head 8800 such as the manufacturer of the golf club head 8800 (i.e., brand of the golf club head 8800). Accordingly, the badge 9128 may be configured to be inserted and secured in the recessed portion 9126. In one example, the badge 9128 may be secured in the recessed portion 9126 with an adhesive or a bonding agent. In another example, depending on the material of construction of the badge 9128, welding or soldering may be used to attach the badge 9128 inside the recessed portion 9126. In another example, the badge 9128 may be press fit into the recessed portion 9126. In yet another example, one or more fasteners may be used to attach the badge 9128 inside recessed portion 9126. As described herein, the badge 9128 may cover and/or close the first port 9021. In one example, the badge 9128 may be plate shaped to fit in the recessed portion 9126. In another example, the badge 9128 may further have a projection that may be received in the first port 9021 to close the first port 9021. In another example, the badge 9128 may be rectangular, circular, or have any shape. In another example, the badge 9128 may be visible and distinguishable from the remaining parts of the body portion 8810 by color, texture, materials of construction, and/or other visual features. In yet another example, the badge 9128 may be attached to the body portion 8810 such as to appear seamless with the body portion 8810 and be an integral part of the body portion 8810, i.e., indistinguishable or substantially indistinguishable from the body portion 8810. The apparatus, methods, and articles of manufacture described herein are not limited in this regard.

In one example, as illustrated in FIGS. 88-106, the second port 9031 may be larger in diameter than the first port 9021. The second port 9031 may be located at or proximate to the center portion 8873 of the back wall portion 8872 and at or proximate to the sole portion edge 8892. The second port 9031 may be located between the sole portion edge 8892 and the second ledge portion 8934. The second port 9031 may be similar in many respects to the second port 2231 of the golf club head 2000. The second port 9031 may have a second port outer opening 9033 on the back wall portion 8872 and port walls 9035 that extend from the second port outer opening 9033 to a second port inner opening 9037 that may be connected to the interior cavity 8910. Accordingly, the interior cavity 8910 may be accessed from outside the body portion 8810 through the second port outer opening 9033 and the second port inner opening 9037. The second port inner opening 9037 may have a smaller diameter than the second port outer opening 9033 to define a port bottom 9039. In one example, an inner diameter of the second port 9031, which may define the diameter of the second port 9031 from the second port outer opening 9033 to the port bottom 9039, may be greater than or equal to 0.2 inch (5.08 mm) and less than or equal to 1.0 inch (25.4 mm). In another example, the inner diameter of the second port 9031 may be greater than or equal to 0.3 inch (7.62 mm) and less than 1.5 inch (38.1 mm). In another example, the inner diameter of the second port 9031 may be greater than or equal to 0.4 inch (10.16 mm) and less than or equal to 0.8 inch (20.32 mm). In yet another example, the inner diameter of the second port 9031 may be greater than or equal to 0.5 inch (12.7 mm) and less than or equal to 0.7 inch (17.78 mm). The apparatus, methods, and articles of manufacture described herein are not limited in this regard.

As described herein, the first ledge portion 8932 may extend in a downwardly inclined direction toward the sole portion 8890 as it extends from a location at or proximate to the toe portion edge 8842 to the second ledge portion 8934, and the third ledge portion 8936 may extend in a downwardly inclined direction toward the sole portion 8890 as it extends from a location at or proximate to the heel portion edge 8852 to the second ledge portion 8934. As illustrated in FIGS. 88-106, the width (i.e., measured in a direction between the lower back wall portion 8922 and the upper back wall portion 8920) of the first ledge portion 8932 may increase as the first ledge portion 8932 extends from a location at or proximate to the toe portion edge 8842 to the second ledge portion 8934, and the width (i.e., measured in a direction between the lower back wall portion 8922 and the upper back wall portion 8920) of the third ledge portion 8936 may increase as the third ledge portion 8936 extends from a location at or proximate to the heel portion edge 8852 to the second ledge portion 8934. As illustrated in FIGS. 88-106, the second ledge portion 8934 may partially surround the second port 9031. Accordingly, the second ledge portion 8934 may have a curved, semi-circular, segmented, or concave shape relative to the sole portion edge 8892. In the example of FIGS. 88-106, the second ledge portion 8934 may include a toe-side wall 8944 extending upward from the first ledge portion 8932 to a location above the second port 9031, and a heel-side wall 8964 extending upward from the third ledge portion 8936 to a location above the second port 9031. A center ledge portion 8954 may extend between and connect the toe-side wall 8944 and the heel-side wall 8964. The second ledge portion 8934 may have any shape and connect the first ledge portion 8932 and the third ledge portion 8936. The apparatus, methods, and articles of manufacture described herein are not limited in this regard.

The body portion 8810 may include any number of ports above and/or below the first ledge portion 8932, the second ledge portion 8934, and/or the third ledge portion 8936. The body portion 8810 may include any number of ports above and/or below the horizontal midplane 9220. The body portion 8810 may include any number of ports on the toe portion edge 8842, the heel portion edge 8852, the top portion edge 8882, and/or the sole portion edge 8892. Any port of the golf club head 8800 may be connected to the interior cavity 8910. The number of ports on the body portion 8810, the arrangement and/or the configuration of the ports on the body portion 8810 may be similar in many respects to any of the golf club heads described in any of the incorporated by reference patent documents. The apparatus, methods, and articles of manufacture described herein are not limited in this regard.

The body portion 8810 may include one or more mass portions (e.g., weight portion(s)) at any location on the body portion 8810. The one or more mass portions may be integral mass portion(s) or separate mass portion(s) that may be coupled to the body portion 8810 at any exterior or interior location on the body portion 8810. In the illustrated example of FIGS. 88-106, the body portion 8810 may include an external mass portion 9135, which may be also referred to herein as the first mass portion, and an internal mass portion 9145, which may be also referred to herein as the second mass portion. The external mass portion 9135 may be similar in many respects to the mass portion 2331 of the golf club head 2000. Accordingly, the external mass portion 9135 may be disc shaped as illustrated in FIG. 34. The diameter of the external mass portion 9135 may be determined based on one or more properties (e.g., material density) of the materials of construction of the external mass portion 9135. The second port 9031 may be configured to receive the external mass portion 9135, which may be inserted and secured into the second port 9031 by any of the methods described herein with respect to any of the golf club heads described herein such as being screwed in (i.e., second port 9031 with internal threads), press fitted, secured with an adhesive, or welded. The external mass portion 9135 may engage the port bottom 9039 to prevent further insertion of the external mass portion 9135 into the second port 9031. Accordingly, the inner diameter of the second port 9031 may correspond to the outer diameter of the external mass portion 9135. The apparatus, methods, and articles of manufacture described herein are not limited in this regard.

A center region or a geometric center of the second port 9031 may be located at or proximate to the CG of the golf club head 8800. Accordingly, a center of gravity of the external mass portion 9135 may also be located at or proximate to the CG of the golf club head 8800 when the external mass portion 9135 is secured in the second port 9031 as described herein. As a result, the external mass portion 9135 may be interchangeable with another mass portion having a lower mass or a mass portion having a higher mass without causing a relatively large or a significant shift in the CG of the golf club head 8800. In one example, for each gram of mass increase of the external mass portion 9135, the CG location of the golf club head may shift by less than 0.5% of the $CG_X$ location (x-axis coordinate of the CG), less than 0.5% of the $CG_Y$ location (y-axis coordinate of the CG), and/or less than 0.2% of the $CG_Z$ location (z-axis coordinate of the CG). In another example, for each gram of mass increase of the external mass portion 9135, the CG location of the golf club head may shift by less than 0.35% of the $CG_X$ location, less than 0.35% of the $CG_Y$ location, and/or less than 0.15% of the $CG_Z$ location. In yet another example, for each gram of mass increase of the external mass portion 9135, the CG location of the golf club head may shift by less than 0.25% of the $CG_X$ location, less than 0.25% of the $CG_Y$ location, and/or less than 0.10% of the $CG_Z$ location. Thus, the external mass portion 9135 may be interchangeable with another mass portion having a lower or a greater mass to provide certain performance characteristics for an individual (i.e., customize the performance of the golf club head 8800 for a certain individual) without substantially shifting the CG of the golf club head 8800 and/or altering the overall or general performance characteristics of the golf club head 8800. The apparatus, methods, and articles of manufacture described herein are not limited in this regard.

The internal mass portion 9145 may be at any location on the body portion 8810. In one example, as illustrated in FIGS. 88-106, the internal mass portion 9145 may be located proximate to the toe portion edge 8842. In another example, the internal mass portion 9145 may be located between the external mass portion 9135 and the toe portion edge 8842. The location of the internal mass portion 9145 being proximate to the toe portion edge 8842 may increase the moment of inertia of the golf club head 8800 to improve performance. All or portions of the internal mass portion 9145 may be placed close to the toe portion edge 8842 to increase the moment of inertia of the golf club head. In one example, as illustrated in FIGS. 88-106, the internal mass portion 9145 may have an angled shape that may approximately correspond to the shape of the toe portion edge 8842. Accordingly, a top portion 9646 of the internal mass portion 9145 may be oriented at an obtuse angle 9647 relative to a bottom portion 9648 of the internal mass portion 9145 to discreetly simulate the curvature of the toe portion edge 8842. In another example (not shown), the internal mass portion 9145 may be located close to the toe portion edge 8842 and have a plurality of continuous portions oriented at obtuse angles relative to each other to closely discreetly but more closely simulate the curved shape of the toe portion edge 8842. In another example (not shown), the internal mass portion 9145 may have a curvature that may exactly or substantially exactly simulate the curved shape of the toe portion edge 8842 and be located close to the toe portion edge 8842. In another example, the internal mass portion 9145 may include two separate mass portions that may be located close to the toe portion edge 8842. In yet another example, the internal mass portion 9145 may include a plurality of separate mass portions that may be arranged close to the toe portion edge 8842 to correspond to the shape of the toe portion edge 8842. The apparatus, methods, and articles of manufacture described herein are not limited in this regard.

In one example as illustrated in FIGS. 88-106, the top portion 9646 of the internal mass portion 9145 may have a smaller volume than the bottom portion 9648, and the internal mass portion 9145 may have a gradually increasing volume from the top portion 9646 to the bottom portion 9648. Accordingly, to lower a center of gravity of the golf club head 8800, all or a larger portion of the internal mass portion 9145 may be below the horizontal midplane 9220, and/or a distance between a center of gravity of the internal mass portion 9145 and the sole portion edge 8892 may be less than or substantially less than a distance between the center of gravity of the internal mass portion 9145 and the top portion edge 8882. In other words, the shape of the internal mass portion 9145 as provided herein allows placement of the internal mass portion 9145 close to the toe portion edge and placement of all or a relatively larger portion of the internal mass portion 9145 below the horizontal midplane 9220. In another example, all portions of the internal mass portion 9145 may be below the horizontal midplane 9220. In another example, the internal mass portion 9145 may include a plurality of internal mass portions arranged proximate to the toe portion edge 8842 in a top-to-sole and toe-to heel direction, with a greater number or all of the mass portions being located below the horizontal midplane 9220. In another example, the internal mass portion 9145 may include large portions that extend close to the sole portion edge 8892. The apparatus, methods, and articles of manufacture described herein are not limited in this regard.

As illustrated in FIGS. 88-106, the internal mass portion 9145 may include a height 9420 in a top-to-sole direction, a width 9430 in a toe-to-heel direction, and a depth 9440 in a front-to-back direction. In one example, as illustrated in FIGS. 88-106, the height 9420 may be greater than the width 9430 and greater than the depth 9440. Accordingly, the internal mass portion 9145 may extend proximate to a greater portion of the toe portion edge 8842 to increase the moment of inertia of the golf club head 8800. In another example, as illustrated in FIGS. 88-106, the depth 9440 may increase in a top-to-sole direction to increase the volume and the mass of the internal mass portion 9145 in a top-to-sole direction as described herein. In another example, as illustrated in FIGS. 88-106, the depth 9440 may be greater than the width 9430. Accordingly, the internal mass portion 9145 may extend proximate to a greater portion of the toe portion edge 8842 and farther aft to increase the moment of inertia of the golf club head 8800 and move the center of gravity of the golf club head 8800 lower and farther aft. The apparatus, methods, and articles of manufacture described herein are not limited in this regard.

Figure 72:
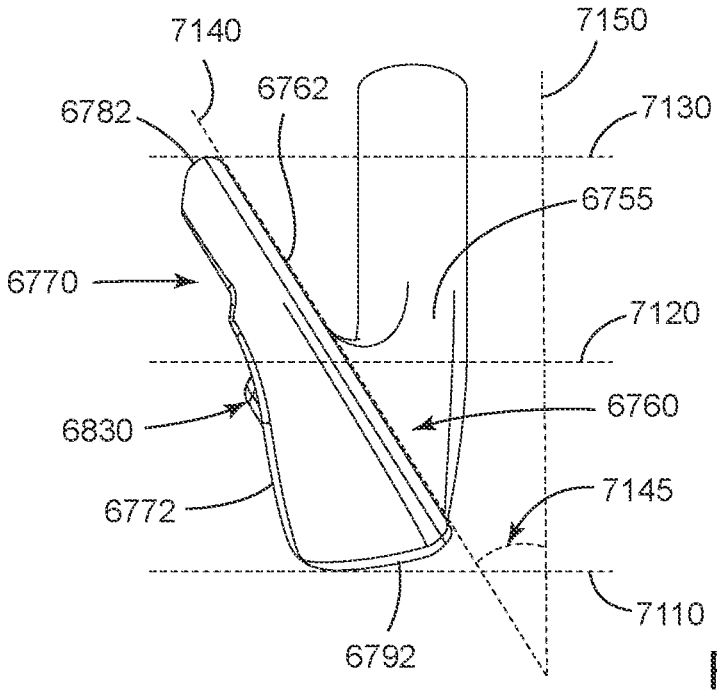
Figure 73:
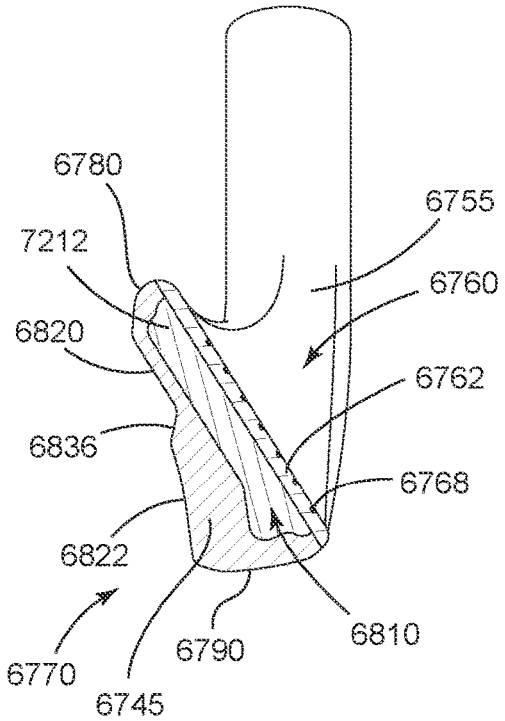
Figure 93:
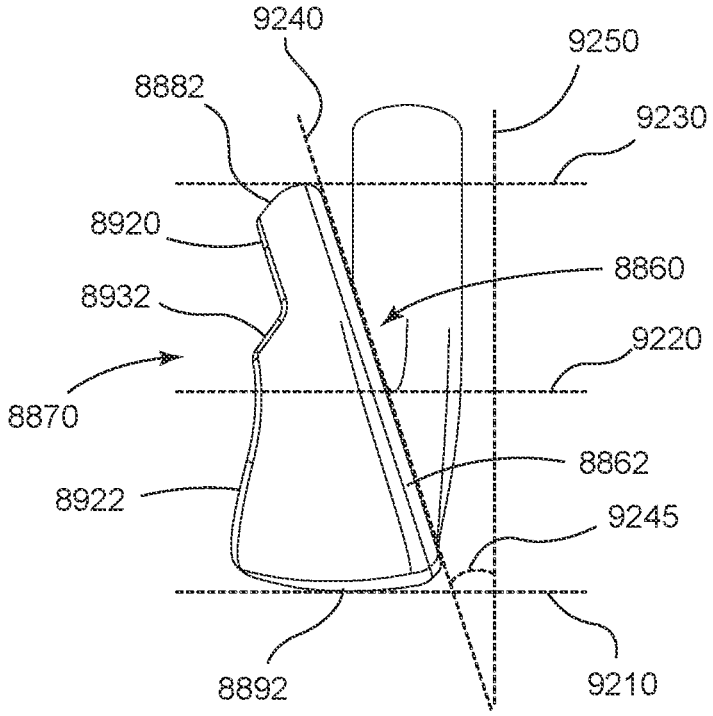
Figure 94:
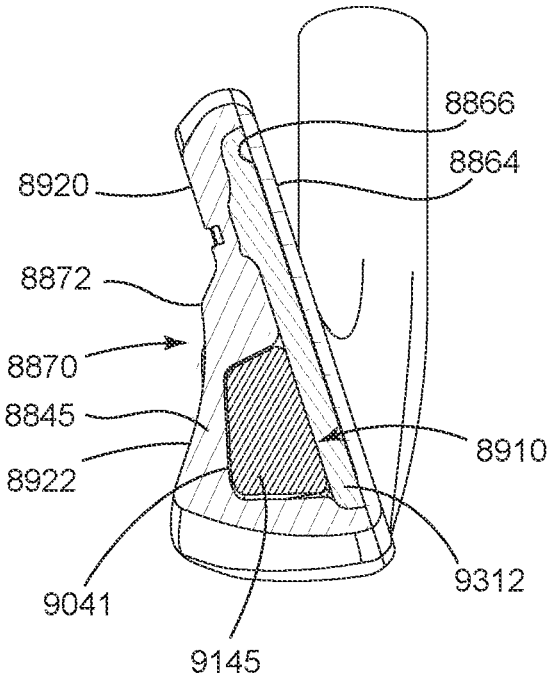
Figure 95:
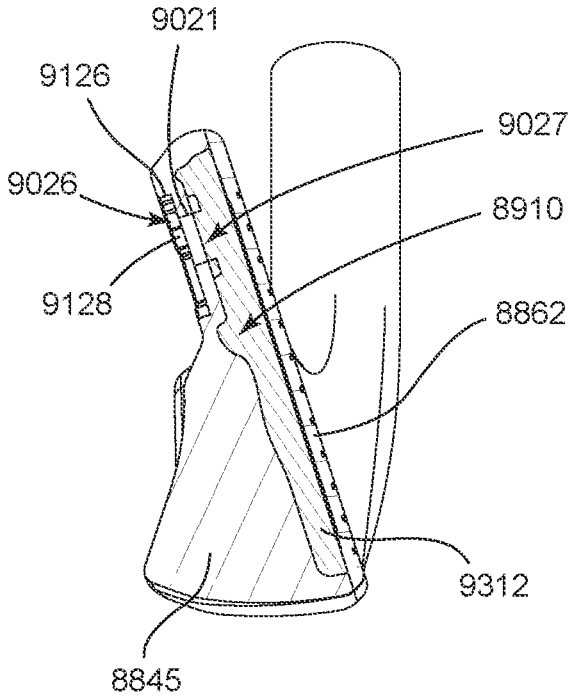
Figure 96:
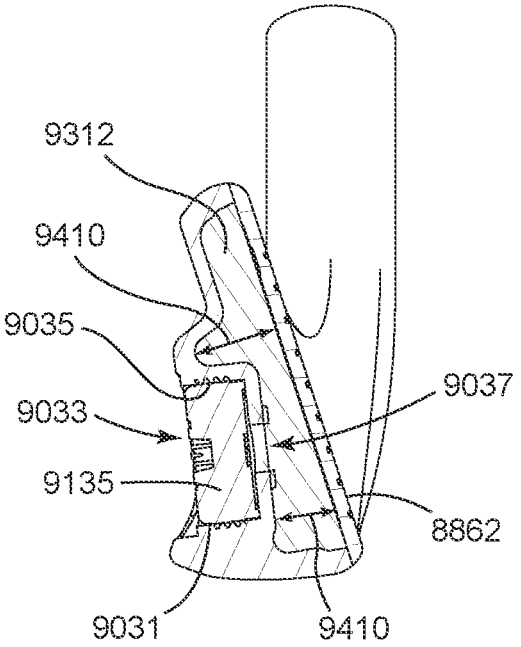
Figure 97:
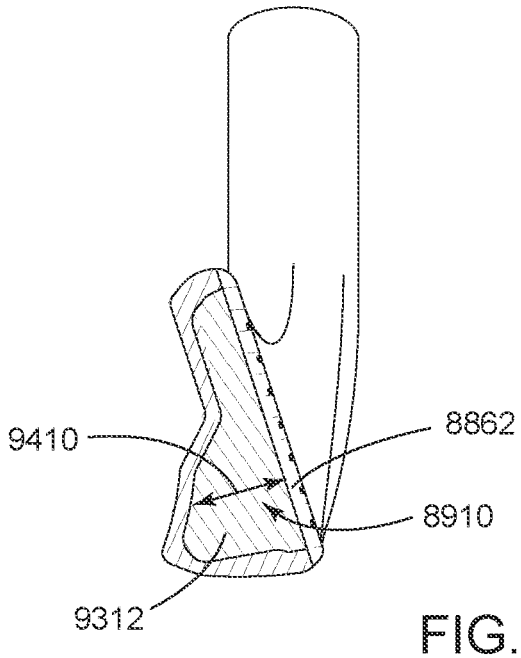
Figure 98:
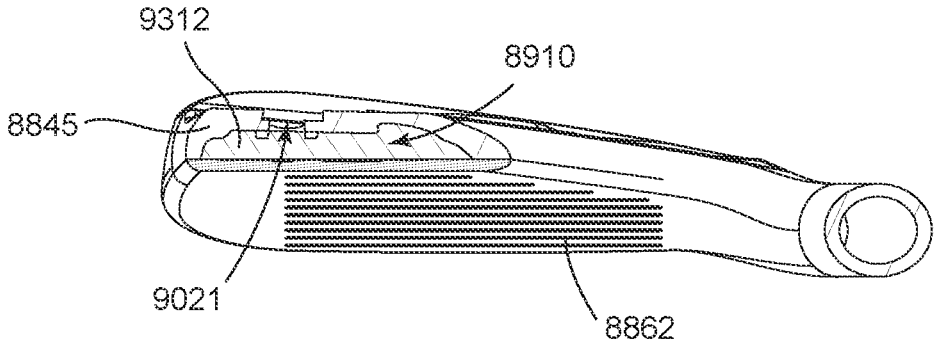
Figure 99:
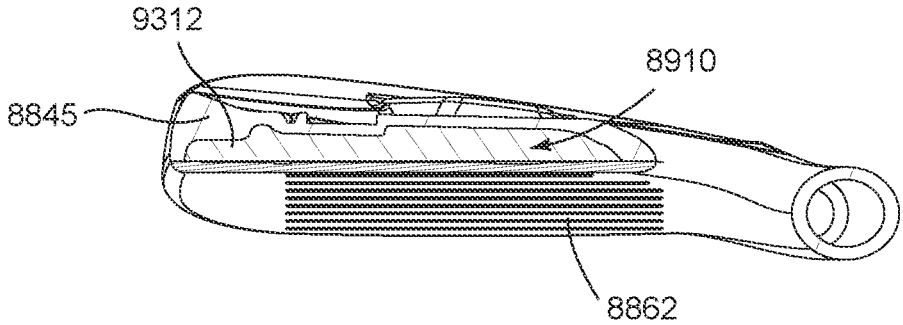
Figure 100:
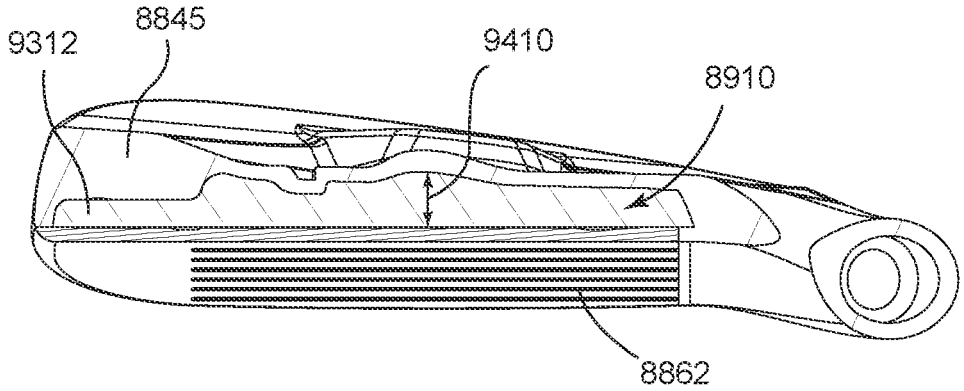
Figure 101:
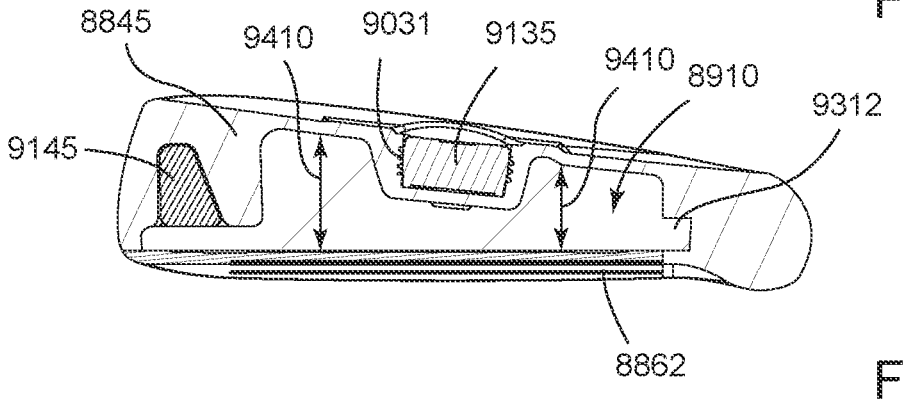

The third port 9041 may define a recess or cavity in the body portion 8810 that may be shaped to correspond to the shape of the internal mass portion 9145 to receive the internal mass portion 9145. In one example, as illustrated in FIGS. 88-106, the third port 9041 may be shaped to completely receive the internal mass portion 9145 so that the outer surface of the internal mass portion is flush with the interior walls of the body portion 8810 defining the interior cavity 8910. The internal mass portion 9145 may be secured inside the third port 9041 with one or more adhesives or bonding agents, by welding or soldering, and/or by being press fit. The third port 9041 may be defined by a cavity inside a body mass portion 8845, which may be an integral portion of the body portion 8810, formed with the body portion 8810, and/or include the same materials as the materials of the body portion 8810. The body mass portion 8845 may be located in the toe portion 8840 and may extend to the toe portion edge 8842 to increase the moment of inertia of the golf club head 8800. The shape, size, volume, and/or mass of the body mass portion 8845 may be determined to provide certain performance characteristics for the golf club head 8800. In one example, as illustrated in FIGS. 88-106, the body mass portion 8845 may be located in the toe portion 8840, extend to the toe portion edge 6742, and extend from a location at or proximate to the horizontal midplane 9220 to the sole portion edge 6792. The shape, size, volume, and/or mass of the body mass portion 8845 may vary and depend on various properties of the golf club head 8800 including the loft angle 9245. For example, as illustrated in FIGS. 72 and 93, the loft angle 7145 of the golf club head 6700 is greater than the loft angle 9245 of the golf club head 8800. Accordingly, as illustrated in FIGS. 67-106, the body mass portion 6745 has a different configuration than the body mass portion 8845. As illustrated in FIGS. 67-106, the third port 6941 and the third port 9041 and the internal mass portions 7045 and 9145 may also have different configurations (e.g., height, width, depth, shape, size) that may depend on certain golf club characteristics including loft angle to provide certain performance characteristics (e.g., ball speed, distance, spin, height, trajectory) for a golf club head. The apparatus, methods, and articles of manufacture described herein are not limited in this regard.

The interior cavity 8910 may vary in width between the toe portion 8840 and the heel portion 8850. An interior cavity width 9410 may be smaller proximate to the toe portion edge 8842 than the interior cavity width 9410 at the center portion of the body portion or at the heel portion 8850. Accordingly, a greater portion of the mass of the body portion 8810 may be closer to the toe portion edge 8842 than the heel portion edge 8852 to increase the moment of inertia of the body portion 8810. In one example, as illustrated in FIGS. 88-106, the interior cavity width 9410 may have a maximum value at a location between the external mass portion 9135 and the internal mass portion 9145. In another example, as also illustrated in FIGS. 88-106, a center portion of the interior cavity 8910, which may be a region of the interior cavity that is at or surrounding the first port 9021 may define the largest volume of the interior cavity as compared to other portions of the interior cavity 8910 so as to accommodate a larger volume of a filler material as described herein for enhanced sound and vibration dampening and feel. In yet another example, as also illustrated in FIGS. 88-106, a portion of the interior cavity 8910 above the internal mass portion 9145 and any filler material that may be in the interior cavity 8910 may extend aft of the internal mass portion 9145 above the internal mass portion 9145. Accordingly, as described herein, a region of the interior cavity that surrounds the first port 9021 may define the largest volume of the interior cavity as compared to other portions of the interior cavity 8910 to accommodate a larger volume of a filler material as described herein for enhanced sound and vibration dampening and feel. The apparatus, methods, and articles of manufacture described herein are not limited in this regard.

In one example, as illustrated in FIGS. 88-106, the second port 9031, the badge 9128, and the internal mass portion 9145 may be located between the external mass portion 9135 and the toe portion edge 8842. As described herein, the external mass portion 9135 may function to lower the center of gravity of the golf club head 8800 and shift the center of gravity rearward. The internal mass portion 9145 may function to increase the moment of inertia of the golf club head 8800. Additionally, with the bottom portion 9648 of the internal mass portion 9145 having a greater mass than the top portion 9646, a vertical location of the center of gravity of the golf club head 8800 may not be largely shifted by the internal mass portion 9145. In one example, the size, shape, and/or location of the internal mass portion 9145 may be associated with the loft angle 9245. A golf club head with a lower loft angle may experience higher swing velocities and ball impact forces than a golf club head with a higher loft angle. Accordingly, the shape, size, and/or location of the internal mass portion 9145 may vary and be determined based on the loft angle to provide certain center of gravity location and moments of inertia for optimum golf club head performance. For example, the golf club head 8800 has a smaller loft angle than the golf club head 6700. As illustrated in FIGS. 67-106, the internal mass portion 7045 may have a different shape, size (e.g., different dimensions, profiles, angles, and/or relative segment proportions) and location (e.g., different distances to toe portion edge 8842 and/or sole portion edge 8892) relative to the internal mass portion 9145. The apparatus, methods, and articles of manufacture described herein are not limited in this regard.

In one example, the badge 9128 may be constructed from a material having a lower density than the material of the body portion 8810 to not have a large effect on the mass distribution of the body portion 8810. In yet another example, the badge 9128 may be made from a material having a relatively large density such as the material form which any of the mass portions may be constructed. Accordingly, the badge 9128 may function to increase the moment of inertia of the golf club head 8800. The apparatus, methods, and articles of manufacture described herein are not limited in this regard.

The interior cavity 8910 may be partially or entirely filled with one or more filler materials (i.e., a cavity filling material), which may include one or more similar or different types of materials. In one example, as illustrated in FIGS. 88-106, the interior cavity 8910 may be filled with a filler material 9312 that may be similar to the filler material 2512 of the golf club head 2000 or similar to any of the filler materials described herein or in any of the incorporated by reference patent documents. In another example (not illustrated for FIGS. 88-106), the interior cavity 8910 may be filled with a first filler material and a second filler material that may be similar to the first filler material 512 and the second filler material 514 of the golf club head 200 or similar to any of the golf club heads described in any of the incorporated by reference patent documents. In one example, as illustrated in FIGS. 88-106, the filler material 9312 may be injected into the interior cavity 8910 from any of the first port 9021 or the second port 9031, while the other one of the first port 9021 or the second port 9031 may functions as an air exhaust port through which the air in the interior cavity 8910 that is displaced by the filler material 9312 or excess filler material 9312 may exit. Accordingly, as illustrated in FIGS. 88-106, the filler material 9312 may be molded in the shape of the interior cavity 8910. The apparatus, methods, and articles of manufacture described herein are not limited in this regard.

Figure 102:
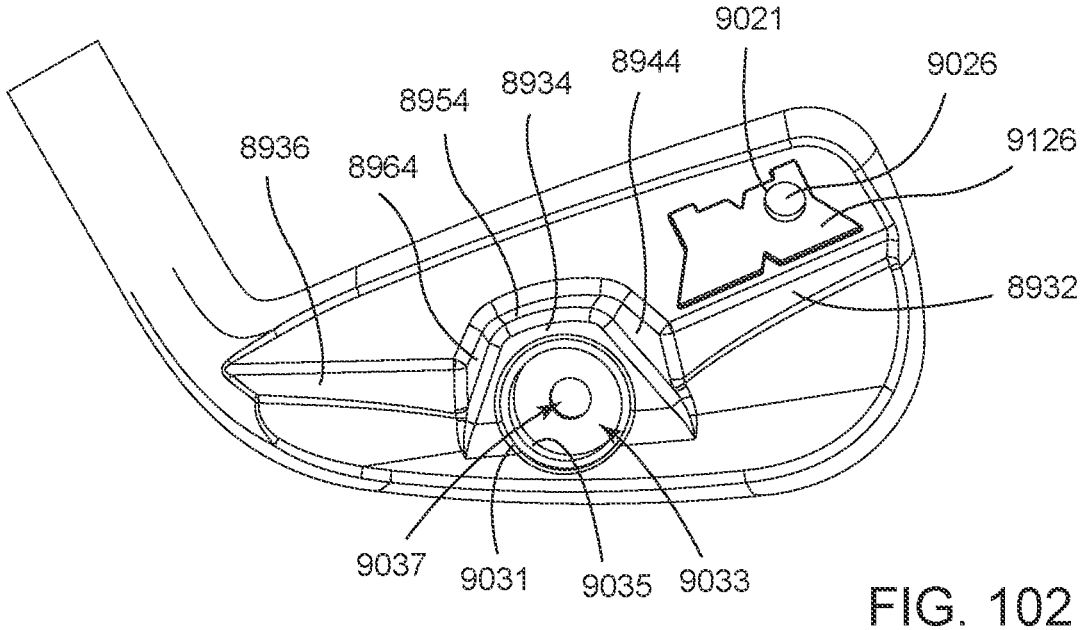
Figure 103:
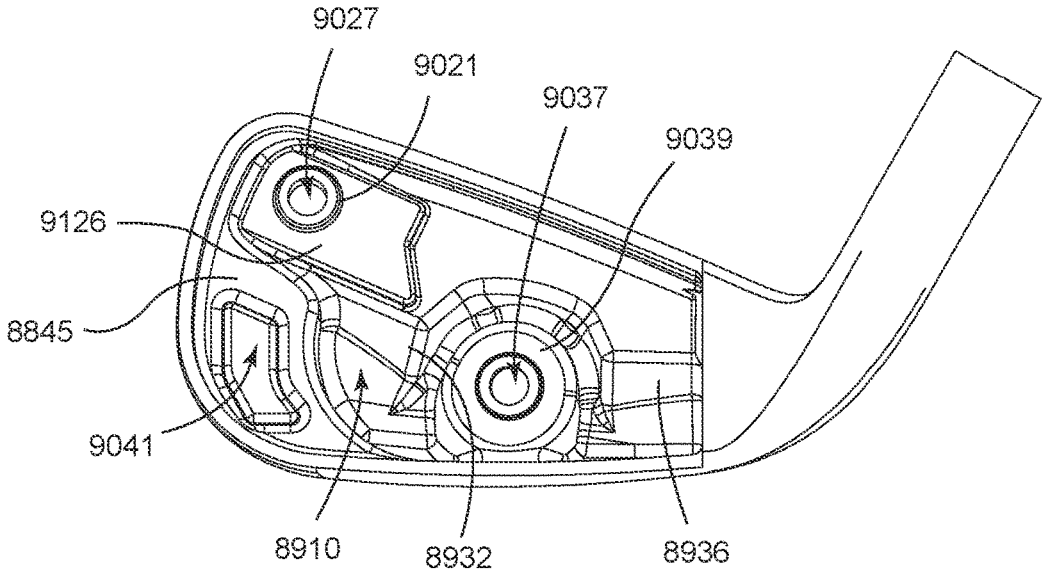
Figure 104:
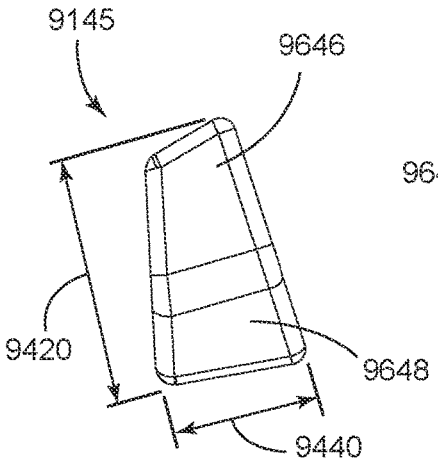
Figure 105:
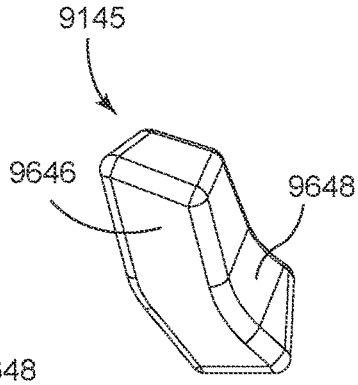
Figure 106:
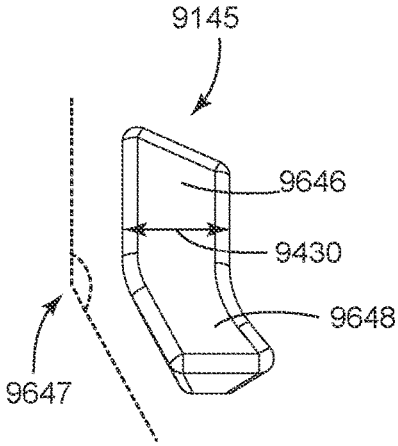
Figure 107:
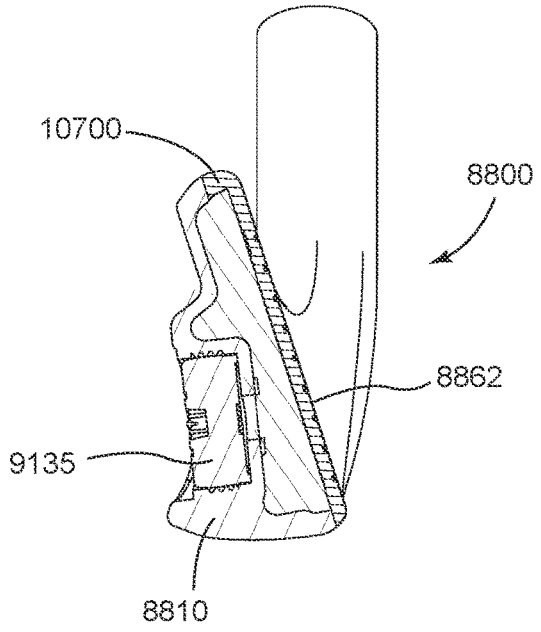
FIGS. 107, 108, 109, and 110 illustrate face portions configurations for of a golf club head according to embodiments of the apparatus, methods, and articles of manufacture described herein.
Figure 108:
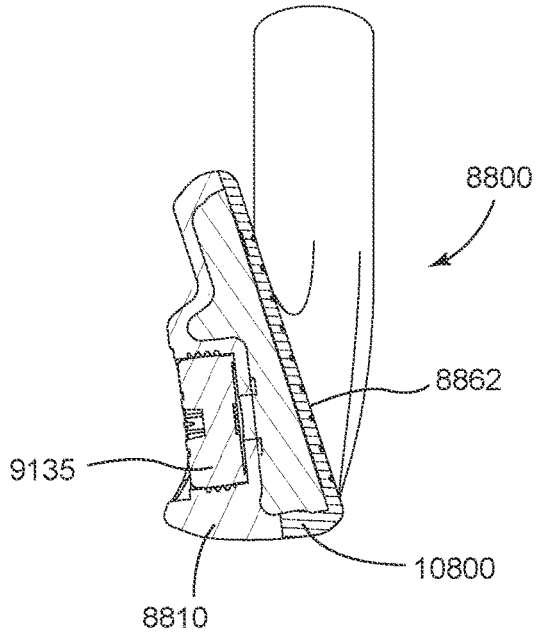
Figure 109:
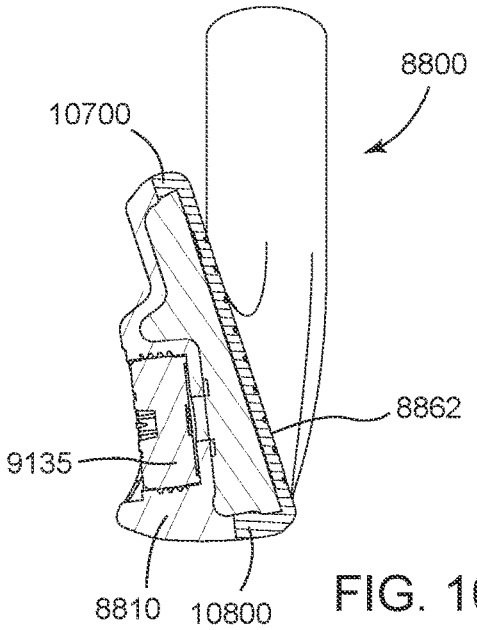
Figure 110:
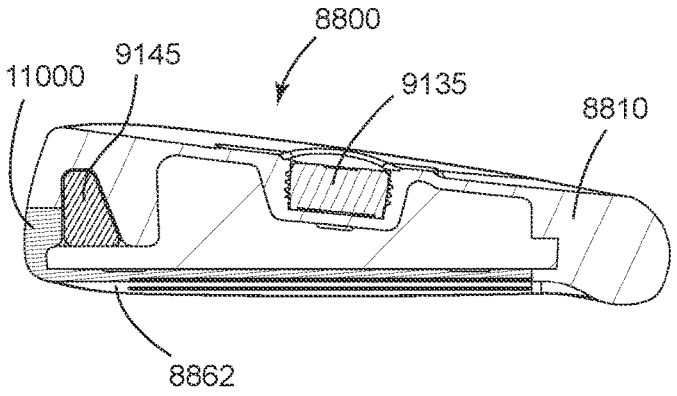
Figure 111:
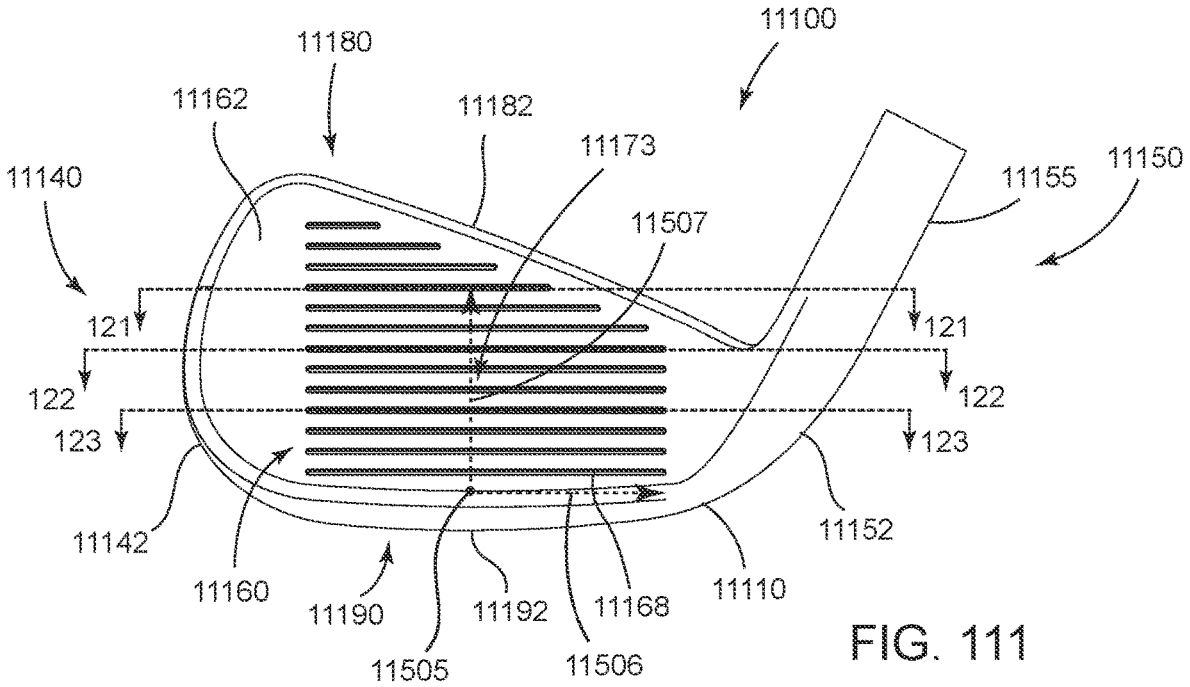
FIGS. 111, 112, 113, 114, 115, 116, 117, 118, 119, 120, 121, 122, 123, 124, 125, 126, 127, 128, 129, 130, 131, 132, 133, 134, 135, 136, and 137 illustrate a front view, a back view, a top view, a bottom view, a heel side view, a toe side view, a cross-sectional view taken at line 117-117 of FIG. 112, a cross-sectional view taken at line 118-118 of FIG. 112, a cross-sectional view taken at line 119-119 of FIG. 112, a cross-sectional view taken at line 120-120 of FIG. 112, a cross-sectional view taken at line 121-121 of FIG. 111, a cross-sectional view taken at line 122-122 of FIG. 111, a cross-sectional view taken at line 123-123 of FIG. 111, a cross-sectional view taken at line 125-125 of FIG. 112, another cross-sectional view taken at line 125-125 of FIG. 112, a back view of a port sleeve, a front view of a port sleeve, a front-side view of a mass portion, a side view of a mass portion, a back view, another back view, a front view without a face portion, a method of manufacturing, a cross-sectional view of another example taken at line 125-125 of FIG. 112, a perspective view of a filler compression portion, a rear view of another face portion, and a cross sectional view of the face portion of FIG. 136 taken at line 137-137 of FIG. 136, respectively, of a golf club head according to embodiments of the apparatus, methods, and articles of manufacture described herein.
Figure 112:
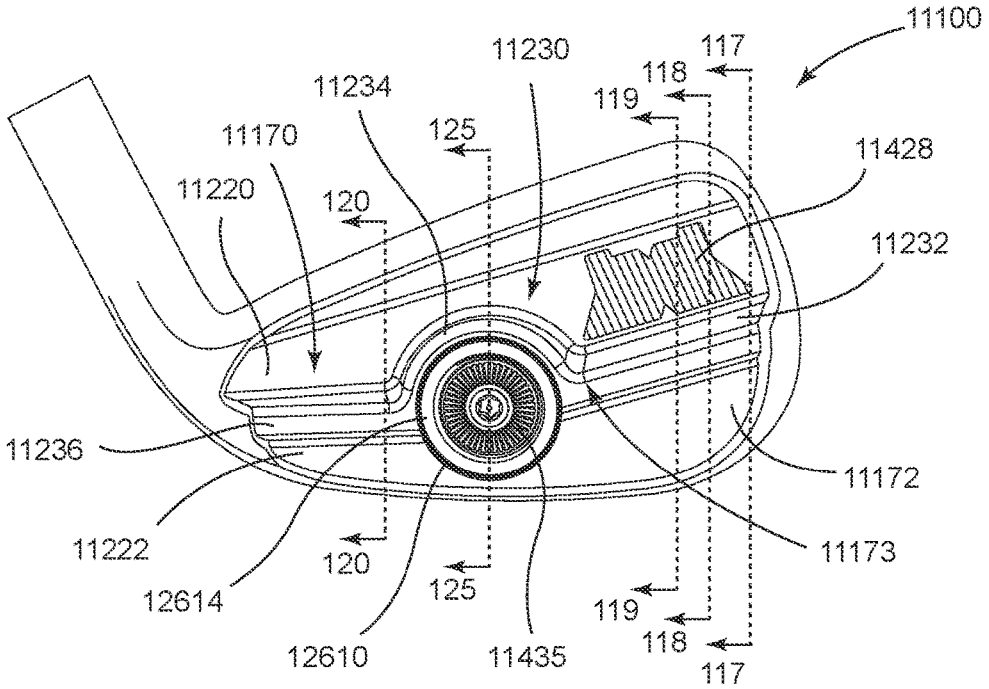

As described herein, the face portion 8862 may be a one-piece part with the body portion 8810 and be co-manufactured with the body portion 8810, or as illustrated in FIGS. 88-106, the face portion 8862 may be a separate piece that may be plate shaped and attached to the front portion 8860 to enclose the interior cavity 8910. In another example, as illustrated in FIG. 107, the face portion 8862 may define portions of the body portion 8810 at the top portion 8880. Accordingly, the face portion 8862 may be L-shaped (i.e., an inverted L-shape as illustrated in FIG. 102) and attached to the front portion 8860 to enclose the interior cavity 8910. As illustrated in the example of FIG. 107, the face portion 8862 may include a face top portion 10700 that may define a portion or portions of the top portion 8880 and the top portion edge 8882. In another example, as illustrated in FIG. 108, the face portion 8862 may define portions of the body portion 8810 at the sole portion 8890. Accordingly, the face portion 8862 may be L-shaped and attached to the front portion 8860 to enclose the interior cavity 8910. As illustrated in the example of FIG. 108, the face portion 8862 may include a face sole portion 10800 that may define a portion or portions of the sole portion 8890 and the sole portion edge 8892. In another example, as illustrated in FIG. 109, the face portion 8862 may define portions of the body portion 8810 at the top portion 8880 and portions of the body portion 8810 at the sole portion 8890. Accordingly, the face portion 8862 may be C-shaped or cup shaped and attached to the front portion 8860 to enclose the interior cavity 8910. As illustrated in the example of FIG. 109, the face portion 8862 may include a face top portion 10700 and a face sole portion 10800 that may define a portion or portions of the top portion 8880 including the top portion edge 8882 and the sole portion 8890, including the sole portion edge 8892, respectively. In another example, as illustrated in FIG. 110, the face portion 8862 may define all or portions of the body portion 8810 at the toe portion 8840. Accordingly, the face portion 8862 may be L-shaped and attached to the front portion 8860 to enclose the interior cavity 8910. As illustrated in the example of FIG. 110, the face portion 8862 may include a face toe portion 11000 that may define a portions or portions of the toe portion 8840 include the toe portion edge 8842. In yet another example, the face portion 8862 may be defined by any combination of the face portions illustrated in FIGS. 88-106 and 107-110. The apparatus, methods, and articles of manufacture described herein are not limited in this regard.

In the example of FIGS. 111-135, a golf club head 11100 may include a body portion 11110 having a toe portion 11140 with a toe portion edge 11142, a heel portion 11150 with a heel portion edge 11152 that may include a hosel portion 11155. A golf club shaft (such as the shaft 104 that is illustrated for example in FIG. 1) may include one end coupled to the hosel portion 11155 and an opposite end coupled to a golf club grip (such as the grip 106 that is illustrated for example in FIG. 1) to form a golf club (such as the golf club 100 that is illustrated for example in FIG. 1). The body portion 11110 may further include a front portion 11160, a back portion 11170 with a back wall portion 11172, a top portion 11180 with a top portion edge 11182, and a sole portion 11190 with a sole portion edge 11192. The toe portion 11140, the heel portion 11150, the front portion 11160, the back portion 11170, the top portion 11180, and/or the sole portion 11190 may partially overlap. The toe portion edge 11142, the heel portion edge 11152, the top portion edge 11182, and the sole portion edge 11192 may define a periphery or boundary of the body portion 11110. The golf club head 11100 may be any type of golf club head described herein, such as, for example, an iron-type golf club head or a wedge-type golf club head. The volume of the golf club head 11100, the materials of construction of the golf club head 11100, and/or any components thereof may be similar to any of the golf club heads described herein and/or described in any of the incorporated by reference patent documents. The apparatus, methods, and articles of manufacture described herein are not limited in this regard.

The golf club head 11100 may include a face portion 11162 (i.e., the strike face), which may be integrally formed with the body portion 11110 (e.g., a single unitary piece). In one example, as illustrated in FIGS. 111-135, the face portion 11162 may be a separate piece coupled (e.g., directly or indirectly, adhesively, mechanically, by welding, and/or by soldering) to the front portion 11160 to close a front opening of the front portion 11160. The face portion 11162 may include a front surface 11164 and a back surface 11166. The front surface 11164 may include front grooves 11168 that may extend between the toe portion 11140 and the heel portion 11150. The front grooves 11168 may be similar in many respects to the front grooves 2068 of the golf club head 2000 or similar to the front grooves of any of the golf club heads described herein or described in any of the incorporated by reference patent documents. The back surface 11166 of the face portion 11162 may include one or more grooves, slots, channels, depressions, or recesses. In one example, the grooves on the back surface 11166 may be similar in many respects to the back grooves of the golf club head 2000, such as the back grooves illustrated in FIGS. 35-38 and 43-66. In another example, the back surface 11166 may not include any grooves, slots, channels, depressions, or recesses. The face portion 11162 and the attachment thereof to the body portion 11110 or manufacturing thereof with the body portion 11110 may be similar in many respects to any of the face portions described herein or described in any of the incorporated by reference patent documents. The apparatus, methods, and articles of manufacture described herein are not limited in this regard.

Figure 113:
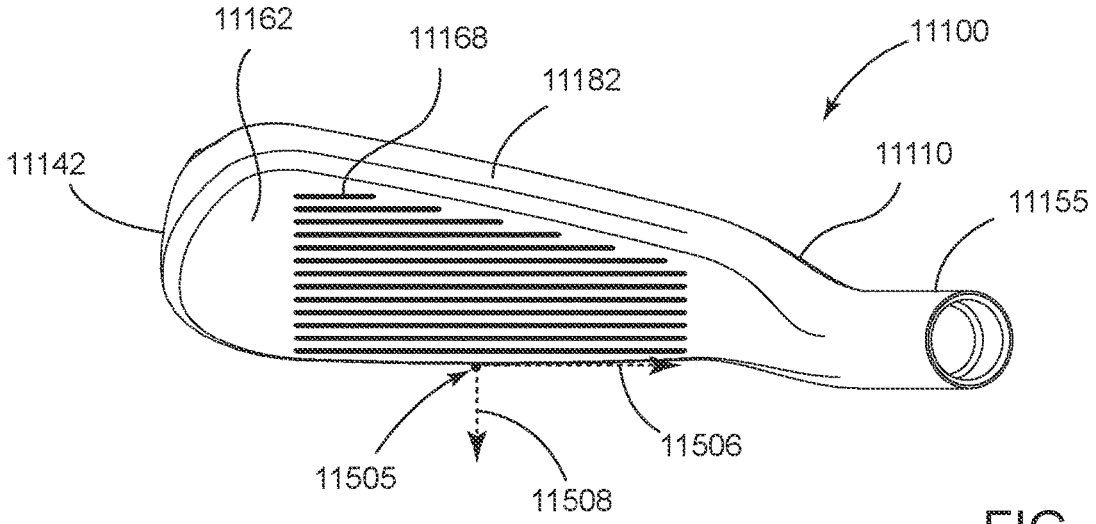
Figure 114:
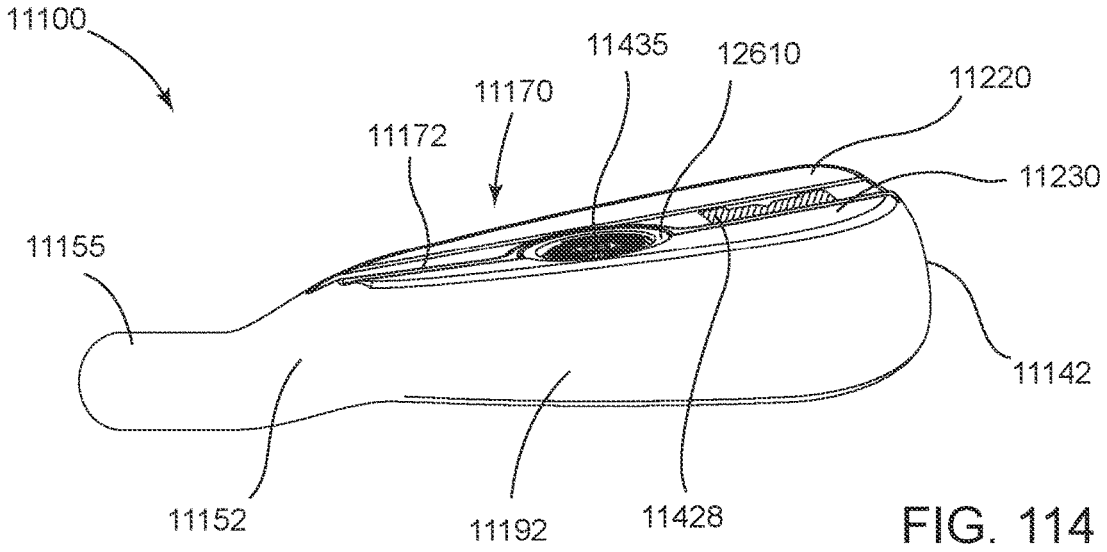
Figure 115:
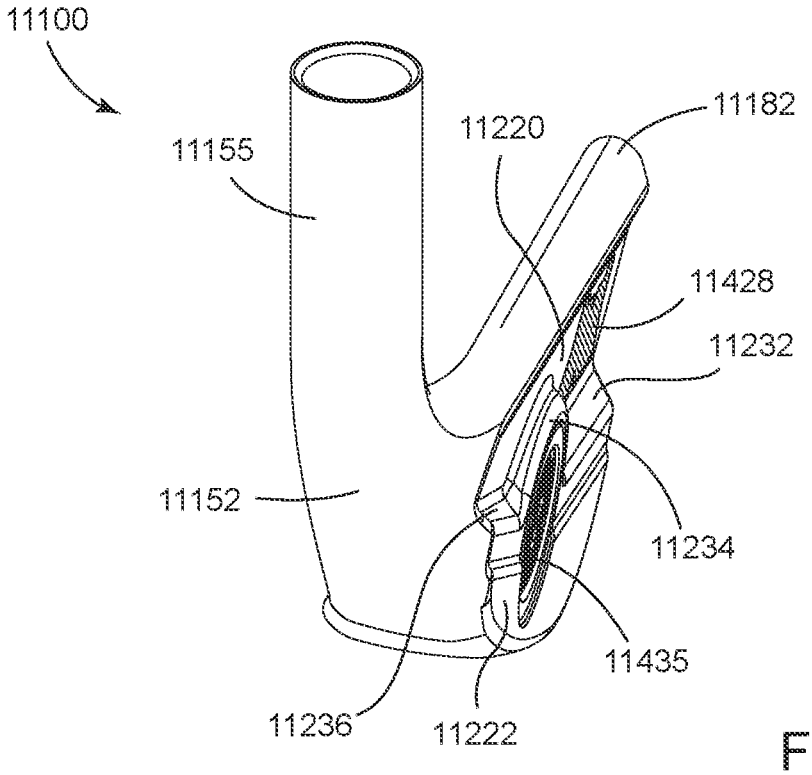
Figure 116:
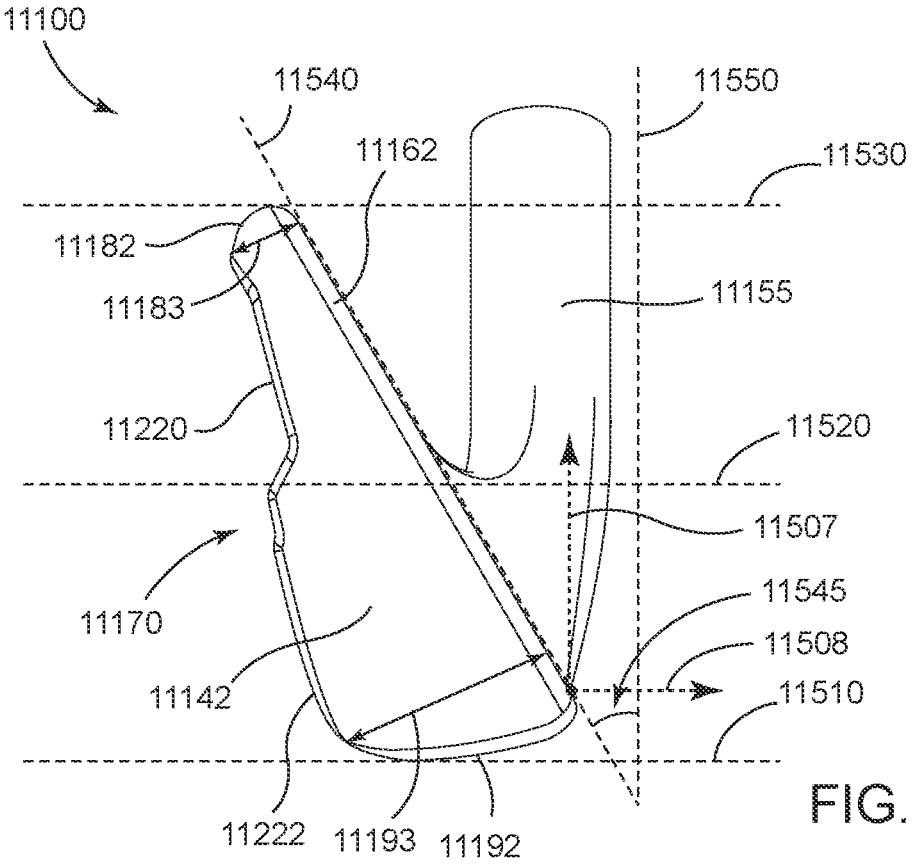
Figure 117:
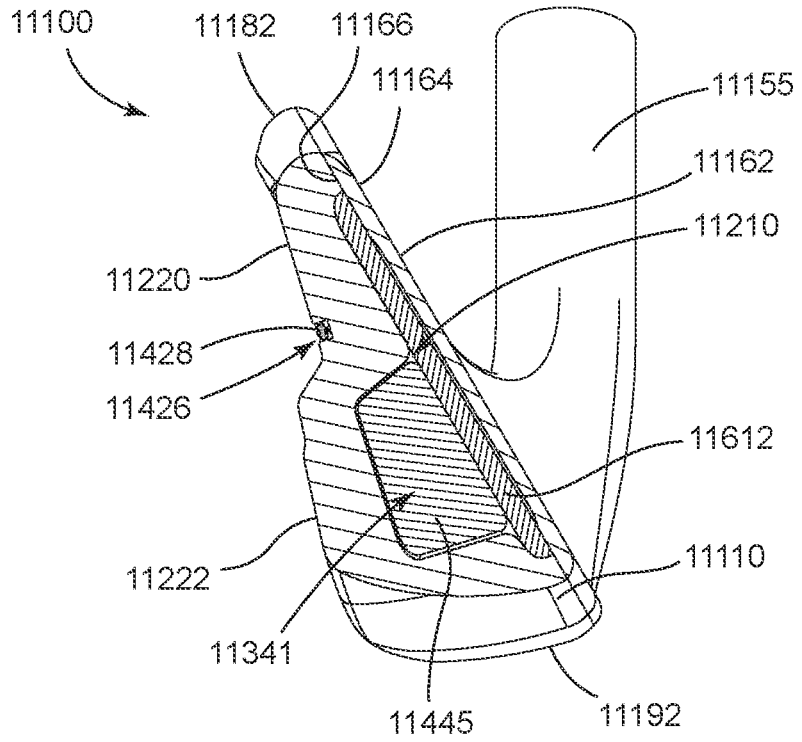
Figure 118:
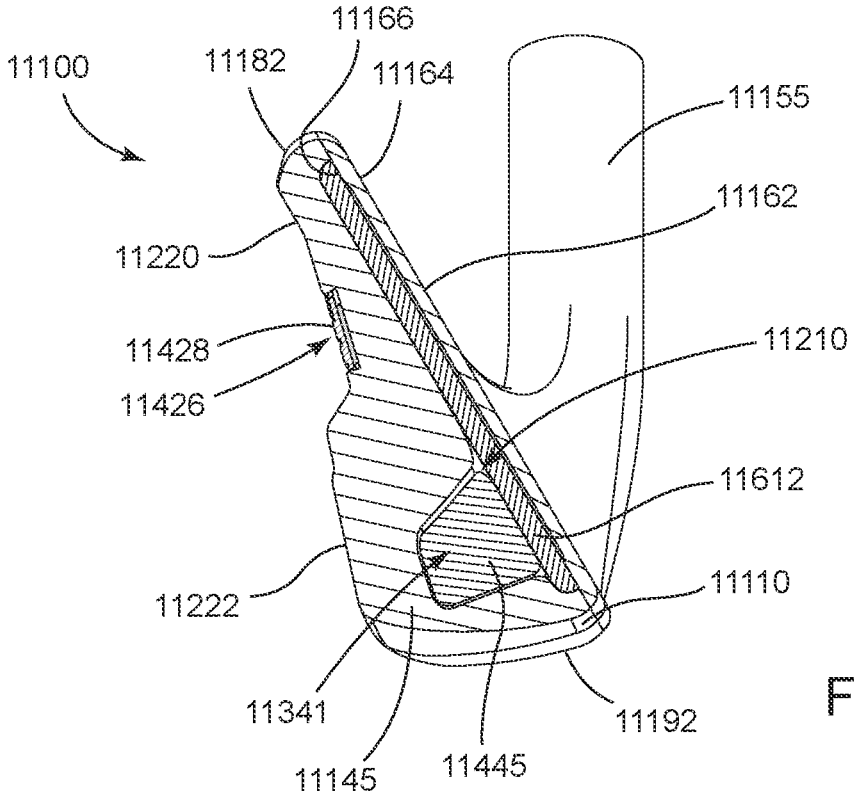
Figure 119:
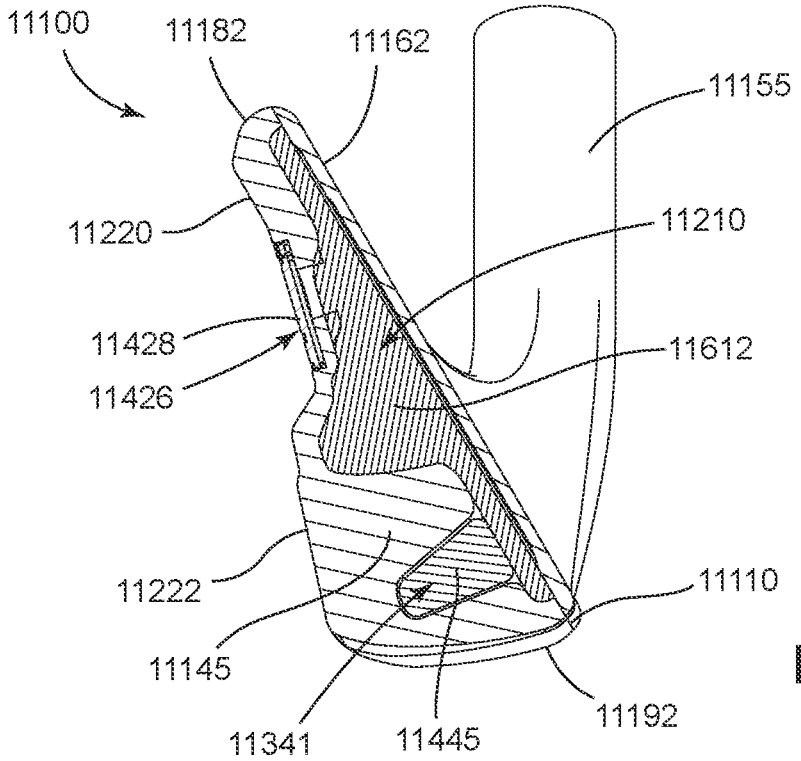
Figure 120:
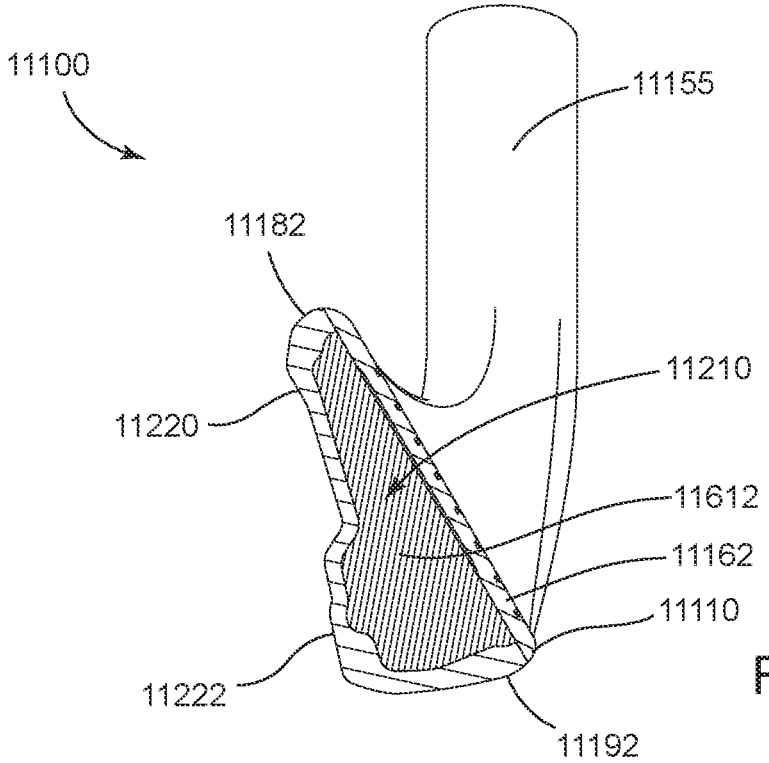
Figure 121:
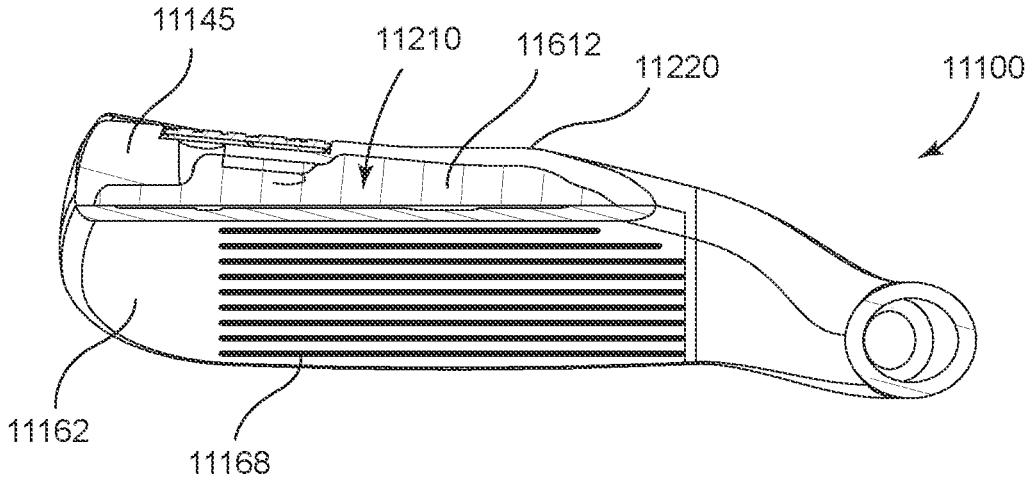
Figure 122:
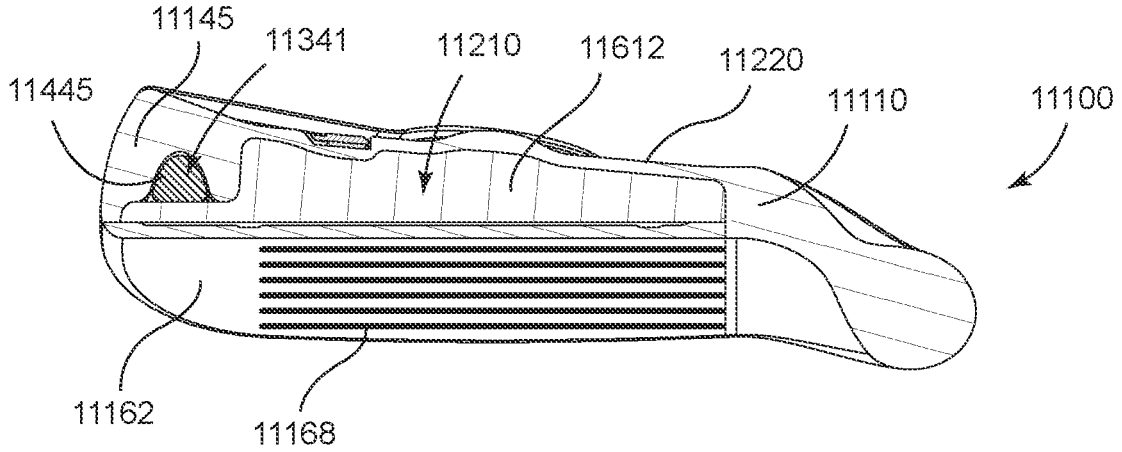

Any location on the golf club head 11100 (or any of the golf club heads described herein) may be referenced by x, y, and z coordinates of a reference coordinate system. The coordinate system may have a horizontal x-axis, a vertical y-axis that is orthogonal to the x-axis, and a z-axis that is orthogonal to both the x-axis and the y-axis, all of which intersect at an origin of the coordinate system. In one example, as illustrated in FIGS. 111-116, the origin 11505 of the coordinate system or the location of coordinates x=0, y=0, and z=0 may be at the lowest point of the planar portion or flat portion of the face portion 11162 or the lowest point on the face portion 11162 prior to any curved transition portion between the face portion 11162 and the sole portion edge 11192. The x-axis (shown for example by reference number 11506) of the coordinate system may extend in the horizontal and heel-to-toe direction with the positive x-axis extending from the origin 11505 in a direction towards the heel portion edge 11152. The y-axis (shown for example by reference number 11507) of the coordinate system may extend in the vertical direction and be orthogonal to the x-axis with the positive y-axis extending vertically upward from the origin 11505. The z-axis (shown for example by reference number 11508) of the coordinate system may be orthogonal with both the x-axis and the y-axis with the negative z-axis extending from the origin in a direction towards the back portion 11170 (positive z-axis direction is shown in FIGS. 113 and 116). In another example, the location of coordinates x=0, y=0, and z=0 may be at the lowest location of the toe portion edge 11142. In another example, the location of coordinates x=0, y=0, and z=0 may be at the center of gravity of the golf club head 11100. In yet another example, the location of coordinates x=0, y=0, and z=0 may be at a geometric center of the face portion 11162. The location of coordinates x=0, y=0, and z=0 may be at any location on the golf club head 11100 or outside the golf club head 11100. Additionally, the coordinate system may have the x-axis, y-axis, and the z-axis at different directions (e.g., x direction being vertical and y direction being horizontal) than the coordinate systems described herein. Accordingly, any location on the golf club head 11100 may be referenced with x, y, and z coordinates relative to x=0, y=0, and z=0 of a reference coordinate system. The apparatus, methods, and articles of manufacture described herein are not limited in this regard.

The golf club head 11100 may be associated with a ground plane 11510, a horizontal midplane 11520, and a top plane 11530. In particular, the ground plane 11510 may be a plane that is parallel or substantially parallel to the ground and is tangent to the lowest portion of the sole portion edge 11192 when the golf club head 11100 is at an address position (e.g., the golf club head 11100 aligned to strike a golf ball). A top plane 11530 may be a plane that is tangent to the upper most portion of top portion edge 11182 when the golf club head 11100 is at the address position. The ground plane 11510 and the top plane 11530 may be parallel or substantially parallel. The horizontal midplane 11520 may be vertically halfway between the ground plane 11510 and the top plane 11530, respectively, and be parallel or substantially parallel to the ground plane 11510. Further, the golf club head 11100 may be associated with a loft plane 11540 defining a loft angle 11545 ($\alpha$) of the golf club head 11100. The loft plane 11540 may be a plane that is tangent to or coplanar with the face portion 11162. The loft angle 11545 may be defined by an angle between the loft plane 11540 and a vertical plane 11550 that is normal to the ground plane 11510. The apparatus, methods, and articles of manufacture described herein are not limited in this regard.

The back wall portion 11172 may include an upper back wall portion 11220, a lower back wall portion 11222, and a ledge portion 11230 between the upper back wall portion 11220 and the lower back wall portion 11222. The ledge portion 11230 may extend outward (i.e., away from the face portion 11162) from the upper back wall portion 11220 to the lower back wall portion 11222 (i.e., the ledge portion 11230 may extend inward or toward the face portion 11162 from the lower back wall portion 11222 to the upper back wall portion 11220). The ledge portion 11230 may include a first ledge portion 11232 that may extend from a location at or proximate to the toe portion edge 11142 toward the heel portion 11150, a second ledge portion 11234 that may be located at or proximate to a center portion 11173 of the back wall portion 11172, and a third ledge portion 11236 that may extend from a location at or proximate to the heel portion edge 11152 toward the toe portion 11140. The second ledge portion 11234 may extend between the first ledge portion 11232 and the third ledge portion 11236. The first ledge portion 11232 may also extend in a downwardly inclined direction from a location at or proximate to the toe portion edge 11142 to the second ledge portion 11234. The third ledge portion 11236 may also extend in a downwardly inclined direction from a location at or proximate to the heel portion edge 11152 to the second ledge portion 11234. Alternatively, the first ledge portion 11232 and/or the third ledge portion 11236 may be upwardly inclined or horizontally oriented. The ledge portion 11230 including the first ledge portion 11232, the second ledge portion 11234, and the third ledge portion 11236 may be similar in many respects (e.g., height, width, orientation, configurations of any sidewall portions, configurations of any ledge portion transition portions, etc.) to the ledge portion 2130 including the first ledge portion 2132, the second ledge portion 2134, and the third ledge portion 2136, respectively, of the golf club head 2000. The ledge portion 11230 may be similar in many respects to any of the ledge portions described herein or described in any of the incorporated by reference patent documents. The apparatus, methods, and articles of manufacture described herein are not limited in this regard.

In one example, as illustrated in FIG. 116, a top rail width 11183, which may be defined as a distance between the back wall portion 11172 and the face portion 11162 at the top portion edge 11182, may be greater than equal to 0.25 inch (6.35 mm) and less than or equal to 0.35 inch (8.89 mm), and a sole width 11193, which may be defined as a distance between the back wall portion 11172 and the face portion 11162 at the sole portion edge 11192, may be greater than equal to 0.75 inch (19.05 mm) and less than or equal to 1.05 inch (26.67 mm). In another example, the top rail width 11183 may be greater than equal to 0.2 inch (5.08 mm) and less than or equal to 0.5 inch (12.7 mm), and the sole width 11193 may be greater than equal to 0.5 inch (12.7 mm) and less than or equal to 1.75 inch (44.45 mm). In yet another example, a ratio of the sole width 11193 to the top rail width 11183 may be greater than or equal to 2.5 and less than or equal to 3.5. Accordingly, a greater portion of the mass portion of the body portion 11100 may be located closer to the sole portion edge 11192 than the top portion edge 11182 to place the center of gravity of the golf club head 11100 relatively low or as low as possible while complying with rules established by one or more golf governing bodies to provide optimum performance for the golf club head 11100. The apparatus, methods, and articles of manufacture described herein are not limited in this regard.

The body portion 11110 may include one or more ports, which may be exterior ports and/or interior ports (e.g., located inside the body portion 11110). The one or more ports may be at any location on the body portion 11110. The inner walls of the body portion 11110 that define the interior cavity 11210 may include one or more ports. In one example, the body portion 11110 may include ports that may be similar in many respects to the ports of the golf club head 2000 as illustrated in FIG. 23. In another example, the body portion 11110 may include ports that may be similar in many respects to the ports of the golf club head 200 as illustrated in FIG. 3. In another example, the body portion 11110 may include ports that may be similar in many respects to any of the ports described in any of the incorporated by reference patent documents. In yet another example, as illustrated in FIGS. 111-135, the body portion 11110 may include a first port 11321 above the first ledge portion 11232, a second port 11331 located below the second ledge portion 11234, and a third port 11341 in the interior cavity 11210. Accordingly, the first port 11321 and the second port 11331 may be external ports, i.e., having port openings on an external surface of the body portion 11110, whereas the third port 11341 may be an internal port having an opening on one or more internal walls of the body portion 11110 that define the interior cavity 11210. The apparatus, methods, and articles of manufacture described herein are not limited in this regard.

In one example as illustrated in FIGS. 111-135, the first port 11321 may be located above the first ledge portion 11232 and proximate to the toe portion edge 11142. In another example, the first port 11321 may be on the toe portion edge 11142. In yet another example, the first port 11321 may be below the first ledge portion 11232. The first port 11321 may have a first port first opening 11326 on the back wall portion 11172 that may be raised, coplanar, or recessed relative to portions of the back wall portion 11172 that surround the first port first opening 11326. In one example, as illustrated in FIGS. 111-135, the first port first opening 11326 may be inside a recessed portion 11426 on the upper back wall portion 11220. The first port 11321 may be cylindrical and extend from the first port first opening 11326 to the interior cavity at a first port second opening 11327 to connect to the interior cavity 11210. Accordingly, the first port first opening 11326 may provide access to the interior cavity 11210 from outside of the body portion 11110 via the first port second opening 11327. As illustrated in FIGS. 111-135, the first port 11321 may have a circular cross section (i.e., cylindrical port). In another example, the first port 11321 may be elliptical. In yet another example, the first port 11321 may have any shape. In one example, as illustrated in FIGS. 111-135, the recessed portion 11426 may be configured to receive a cover portion or a badge 11428 to cover the first port first opening 11326. In another example, the first port 11321 may be closed with a mass portion that may be constructed from a material having a different density than a material of the body portion 11110. In yet another example, the first port 11321 may be closed with a mass portion that may be constructed from a material having the same density as a material of the body portion 11110. The apparatus, methods, and articles of manufacture described herein are not limited in this regard.

In one example, the badge 11428 may display one or more alphanumeric characters, symbols, shapes or other visual marks to signify a particular feature of or information about of the golf club head 11100. Accordingly, the badge 11428 may be configured to be inserted and secured in the recessed portion 11426. In one example, the badge 11428 may be secured in the recessed portion 11426 with an adhesive or a bonding agent. In another example, depending on the material of construction of the badge 11428, welding or soldering may be used to attach the badge 11428 inside the recessed portion 11426. In another example, the badge 11428 may be press fit into the recessed portion 11426. In yet another example, one or more fasteners may be used to attach the badge 11428 inside recessed portion 11426. As described herein, the badge 11428 may cover and/or close the first port 11321. In one example, the badge 11428 may be plate shaped to fit in the recessed portion 11426. In another example, the badge 11428 may further have a projection that may be received in the first port 11321 to close the first port 11321. In another example, the badge 11428 may be rectangular, circular, or have any shape. In another example, the badge 11428 may be visible and distinguishable from the remaining parts of the body portion 11110 by color, texture, materials of construction, and/or other visual features. In yet another example, the badge 11428 may be attached to the body portion 11110 such as to appear seamless or almost seamless with the body portion 11110 and be an integral part of the body portion 11110, i.e., indistinguishable or almost indistinguishable from the body portion 11110. The apparatus, methods, and articles of manufacture described herein are not limited in this regard.

In one example, as illustrated in FIGS. 111-135, the second port 11331 may be larger in diameter than the first port 11321. The distance between a center of the second port 11331 and the sole portion edge 11192 may be less than the distance between the center of the second port 11331 and the top portion edge 11182. Accordingly, the second port 11331 may be closer to the sole portion edge 11192 than to the top portion edge 11182. The second port 11331 may be located at or proximate to the center portion 11173 of the back wall portion 11172 and at or proximate to the sole portion edge 11192. The second port 11331 may be located between the sole portion edge 11192 and the second ledge portion 11234. The second port 11331 may be similar in many respects to the second port 2231 of the golf club head 2000. The second port 11331 may have a second port first opening 11333 on the back wall portion 11172 and port walls 11335 that extend from the second port first opening 11333 to a second port second opening 11337 that may be connected to the interior cavity 11210. Accordingly, the interior cavity 11210 may be accessed from outside of the body portion 11110 through the second port first opening 11333 and the second port second opening 11337. In one example, an inner diameter of the second port 11331 may be greater than or equal to 0.2 inch (5.08 mm) and less than or equal to 1.0 inch (25.4 mm). In another example, the inner diameter of the second port 11331 may be greater than or equal to 0.3 inch (7.62 mm) and less than 1.5 inch (38.1 mm). In another example, the inner diameter of the second port 11331 may be greater than or equal to 0.4 inch (10.16 mm) and less than or equal to 0.8 inch (20.32 mm). In yet another example, the inner diameter of the second port 11331 may be greater than or equal to 0.5 inch (12.7 mm) and less than or equal to 0.7 inch (17.78 mm). The apparatus, methods, and articles of manufacture described herein are not limited in this regard.

As illustrated in FIGS. 111-135, the second ledge portion 11234 may partially surround the second port 11331. Accordingly, in one example, as illustrated in FIGS. 111-135, the second ledge portion 11234 may have a curved or semi-circular shape that may surround the upper portion of the second port 11331. Alternatively, the second ledge portion 11234 may be similar to any of the second ledge portions described herein or described in any of the incorporated by reference patent documents. The apparatus, methods, and articles of manufacture described herein are not limited in this regard.

The body portion 11110 may include any number of ports above and/or below the first ledge portion 11232, the second ledge portion 11234, and/or the third ledge portion 11236. The body portion 11110 may include any number of ports above and/or below the horizontal midplane 11520. The body portion 11110 may include any number of ports on the toe portion edge 11142, the heel portion edge 11152, the top portion edge 11182, and/or the sole portion edge 11192. Any port may be connected to the interior cavity 11210. The number of ports on the body portion 11110, the arrangement and/or the configuration of the ports on the body portion 11110 may be similar in many respects to any of the golf club heads described herein or in any of the incorporated by reference patent documents. The apparatus, methods, and articles of manufacture described herein are not limited in this regard.

In one example, as illustrated in FIGS. 111-135, the golf club head may include a port sleeve 12610 that may be sized to be inserted into the second port 11331. The port sleeve 12610 may be constructed from any material such as metals, polymers, and/or composite materials. The port sleeve 12610 may be constructed from a material having a lower density than the material of the body portion 11110. The lower mass of the port sleeve 12610 relative to a port sleeve 12610 constructed from a material having the same or higher density than the material of the body portion 11110, or a golf club head 11100 without a port sleeve 12610 (i.e., the space filled by the port sleeve 12610 is filled with a material having the same or higher density than the material of the body portion 11110), allows more mass to be shifted to the toe region of the body portion 11110 to increase the moment of inertia of the golf club head or optimize the location of the center of gravity of the golf club head 11100 without changing or greatly changing the total mass of the golf club head 11100. In other words, the port sleeve 12610 allows mass to be shifted from the center portion of the golf club head 11100 to other parts of the golf club head 11100 to optimize the performance of the golf club head 11100. In one example, the port sleeve 12610 may provide a weight savings of greater than or equal to 0.5 gram and less than or equal to 10 grams at the center portion of the golf club head 11100 to be shifted to other locations on the golf club head 11100 as described herein. In another example, the port sleeve 12610 may provide a weight savings of greater than or equal to 2 gram and less than or equal to 7 grams at the center portion of the golf club head 11100 to be shifted to other locations on the golf club head 11100 as described herein. In yet another example, the port sleeve 12610 may provide a weight savings of greater than or equal to 1 gram and less than or equal to 5 grams at the center portion of the golf club head 11100 to be shifted to other locations on the golf club head 11100 as described herein. The apparatus, methods, and articles of manufacture described herein are not limited in this regard.

In one example, as illustrated in FIGS. 111-135, the port sleeve 12610 may be constructed from titanium or any titanium-based materials, whereas all or portions of the body portion 11110 may be constructed from steel or steel-based materials. In another example, the port sleeve 12610 may be constructed from a polymer material. In yet another example, the port sleeve 12610 may be constructed from a composite material. For certain applications or configurations of the golf club head 11100, the port sleeve 12610 may be constructed from a material having a greater density than the density of the material of the body portion 11110 to place more mass at or proximate to the center portion of the golf club head 11100. The port sleeve 12610 may be constructed from a material having the same density or a different density as the density of the material of the body portion 11110. The apparatus, methods, and articles of manufacture described herein are not limited in this regard.

In one example, as illustrated in FIGS. 111-135, the port sleeve 12610 may include a sleeve body 12612 and a sleeve bezel 12614. The sleeve body 12612 may have an outer diameter that is sized to be movably received in the second port 11331 while coupling to or engaging the inner walls of the second port 11331 as described herein. In one example, the sleeve body 12612 may be externally threaded and compatible with threaded port walls 11335 of the second port 11331. Accordingly, the port sleeve 12610 may be inserted into and engage the threaded inner walls of the second port 11331 by being screwed into the second port 11331. The port sleeve 12610 may include a sleeve bottom 12616 having one or more structures, such as projections, recesses, and/or apertures for engaging a tool to turn the port sleeve 12610 inside the second port 11331 and/or to provide access to the interior cavity 11210. In one example, as illustrated in FIGS. 111-135, the sleeve bottom 12616 may include a bottom opening 12617 to provide access to the interior cavity 11210 from the second port 11331 when the port sleeve 12610 is inside the second port 11331, and the sleeve bottom 12616 may include recesses 12618 that may be rectangular and configured in a four quadrant arrangement to provide engagement with a correspondingly shaped tool (not shown) to turn the port sleeve 12610 and secure the port sleeve 12610 in the second port 11331. A tool that engages the recesses 12618 may also include a cylindrical projection that may be inserted into the bottom opening 12617 to engage the sleeve bottom 12616 and/or function to center the tool on the sleeve bottom 12616 for engagement with the recesses 12618. The sleeve bottom 12616 may have any structure and/or openings for engaging a corresponding tool for turning the port sleeve 12610 inside the second port 11331. The apparatus, methods, and articles of manufacture described herein are not limited in this regard.

The sleeve bezel 12614 may have a greater diameter than the sleeve body 12612 and a greater diameter than the internal diameter of the second port 11331. Accordingly, the sleeve bezel 12614 may engage the back wall portion 11172 surrounding the second port 11331 to prevent further insertion of the sleeve body 12612 into the second port 11331. In one example, as illustrated in FIGS. 111-135, a portion of the back wall portion 11172 surrounding the second port 11331 may include a recessed ledge portion 11177 that may be sized and shaped to receive the sleeve bezel 12614 therein and prevent further insertion of the sleeve body 12612 into the second port 11331. Accordingly, in one example, the sleeve bezel 12614 may sit flush with the back wall portion 11172 when the port sleeve 12610 is fully inserted into the second port 11331 and the sleeve bezel 12614 is engaged with the recessed ledge portion 11177. Alternatively, the sleeve bezel 12614 may not be flush with the back wall portion 11172 such that the sleeve bezel 12614 may be partially or fully raised or partially or fully recessed relative to the back wall portion 11172. In one example, the sleeve bezel 12614 may also include one or more structures for engaging a correspondingly shaped tool to secure the port sleeve 12610 in the second port 11331. The apparatus, methods, and articles of manufacture described herein are not limited in this regard.

In one example, as illustrated in FIGS. 111-135, the length of the port sleeve 12610 may be greater than the length of the second port 11331. Accordingly, a sleeve front portion 12620 of the port sleeve 12610 may extend past the second port 11331 and into the interior cavity 11210. As the port sleeve 12610 is screwed into the second port 11331 as described herein, the sleeve front portion 12620 may extend through the second port 11331 and enter or penetrate the interior cavity 11210. As the port sleeve 12610 is further screwed into the second port 11331, the sleeve front portion 12620 may advance farther into the interior cavity 11210 until the engagement of the sleeve bezel 12614 with the recessed ledge portion 11177 prevents further insertion of the port sleeve 12610 into the second port 11331. Accordingly, interior cavity penetration depth of the sleeve front portion 12620 may be adjusted by the port sleeve 12610 being screwed into and out of the second port 11331 with the maximum interior cavity penetration depth being defined by engagement of the sleeve bezel 12614 with the recessed ledge portion 11177. The apparatus, methods, and articles of manufacture described herein are not limited in this regard.

The body portion 11110 may include one or more mass portions (e.g., weight portion(s)) at any location on the body portion 11110. The one or more mass portions may be integral mass portion(s) or separate mass portion(s) that may be coupled to the body portion 11110 at any exterior or interior location on the body portion 11110. In the illustrated example of FIGS. 111-135, the body portion 11110 may include an external mass portion 11435, which may be also referred to herein as the first mass portion, and an internal mass portion 11445, which may be also referred to herein as the second mass portion. The external mass portion 11435 may be similar in many respects to the mass portion 2331 of the golf club head 2000. Accordingly, the external mass portion 11435 may be disc shaped as illustrated in FIG. 34. The diameter of the external mass portion 11435 may be determined based on one or more properties (e.g., material density) of the materials of construction of the external mass portion 11435. The port sleeve 12610 may be configured to receive the external mass portion 11435, which may be inserted and secured into the port sleeve 12610 by any of the methods described herein with respect to any of the golf club heads described herein such as being screwed in, press fitted, secured with an adhesive, or welded. In other words, the port sleeve 12610 may function as a sleeve for receiving the external mass portion 11435. In one example, as illustrated in FIGS. 111-135, the inner walls of the port sleeve 12610 may be threaded to engage corresponding threads on the external mass portion 11435. Accordingly, the inner diameter of the port sleeve 12610 may correspond to the outer diameter of the external mass portion 11435. The external mass portion 11435 may be fully inserted into the port sleeve 12610 and engage the sleeve bottom 12616. Accordingly, the outer surface of the external mass portion 11435 may define a portion of the back wall portion 11172 and be flush with the sleeve bezel 12614. Alternatively, the external mass portion 11435 may be recessed relative to the sleeve bezel 12614 or protrude outward relative to the sleeve bezel 12614. The external mass portion 11435 may be visible to an individual viewing the golf club head 11100. The apparatus, methods, and articles of manufacture described herein are not limited in this regard.

A center region or a geometric center of the second port 11331 may be located at or proximate to the CG of the golf club head 11100. Accordingly, a center of gravity of the external mass portion 11435 may also be located at or proximate to the CG of the golf club head 11100 when the external mass portion 11435 is secured in the second port 11331 as described herein. The x, y, and z coordinates of the center of gravity of the golf club head 11100 may be denoted herein by $CG_X$, $CG_Y$, and $CG_Z$, respectively, and the x, y, and z coordinates of the center of gravity of the external mass portion 11435 may be denoted herein by $CG_{M1X}$, $CG_{M1Y}$, and $CG_{M1Z}$, respectively. In one example, a distance on the x-axis between $CG_{M1X}$ and $CG_X$ may be less than or equal to 0.02 inch (0.51 mm), a distance on the y-axis between $CG_{M1Y}$ and $CG_Y$ may be less than or equal to 0.3 inch (7.62 mm), and/or a distance on the z-axis between $CG_{M1Z}$ and $CG_Z$ may be less than or equal to 0.2 inch (5.08 mm). In another example, a distance on the x-axis between $CG_{M1X}$ and $CG_X$ may be less than or equal to 0.1 inch (2.54 mm), a distance on the y-axis between $CG_{M1Y}$ and $CG_Y$ may be less than or equal to 0.6 inch (15.24 mm), and/or a distance on the z-axis between $CG_{M1Z}$ and $CG_Z$ may be less than or equal to 0.4 inch (10.16 mm). In another example, a distance on the x-axis between $CG_{M1X}$ and $CG_X$ may be less than or equal to 0.01 inch (0.25 mm), a distance on the y-axis between $CG_{M1Y}$ and $CG_Y$ may be less than or equal to 0.15 inch (3.81 mm), and/or a distance on the z-axis between $CG_{M1Z}$ and $CG_Z$ may be less than or equal to 0.1 inch (2.54 mm). In yet another example, a distance on the x-axis between $CG_{M1X}$ and $CG_X$ may be less than or equal to 0.25 inch (6.35 mm), a distance on the y-axis between $CG_{M1Y}$ and $CG_Y$ may be less than or equal to 0.25 inch (6.35 mm), and/or a distance on the z-axis between $CG_{M1Z}$ and $CG_Z$ may be less than or equal to 0.25 inch (6.35 mm). As a result, the external mass portion 11435 may be interchangeable with another mass portion having a lower mass or a mass portion having a higher mass without causing a relatively large or a significant shift in the CG of the golf club head 11100. In one example, for each gram of mass increase of the external mass portion 11435, the CG location of the golf club head may shift by less than 0.5% of the $CG_X$ location (x-axis coordinate of the CG), less than 0.5% of the $CG_Y$ location (y-axis coordinate of the CG), and/or less than 0.2% of the $CG_Z$ location (z-axis coordinate of the CG). In another example, for each gram of mass increase of the external mass portion 11435, the CG location of the golf club head may shift by less than 0.35% of the $CG_X$ location, less than 0.35% of the $CG_Y$ location, and/or less than 0.15% of the $CG_Z$ location. In yet another example, for each gram of mass increase of the external mass portion 11435, the CG location of the golf club head may shift by less than 0.25% of the $CG_X$ location, less than 0.25% of the $CG_Y$ location, and/or less than 0.10% of the $CG_Z$ location. Thus, the external mass portion 11435 may be interchangeable with another mass portion having a lower or a greater mass to provide certain performance characteristics for an individual (i.e., customize the performance of the golf club head 11100 for a certain individual) without substantially shifting the CG of the golf club head 11100 and/or altering the overall or general performance characteristics of the golf club head 11100. In one example, as illustrated in FIGS. 111-135, the entire external mass portion 11435 may be below the horizontal midplane 11520. In another example, a substantial portion of the external mass portion 11435 may be below the horizontal midplane 11520. The apparatus, methods, and articles of manufacture described herein are not limited in this regard.

Figure 123:
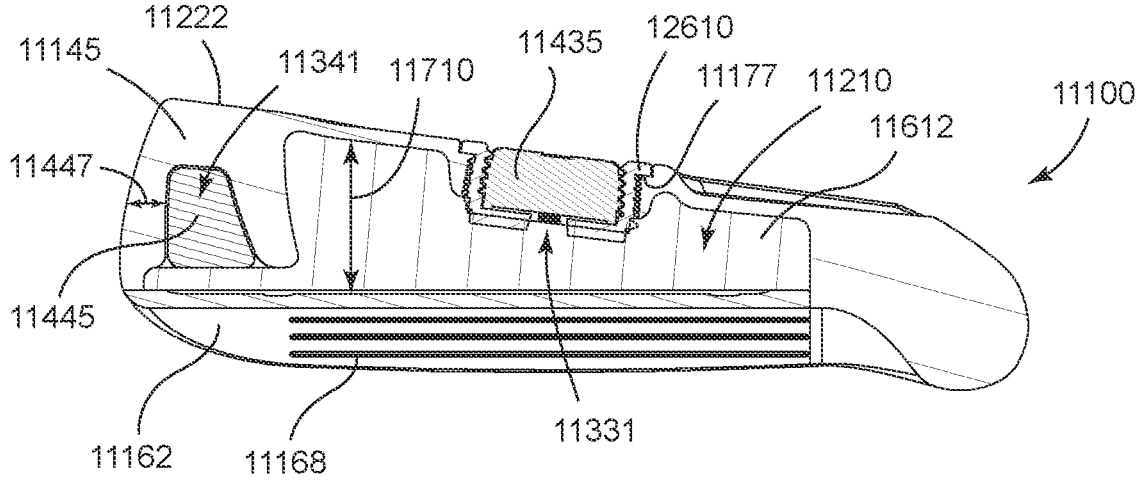
Figure 124:
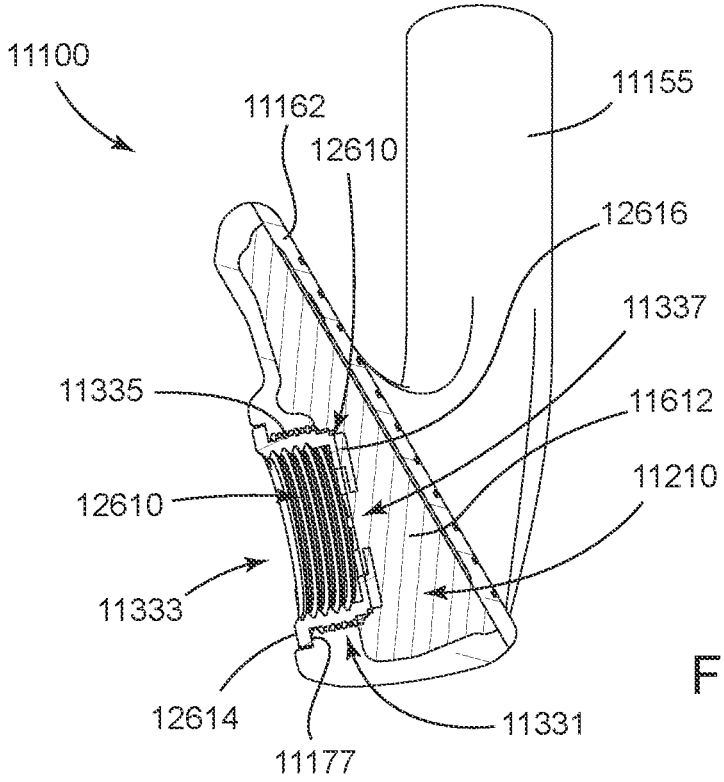
Figure 125:
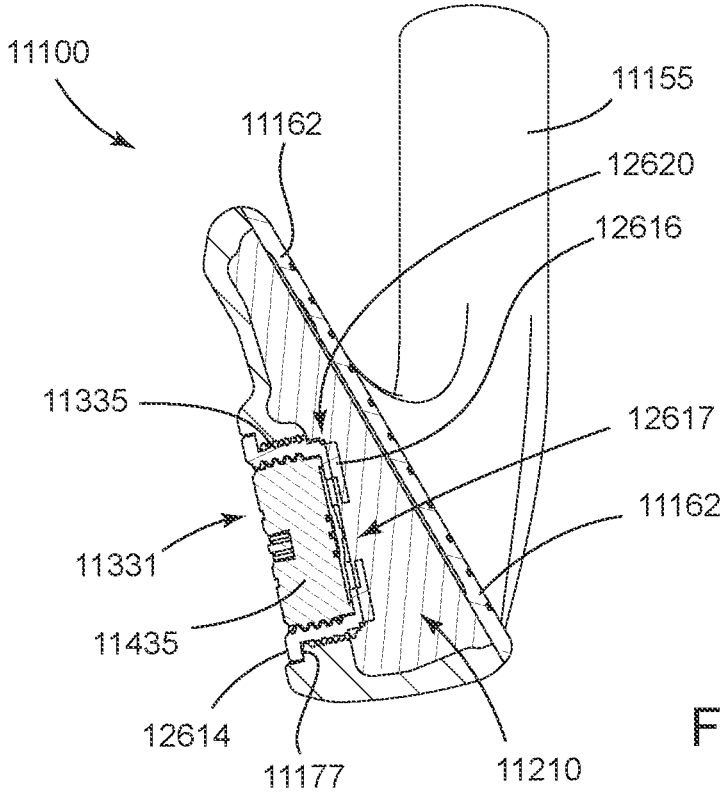
Figure 126:
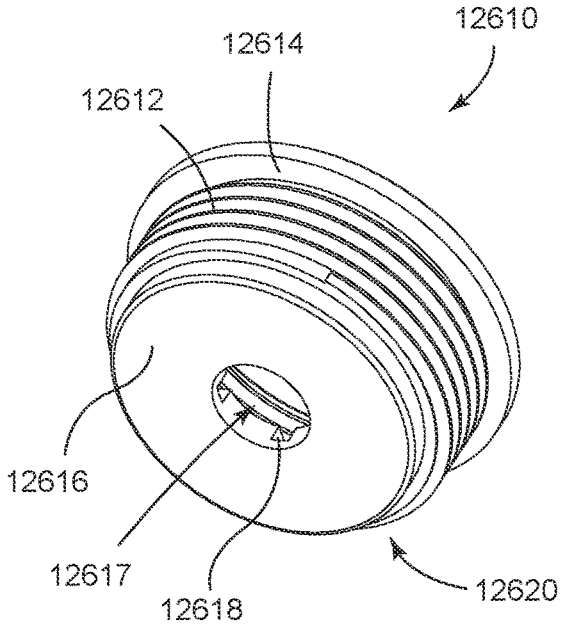
Figure 127:
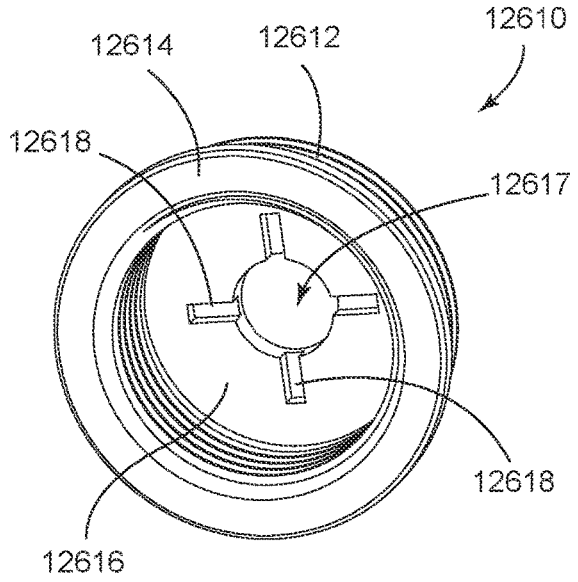
Figure 128:
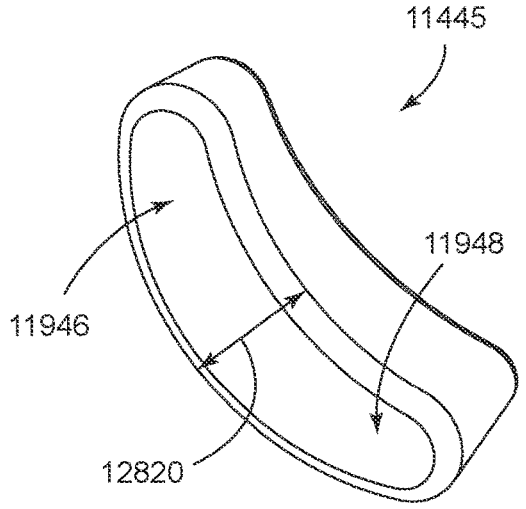
Figure 129:
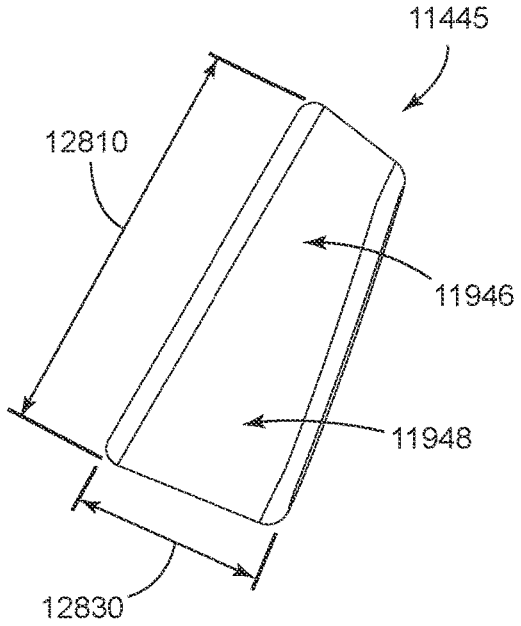
Figure 130:
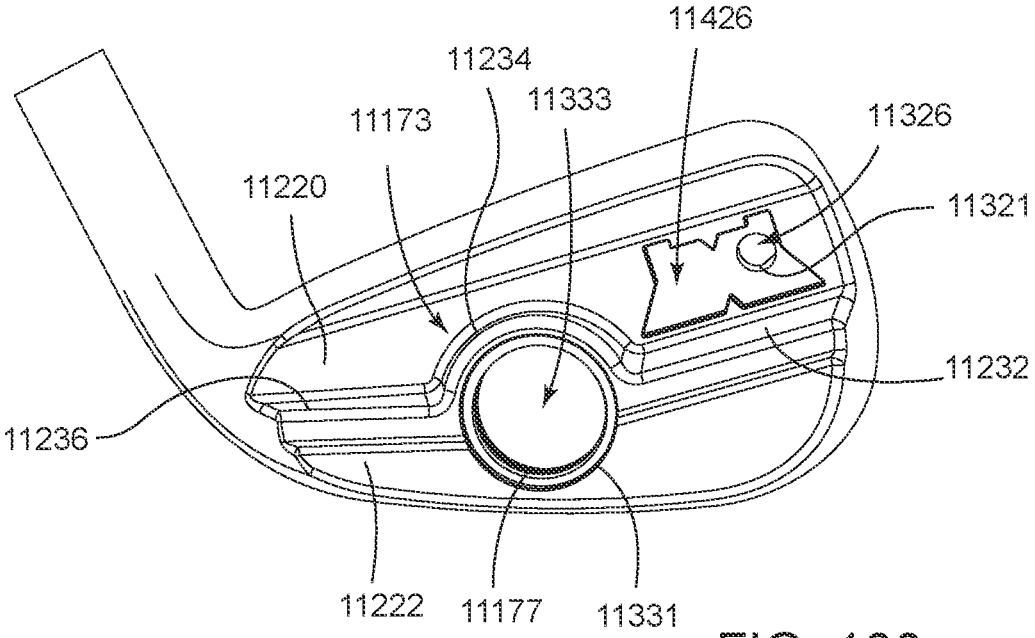
Figure 131:
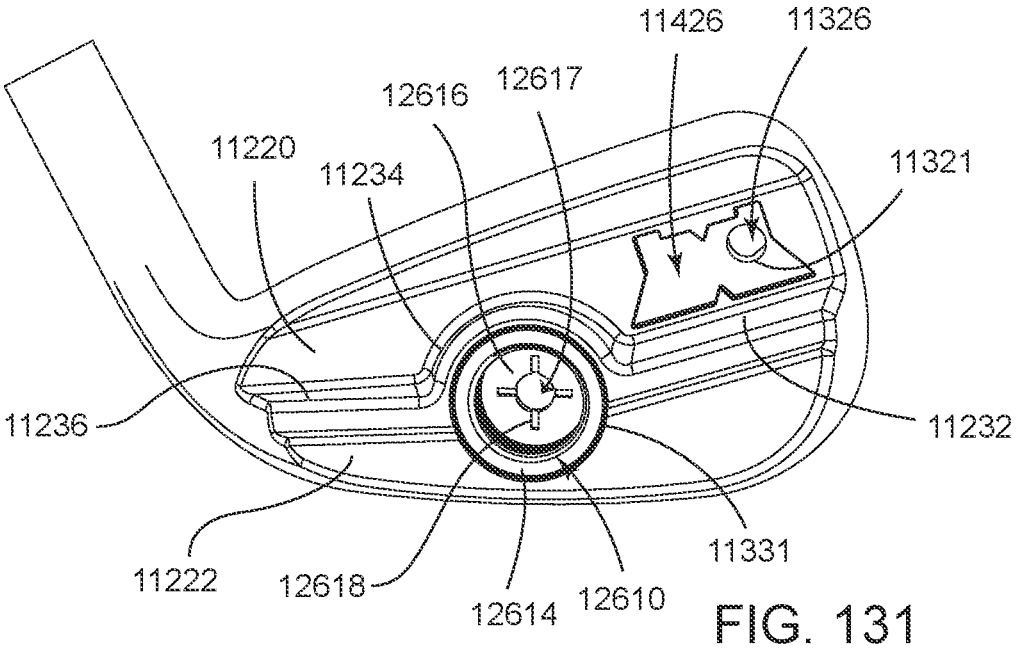
Figure 132:
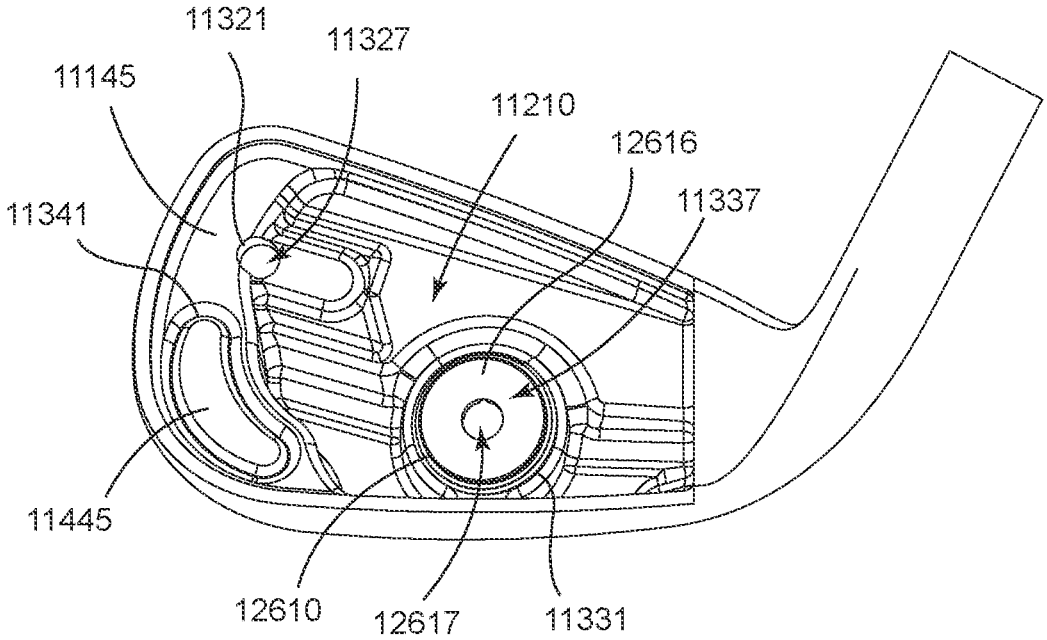

The internal mass portion 11445 may be at any location on the body portion 11110. In one example, as illustrated in FIGS. 111-135, the internal mass portion 11445 may be located proximate to the toe portion edge 11142. In another example, the internal mass portion 11445 may be located between the external mass portion 11435 and the toe portion edge 11142. The location of the internal mass portion 11445 being proximate to the toe portion edge 11142 may increase the moment of inertia of the golf club head 11100 to improve performance. All or portions of the internal mass portion 11445 may be placed close to the toe portion edge 11142 to increase the moment of inertia of the golf club head. Referring to FIGS. 123, in one example, the shortest distance 11447 between the internal mass portion 11445 and the toe portion edge 11142 may be less than or equal to 0.1 inch (2.54 mm). In another example, the shortest distance 11447 between the internal mass portion 11445 and the toe portion edge 11142 may be less than or equal to 0.2 inch (5.08 mm). In another example, the shortest distance 11447 between the internal mass portion 11445 and the toe portion edge 11142 may be less than or equal to 0.3 inch (7.62 mm). In another example, the shortest distance 11447 between the internal mass portion 11445 and the toe portion edge 11142 may be less than or equal to 0.4 inch (10.16 mm). In another example, the shortest distance 11447 between the internal mass portion 11445 and the toe portion edge 11142 may be less than or equal to 0.5 inch (12.70 mm). In another example, the shortest distance 11447 between the internal mass portion 11445 and the toe portion edge 11142 may be less than or equal to half the distance between the external mass portion 11435 and the toe portion edge 11142. In yet another example, the shortest distance 11447 between the internal mass portion 11445 and the toe portion edge 11142 may be less than or equal to ¼ the distance between the external mass portion 11435 and the toe portion edge 11142. The apparatus, methods, and articles of manufacture described herein are not limited in this regard.

In one example, as illustrated in FIGS. 111-135, the internal mass portion 11445 may have a curved shape that may correspond or approximately correspond to the shape of portions of the toe portion edge 11142 that are proximate to the internal mass portion 11445. Accordingly, the internal mass portion 11445 may be located close to the toe portion edge 11142 and have curvature that is the same or substantially the same as the curved shape of the toe portion edge 11142. The shape and location of the internal mass portion 11445 allows the internal mass portion to be placed close to the toe portion edge and have a mass distribution that closely resembles or resembles the curvature of the portions of the of the toe portion edge that are proximate to the internal mass portion 11445. Accordingly, the internal mass portion 11445 may increase the moment of inertia (MOI) of the golf club head 11100. The location of the internal mass portion 11445 along the y-axis and the z-axis may be determined so that the internal mass portion 11445 may not greatly affect or shift the location of the CG of the golf club head 11100. In other words, the y-coordinate and/or the z-coordinate of the CG of the internal mass portion 11445 may be the same or substantially similar (considering manufacturing tolerances) or offset from the y-coordinate and/or z-coordinate of the CG of the golf club head, respectively, by a small amount so that the CG of the golf club head 11100 may be maintained relatively low and aft on the golf club head 11100. The x, y, and z coordinates of the center of gravity of the internal mass portion 11445 may be denoted herein by $CG_{M2X}$, $CG_{M2Y}$, and $CG_{M2Z}$, respectively. In one example, a distance on the x-axis between $CG_{M2X}$ and $CG_X$ may be greater than or equal to 0.5 inch (12.70 mm) and less than or equal to 1.5 inch (38.10 mm), a distance on the y-axis between $CG_{M2Y}$ and $CG_Y$ may be less than or equal to 0.2 inch (5.08 mm), and/or a distance on the z-axis between $CG_{M2Z}$ and $CG_Z$ may be less than or equal to 0.2 inch (5.08 mm). In another example, a distance on the x-axis between $CG_{M2X}$ and $CG_X$ may be greater than or equal to 0.5 inch (12.70 mm) and less than or equal to 2.0 inch (50.80 mm), a distance on the y-axis between $CG_{M2Y}$ and $CG_Y$ may be less than or equal to 0.5 inch (12.70 mm), and/or a distance on the z-axis between $CG_{M2Z}$ and $CG_Z$ may be less than or equal to 0.5 inch (12.70 mm). In another example, a distance on the x-axis between $CG_{M2X}$ and $CG_X$ may be greater than or equal to 0.75 inch (19.05 mm) and less than or equal to 1.75 inch (44.45 mm), a distance on the y-axis between $CG_{M2Y}$ and $CG_Y$ may be less than or equal to 0.25 inch (6.35 mm), and/or a distance on the z-axis between $CG_{M2Z}$ and $CG_Z$ may be less than or equal to 0.25 inch (6.35 mm). In yet another example, a distance on the x-axis between $CG_{M2X}$ and $CG_X$ may be greater than or equal to 1.0 inch (25.40 mm) and less than or equal to 1.75 inch (44.45 mm), a distance on the y-axis between $CG_{M2Y}$ and $CG_Y$ may be less than or equal to 0.75 inch (19.05 mm), and/or a distance on the z-axis between $CG_{M2Z}$ and $CG_Z$ may be less than or equal to 0.75 inch (19.05 mm). In other examples, the internal mass portion 11445 may be the same or substantially the same as any of the internal mass portions described herein. The apparatus, methods, and articles of manufacture described herein are not limited in this regard.

The external mass portion 11435 and the internal mass portion 11445 may be strategically located to lower the center of gravity of the golf club head 11100, whereas the internal mass portion 11445 may also increase the MOI of the golf club head 11100. Accordingly, the distance between the external mass portion 11435 and the internal mass portion 11445 along the x-axis may be relatively large to increase the MOI of the golf club head 11100, whereas the distances between the external mass portion 11435 and the internal mass portion 11445 along the y-axis and the z-axis, respectively, may be relatively small to maintain a relatively low position for the center of gravity of the golf club head 11100. In one example, a distance on the x-axis between $CG_{M1X}$ and $CG_{M2X}$ may be greater than or equal to 0.5 inch (12.70 mm) and less than or equal to 2.0 inch (50.80 mm), a distance on the y-axis between $CG_{M1Y}$ and $CG_{M2Y}$ may be less than or equal to 0.25 inch (6.35 mm), and/or a distance on the z-axis between $CG_{M1Z}$ and $CG_{M2Z}$ may be less than or equal to 0.1 inch (2.54 mm). In another example, a distance on the x-axis between $CG_{M1X}$ and $CG_{M2X}$ may be greater than or equal to 0.75 inch (19.05 mm) and less than or equal to 1.75 inch (44.45 mm), a distance on the y-axis between $CG_{M1Y}$ and $CG_{M2Y}$ may be less than or equal to 0.2 inch (5.08 mm), and/or a distance on the z-axis between $CG_{M1Z}$ and $CG_{M2Z}$ may be less than or equal to 0.2 inch (5.08 mm). In another example, a distance on the x-axis between $CG_{M1X}$ and $CG_{M2X}$ may be greater than or equal to 1.0 inch (25.40 mm) and less than or equal to 2.0 inch (50.80 mm), a distance on the y-axis between $CG_{M1Y}$ and $CG_{M2Y}$ may be less than or equal to 0.5 inch (12.70 mm), and/or a distance on the z-axis between $CG_{M1Z}$ and $CG_{M2Z}$ may be less than or equal to 0.25 inch (6.35 mm). In yet another example, a distance on the x-axis between $CG_{M1X}$ and $CG_{M2X}$ may be greater than or equal to 1.0 inch (25.40 mm) and less than or equal to 1.75 inch (44.45 mm), a distance on the y-axis between $CG_{M1Y}$ and $CG_{M2Y}$ may be less than or equal to 0.4 inch (10.16 mm), and/or a distance on the z-axis between $CG_{M1Z}$ and $CG_{M2Z}$ may be less than or equal to 0.4 inch (10.16 mm). The apparatus, methods, and articles of manufacture described herein are not limited in this regard.

In one example as illustrated in FIGS. 111-135, the top portion 11946 of the internal mass portion 11445 may have a smaller volume than the bottom portion 11948, and the internal mass portion 11445 may have a gradually increasing volume from the top portion 11946 to the bottom portion 11948. Accordingly, to lower a center of gravity of the golf club head 11100, a distance between a center of gravity of the internal mass portion 11445 and the sole portion edge 11192 may be less than or substantially less than a distance between the center of gravity of the internal mass portion 11445 and the horizontal midplane 11520. In other words, the shape of the internal mass portion 11445 as provided herein allows placement of the internal mass portion 11445 close to the toe portion edge and placement of a relatively larger portion of the internal mass portion 11445 below the horizontal midplane 11520 and relatively close to the sole portion edge 11192. As illustrated in the example of FIGS. 111-135, the entire internal mass portion 11445 may be below the horizontal midplane 11520. In another example, a substantial portion of the internal mass portion 11445 may be below the horizontal midplane 11520. In another example, the internal mass portion 11445 may include a plurality of internal mass portions arranged proximate to the toe portion edge 11142 in a top-to-sole and toe-to heel direction, with a greater number or all of the mass portions being located below the horizontal midplane 11520. In another example, the internal mass portion 11445 may include large portions that extend close to the sole portion edge 11192. The apparatus, methods, and articles of manufacture described herein are not limited in this regard.

As illustrated in FIGS. 111-135, the internal mass portion 11445 may include a height 12810 in a top-to-sole direction, a width 12820 in a toe-to-heel direction, and a depth 12830 in a front-to-back direction. In one example, as illustrated in FIGS. 111-135, the height 12810 may be greater than the width 12820 and greater than the depth 12830. Accordingly, the internal mass portion 11445 may extend proximate to a greater portion of the toe portion edge 11142 to increase the moment of inertia of the golf club head 11100. In another example, as illustrated in FIGS. 111-135, the depth 12830 may increase in a top-to-sole direction to increase the volume and the mass of the internal mass portion 11445 in a top-to-sole direction as described herein. In another example, as illustrated in FIGS. 111-135, the depth 12830 may be greater than the width 12820. Accordingly, the internal mass portion 11445 may extend proximate to a greater portion of the toe portion edge 11142 and farther aft to increase the moment of inertia of the golf club head 11100 and move the center of gravity of the golf club head 11100 lower and farther aft. In one example, the height 12810 may be greater than or equal to 0.5 inch (12.70 mm) and less than or equal to 1.25 inch (31.75 mm). In another example, the height 12810 may be greater than or equal to 0.8 inch (20.32 mm) and less than or equal to 1.1 inch (27.94 mm). In yet another example, the height 12810 may be greater than or equal to 0.9 inch (22.86 mm) and less than or equal to 1.0 inch (25.40 mm). In one example, the width 12820 and the depth 12830 may have the same values with any variation being due to manufacturing tolerances. In another example, the width 12820 may be greater than equal to 75% and less than or equal to 125% of the depth 12830. In another example, the depth 12830 may be greater than or equal to 75% and less than or equal to 125% of the width 12820. In another example, the width 12820 and/or the depth 1830 may be greater than or equal to 0.2 inch (5.08 mm) and less than or equal to 0.5 inch (12.70 mm). In another example, the width 12820 and/or the depth 12830 may be greater than or equal to 0.27 inch and less than or equal to 0.37 inch. In another example, the width 12820 and/or the depth 1830 may be greater than or equal to 0.3 inch (7.62 mm) and less than or equal to 0.35 inch (8.89 mm). In another example, the width 12820 and/or the depth 1830 may be greater than or equal to 10% of the height 12810 and less than or equal to 50% of the height 12810. The apparatus, methods, and articles of manufacture described herein are not limited in this regard.

The third port 11341 may define a recess or cavity in the body portion 11110 that may be shaped to correspond to the shape of the internal mass portion 11445 to receive the internal mass portion 11445. In one example, as illustrated in FIGS. 111-135, the third port 11341 may be shaped to completely receive the internal mass portion 11445 so that the outer surface of the internal mass portion is flush with the interior walls of the body portion 11110 defining the interior cavity 11210. The internal mass portion 11445 may be secured inside the third port 11341 with one or more adhesives or bonding agents, by welding or soldering, and/or by being press fit. The third port 11341 may be defined by a cavity inside a body mass portion 11145, which may be an integral portion of the body portion 11110, formed with the body portion 11110, and/or include the same materials as the materials of the body portion 11110. The body mass portion 11145 may be located in the toe portion 11140 and may extend to the toe portion edge 11142 to increase the moment of inertial of the golf club head 11100. In the illustrated example of FIGS. 111-135, the body mass portion may extend from the top portion edge 11182 to the sole portion edge 11192 and extend into the interior cavity 11210 from the toe portion edge 11142. The shape, size, volume, and/or mass of the body mass portion 11145 may be determined to provide certain performance characteristics for the golf club head 11100. In one example, as illustrated in FIGS. 111-135, the body mass portion 11145 may be located in the toe portion 11140, extend to the toe portion edge 11142, and extend from the top portion edge 11182 to the sole portion edge 11192. The shape, size, volume, and/or mass of the body mass portion 11145 may vary and depend on various properties of the golf club head 11100 including the loft angle 11545. The apparatus, methods, and articles of manufacture described herein are not limited in this regard.

The interior cavity 11210 may vary in width between the toe portion 11140 and the heel portion 11150. An interior cavity width 11710 may be smaller proximate to the toe portion edge 11142 than the interior cavity width 11710 at the center portion of the body portion or at the heel portion 11150 due to the presence of the body mass portion 11145. Accordingly, a greater portion of the mass of the body portion 11110 may be closer to the toe portion edge 11142 than the heel portion edge 11152 to increase the moment of inertia of the body portion 11110. In one example, as illustrated in FIGS. 111-135, the interior cavity width 11710 may have a maximum value at a location between the external mass portion 11435 and the internal mass portion 11445. As illustrated in the example of FIGS. 111-135, portions of the interior cavity 11210 may extend vertically below the port sleeve 12610 and/or the external mass portion 11435 and be farther from the face portion 11162 than portions of the port sleeve 12610 and/or the external mass portion 11435. Accordingly, in the example illustrated in FIGS. 111-135, a maximum value of the interior cavity width 11710, which may be measured in a face-to-back direction, may be between the external mass portion 11435 and the internal mass portion 11445 in a toe-to-heel direction and between the sole portion edge 11192 and the external mass portion 11435 in a top-to sole direction. In one example, the maximum value of the interior cavity width 11710 may be greater than or equal to 0.4 inch (10.16 mm) and less than or equal to 0.9 inch (22.86 mm). In another example, the maximum value of the interior cavity width 11710 may be greater than or equal to 0.5 inch (12.70 mm) and less than or equal to 0.8 inch (20.32 mm). In yet another example, the maximum value of the interior cavity width 11710 may be greater than or equal to 0.6 inch (15.24 mm) and less than or equal to 0.7 inch (17.78 mm). As illustrated in the example of FIGS. 111-135, portions of the interior cavity 11210 located vertically above the port sleeve 12610 and/or the external mass portion 11435 may be farther from the face portion 11162 than portions of the port sleeve 12610 and/or the external mass portion 11435. The apparatus, methods, and articles of manufacture described herein are not limited in this regard.

In one example, as illustrated in FIGS. 111-135, the second port 11331, the badge 11428, and the internal mass portion 11445 may be located between the external mass portion 11435 and the toe portion edge 11142. As described herein, the external mass portion 11435 may function to lower the center of gravity of the golf club head 11100 and shift the center of gravity rearward. The internal mass portion 11445 may function to increase the moment of inertia of the golf club head 11100. The internal mass portion 11445 may also lower and/or shift rearward the center of gravity of the golf club head 11100. Additionally, with the bottom portion 11948 of the internal mass portion 11445 having a greater mass than the top portion 11946, a vertical location of the center of gravity of the golf club head 11100 may not be largely shifted by the internal mass portion 11445 while placing more mass toward the toe portion edge to increase the MOI of the golf club head 11100. The apparatus, methods, and articles of manufacture described herein are not limited in this regard.

In one example, the badge 11428 may be constructed from a material having a lower density than the material of the body portion 11110 to not have a large effect on the mass distribution of the body portion 11110. In yet another example, the badge 11428 may be made from a material having a relatively large density such as the material form which any of the mass portions may be constructed. Accordingly, the badge 11428 may function to increase the moment of inertia of the golf club head 11100. The apparatus, methods, and articles of manufacture described herein are not limited in this regard.

The interior cavity 11210 may be partially or entirely filled with one or more filler materials (i.e., a cavity filling material), which may include one or more similar or different types of materials. In one example, as illustrated in FIGS. 111-135, the filler material 11612 may be a urethane elastomer material that may be curable at room temperature or higher temperatures to accelerate the curing process. In one example, the filler material 11612 may be injected into the interior cavity 11210 from the first port 11321 and/or the second port 1131 to fill the interior cavity 11210 partially or completely. The first port 11321 may serve as an injection port whereas the second port 11331 may serve as an exhaust port to allow the air that is displaced in the interior cavity 11210 by the filler material to exit the interior cavity 11210. Alternatively, the second port 11331 may serve as an injection port whereas the first port 11321 may serve as an exhaust port. Accordingly, as illustrated in FIGS. 111-135, the filler material 11612 may be molded in the shape of the interior cavity 11210. After injection of the filler material 11612 into the interior cavity 11210, the filler material 11612 may be allowed to cure. In one example, the filler material 11612 may cure at room temperature. In another example, the filler material 11612 may be cured at 50 degrees Celsius. In another example, the filler material 11612 may be cured at 70 degrees Celsius. In yet another example, the filler material 11612 may be cured at 80 degrees Celsius. The apparatus, methods, and articles of manufacture described herein are not limited in this regard. In another example, the filler material 11612 may be similar to the filler material 2512 of the golf club head 2000 or similar to any of the filler materials described herein or in any of the incorporated by reference patent documents. In yet another example, the interior cavity 11210 may be filled with a first filler material and a second filler material that may be similar to the first filler material 512 and the second filler material 514 of the golf club head 200 or similar to any of the golf club heads described in any of the incorporated by reference patent documents. The apparatus, methods, and articles of manufacture described herein are not limited in this regard.

In one example, the golf club head 11100 may have a total weight of greater than or equal to 180 grams and less than or equal to 340 grams. In another example, the golf club head 11100 may have a total weight of greater than or equal to 220 grams and less than or equal to 300 grams. In yet another example, the golf club head 11100 may have a total weight of greater than or equal to 250 grams and less than or equal to 270 grams. In one example, the weight of the filler material may be greater than or equal to 15 grams and less than or equal to 35 grams. In another example, the weight of the filler material may be greater than or equal to 22 grams and less than or equal to 30 grams. In yet another example, the weight of the filler material may be greater than or equal to 22 grams and less than or equal to 28 grams. The total weight of the filler material 11612 may be expressed as a percentage of the total weight of the golf club head 11100. Accordingly, the weight of the filler material may comprise greater than or equal to 5% and less than or equal to 19% of the total weight of the golf club head 11100. The apparatus, methods, and articles of manufacture described herein are not limited in this regard.

As described herein, the sizes and weights of the external mass portion 11435, the internal mass portion 11445, and/or the port sleeve 12610 may be determined to affect the moments of inertia and CG location of the golf club head 11100 to provide certain performance characteristics for the golf club head 11100. The internal mass portion 11445 may have a total weight that may be greater than the total weight of the external mass portion 11435, the total weight of the port sleeve 12610, and/or the sum of the total weights of the external mass portion 11435 and the port sleeve 12610 to increase the MOI of the golf club head 11100. In one example, the total weight of the internal mass portion 11445 may be greater than or equal to 10 grams and less than or equal to 20 grams. In another example, the total weight of the internal mass portion 11445 may be greater than or equal to 12 grams and less than or equal to 16 grams. In yet another example, the total weight of the internal mass portion 11445 may be greater than or equal to 13 grams and less than or equal to 15 grams. The apparatus, methods, and articles of manufacture described herein are not limited in this regard.

In one example, the total weight of the external mass portion 11435 may be greater than or equal to 5 grams and less than or equal to 11 grams. In another example, the total weight of the external mass portion 11435 may be greater than or equal to 7 grams and less than or equal to 9 grams. In another example, the total weight of the external mass portion 11435 may be greater than or equal to 6 grams and less than or equal to 8 grams. In another example, the total weight of the external mass portion 11435 may be greater than or equal to 25% and less than or equal to 75% of the total weight of the internal mass portion 11445. In another example, the total weight of the external mass portion 11435 may be greater than or equal to 40% and less than or equal to 60% of the total weight of the internal mass portion 11445. In another example, a ratio of a weight of the internal mass portion 11445 to a weight of the external mass portion may be greater than or equal to 1.0. In another example, a ratio of a weight of the internal mass portion 11445 to a weight of the external mass portion may be greater than or equal to 1.25. In yet another example, a ratio of a weight of the internal mass portion 11445 to a weight of the external mass portion may be greater than or equal to 1.25 and less than or equal to 2.0. The apparatus, methods, and articles of manufacture described herein are not limited in this regard.

The port sleeve 12610 may be constructed from a material that has a lower density than the density of the material of the body portion 11110 and the density of the material of the external mass portion 11435 so that the weight savings from using the port sleeve 12610 may be strategically transferred to other portions of the golf club head 11100 to achieve certain performance characteristics. In one example, the port sleeve 12610 may be constructed from an aluminum-based material. In another example, the port sleeve 12610 may be constructed from a titanium-based material. In yet another example, the port sleeve 12610 may be constructed from a polymer material. As described herein, the external mass portion 11435 may be constructed from a material having a greater density than the density of the material of the body portion 11110. In one example, the external mass portion 11435 may be constructed from a tungsten-based material.

Accordingly, the total weight of the external mass portion 11435 may be greater than the total weight of the port sleeve 12610. In one example, the total weight of the port sleeve 12610 may be greater than or equal to 3 grams and less than or equal to 6 grams. In another example, the total weight of the port sleeve 12610 may be greater than or equal to 3.5 grams and less than or equal to 5 grams. In another example, the total weight of the port sleeve 12610 may be greater than or equal to 4 grams and less than or equal to 4.75 grams. In another example, the total weight of the port sleeve 12610 may be greater than or equal to 25% and less than or equal to 75% of the total weight of the external mass portion 11435. In yet another example, the total weight of the port sleeve 12610 may be greater than or equal to 40% and less than or equal to 60% of the total weight of the external mass portion 11435. The apparatus, methods, and articles of manufacture described herein are not limited in this regard.

As described herein, the interior cavity 11210 may be partially or entirely filled with one or more filler materials (i.e., a cavity filling material), which may include one or more similar or different types of materials. The amount (i.e., volume and/or mass) filler material may be determined for each golf club head (i.e., having a certain loft angle) to (i) provide vibration dampening or sound dampening (e.g., consistent and/or pleasing sound and feel when the golf club head strikes a golf ball as perceived by an individual using the golf club head), (ii) provide structural support for the face portion, and/or (iii) optimize ball travel distance, ball speed, ball launch angle, ball spin rate, ball peak height, ball landing angle and/or ball dispersion. The interior cavity 11210 may be filled with a filler material such that the back surface 11166 of the face portion is covered with the filler material. Accordingly, the filler material may provide structural support for the relatively thinner portions of the face portion 11162.

The resilience of the urethane elastomer filler material 11612 of the golf club head 11100, which is referred to herein as GC1 (i.e., Golf Club No. 1), was tested and compared with the resilience of the filler materials of three example golf clubs, which are referred to herein as GC2, GC3, and CG4. To test each golf club head, the face portion of each golf club head was removed by a milling machine by cutting around the perimeter of the face portion and exposing the filler material in intact for by carefully removing the face portion. The resilience of the filler material of each golf club head was tested using the test equipment and procedures used by United States Golf Association to determine the characteristic time (CT) of a golf club head as provided in *R&A Rules Limited and United States Golf Association PROTOCOL FOR MEASURING THE FLEXIBLITY OF A GOLF CLUBHEAD*, TPX3004 Rev. 2.0 9 Apr. 2019; and *United States Golf Association PROCEDURE FOR MEASURING THE FLEXIBILITY OF A GOLF CLUBHEAD*, USGA-TPX3004 Revision 1.0.0 May 1, 2008. In other words, the CT test equipment used by the United States Golf Association, which includes a pendulum striking the face of a test golf club, was used to determine the resilience of the filler material. Each golf club head was mounted in the fixture of the CT test equipment such that the pendulum struck the face portion at a location approximately 0.75 inch (19.05 mm) from the leading edge of the sole portion edge 11192 and at a center of a face groove at that location. Additionally, each golf club head was mounted in the fixture such that the heel-to-toe direction of the golf club head was in a vertical orientation (i.e., face groove oriented vertically). The pendulum was equipped with an accelerometer and accelerometer data was sampled at 10240 Hz to determine the maximum velocity of the pendulum in meters per second (m/s) before contact with the filler material and the maximum velocity of the pendulum in m/s after contact with the filler material during the rebound of the pendulum. For all tests, the average pendulum velocity when striking the filler material was between 0.79 and 0.81 m/s. In one example, the maximum rebound velocity obtained from multiple tests for GC1 was greater than 2.0 m/s and less than 2.09 m/s with an average maximum rebound velocity of 2.06 m/s; the maximum rebound velocity obtained from multiple tests for GC2 was greater than 1.9 m/s and less than 1.98 m/s with an average maximum rebound velocity of 1.95 m/s; the maximum rebound velocities obtained from multiple tests for GC3 and CG4 were similar and greater than 1.71 m/s and less than 1.79 m/s with an average maximum rebound velocity of 1.76. Accordingly, the average maximum rebound velocity of GC1 or golf club head 11100 may be greater than the maximum rebound velocity of GC2 by 5%, and greater than the maximum rebound velocities of GC3 and GC4 by 15%. The golf swing speed of an individual may vary between 60 miles per hour (27 m/s) to 170 miles per hour (76 m/s). Accordingly, the increased rebound or resiliency of the filler material 11612 of the golf club head 11100 as evidenced by the increase in the average maximum rebound velocity of GC1 relative to the average maximum rebound velocities of GC2, CG3, and CG4, may represent a significant improvement in ball speed and consequently ball carry distance when a golf club having a golf club head 11100 is used by an individual.

In one example, as the sleeve front portion 12620 penetrates the interior cavity 11210 as described herein by the port sleeve 12610 being screwed into the second port 11331, the sleeve front portion 12620 may compress the filler material 11612 between the sleeve front portion 12620 and the face portion 11162 at or proximate to the ball strike region of the face portion 11162. Accordingly, driving the port sleeve 12610 into the interior cavity 11210 may provide preloading of the filler material 11612 at or around the ball strike region of the golf club head 11100 to provide a higher coefficient of restitution (COR) for the golf club head 11100. The COR of the golf club head 11100 may be adjusted by the depth of penetration of the port sleeve 12610 into the interior cavity 11210. Accordingly, by engaging the port sleeve 12610 with a tool to screw the port sleeve 12610 into or out of the second port 11331, the COR of the golf club head 11100 may be adjusted. The COR may be adjusted to a certain value to comply with rules of certain golf governing bodies. For example, the COR of the golf club head 11100 may be adjusted to a maximum or a near maximum value permitted by a certain golf governing body such as the United States Golf Association (USGA). In one example, the COR of the golf club head 11100 may be greater than or equal to 0.80 and less than or equal to 0.86. In another example, the COR of the golf club head 11100 may be greater than or equal to 0.82 and less than or equal to 0.85. In yet another example, the COR of the golf club head may be greater than or equal to 0.82 and less than or equal to a COR value that complies with the maximum COR value allowed by a golf governing body. The apparatus, methods, and articles of manufacture described herein are not limited in this regard.

Figure 133:
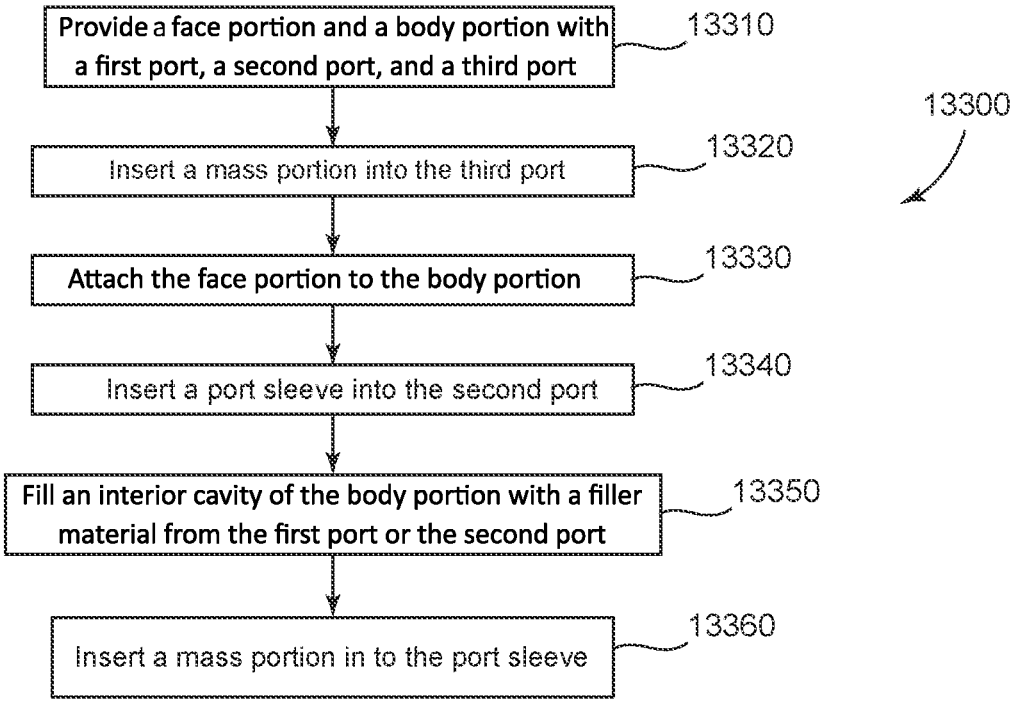

In one example, as illustrated in FIG. 133, a method 13300 of manufacturing the golf club head 11100 includes providing a body portion 11110, a face portion 11162, an external mass portion 11435, an internal mass portion 11445, a port sleeve 12610, and a badge 11428 as described herein (block 13310). The internal mass portion 11445 is inserted and/or attached to the body portion 11110 inside the third port 11341 (block 13320) as described herein. The face portion 11162 is attached to the body portion 11110 to enclose the interior cavity 11210 at the front portion 11160 of the body portion 11110 (block 13330). The port sleeve 12610 is inserted into the second port 11331 by being screwed into the second port 11331 (block 13340) as described herein. In one example, the port sleeve 12610 may be completely screwed into the second port 11331 until further penetration into the interior cavity 11210 is prevented by the sleeve bezel 12614 as described herein. In another example, the port sleeve 12610 may be partially screwed into the second port 11331 to allow preloading of one or more filler materials in the interior cavity 11210 as described herein. In yet another example, the port sleeve 12610 may be partially screwed into the second port 11331 to allow the filler material to fill portions of the second port 11331. The interior cavity 11210 may be filled with a filler material (block 13350) from the first port 11321 or the second port 11331 as described herein. The filler material may then cure at room temperature, at a temperature greater than room temperature, and/or using one or more cure cycles. The badge 11428 may then be coupled to the body portion 11110 over the first port 11321 to close the first port 11321. As described herein, the badge 11428 may be attached to the body portion 11110 by being inserted and/or secured inside the recessed portion 11426. The external mass portion 11435 may then be secured into the second port 11331 (block 13360) as described herein. The external mass portion 11435 may be removed if required to change the penetration depth of the port sleeve 12610 as described herein and reinstalled inside the second port 11331. In other words, the preloading of the filler material 11612 may be adjusted at any time. The apparatus, methods, and articles of manufacture described herein are not limited in this regard.

Figure 134:
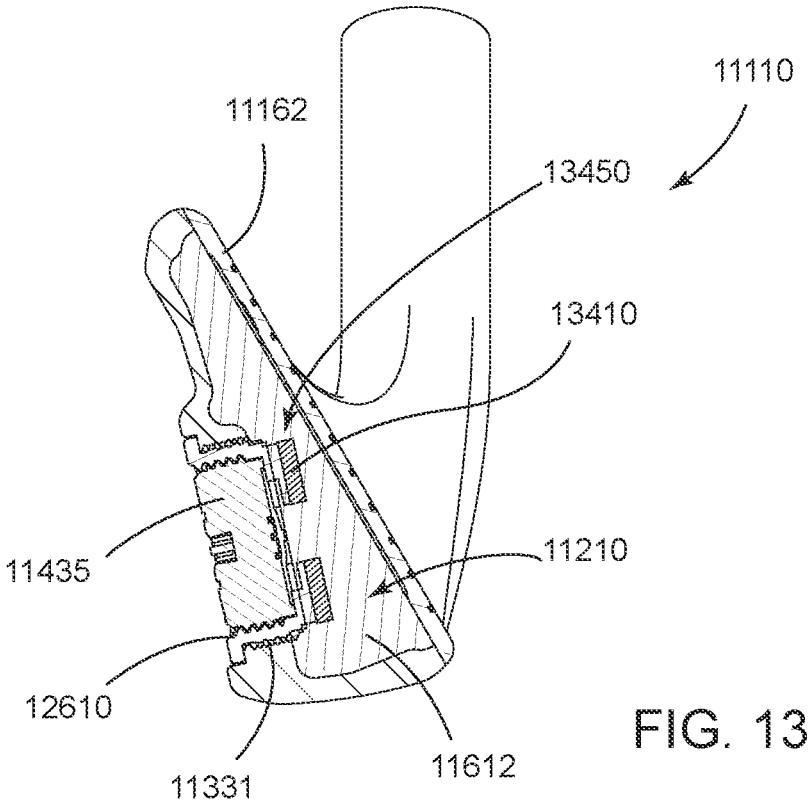
Figure 135:
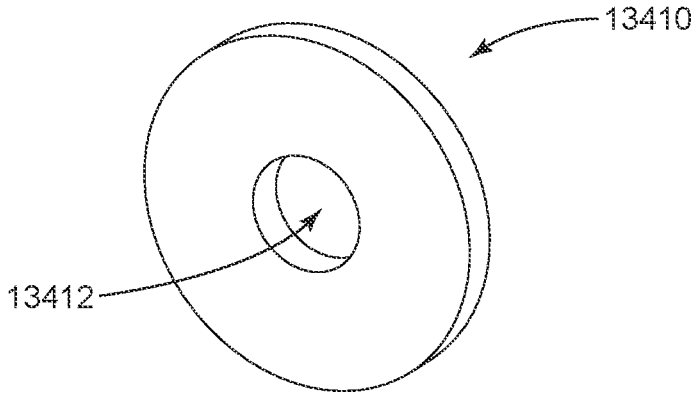

In one example, as illustrated in FIGS. 134 and 135, the golf club head 11100 may include a filler compression portion 13410 between the port sleeve 12610 and the filler material 11612. The filler compression portion 13410 may have any shape, size, orientation and/or configuration. In one example, as illustrated in FIGS. FIGS. 134 and 135, the filler compression portion 13410 may be annular and include a center hole 13412. The outer diameter of the filler compression portion 13410 may be the same, greater or smaller than the outer diameter of the port sleeve 12610. In one example, as illustrated in FIGS. FIGS. 134 and 135, the filler compression portion 13410 may have the same or substantially the same outer diameter as the outer diameter of the port sleeve 12610. In another example, the sleeve front portion 12620 may include a circular recess to receive the filler compression portion 13410 therein. As the sleeve front portion 12620 penetrates the interior cavity 11210 as described herein by the port sleeve 12610 being screwed into the second port 11331, the filler compression portion 13410 may compress the filler material 11612 behind the face portion 11162 and at or proximate to the ball strike region of the face portion 11162. Accordingly, driving the port sleeve 12610 into the interior cavity 11210 and using the filler compression portion 13410 may provide preloading of the filler material 11612 to provide a higher coefficient of restitution (COR) for the golf club head 11100 as described herein. To avoid an excessive force on the face portion 11162 due to the preloading of the filler material 11612 and possible bulging of the face portion 11162, portions of the filler material 11612 may flow, displace or move due to the elasticity of the filler material 11612 into the center hole 13412 of the filler compression portion 13410 and gaps 13450 inside the interior cavity 11210 around the port sleeve 12610 and the filler compression portion 13410. Accordingly, the center hole 13412 and the gaps 13450 may provide certain compression relief to the filler material 11612 to prevent bulging of the face portion 11162. The apparatus, methods, and articles of manufacture described herein are not limited in this regard.

The filler compression portion 13410 may be constructed from a polymer material having a higher COR than the filler material 11612. Accordingly, the filler compression portion 13410 may compress and rebound during use and contribute to increasing the COR of the golf club head 11100. In other words, the filler compression portion 13410 may increase the COR of the golf club head 11100 by preloading the filler material 11612 and by providing a rebounding force on the face during a golf ball strike. Alternatively, the filler compression portion 13410 may be constructed from a relatively more rigid material to provide preloading of the filler material 11612. In one example, the filler compression portion 13410 may be constructed from any of the filler materials described herein such as any urethane-based materials, and the filler material 11612 may be constructed from a polymer material having a lower COR than the filler compression portion 13410. For example, the filler material 11612 may be constructed from a polybutadiene material or any of the filler materials described herein. The filler compression portion, however, may be constructed from any type of material. The apparatus, methods, and articles of manufacture described herein are not limited in this regard.

Figure 136:
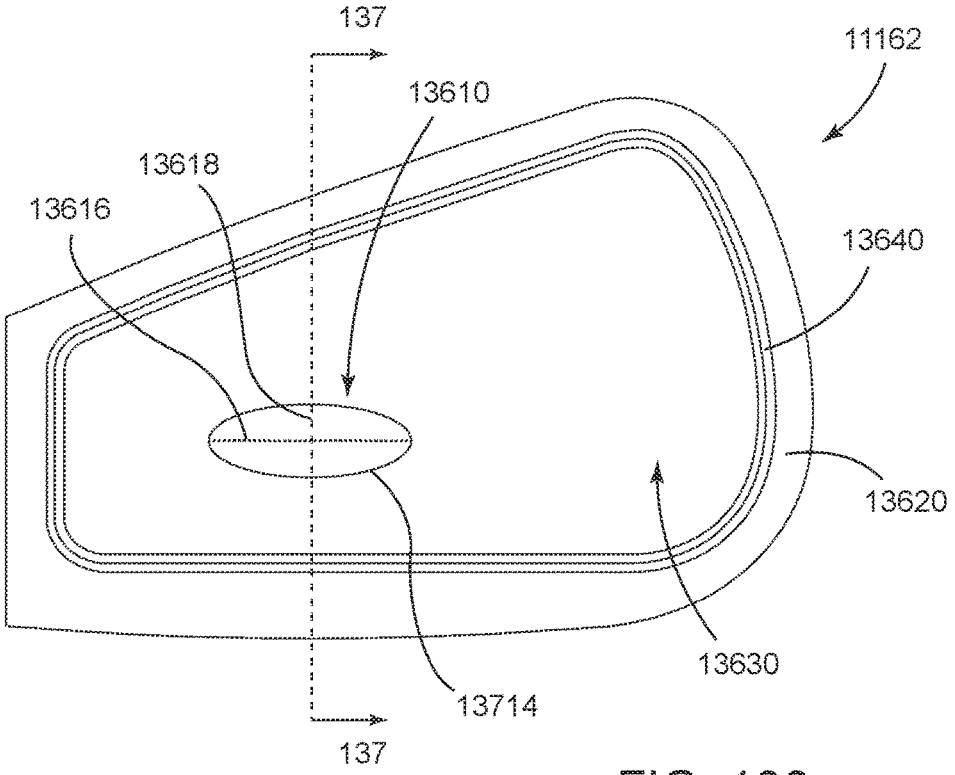
Figure 137:
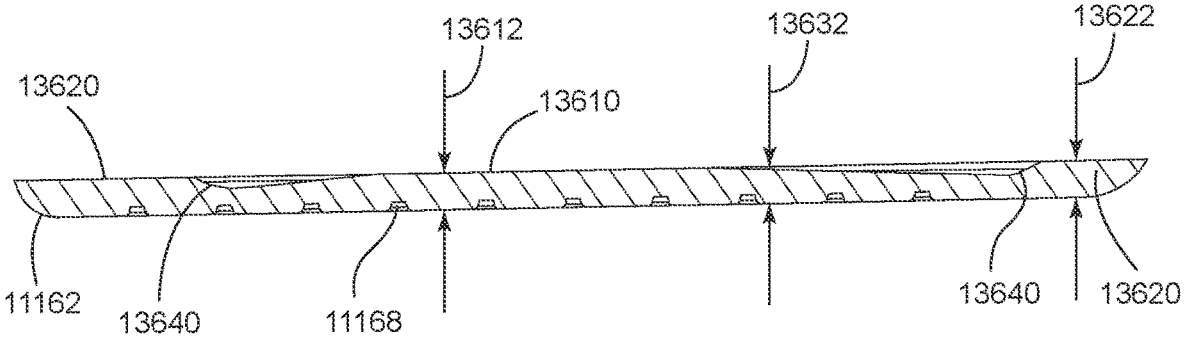

As illustrated in FIGS. 136 and 137, for example, the back surface 11166 of the face portion 11162 may include a center portion 13610 having a first thickness 13612 ($T_1$), a perimeter portion 13620 having a second thickness 13622 ($T_2$), and a transition portion 13630 having a third thickness 13632 ($T_3$). The center portion 13610 may generally correspond to the ball strike region of the front surface 11164, include at least a portion of the ball strike region, be least partially encompassed by the ball strike region, or be fully encompassed by the ball strike region. In other words, the center portion 13610 may define a region of the face portion 11162 that may impact a golf ball or have a high probability of experiencing golf ball impact for a typical golfer. The center portion 13610 may have any geometric, non-geometric, symmetrical, or asymmetrical shape. In one example, as illustrated in FIGS. 136 and 137, the center portion 13610 may be elliptical. Accordingly, the center portion 13610 may be defined by an ellipse having a boundary 13714 (i.e., periphery or perimeter), a major axis 13616, and a minor axis 13618. In one example, as illustrated in FIGS. FIGS. 136 and 137, the major axis 13616 extends in a direction between the toe portion 11140 and the heel portion 11150 and the minor axis 13618 is perpendicular to the major axis 13616. In another example, the major axis 13616 may extend in a direction between the top portion 11180 and the sole portion 11190 and the minor axis 13618 is perpendicular to the major axis 13616, which would render the center portion 13610 as a vertically oriented ellipse (i.e., vertically oblong). In yet other examples, the major axis 13616 may extend in a direction that may be at 30 degrees, at 45 degrees, or at any angle between and including 0 and 90 degrees from horizontal and the minor axis 13618 is perpendicular to the major axis 13616. In another example, the center portion 13610 may be circular (i.e., a=b in the above equation). In another example, the center portion 13610 may be oblong shaped or lozenge shaped. In another example, the center portion 13610 may be a rounded rectangular shape. In yet another example, the center portion 13610 may have a compounded geometric shape (e.g., two overlapping circles resembling a figure eight shape). The apparatus, methods, and articles of manufacture described herein are not limited in this regard.

In one example, the first thickness 13612 and the second thickness 13622 may be the same or substantially the same considering manufacturing tolerances. In another example, the first thickness 13612 may be greater than the second thickness 13622. In another example, the first thickness 13612 may be less than the second thickness 13622. In another example, the first thickness 13612 and/or the second thickness 13622 may be greater than equal to 0.03 inch (0.762 mm) and less than or equal to 0.20 inch (5.08 mm). In another example, the first thickness 13612 and/or the second thickness 13622 may be greater than or equal to 0.03 inch (0.762 mm) and less than or equal to 0.09 inch (2.286 mm). In another example, the first thickness 13612 and/or the second thickness 13622 may be greater than or equal to 0.02 inch (0.508 mm) and less than or equal to 0.11 inch (2.794 mm). In another example, the first thickness 13612 and/or the second thickness 13622 may be greater than or equal to 0.03 inch (0.762 mm) and less than or equal to 0.125 inch (3.175 mm). In another example, the first thickness 13612 and/or the second thickness 13622 may be greater than or equal to 0.04 inch (1.016 mm) and less than or equal to 0.15 inch (3.810 mm). In another example, the first thickness 13612 and/or the second thickness 13622 may be greater than or equal to 0.05 inch (1.270 mm) and less than or equal to 0.175 inch (4.445 mm). In another example, the first thickness 13612 and/or the second thickness 13622 may be greater than or equal to 0.06 inch (1.524 mm) and less than or equal to 0.2 inch (5.080 mm). In yet another example, the first thickness 13612 and/or the second thickness 13622 may be greater than or equal to 0.06 inch (1.524 mm) and less than or equal to 0.07 inch (1.778 mm). The apparatus, methods, and articles of manufacture described herein are not limited in this regard.

In one example, as illustrated in FIGS. 136 and 137, the transition portion 13630 has a third thickness 13632 that decreases from the center portion 13610 to a minimum thickness of the face portion 11162 adjacent the perimeter portion 13620. The back surface 11166 of the face portion 11162 may include a perimeter wall 13640 that provides a steep transition or face thickness variation from the transition portion 13630 to the perimeter portion 13620. Accordingly, the maximum thickness of the transition portion 13630 or the maximum value of the third thickness 13632 may be the same or substantially the same as the first thickness 13612 considering manufacturing tolerances and a minimum thickness of the face portion 11162 may be adjacent the perimeter portion 13620. In one example, the third thickness 13632 may be greater than equal to 0.03 inch (0.762 mm) and less than or equal to 0.06 inch (1.524 mm). In another example, the third thickness 13632 may be greater than or equal to 0.02 inch (0.508 mm) and less than or equal to 0.07 inch (1.778 mm). In another example, the third thickness 13632 may be greater than or equal to 0.04 inch (1.016 mm) and less than or equal to 0.05 inch (1.27 mm). The apparatus, methods, and articles of manufacture described herein are not limited in this regard.

The size of the center portion 13610 may vary depending on a variety of physical properties and/or performance parameters of the golf club head 11100. In one example, the size of the center portion 13610 may depend on the loft angle 11545 of the golf club head 11100. For iron-type golf club heads, a lower loft angle 11545 golf club may be used to achieve a high ball velocity and a long ball distance, whereas higher loft angle 11545 golf club may be used to achieve a high ball trajectory and a relatively low ball distance. As a result, a lower loft angle 11545 golf club may experience greater ball impact forces and the resulting higher face deflections than a higher loft angle 11545 golf club. Accordingly, to account for higher impact forces experienced by lower loft angle golf clubs, in one example, an increase in the size of the center portion 13610 may be proportional to an increase in the loft angle 11545 of the golf club head 11100, and a decrease in the size of the center portion 13610 may be proportional to a decrease in the loft angle 11545 of the golf club head 11100. In one example, the size, shape, and/or location of the center portion 13610 may not change and/or may not depend on the loft angle 11545. The apparatus, methods, and articles of manufacture described herein are not limited in this regard.

As described herein, the center portion 13610 may be elliptical such that the shape and size of the center portion 13610 may be determined by the length of the major axis 13616 and the length of the minor axis 13618. In one example, the major axis 13616 may be greater than or equal to 0.4 inch (10.16 mm) and less than or equal to 1.5 inch (38.1 mm). In another example, the major axis 13616 may be greater than or equal to 0.25 inch (6.35 mm) and less than or equal to 1 inch (25.4 mm). In another example, the minor axis 13618 may be greater than or equal to 0.10 inch (2.54 mm) and less than or equal to 0.8 inch (20.32 mm). In yet another example, the minor axis 13618 may be greater than or equal to 0.2 inch (5.08 mm) and less than or equal to 0.5 inch (12.7 mm). As described herein, the center portion 13610 may be circular or close to circular. Accordingly, the major axis 13616 and the minor axis 13618 may have the same or substantially the same value. The apparatus, methods, and articles of manufacture described herein are not limited in this regard.

The perimeter portion 13620 may partially or fully provide a coupling or engagement surface for attachment of the face portion 11162 to the front portion 11160 of the body portion 11110 to enclose the interior cavity 11210. Accordingly, the perimeter portion 13620 may provide a peripheral structural support for the face portion 11162. In other words, impact forces on the center portion 13610 or surrounding the center portion 13610 may be transferred to the perimeter portion 13620 via the transition portion 13630 and dissipated through the body portion 11110. The apparatus, methods, and articles of manufacture described herein are not limited in this regard.

As described herein, the size of the center portion 13610 may vary depending on a variety of physical properties and/or performance parameters of the golf club head 11100. Additionally, the first thickness 13612 may vary depending on a variety of physical properties and/or performance parameters of the golf club head 11100. In one example, the first thickness 13612 may depend on the loft angle 11545 of the golf club head 11100. For iron-type golf club heads, a lower loft angle 11545 golf club may be used to achieve a high ball velocity and a long ball distance, whereas higher loft angle 11545 golf club may be used to achieve a high ball trajectory and a relatively low ball distance. As a result, a lower loft angle 11545 golf club may experience greater ball impact forces and the resulting higher face deflections than a higher loft angle 11545 golf club. Accordingly, to account for higher impact forces experienced by lower loft angle golf clubs, in one example, an increase in the first thickness 13612 may be proportional to an increase in the loft angle 11545 of the golf club head 11100, and a decrease in the first thickness 13612 may be proportional to a decrease in the loft angle 11545 of the golf club head 11100. In another example, a driver-type golf club head may be used to achieve a high ball velocity and a long ball distance. As a result, a driver-type golf club head may experience relatively high impact forces and the resulting higher face deflections. The size, shape, thickness, and/or other physical properties of the center portion 13610 may vary with certain properties of a golf club head such as the type of golf club head, the loft angle 11545, the materials of constructions of the golf club head and/or the face portion, center of gravity of the golf club head, moment of inertia of the golf club head about one or more golf club head axes, and/or other properties of the golf club head. The apparatus, methods, and articles of manufacture described herein are not limited in this regard.

As described herein, the size, shape, and/or thickness of the center portion 13610 may vary with certain properties of a golf club head such as the type of golf club head and the loft angle 11545. In another example, the vertical location of the center portion 13610 may also vary with certain characteristics of the golf club head 11100. In another example, the horizontal location of the center portion 13610 may also vary with certain characteristics of the golf club head 11100. The characteristics of the golf club head 11100 that may affect the size, shape, and/or location of the center portion 13610 may include the loft angle 11545, the area of the face portion 11162, materials of construction of the face portion 11162 (e.g., aluminum, titanium, steel), thickness characteristics of the face portion 11162 at one or more locations on the face portion 11162, the number and characteristics of the front grooves 11168 on the front surface 11164 of the face portion, method of manufacturing the face portion 11162, the type of golf club head (e.g., iron-type golf club head, driver-type golf club head, hybrid-type golf club head), and/or any filler material in the interior cavity and the properties of the filler material. The apparatus, methods, and articles of manufacture described herein are not limited in this regard.

Any of the mass portions described herein may be constructed from a material having a greater density than one or more materials of a body portion of a golf club head. In one example, any of the mass portions described herein may be constructed from tungsten or tungsten-based materials, whereas the body portion may be constructed from one or more materials having a lower density than tungsten or tungsten-based materials such as aluminum, steel, titanium, and/or composite materials. Any of the mass portions described herein may be similar in some physical properties but different in other physical properties. For example, a mass portion may be made from an aluminum-based material or an aluminum alloy whereas another mass portion may be made from a tungsten-based material or a tungsten alloy. In another example, a mass portion may be made from a polymer material whereas another mass portion may be made from a steel-based material. Any of the mass portions described herein may be constructed from a material having a lower density than one or more materials of a body portion of a golf club head. The apparatus, methods, and articles of manufacture described herein are not limited in this regard.

Any of the golf club heads described herein may be an iron-type golf club head (e.g., a 1-iron, a 2-iron, a 3-iron, a 4-iron, a 5-iron, a 6-iron, a 7-iron, an 8-iron, a 9-iron, etc.), or a wedge-type golf club head (e.g., a pitching wedge, a lob wedge, a sand wedge, an n-degree wedge such as 44 degrees (°), 48°, 52°, 56°, 60°, etc.). Although a particular type of club head may be depicted and described, the apparatus, methods, and articles of manufacture described herein may be applicable to other types of club heads (e.g., a driver-type club head, a fairway wood-type club head, a hybrid-type club head, a putter-type club head, etc.). The apparatus, methods, and articles of manufacture described herein are not limited in this regard.

The body portion and/or the face portion of any of the golf club heads described herein may be partially or entirely made of a steel-based material (e.g., 17-4 PH stainless steel, Nitronic® 50 stainless steel, alloy steel 8620, maraging steel or other types of stainless steel), a titanium-based material, an aluminum-based material (e.g., a high-strength aluminum alloy or a composite aluminum alloy coated with a high-strength alloy), any combination thereof, non-metallic materials, composite materials, and/or other suitable types of materials. The body portion and/or the face portion may be constructed with materials that are similar to any of the body portions and/or face portions described herein or in any of the incorporated by reference patent documents. The apparatus, methods, and articles of manufacture described herein are not limited in this regard.

In one example, the area of the front surface of the face portion of any of the golf club heads described herein may be greater than or equal to 330 $mm^2$ and less than or equal to 5000 $mm^2$. In another example, the area of the front surface of the face portion of any of the golf club heads described herein may be greater than or equal to 1000 $mm^2$ and less than or equal to 5300 $mm^2$. In yet another example, the area of the front surface of the face portion of any of the golf club heads described herein may be greater than or equal to 1500 $mm^2$ and less than or equal to 4800 $mm^2$. While the above examples may describe particular areas, the area of the front surface may greater than or less than those numbers. The apparatus, methods, and articles of manufacture described herein are not limited in this regard.

In one example, a filler material as described herein may include an elastic polymer or an elastomer material, a thermoplastic elastomer material (TPE), a thermoplastic polyurethane material (TPU), other polymer material(s), bonding material(s) (e.g., adhesive), and/or other suitable types of materials that may absorb shock, isolate vibration, and/or dampen noise. In another example, a filler material may be one or more thermoset polymers having bonding properties. In another example, a filler material may include low-viscosity, organic, solvent-based solutions and/or dispersions of polymers and other reactive chemicals. In another example, a filler material may be a polymer material such as an ethylene copolymer material that may absorb shock, isolate vibration, and/or dampen noise when a golf club head strikes a golf ball via the face portion. In another example, a filler material may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, an ethylene copolymer having high compression and low resilience similar to thermoset polybutadiene rubbers, and/or a blend of highly neutralized polymer compositions, highly neutralized acid polymers or highly neutralized acid polymer compositions, and fillers. In another example, any one or more of the filler materials described herein may be formed from one or more metals or metal alloys, such as aluminum, copper, zinc, and/or titanium. A filler material not specifically described in detail herein may include one or more similar or different types of materials described herein and in any of the incorporated by reference patent documents. The apparatus, methods, and articles of manufacture described herein are not limited in this regard.

Any of the filler materials described herein may be subjected to different processes during manufacturing of any of the golf club heads described herein. Such processes may include one or more filler materials being heated and/or cooled by conduction, convection, and/or radiation during one or more injection molding processes or post injection molding curing processes. For example, all the heating and cooling processes may be performed by using heating or cooling systems that employ conveyor belts that move a golf club head described herein through a heating or cooling environment for a period of time as described herein. The processes of manufacturing a golf club head with one or more filler materials may be similar to any of the processes described in any of the incorporated by reference patent documents. The apparatus, methods, and articles of manufacture described herein are not limited in this regard.

While each of the above examples may describe a certain type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, a putter-type golf club head, etc.).

Procedures defined by golf standard organizations and/or governing bodies such as the United States Golf Association (USGA) and/or the Royal and Ancient Golf Club of St. Andrews (R&A) may be used for measuring the club head volume of any of the golf club heads described herein. For example, a club head volume may be determined by using the weighted water displacement method (i.e., Archimedes Principle). Although the figures may depict particular types of club heads (e.g., a driver-type club head or iron-type golf club head), the apparatus, methods, and articles of manufacture described herein may be applicable to other types of club head (e.g., a fairway wood-type club head, a hybrid-type club head, a putter-type club head, etc.). Accordingly, any golf club head as described herein may have a volume that is within a volume range corresponding to certain type of golf club head as defined by golf governing bodies. A driver-type golf club head may have a club head volume of greater than or equal to 300 cubic centimeters (cm 3 or cc). In another example, a driver-type golf club head may have a club head volume of 460 cc. A fairway wood golf club head may have a club head volume of between 100 cc and 300 cc. In one example, a fairway wood golf club head may have a club head volume of 180 cc. An iron-type golf club head may have a club head volume of between 25 cc and 100 cc. In one example, an iron-type golf club head may have a volume of 50 cc. Any of the golf clubs described herein may have the physical characteristics of a certain type of golf club (i.e., driver, fairway wood, iron, etc.), but have a volume that may fall outside of the above-described ranges. The apparatus, methods, and articles of manufacture described herein are not limited in this regard.

Any of the golf club heads and/or golf clubs described herein may include one or more sensors (e.g., accelerometers, strain gauges, etc.) for sensing linear motion (e.g., acceleration) and/or forces in all three axes of motion and/or rotational motion (e.g., angular acceleration) and rotational forces about all three axes of motion. In one example, the one or more sensors may be internal sensors that may be located inside the golf club head, the hosel, the shaft, and/or the grip. In another example, the one or more sensors may be external sensors that may be located on the grip, on the shaft, on the hosel, and/or on the golf club head. In yet another example, the one or more sensors may be external sensors that may be attached by an individual to the grip, to the shaft, to the hosel, and/or to the golf club head. In one example, data collected from the sensors may be used to determine any one or more design parameters for any of the golf club heads and/or golf clubs described herein to provide certain performance or optimum performance characteristics. In another example, data from the sensors may be collected during play to assess the performance of an individual. The apparatus, methods, and articles of manufacture described herein are not limited in this regard.

Any of the apparatus, methods, or articles of manufacture described herein may include one or more visual identifiers such as alphanumeric characters, colors, images, symbols, logos, and/or geometric shapes. For example, one or more visual identifiers may be manufactured with one or more portions of a golf club such as the golf club head (e.g., casted or molded with the golf club head), painted on the golf club head, etched on the golf club (e.g., laser etching), embossed on the golf club head, machined onto the golf club head, attached as a separate badge or a sticker on the golf club head (e.g., adhesive, welding, brazing, mechanical lock(s), any combination thereof, etc.), or any combination thereof. The visual identifier may be made from the same material as the golf club head or a different material than the golf club head (e.g., a plastic badge attached to the golf club head with an adhesive). Further, the visual identifier may be associated with manufacturing and/or brand information of the golf club head, the type of golf club head, one or more physical characteristics of the golf club head, or any combination thereof. In particular, a visual identifier may include a brand identifier associated with a manufacturer of the golf club (e.g., trademark, trade name, logo, etc.) or other information regarding the manufacturer. In addition, or alternatively, the visual identifier may include a location (e.g., country of origin), a date of manufacture of the golf club or golf club head, or both.

The visual identifier may include a serial number of the golf club or golf club head, which may be used to check the authenticity to determine whether or not the golf club or golf club head is a counterfeit product. The serial number may also include other information about the golf club that may be encoded with alphanumeric characters (e.g., country of origin, date of manufacture of the golf club, or both). In another example, the visual identifier may include the category or type of the golf club head (e.g., 5-iron, 7-iron, pitching wedge, etc.). In yet another example, the visual identifier may indicate one or more physical characteristics of the golf club head, such as one or more materials of manufacture (e.g., visual identifier of "Titanium" indicating the use of titanium in the golf club head), loft angle, face portion characteristics, mass portion characteristics (e.g., visual identifier of "Tungsten" indicating the use of tungsten mass portions in the golf club head), interior cavity and filler material characteristics (e.g., one or more abbreviations, phrases, or words indicating that the interior cavity is filled with a polymer material), any other information that may visually indicate any physical or play characteristic of the golf club head, or any combination thereof. Further, one or more visual identifiers may provide an ornamental design or contribute to the appearance of the golf club, or the golf club head.

Any of the golf club heads described herein may be manufactured by casting from metal such as steel. However, other techniques for manufacturing a golf club head as described herein may be used such as 3D printing or molding a golf club head from metal or non-metal materials such as ceramics.

All methods described herein may be performed in any suitable order unless otherwise indicated herein or otherwise clearly contradicted by context. Although a particular order of actions may be described herein with respect to one or more processes, these actions may be performed in other temporal sequences. Further, two or more actions in any of the processes described herein may be performed sequentially, concurrently, or simultaneously.

The terms "and" and "or" may have both conjunctive and disjunctive meanings. The terms "a" and "an" are defined as one or more unless this disclosure indicates otherwise. The term "coupled," and any variation thereof, refers to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby," "neighboring," etc., and such terms may be used interchangeably as appearing in this disclosure.

Recitation of ranges of values herein is merely intended to serve as a shorthand method of referring individually to each separate value falling within the range. Unless otherwise indicated herein, each individual value is incorporated into the specification as if it were individually recited herein. A numerical range defined using the word "between" includes numerical values at both end points of the numerical range. A spatial range defined using the word "between" includes any point within the spatial range and the boundaries of the spatial range. A location expressed relative to two spaced apart or overlapping elements using the word "between" includes (i) any space between the elements, (ii) a portion of each element, and/or (iii) the boundaries of each element.

The use of any and all examples, or exemplary language (e.g., "such as") provided herein is intended merely for clarification and does not pose a limitation on the scope of the present disclosure. No language in the specification should be construed as indicating any non-claimed element essential to the practice of any embodiments discussed herein.

Groupings of alternative elements or embodiments disclosed herein are not to be construed as limitations. Each group member may be referred to and claimed individually or in any combination with other members of the group or other elements disclosed herein. One or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

While different features or aspects of an embodiment may be described with respect to one or more features, a singular feature may comprise multiple elements, and multiple features may be combined into one element without departing from the scope of the present disclosure. Further, although methods may be disclosed as comprising one or more operations, a single operation may comprise multiple steps, and multiple operations may be combined into one step without departing from the scope of the present disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion having a volume of less than or equal to 100 cubic centimeters, the body portion comprising a first material having a first density, an interior cavity, a toe portion with a toe portion edge, a heel portion with a heel portion edge, a front opening at a front portion, a back portion having a back wall portion, and a top portion;

a reference coordinate system comprising a horizontal x-axis, a vertical y-axis orthogonal to the x-axis, and a z-axis orthogonal to both the x-axis and the y-axis;

a center of gravity located at x-coordinate location $CG_X$, y-coordinate location $CG_Y$, and z-coordinate location $CG_Z$;

a face portion coupled to the front portion to close the front opening, the face portion comprising at least one back groove portion;

a filler material in the interior cavity;

a coefficient of restitution of greater than or equal to 0.81;

a first mass portion coupled to the body portion, the first mass portion comprising a second material having a second density different from the first density, the first mass portion having a first mass portion center of gravity located at x-coordinate location $CG_{M1X}$, y-coordinate location $CG_{M1Y}$, and z-coordinate location $CG_{M1Z}$; and a second mass portion coupled to the body portion, the second mass portion comprising a third material having a third density different from the first density, wherein the first mass portion has a first shape and the second mass portion has a second shape different from the first shape, wherein a distance between the second mass portion and the toe portion edge is less than half a distance between the first mass portion and the toe portion edge, wherein a distance on the x-axis between $CG_{M1X}$ and $CG_X$ is less than or equal to 0.1 inch, wherein a distance on the y-axis between $CG_{M1Y}$ and $CG_Y$ is less than or equal to 0.6 inch, and wherein a distance on the z-axis between $CG_{M1Z}$ and $CG_Z$ is less than or equal to 0.4 inch.

2. A golf club head as defined in claim 1, wherein a ratio of a weight of the second mass portion to a weight of the first mass portion is greater than or equal to 1.0.

3. A golf club head as defined in claim 1, wherein a portion of the first mass portion defines an outer surface of the body portion.

4. A golf club head as defined in claim 1, wherein the second mass portion is in the interior cavity.

5. A golf club head as defined in claim 1, wherein the face portion comprises a plurality of front grooves and a minimum thickness, wherein the minimum thickness is a distance between a bottom of a front groove and a bottom of the at least one back groove portion.

6. A golf club head as defined in claim 1, wherein a portion of the second mass portion proximate to a portion of the toe portion edge has a same curvature as the portion of the toe portion edge or a substantially similar curvature as the portion of the toe portion edge.

7. A golf club head comprising:

a body portion having a volume of less than or equal to 100 cubic centimeters, the body portion comprising a first material having a first density, an interior cavity, a toe portion with a toe portion edge, a heel portion with a heel portion edge, a front opening at a front portion, a back portion having a back wall portion, and a top portion;

a reference coordinate system comprising a horizontal x-axis, a vertical y-axis orthogonal to the x-axis, and a z-axis orthogonal to both the x-axis and the y-axis;

a center of gravity located at x-coordinate location $CG_X$, y-coordinate location $CG_Y$, and z-coordinate location $CG_Z$;

a face portion coupled to the front portion to close the front opening, the face portion comprising at least one back groove portion;

a filler material in the interior cavity;

a coefficient of restitution of greater than or equal to 0.81;

a first mass portion coupled to the body portion, the first mass portion comprising a second material having a second density different from the first density; and a second mass portion coupled to the body portion, the second mass portion comprising a third material having a third density different from the first density, the second mass portion having a second mass portion center of gravity located at x-coordinate location $CG_{M2X}$, y-coordinate location $CG_{M2Y}$, and z-coordinate location $CG_{M2Z}$, wherein a distance between the second mass portion and the toe portion edge is greater than or equal to 0.1 inch and less than or equal to 0.25 inch, wherein a distance on the x-axis between $CG_{M2X}$ and $CG_X$ is greater than or equal to 0.5 inch and less than or equal to 2.0 inch, wherein a distance on the y-axis between $CG_{M2Y}$ and $CG_Y$ is less than or equal to 0.5 inch, and wherein a distance on the z-axis between $CG_{M2Z}$ and $CG_Z$ is less than or equal to 0.5 inch.

8. A golf club head as defined in claim 7, wherein the second density and the third density are different.

9. A golf club head as defined in claim 7, wherein a distance between the second mass portion and the toe portion edge is less than half a distance between the first mass portion and the toe portion edge.

10. A golf club head as defined in claim 7, wherein a portion of the first mass portion defines an outer surface of the body portion.

11. A golf club head as defined in claim 7, wherein the second mass portion is in the interior cavity.

12. A golf club head as defined in claim 7, wherein the at least one back groove portion is filled or at least partially filled with the filler material.

13. A golf club head as defined in claim 7, wherein a portion of the second mass portion proximate to a portion of the toe portion edge has a same curvature as the portion of the toe portion edge or a substantially similar curvature as the portion of the toe portion edge.

14. A golf club head comprising:

a body portion having a volume of less than or equal to 100 cubic centimeters, the body portion comprising an interior cavity, a toe portion with a toe portion edge, a heel portion with a heel portion edge, a front opening at a front portion, a back portion having a back wall portion, and a top portion;

a reference coordinate system comprising a horizontal x-axis, a vertical y-axis orthogonal to the x-axis, and a z-axis orthogonal to both the x-axis and the y-axis;

a center of gravity located at x-coordinate location $CG_X$, y-coordinate location $CG_Y$, and z-coordinate location $CG_Z$;

a face portion coupled to the front portion to close the front opening, the face portion comprising at least one back groove portion;

a filler material in the interior cavity;

a coefficient of restitution of greater than or equal to 0.81;

a first mass portion coupled to the body portion, the first mass portion having a first mass portion center of gravity located at x-coordinate location $CG_{M1X}$, y-coordinate location $CG_{M1Y}$, and z-coordinate location $CG_{M1Z}$; and a second mass portion coupled to the body portion, the second mass portion having a second mass portion center of gravity located at x-coordinate location $CG_{M2X}$, y-coordinate location $CG_{M2Y}$, and z-coordinate location $CG_{M2Z}$, wherein a ratio of a weight of the second mass portion to a weight of the first mass portion is greater than or equal to 1.0, wherein a shape of the first mass portion is different from a shape of the second mass portion, wherein a distance on the x-axis between $CG_{M1X}$ and $CG_{M2X}$ is greater than or equal to 0.5 inch and less than or equal to 2.0 inch, wherein a distance on the y-axis between $CG_{M1Y}$ and $CG_{M2Y}$ is less than or equal to 0.25 inch, and wherein a distance on the z-axis between $CG_{M1Z}$ and $CG_{M2Z}$ is less than or equal to 0.1 inch.

15. A golf club head as defined in claim 14, wherein a distance between the second mass portion and the toe portion edge is greater than or equal to 0.1 inch and less than or equal to 0.25 inch.

16. A golf club head as defined in claim 14, further comprising a port in the interior cavity, the port having a port height extending in a top-to-sole direction, a port width extending in a heel-to-toe direction and a port width extending in a front-to-back direction from the interior cavity toward the back wall portion, wherein the port is configured to receive the second mass portion.

17. A golf club head as defined in claim 14, wherein a portion of the first mass portion defines an outer surface of the body portion and is visible on an exterior of the body portion, and wherein the second mass portion is in the interior cavity and is not visible from an exterior of the body portion.

18. A golf club head as defined in claim 14, wherein a distance between the second mass portion and the toe portion edge is less than half a distance between the first mass portion and the toe portion edge.

19. A golf club head as defined in claim 14, wherein a portion of the second mass portion proximate to a portion of the toe portion edge has a same curvature as the portion of the toe portion edge or a substantially similar curvature as the portion of the toe portion edge.

20. A golf club head as defined in claim 14, wherein a total weight of the filler material is greater than or equal to 15 grams and less than or equal to 35 grams.

* * * * *